US009483973B2

(12) United States Patent
Kimura

(10) Patent No.: US 9,483,973 B2
(45) Date of Patent: Nov. 1, 2016

(54) LIQUID CRYSTAL DISPLAY DEVICE, DRIVING METHOD OF THE LIQUID CRYSTAL DISPLAY DEVICE, AND ELECTRONIC DEVICE EMPLOYING THE SAME DEVICE AND THE SAME METHOD

(75) Inventor: Hajime Kimura, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 1432 days.

(21) Appl. No.: 12/116,120

(22) Filed: May 6, 2008

(65) Prior Publication Data

US 2009/0009455 A1 Jan. 8, 2009

(30) Foreign Application Priority Data

May 18, 2007 (JP) ..... 2007-132302

(51) Int. Cl.
*G09G 3/36* (2006.01)
*G09G 3/20* (2006.01)

(52) U.S. Cl.
CPC ..... *G09G 3/2074* (2013.01); *G09G 3/3685* (2013.01); *G09G 2300/0443* (2013.01); *G09G 2300/0465* (2013.01); *G09G 2320/028* (2013.01)

(58) Field of Classification Search
USPC ..... 345/89, 690
See application file for complete search history.

(56) References Cited

U.S. PATENT DOCUMENTS 5,847,688 A 12/1998 Ohi et al.
6,528,951 B2 3/2003 Yamazaki et al.
6,828,950 B2 12/2004 Koyama
7,113,159 B2 9/2006 Sawabe
7,796,104 B2 9/2010 Kim
7,817,124 B2 10/2010 Shin
7,898,623 B2 3/2011 Kimura et al.
7,969,396 B2 6/2011 Kim (Continued)

FOREIGN PATENT DOCUMENTS

EP 1818903 A 8/2007
JP 05-341734 A 12/1993

(Continued)

OTHER PUBLICATIONS

Sang Soon Kim; 66.1: Invited Paper: The World's Largest (82-in.) TFT-LCD; *SID '05 Digest: SID International Symposium Digest of Technical Papers*; pp. 1842-1847; 2005.

(Continued)

*Primary Examiner* — Towfiq Elahi
(74) *Attorney, Agent, or Firm* — Fish & Richardson P.C.

(57) ABSTRACT

To provide a liquid crystal display device which can improve viewing angle characteristics and a driving method of the liquid crystal display device, and an electronic device including the liquid crystal display device. In a liquid crystal display device which performs display by aligning liquid crystal molecules at a tilt or radially at a tilt, one pixel is divided into a plurality of regions (sub-pixels) and a signal applied to each sub-pixel is made different every desired period. Alternatively, a signal applied to each sub-pixel is made different with respect to an adjacent pixel. To improve viewing angle characteristics by changing transmittance of the liquid crystal molecules every desired period in addition to improving the viewing angle characteristics of a viewer by making the liquid crystal molecules slanted to increase directions of alignment.

17 Claims, 90 Drawing Sheets

(56) References Cited

U.S. PATENT DOCUMENTS

| | | | | |
|---|---|---|---|---|
| 7,982,702 | B2 | 7/2011 | Kamada | |
| 8,026,934 | B2 | 9/2011 | Tomizawa | |
| 8,154,678 | B2 | 4/2012 | Kimura et al. | |
| 8,207,923 | B2 | 6/2012 | Shin | |
| 8,310,424 | B2 | 11/2012 | Irie et al. | |
| 8,339,530 | B2 | 12/2012 | Kimura et al. | |
| 8,487,849 | B2 | 7/2013 | Kim | |
| 8,587,742 | B2 | 11/2013 | Kimura et al. | |
| 2001/0033252 | A1 | 10/2001 | Yamazaki et al. | |
| 2002/0017643 | A1 | 2/2002 | Koyama | |
| 2002/0140364 | A1 | 10/2002 | Inukai | |
| 2003/0067426 | A1* | 4/2003 | Awamoto et al. | 345/72 |
| 2003/0189410 | A1 | 10/2003 | Yamazaki et al. | |
| 2005/0012731 | A1 | 1/2005 | Yamazaki et al. | |
| 2005/0017933 | A1 | 1/2005 | Koyama | |
| 2005/0017963 | A1 | 1/2005 | Yamazaki et al. | |
| 2005/0017964 | A1 | 1/2005 | Yamazaki et al. | |
| 2005/0024303 | A1 | 2/2005 | Kimura et al. | |
| 2005/0122349 | A1 | 6/2005 | Yamazaki et al. | |
| 2005/0285823 | A1 | 12/2005 | Kimura et al. | |
| 2006/0007091 | A1 | 1/2006 | Yang et al. | |
| 2006/0038804 | A1 | 2/2006 | Hayakawa et al. | |
| 2006/0082525 | A1* | 4/2006 | Suzuki et al. | 345/77 |
| 2006/0164352 | A1* | 7/2006 | Yoo et al. | 345/87 |
| 2007/0001945 | A1 | 1/2007 | Yoshida et al. | |
| 2007/0001954 | A1 | 1/2007 | Shishido et al. | |
| 2007/0279344 | A1 | 12/2007 | Kimura et al. | |
| 2008/0024411 | A1* | 1/2008 | Hsieh et al. | 345/89 |
| 2009/0244111 | A1 | 10/2009 | Yang et al. | |
| 2013/0300641 | A1 | 11/2013 | Kim | |

FOREIGN PATENT DOCUMENTS

| | | | |
|---|---|---|---|
| JP | 2000-206922 | | 7/2000 |
| JP | 2001-174786 | A | 6/2001 |
| JP | 2003255306 | A | 9/2003 |
| JP | 2003295160 | A | 10/2003 |
| JP | 2005-250085 | A | 9/2005 |
| JP | 2005-316211 | A | 11/2005 |
| JP | 2006011427 | A | 1/2006 |
| JP | 2006-189682 | A | 7/2006 |
| JP | 2006-209135 | | 8/2006 |
| JP | 2006-292972 | A | 10/2006 |
| JP | 2006-293373 | A | 10/2006 |
| JP | 2007-041578 | A | 2/2007 |
| JP | 2007-086791 | A | 4/2007 |
| WO | WO-2006/049245 | | 5/2006 |
| WO | WO2007018219 | A1 | 2/2007 |

OTHER PUBLICATIONS

Bong Hyun You et al.; "61.3: A Novel Driving Method Using 2-Dimension Spatial Averaging for High Speed Driving of AMLCD"; *SID '07 Digest: SID International Symposium Digest of Technical Papers*; pp. 1725-1728; 2007.

Sang Soo Kim et al.; "Invited Paper: Super PVA Achieves Ultimate LCD-TV Performance Leadership"; *IMID '05 Digest*; pp. 15-20; 2005.

* cited by examiner

FIG. 2

| gray signal number of the gray scale signal | first combination data | second combination data |
|---|---|---|
| 0 | (a0,b0) | (c0,d0) |
| 1 | (a1,b1) | (c1,d1) |
| 2 | (a2,b2) | (c2,d2) |
| 3 | (a3,b3) | (c3,d3) |
| 4 | (a4,b4) | (c4,d4) |
| 5 | (a5,b5) | (c5,d5) |
| ------- | ------- | ------- |
| n−1 | (a(n−1),b(n−1)) | (c(n−1),d(n−1)) |

201

202

FIG. 12

| gray signal number of the gray scale signal | first combination data | second combination data |
|---|---|---|
| 0 | (a0,b0,c0) | (d0,e0,f0) |
| 1 | (a1,b1,c1) | (d1,e1,f1) |
| 2 | (a2,b2,c2) | (d2,e2,f2) |
| 3 | (a3,b3,c3) | (d3,e3,f3) |
| 4 | (a4,b4,c4) | (d4,e4,f4) |
| 5 | (a5,b5,c5) | (d5,e5,f5) |
| ⋮ | ⋮ | ⋮ |
| n−1 | (a(n−1),b(n−1),c(n−1)) | (d(n−1),e(n−1),f(n−1)) |

1201

1202

FIG. 16

| gray signal number of the gray scale signal | first combination data | second combination data | third combination data |
|---|---|---|---|
| 0 | (a0,b0) | (c0,d0) | (e0,f0) |
| 1 | (a1,b1) | (c1,d1) | (e1,f1) |
| 2 | (a2,b2) | (c2,d2) | (e2,f2) |
| 3 | (a3,b3) | (c3,d3) | (e3,f3) |
| 4 | (a4,b4) | (c4,d4) | (e4,f4) |
| 5 | (a5,b5) | (c5,d5) | (e5,f5) |
| ⋮ | ⋮ | ⋮ | ⋮ |
| n−1 | (a(n−1),b(n−1)) | (c(n−1),d(n−1)) | (e(n−1),f(n−1)) |
| | 1601 | 1602 | 1603 |

LIQUID CRYSTAL DISPLAY DEVICE, DRIVING METHOD OF THE LIQUID CRYSTAL DISPLAY DEVICE, AND ELECTRONIC DEVICE EMPLOYING THE SAME DEVICE AND THE SAME METHOD

BACKGROUND OF THE INVENTION

1. Field of the Invention

The present invention relates to an object, a method, or a method for manufacturing the object. Specifically, the present invention relates to a display device or a semiconductor device. Further, the present invention relates to a liquid crystal display device. Alternatively, the present invention relates to a driving method of a liquid crystal display device. Alternatively, the present invention relates to an electronic device provided with a display device.

2. Description of the Related Art

A liquid crystal display device is used for various electronic products such as a mobile phone, a television receiver, and the like. Since a liquid crystal display device is still required to be improved in contrast ratio, responsiveness (hereinafter referred to as quick responsiveness) of liquid crystal molecules for input signals, and viewing angle characteristics, research on higher image quality is significantly active.

Here, in a liquid crystal display device, in order to improve responsiveness (hereinafter referred to as quick responsiveness) of liquid crystal molecules for input signals, research is promoted on display technology of VA (vertical alignment) mode liquid crystal (hereinafter, simply referred to as a VA mode) in which the liquid crystal molecules are aligned perpendicular to substrates which sandwich the liquid crystal molecules therebetween. In the VA mode, viewing angle characteristics are required to be improved; and therefore, in recent, research is promoted on display technology called MVA (multi-domain vertical alignment) mode liquid crystal in which protrusions are provided to electrode portions which sandwich liquid crystal molecules therebetween so that the liquid crystal molecules are aligned in a gradient manner or a radial gradient manner, PVA (patterned vertical alignment) mode liquid crystal, and ASV (advanced super view) mode liquid crystal (hereinafter, simply referred to as a MVA mode, a PVA mode, and an ASV mode, respectively).

In the MVA mode, the PVA mode, and the ASV mode, viewing angle characteristics of displayed images are improved by making liquid crystal molecules aligned in a gradient manner or a radial gradient manner. However, there are many spots where the liquid crystal molecules are aligned in different directions. As a result, there has been a problem that it is hard to control alignment of liquid crystal, there are variations in visibility between the front and the side of the liquid crystal display device, and image quality deteriorates. Therefore, research is promoted on display technology which aims to improve viewing angle characteristics for a viewer by dividing one pixel into a plurality of regions (hereinafter, referred to as sub-pixels) so that directions of alignment are increased by making each liquid crystal molecule aligned to different directions (for example, see Patent Document 1: Japanese Published Patent Application No. 2006-209135, and Non Patent Document 1: SID '05 DIGEST, 66.1, pp 1842, (2005)).

SUMMARY OF THE INVENTION

Unlike display devices using CRTs or self-luminous display elements, in a liquid crystal display device, light from a backlight and the like transmits through a polarizer layer and a liquid crystal layer and a voltage applied to the liquid crystal layer is changed to control the amount of light to be transmitted so that display is performed. Since viewing angle characteristics of a liquid crystal element are not as good as viewing characteristics of the display devices using the CRTs or the self-luminous display elements which directly control the amount of light to be transmitted by applying a voltage to the display elements, the viewing angle characteristics of a liquid crystal element are required to be improved. In the above-mentioned Patent Document 1 and Non Patent Document 1, viewing angle characteristics of a liquid crystal display device can be improved. However, as simply shown in Patent Document 1, by increasing the number of sub-pixels to increase directions of alignment of the liquid crystal molecules and improve viewing angle characteristics, a decrease in an aperture ratio of a pixel and an increase in power consumption due to the decrease in the aperture ratio occur.

An object of the present invention is to provide a liquid crystal display device in which viewing angle characteristics are improved, and electronic devices including a driving method of the liquid crystal display device and the liquid crystal display device. In addition, another object of the present invention is to provide a liquid crystal display device in which image quality is improved, and electronic devices including a driving method of the liquid crystal display device and the liquid crystal display device. In addition, another object of the present invention is to provide a liquid crystal display device in which the number of sub-pixels is not increased so that density of arrangement of wirings and electrodes which are included in a pixel is reduced and an aperture ratio of the pixel is improved, and to provide electronic devices including a driving method of the liquid crystal display device and the liquid crystal display device. In addition, another object of the present invention is to provide a liquid crystal display device in which a decrease in an aperture ratio caused by increasing the number of sub-pixels is suppressed and power consumption is reduced, and to provide electronic devices including a driving method of the liquid crystal display device and the liquid crystal display device.

In order to solve the above-described problems, the present inventor came to a conception of dividing one pixel into sub-pixels and making different signals applied to each sub-pixel every desired period in a liquid crystal display device. In addition, the present inventor came to a conception of dividing one pixel into sub-pixels and making different signals applied to each sub-pixel with respect to an adjacent pixel in a liquid crystal display device. In addition, the present inventor came to a conception of dividing one pixel into sub-pixels and making different signals applied to each sub-pixel every desired period and making different signals applied to each sub-pixel with respect to an adjacent pixel in a liquid crystal display device. As a result, as one aspect of the present invention, viewing angle characteristics of a viewer are improved by increasing directions of alignment of liquid crystal molecules, and the viewing angle characteristics are improved by change of transmittance of the liquid crystal molecules every desired period.

Note that one or more sub-pixels are preferably included in one pixel. More preferably, two or three sub-pixels are included in one pixel. In the case where one sub-pixel is included in one pixel, that is, one pixel is not divided into sub-pixels, a desired period (e.g., one frame period) is divided into a plurality of periods (e.g., a plurality of sub-frame periods) and a signal applied is preferably different every divided period. However, the present invention is not limited thereto.

Note that various kinds of switches can be used. For example, an electric switch, a mechanical switch, or the like can be given. Thus, there are no limitations on the particular kind of a switch as long as a switch can control current flow. For example, as a switch, transistor (e.g., a bipolar transistor or a MOS transistor), a diode (e.g., a PN diode, a PIN diode, a Shottky diode, a MIM (metal insulator metal) diode, a MIS (metal insulator semiconductor) diode, or a diode-connected transistor), a thyristor, or the like can be used. Alternatively, a logic circuit in which these elements are combined can be used as a switch.

In the case of using a transistor as a switch, polarity (a conductivity type) of the transistor is not particularly limited because it operates just as a switch. However, a transistor of polarity with smaller off-current is preferably used when off-current is to be suppressed. Examples of a transistor with smaller off-current are a transistor provided with an LDD region, a transistor with a multi-gate structure, and the like. In addition, it is preferable that an N-channel transistor be used when a potential of a source terminal is closer to a potential of a low-potential-side power supply (e.g., $V_{ss}$, GND, or 0 V), while it is preferable that a P-channel transistor be used when the potential of the source terminal is closer to a potential of a high-potential-side power supply (e.g., $V_{dd}$). This is because the absolute value of gate-source voltage can be increased when the potential of the source terminal is closer to a potential of a low-potential-side power supply in an N-channel transistor and when the potential of the source terminal is closer to a potential of a high-potential-side power supply in a P-channel transistor so that the transistor easily operates as a switch. This is also because the transistor does not often perform a source follower operation, so that reduction in output voltage does not often occur.

Note that a CMOS switch may be employed as a switch by using both N-channel and P-channel transistors. When a CMOS switch is employed, the switch can more precisely operate as a switch because current can flow when either the P-channel transistor or the N-channel transistor is turned on. For example, voltage can be appropriately output regardless of whether voltage of an input signal to the switch is high or low. In addition, since a voltage amplitude value of a signal for turning on or off the switch can be made small, power consumption can be reduced.

Note that when a transistor is used as a switch, the switch includes an input terminal (one of a source terminal or a drain terminal), an output terminal (the other of the source terminal or the drain terminal), and a terminal (a gate terminal) for controlling electric conduction. On the other hand, when a diode is used as a switch, the switch does not have a terminal for controlling electric conduction in some cases. Therefore, when a diode is used as a switch, the number of wirings for controlling terminals can be further reduced than the case of using a transistor as a switch.

Note that when it is explicitly described that "A and B are connected", the case where A and B are electrically connected, the case where A and B are functionally connected, and the case where A and B are directly connected are included therein. Here, each of A and B corresponds to an object (e.g., a device, an element, a circuit, a wiring, an electrode, a terminal, a conductive film, or a layer). Accordingly, another element may be interposed between elements having a connection relation shown in drawings and description, without limiting to a predetermined connection relation, for example, the connection relation shown in the drawings and the description.

For example, in the case where A and B are electrically connected, one or more elements which enable electric connection between A and B (e.g., a switch, a transistor, a capacitor, an inductor, a resistor, and/or a diode) may be provided between A and B. In addition, in the case where A and B are functionally connected, one or more circuits which enable functional connection between A and B (e.g., a logic circuit such as an inverter, a NAND circuit, or a NOR circuit, a signal converter circuit such as a DA converter circuit, an AD converter circuit, or a gamma correction circuit, a potential level converter circuit such as a power supply circuit (e.g., a dc-dc converter, a step-up dc-dc converter, or a step-down dc-dc converter) or a level shifter circuit for changing a potential level of a signal, a voltage source, a current source, a switching circuit, or an amplifier circuit such as a circuit which can increase signal amplitude, the amount of current, or the like (e.g., an operational amplifier, a differential amplifier circuit, a source follower circuit, or a buffer circuit), a signal generating circuit, a memory circuit, and/or a control circuit) may be provided between A and B. Alternatively, in the case where A and B are directly connected, A and B may be directly connected without interposing another element or another circuit therebetween.

Note that when it is explicitly described that "A and B are directly connected", the case where A and B are directly connected (i.e., the case where A and B are connected without interposing another element or another circuit therebetween) and the case where A and B are electrically connected (i.e., the case where A and B are connected by interposing another element or another circuit therebetween) are included therein.

Note that when it is explicitly described that "A and B are electrically connected", the case where A and B are electrically connected (i.e., the case where A and B are connected by interposing another element or another circuit therebetween), the case where A and B are functionally connected (i.e., the case where A and B are functionally connected by interposing another circuit therebetween), and the case where A and B are directly connected (i.e., the case where A and B are connected without interposing another element or another circuit therebetween) are included therein. That is, when it is explicitly described that "A and B are electrically connected", the description is the same as the case where it is explicitly only described that "A and B are connected".

Note that a display element, a display device which is a device having a display element, a light-emitting element, and a light-emitting device which is a device having a light-emitting element can use various modes and can include various elements. For example, as a display element, a display device, a light-emitting element, or a light-emitting device, a display medium whose contrast, luminance, reflectivity, transmittance, or the like is changed by an electromagnetic action can be employed; for example, an EL element (e.g., an EL element including organic and inorganic materials, an organic EL element, or an inorganic EL element), an electron emitter, a liquid crystal element, electronic ink, an electrophoresis element, a grating light valve (GLV), a plasma display panel (PDP), a digital micromirror device (DMD), a piezoelectric ceramic display, a carbon nanotube, or the like can be used. Note that display devices using EL elements include an EL display; display devices using electron emitters include a field emission display (FED), an SED-type flat panel display (SED: surface-conduction electron-emitter display), and the like; display devices using liquid crystal elements include a liquid crystal display (e.g., a transmissive liquid crystal display, a transflective liquid crystal display, a reflective liquid crystal display, a direct-view liquid crystal display, or a projection liquid crystal display); and display devices using electronic ink or electrophoresis elements include electronic paper.

Note that various types of transistors can be used as a transistor, without limiting to a certain type. For example, a thin film transistor (TFT) including a non-single crystal semiconductor film typified by amorphous silicon, polycrystalline silicon, microcrystalline (also referred to as microcrystal or semi-amorphous) silicon, or the like can be used. In the case of using the TFT, there are various advantages. For example, since the TFT can be formed at temperature lower than that of the case of using single-crystal silicon, manufacturing cost can be reduced or a manufacturing apparatus can be made larger. Since the manufacturing apparatus is made larger, the TFT can be formed using a large substrate. Therefore, a great large number of display devices can be formed at the same time at low cost. In addition, a substrate having low heat resistance can be used, because of low manufacturing temperature. Therefore, the transistor can be formed using a transparent substrate. Accordingly, transmission of light in a display element can be controlled by using the transistor formed using the transparent substrate. Alternatively, part of a film which forms the transistor can transmit light because the film thickness of the transistor is thin. Therefore, the aperture ratio can be improved.

Note that when a catalyst (e.g., nickel) is used in the case of forming polycrystalline silicon, crystallinity can be further improved and a transistor having excellent electric characteristics can be formed. Accordingly, a gate driver circuit (e.g., a scanning line driver circuit), a source driver circuit (e.g., a signal line driver circuit), and/or a signal processing circuit (e.g., a signal generation circuit, a gamma correction circuit, or a DA converter circuit) can be formed over the same substrate.

Note that when a catalyst (e.g., nickel) is used in the case of forming microcrystalline silicon, crystallinity can be further improved and a transistor having excellent electric characteristics can be formed. At this time, crystallinity can be improved by just performing heat treatment without performing laser irradiation. Accordingly, a gate driver circuit (a scanning line driver circuit) and part of a source driver circuit (e.g., an analog switch) can be formed over the same substrate. In addition, in the case of not performing laser irradiation for crystallization, unevenness of silicon can be suppressed. Therefore, a high-quality image can be displayed.

Note that polycrystalline silicon and microcrystalline silicon can be formed without using a catalyst (e.g., nickel).

Note that it is preferable that crystallinity of silicon be improved to polycrystal, microcrystal, or the like in the whole panel; however, the present invention is not limited to this. Crystallinity of silicon may be improved only in part of the panel. Selective increase in crystallinity can be achieved by selective laser irradiation or the like. For example, only a peripheral driver circuit region excluding pixels may be irradiated with laser light. Alternatively, only a region of a gate driver circuit, a source driver circuit, and/or the like may be irradiated with laser light. Further alternatively, only part of a source driver circuit (e.g., an analog switch) may be irradiated with laser light. Accordingly, crystallinity of silicon can be improved only in a region in which a circuit needs to be operated at high speed. Since a pixel region is not necessarily operated at high speed, even if crystallinity is not improved, the pixel circuit can be operated without problems. Since a region, crystallinity of which is improved, is small, manufacturing steps can be decreased, throughput can be increased, and manufacturing cost can be reduced. Since the number of necessary manufacturing apparatus is small, manufacturing cost can be reduced.

A transistor can be formed over using a semiconductor substrate, an SOI substrate, or the like. Thus, a transistor with few variations in characteristics, sizes, shapes, or the like, with high current supply capacity, and with a small size can be formed. When such a transistor is used, power consumption of a circuit can be reduced or a circuit can be highly integrated.

A transistor including a compound semiconductor or an oxide semiconductor such as ZnO, a-InGaZnO, SiGe, GaAs, IZO, ITO, or SnO, a thin film transistor obtained by thinning such a compound semiconductor or an oxide semiconductor, or the like can be used. Thus, manufacturing temperature can be lowered and for example, such a transistor can be formed at room temperature. Accordingly, the transistor can be formed directly on a substrate having low heat resistance, such as a plastic substrate or a film substrate. Note that such a compound semiconductor or an oxide semiconductor can be used for not only a channel portion of the transistor but also other applications. For example, such a compound semiconductor or an oxide semiconductor can be used as a resistor, a pixel electrode, or a transparent electrode. Further, since such an element can be formed at the same time as the transistor, cost can be reduced.

A transistor formed by using an inkjet method or a printing method, or the like can be used. Accordingly, a transistor can be formed at room temperature, can be formed at a low vacuum, or can be formed using a large substrate. In addition, since the transistor can be formed without using a mask (a reticle), a layout of the transistor can be easily changed. Further, since it is not necessary to use a resist, material cost is reduced and the number of steps can be reduced. Furthermore, since a film is formed only in a necessary portion, a material is not wasted compared with a manufacturing method in which etching is performed after the film is formed over the entire surface, so that cost can be reduced.

A transistor including an organic semiconductor or a carbon nanotube, or the like can be used. Accordingly, such a transistor can be formed over a bendable substrate. Therefore, a device using a transistor including an organic semiconductor or a carbon nanotube, or the like can resist a shock.

Further, transistors with various structures can be used. For example, a MOS transistor, a junction transistor, a bipolar transistor, or the like can be used as a transistor. When a MOS transistor is used, the size of the transistor can be reduced. Thus, a large number of transistors can be mounted. When a bipolar transistor is used, large current can flow. Thus, a circuit can be operated at high speed.

Note that a MOS transistor, a bipolar transistor, and the like may be formed over one substrate. Thus, reduction in power consumption, reduction in size, high speed operation, and the like can be realized.

Furthermore, various transistors can be used.

Note that a transistor can be formed using various types of substrates without limiting to a certain type. As the substrate include, for example, a single-crystalline substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used as a substrate. Alternatively, a skin (e.g., epidermis or corium) or hypodermal tissue of an animal such as a human being can be used as a substrate. Further alternatively, the transistor may be formed using one substrate, and then, the transistor may be transferred to another substrate. A single-crystalline substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used as the substrate to which the transistor is transferred. Alternatively, a skin (e.g., epidermis or corium) or hypodermal tissue of an animal such as a human being can be used as the substrate to which the transistor is transferred. Further alternatively, the transistor may be formed using one substrate and the substrate may be thinned by polishing. A single-crystalline substrate, an SOI substrate, a glass substrate, a quartz substrate, a plastic substrate, a paper substrate, a cellophane substrate, a stone substrate, a wood substrate, a cloth substrate (including a natural fiber (e.g., silk, cotton, or hemp), a synthetic fiber (e.g., nylon, polyurethane, or polyester), a regenerated fiber (e.g., acetate, cupra, rayon, or regenerated polyester), or the like), a leather substrate, a rubber substrate, a stainless steel substrate, a substrate including a stainless steel foil, or the like can be used as a substrate to be polished. Alternatively, a skin (e.g., epidermis or corium) or hypodermal tissue of an animal such as a human being can be used as a substrate to be polished. When such a substrate is used, a transistor with excellent properties or a transistor with low power consumption can be formed, a device with high durability, high heat resistance can be provided, or reduction in weight or thickness can be achieved.

Note that a structure of a transistor can be various modes without limiting to a certain structure. For example, a multi-gate structure having two or more gate electrodes may be used. When the multi-gate structure is used, a structure where a plurality of transistors are connected in series is provided because channel regions are connected in series. With the multi-gate structure, off-current can be reduced or the withstand voltage of the transistor can be increased to improve reliability. Alternatively, with the multi-gate structure, drain-source current does not fluctuate very much even if drain-source voltage fluctuates when the transistor operates in a saturation region, so that a flat slope of voltage-current characteristics can be obtained. When the flat slope of the voltage-current characteristics is utilized, an ideal current source circuit or an active load having an extremely high resistance value can be realized. Accordingly, a differential circuit or a current mirror circuit having excellent properties can be realized. Alternatively, a structure where gate electrodes are formed above and below a channel may be used. When the structure where gate electrodes are formed above and below the channel is used, a channel region is increased, so that the amount of current flowing therethrough can be increased or a depletion layer can be easily formed to decrease subthreshold value. When the gate electrodes are formed above and below the channel, a structure where a plurality of transistors are connected in parallel is provided.

Alternatively, a structure where a gate electrode is formed above a channel region, a structure where a gate electrode is formed below a channel region, a staggered structure, an inversely staggered structure, a structure where a channel region is divided into a plurality of regions, or a structure where channel regions are connected in parallel or in series can be used. Further alternatively, a source electrode or a drain electrode may overlap with a channel region (or part of it). When the structure where the source electrode or the drain electrode may overlap with the channel region (or part of it) is used, the case can be prevented in which electric charges are accumulated in part of the channel region, which would result in an unstable operation. Further alternatively, an LDD region may be provided. When the LDD region is provided, off-current can be reduced or the withstand voltage of the transistor can be increased to improve reliability. Further, when the LDD region is provided, drain-source current does not fluctuate very much even if drain-source voltage fluctuates when the transistor operates in the saturation region, so that a flat slope of voltage-current characteristics can be obtained.

Note that various types of transistors can be used as a transistor and the transistor can be formed using various types of substrates. Accordingly, all the circuits that are necessary to realize a predetermined function may be formed using the same substrate. For example, all the circuits that are necessary to realize the predetermined function may be formed using a glass substrate, a plastic substrate, a single-crystalline substrate, an SOI substrate, or any other substrate. When all the circuits that are necessary to realize the predetermined function are formed using the same substrate, cost can be reduced by reduction in the number of component parts or reliability can be improved by reduction in the number of connections to circuit components. Alternatively, part of the circuits which are necessary to realize the predetermined function may be formed using one substrate and another part of the circuits which are necessary to realize the predetermined function may be formed using another substrate. That is, not all the circuits that are necessary to realize the predetermined function are required to be formed using the same substrate. For example, part of the circuits which are necessary to realize the predetermined function may be formed by transistors formed over a glass substrate and another part of the circuits which are necessary to realize the predetermined function may be formed over a single-crystal semiconductor substrate, so that an IC chip formed by a transistor formed over the single-crystalline substrate may be connected to the glass substrate by COG (chip on glass) and the IC chip may be provided over the glass substrate. Alternatively, the IC chip may be connected to the glass substrate by TAB (tape automated bonding) or a printed wiring board. When part of the circuits are formed using the same substrate in this manner, cost can be reduced by reduction in the number of component parts or reliability can be improved by reduction in the number of connections to circuit components. Further alternatively, when circuits with high driving voltage and high driving frequency, which consume large power, are formed over e.g., a single-crystalline substrate instead of forming such circuits using the same substrate, and an IC chip formed by the circuit is used, increase in power consumption can be prevented.

Note that one pixel corresponds to one element whose brightness can be controlled. Therefore, for example, one pixel corresponds to one color element and brightness is expressed with the one color element. Accordingly, in the case of a color display device having color elements of R (red), G (green), and B (blue), a minimum unit of an image is formed of three pixels of an R pixel, a G pixel, and a B pixel. Note that the color elements are not limited to three colors, and color elements of more than three colors may be used or a color other than RGB may be used. For example, RGBW (W corresponds to white) may be used by adding white. Alternatively, one or more colors of yellow, cyan, magenta emerald green, vermilion, and the like may be added to RGB. Further alternatively, a color similar to at least one of R, G, and B may be added to RGB. For example, R, G, B1, and B2 may be used. Although both B1 and B2 are blue, they have slightly different frequency. Similarly, R1, R2, G, and B may be used. When such color elements are used, display which is closer to the real object can be performed and power consumption can be reduced. As another example, in the case of controlling brightness of one color element by using a plurality of regions, one of the plurality of regions may correspond to one pixel. Therefore, for example, in the case of performing area ratio gray scale display or the case of including a sub-pixel, a plurality of regions which control brightness are provided in each color element and gray scales are expressed with all the regions. In this case, one region which controls brightness may correspond to one pixel. Thus, in that case, one color element includes a plurality of pixels. Alternatively, even when the plurality of regions which control brightness are provided in one color element, these regions may be collected as one pixel. Thus, in that case, one color element includes one pixel. In that case, one color element includes one pixel. Further alternatively, in the case where brightness is controlled in a plurality of regions in each color element, regions which contribute to display have different area dimensions depending on pixels in some cases. Further alternatively, in the plurality of regions which control brightness in each color element, signals supplied to each of the plurality of regions may be slightly varied to widen a viewing angle. That is, potentials of pixel electrodes included in the plurality of regions provided in each color element may be different from each other. Accordingly, voltage applied to liquid crystal molecules are different depending on the pixel electrodes. Therefore, the viewing angle can be widened.

Note that explicit description "one pixel (for three colors)" corresponds to the case where three pixels of R, G, and B are considered as one pixel. Meanwhile, explicit description "one pixel (for one color)" corresponds to the case where the plurality of regions are provided in each color element and collectively considered as one pixel.

Note that pixels are provided (arranged) in matrix in some cases. Here, description that pixels are provided (arranged) in matrix includes the case where the pixels are arranged in a straight line and the case where the pixels are arranged in a jagged line, in a longitudinal direction or a lateral direction. Thus, for example, in the case of performing full color display with three color elements (e.g., RGB), the following cases are included therein: the case where the pixels are arranged in stripes and the case where dots of the three color elements are arranged in a delta pattern. In addition, the case is also included therein in which dots of the three color elements are provided in Bayer arrangement. Note that the color elements are not limited to three colors, and color elements of more than three colors may be used. For example, RGBW (W corresponds to white), RGB plus one or more of yellow, cyan, magenta, and the like, or the like may be used. Further, the sizes of display regions may be different between respective dots of color elements. Thus, power consumption can be reduced or the life of a display element can be prolonged.

Note that an active matrix method in which an active element is included in a pixel or a passive matrix method in which an active element is not included in a pixel can be used.

In an active matrix method, as an active element (a non-linear element), not only transistors but also various active elements (non-linear elements) can be used. For example, an MIM (metal insulator metal), a TFD (thin film diode), or the like can also be used. Since such an element can be formed with fewer number of manufacturing steps, manufacturing cost can be reduced or yield can be improved. Further, since the size of the element is small, the aperture ratio can be improved, so that power consumption can be reduced or high luminance can be achieved.

Note that as a method other than an active matrix method, a passive matrix method in which an active element (a non-linear element) is not used can also be used. Since an active element (a non-linear element) is not used, manufacturing steps is few, so that manufacturing cost can be reduced or the yield can be improved. Further, since an active element (a non-linear element) is not used, the aperture ratio can be improved, so that power consumption can be reduced or high luminance can be achieved.

Note that a transistor is an element having at least three terminals of a gate, a drain, and a source. The transistor has a channel region between a drain region and a source region, and current can flow through the drain region, the channel region, and the source region. Here, since the source and the drain of the transistor change depending on the structure, the operating condition, and the like of the transistor, it is difficult to define which is a source or a drain. Therefore, in this description (including this specification, the scope of claims and the drawings), a region functioning as a source and a drain is not called the source or the drain in some cases. In such a case, one of the source and the drain may be referred to as a first terminal and the other thereof may be referred to as a second terminal, for example. Alternatively, one of the source and the drain may be referred to as a first electrode and the other thereof may be referred to as a second electrode. Further alternatively, one of the source and the drain may be referred to as a source region and the other thereof may be called a drain region.

Note that a transistor may be an element having at least three terminals of a base, an emitter, and a collector. Also in this case, one of the emitter and the collector may be referred to as a first terminal and the other terminal may be referred to as a second terminal.

Note that a gate corresponds to all or part of a gate electrode and a gate wiring (also referred to as a gate line, a gate signal line, a scanning line, a scan signal line, or the like). A gate electrode corresponds to a conductive film which overlaps with a semiconductor which forms a channel region with a gate insulating film interposed therebetween. Note that part of the gate electrode overlaps with an LDD (lightly doped drain) region or the source region (or the drain region) with the gate insulating film interposed therebetween in some cases. A gate wiring corresponds to a wiring for connecting gate electrodes of transistors to each other, a wiring for connecting gate electrodes of pixels to each other, or a wiring for connecting a gate electrode to another wiring.

However, there is a portion (a region, a conductive film, a wiring, or the like) which functions as both a gate electrode and a gate wiring. Such a portion (a region, a conductive film, a wiring, or the like) may be referred to as either a gate electrode or a gate wiring. That is, there is a region where a gate electrode and a gate wiring cannot be clearly distinguished from each other. For example, in the case where a channel region overlaps with part of an extended gate wiring, the overlap portion (region, conductive film, wiring, or the like) functions as both a gate wiring and a gate electrode. Accordingly, such a portion (a region, a conductive film, a wiring, or the like) may be referred to as either a gate electrode or a gate wiring.

Note that a portion (a region, a conductive film, a wiring, or the like) which is formed using the same material as a gate electrode, forms the same island as the gate electrode, and is connected to the gate electrode may also be referred to as a gate electrode. Similarly, a portion (a region, a conductive film, a wiring, or the like) which is formed using the same material as a gate wiring, forms the same island as the gate wiring, and is connected to the gate wiring may also be referred to as a gate wiring. In a strict sense, such a portion (a region, a conductive film, a wiring, or the like) does not overlap with a channel region or does not have a function of connecting the gate electrode to another gate electrode in some cases. However, there is a portion (a region, a conductive film, a wiring, or the like) which is formed using the same material as a gate electrode or a gate wiring, forms the same island as the gate electrode or the gate wiring, and is connected to the gate electrode or the gate wiring because of specifications or the like in manufacturing. Thus, such a portion (a region, a conductive film, a wiring, or the like) may also be referred to as either a gate electrode or a gate wiring.

Note that in a multi-gate transistor, for example, a gate electrode is often connected to another gate electrode by using a conductive film which is formed using the same material as the gate electrode. Since such a portion (a region, a conductive film, a wiring, or the like) is a portion (a region, a conductive film, a wiring, or the like) for connecting the gate electrode to another gate electrode, it may be referred to as a gate wiring, and it may also be referred to as a gate electrode because a multi-gate transistor can be considered as one transistor. That is, a portion (a region, a conductive film, a wiring, or the like) which is formed using the same material as a gate electrode or a gate wiring, forms the same island as the gate electrode or the gate wiring, and is connected to the gate electrode or the gate wiring may be referred to as either a gate electrode or a gate wiring. In addition, for example, part of a conductive film which connects the gate electrode and the gate wiring and is formed using a material which is different from that of the gate electrode or the gate wiring may also be referred to as either a gate electrode or a gate wiring.

Note that a gate terminal corresponds to part of a portion (a region, a conductive film, a wiring, or the like) of a gate electrode or a portion (a region, a conductive film, a wiring, or the like) which is electrically connected to the gate electrode.

Note that when a wiring is referred to as a gate wiring, a gate line, a gate signal line, a scanning line, a scan signal line, there is the case in which a gate of a transistor is not connected to a wiring. In this case, the gate wiring, the gate line, the gate signal line, the scanning line, or the scan signal line corresponds to a wiring formed in the same layer as the gate of the transistor, a wiring formed using the same material as the gate of the transistor, or a wiring formed at the same time as the gate of the transistor in some cases. As examples, there are a wiring for storage capacitance, a power supply line, a reference potential supply line, and the like.

Note that a source corresponds to all or part of a source region, a source electrode, and a source wiring (also referred to as a source line, a source signal line, a data line, a data signal line, or the like). A source region corresponds to a semiconductor region including a large amount of p-type impurities (e.g., boron or gallium) or n-type impurities (e.g., phosphorus or arsenic). Therefore, a region including a small amount of p-type impurities or n-type impurities, namely, an LDD (lightly doped drain) region is not included in the source region. A source electrode is part of a conductive layer which is formed using a material different from that of a source region and is electrically connected to the source region. However, there is the case where a source electrode and a source region are collectively referred to as a source electrode. A source wiring is a wiring for connecting source electrodes of transistors to each other, a wiring for connecting source electrodes of pixels to each other, or a wiring for connecting a source electrode to another wiring.

However, there is a portion (a region, a conductive film, a wiring, or the like) functioning as both a source electrode and a source wiring. Such a portion (a region, a conductive film, a wiring, or the like) may be referred to as either a source electrode or a source wiring. That is, there is a region where a source electrode and a source wiring cannot be clearly distinguished from each other. For example, in the case where a source region overlaps with part of an extended source wiring, the overlap portion (region, conductive film, wiring, or the like) functions as both a source wiring and a source electrode. Accordingly, such a portion (a region, a conductive film, a wiring, or the like) may be referred to as either a source electrode or a source wiring.

Note that a portion (a region, a conductive film, a wiring, or the like) which is formed using the same material as a source electrode, forms the same island as the source electrode, and is connected to the source electrode, or a portion (a region, a conductive film, a wiring, or the like) which connects a source electrode and another source electrode may also be referred to as a source electrode. Further, a portion which overlaps with a source region may be referred to as a source electrode. Similarly, a portion (a region, a conductive film, a wiring, or the like) which is formed using the same material as a source wiring, forms the same island as the source wiring, and is connected to the source wiring may also be referred to as a source wiring. In a strict sense, such a portion (a region, a conductive film, a wiring, or the like) does not have a function of connecting the source electrode to another source electrode in some cases. However, there is a portion (a region, a conductive film, a wiring, or the like) which is formed using the same material as a source electrode or a source wiring, forms the same island as the source electrode or the source wiring, and is connected to the source electrode or the source wiring because of specifications or the like in manufacturing. Thus, such a portion (a region, a conductive film, a wiring, or the like) may also be referred to as either a source electrode or a source wiring.

For example, part of a conductive film which connects a source electrode and a source wiring and is formed using a material which is different from that of the source electrode or the source wiring may be referred to as either a source electrode or a source wiring.

Note that a source terminal corresponds to part of a source region, a source electrode, or a portion (a region, a conductive film, a wiring, or the like) which is electrically connected to the source electrode.

Note that when a wiring is referred to as a source wiring, a source line, a source signal line, a data line, a data signal line, there is a case in which a source (a drain) of a transistor is not connected to the wiring. In this case, the source wiring, the source line, the source signal line, the data line, or the data signal line corresponds to a wiring formed in the same layer as the source (the drain) of the transistor, a wiring formed using the same material of the source (the drain) of the transistor, or a wiring formed at the same time as the source (the drain) of the transistor in some cases. As examples, there are a wiring for storage capacitance, a power supply line, a reference potential supply line, and the like.

Note that the same can be said for a drain.

Note that a semiconductor device corresponds to a device having a circuit including a semiconductor element (e.g., a transistor, a diode, or a thyristor). The semiconductor device may also include all devices that can function by utilizing semiconductor characteristics. In addition, the semiconductor device corresponds to a device having a semiconductor material.

Note that a display element corresponds to an optical modulation element, a liquid crystal element, a light-emitting element, an EL element (an organic EL element, an inorganic EL element, or an EL element including organic and inorganic materials), an electron emitter, an electrophoresis element, a discharging element, a light-reflective element, a light diffraction element, a digital micromirror device (DMD), or the like. Note that the present invention is not limited to these examples.

Note that a display device corresponds to a device having a display element. The display device may include a plurality of pixels each having a display element. Note that the display device may also include a peripheral driver circuit for driving the plurality of pixels. The peripheral driver circuit for driving the plurality of pixels may be formed over the same substrate as the plurality of pixels. The display device may also include a peripheral driver circuit provided over a substrate by wire bonding or bump bonding, an IC chip connected by so-called chip on glass (COG), or an IC chip connected by TAB, or the like. Further, the display device may also include a flexible printed circuit (FPC) to which an IC chip, a resistor, a capacitor, an inductor, a transistor, or the like is attached. Note also that the display device includes a printed wiring board (PWB) which is connected through a flexible printed circuit (FPC) and to which an IC chip, a resistor, a capacitor, an inductor, a transistor, or the like is attached. The display device may also include an optical sheet such as a polarizing plate or a retardation plate. The display device may also include a lighting device, a housing, an audio input and output device, a light sensor, or the like. Here, a lighting device such as a backlight unit may include a light guide plate, a prism sheet, a diffusion sheet, a reflective sheet, a light source (e.g., an LED or a cold cathode fluorescent lamp), a cooling device (e.g., a water cooling device or an air cooling device), or the like.

Note that a lighting device corresponds to a device having a backlight unit, a light guide plate, a prism sheet, a diffusion sheet, a reflective sheet, or a light source (e.g., an LED, a cold cathode fluorescent lamp, or a hot cathode fluorescent lamp), a cooling device, or the like.

Note that a light-emitting device corresponds to a device having a light-emitting element or the like. In the case where a light-emitting device includes a light-emitting element as a display element, the light-emitting device is one of specific examples of display devices.

Note that a reflective device corresponds to a device having a light-reflective element, a light diffraction element, light-reflective electrode, or the like.

Note that a liquid crystal display device corresponds to a display device including a liquid crystal element. Liquid crystal display devices include a direct-view liquid crystal display, a projection liquid crystal display, a transmissive liquid crystal display, a reflective liquid crystal display, a transflective liquid crystal display, and the like.

Note that a driving device corresponds to a device having a semiconductor element, an electric circuit, and/or an electronic circuit. For example, a transistor which controls input of a signal from a source signal line to a pixel (also referred to as a selection transistor, a switching transistor, or the like), a transistor which supplies voltage or current to a pixel electrode, a transistor which supplies voltage or current to a light-emitting element, and the like are examples of the driving device. A circuit which supplies a signal to a gate signal line (also referred to as a gate driver, a gate line driver circuit, or the like), a circuit which supplies a signal to a source signal line (also referred to as a source driver, a source line driver circuit, or the like), and the like are also examples of the driving device.

Note that a display device, a semiconductor device, a lighting device, a cooling device, a light-emitting device, a reflective device, a driving device, and the like overlap with each other in some cases. For example, a display device includes a semiconductor device and a light-emitting device in some cases. Alternatively, a semiconductor device includes a display device and a driving device in some cases.

Note that when it is explicitly described that "B is formed on A" or "B is formed over A", it does not necessarily mean that B is formed in direct contact with A. The description includes the case where A and B are not in direct contact with each other, i.e., the case where another object is interposed between A and B. Here, each of A and B corresponds to an object (e.g., a device, an element, a circuit, a wiring, an electrode, a terminal, a conductive film, or a layer).

Accordingly, for example, when it is explicitly described that "a layer B is formed on (or over) a layer A", it includes both the case where the layer B is formed in direct contact with the layer A, and the case where another layer (e.g., a layer C or a layer D) is formed in direct contact with the layer A and the layer B is formed in direct contact with the layer C or D. Note that another layer (e.g., a layer C or a layer D) may be a single layer or a plurality of layers.

Similarly, when it is explicitly described that "B is formed above A", it does not necessarily mean that B is formed in direct contact with A, and another object may be interposed therebetween. Thus, for example, when it is described that "a layer B is formed above a layer A", it includes both the case where the layer B is formed in direct contact with the layer A, and the case where another layer (e.g., a layer C or a layer D) is formed in direct contact with the layer A and the layer B is formed in direct contact with the layer C or D. Note that another layer (e.g., a layer C or a layer D) may be a single layer or a plurality of layers.

Note that when it is explicitly described that "B is formed in direct contact with A", it includes not the case where another object is interposed between A and B but the case where B is formed in direct contact with A.

Note that the same can be applied to the case where it is described that B is formed below or under A.

Note that when an object is explicitly described in a singular form, the object is preferably singular. Note that the present invention is not limited to this, and the object can be plural. Similarly, when an object is explicitly described in a plural form, the object is preferably plural. Note that the present invention is not limited to this, and the object can be singular.

In the present invention, viewing angle characteristics for a viewer can be improved by making liquid crystal molecules slanted to increase directions of alignment, and the viewing angle characteristics can also be improved by changing the transmittance of the liquid crystal molecules every frame. As a result, a liquid crystal display device which is capable of improving viewing angle characteristics, a driving method of the liquid crystal display device, and an electronic device including the liquid crystal display device can be provided.

Moreover, in the present invention, viewing angle characteristics for a viewer can be improved by making liquid crystal molecules slanted to increase directions of alignment, and the viewing angle characteristics can also be improved by using optical illusion due to change in the transmittance of the liquid crystal molecules with respect to adjacent pixels. As a result, a liquid crystal display device which is capable of improving viewing angle characteristics, a driving method of the liquid crystal display device, and an electronic device including the liquid crystal display device can be provided.

BRIEF DESCRIPTION OF THE DRAWINGS

In the accompanying drawings:

FIG. 2 is a diagram for describing a LUT;

FIG. 12 is a diagram for describing a LUT;

FIG. 16 is a diagram for describing a LUT;

DETAILED DESCRIPTION OF THE INVENTION

Figure 1:
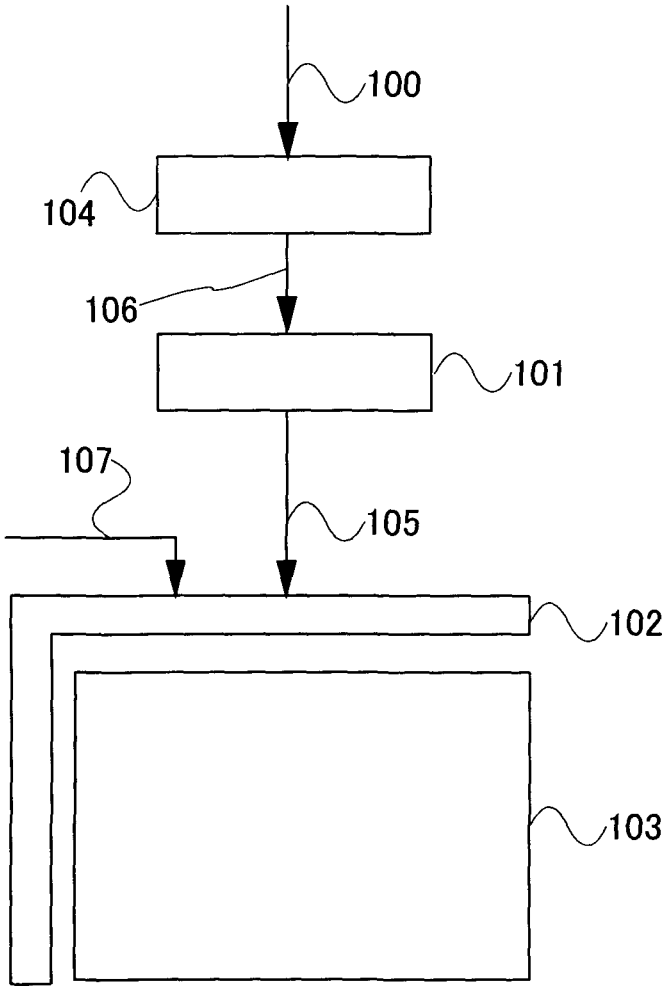
FIG. 1 is a diagram illustrating a liquid crystal display device of the present invention.

Hereinafter, embodiment modes of the present invention will be described with reference to the accompanying drawings. However, it is to be noted that the present invention can be implemented in various modes, and it is easily understood by those skilled in the art that modes and details thereof can be modified in various ways without departing from the spirit and the scope of the present invention. Therefore, the invention should not be limited to the descriptions of the embodiment modes in the present invention. In the drawings of this specification, the same portions or portions having similar functions are denoted by the same reference numerals, and explanation thereof will be omitted.

Embodiment Mode 1

First, a basic principle for describing the present invention will be mentioned in detail.

Figure 75:
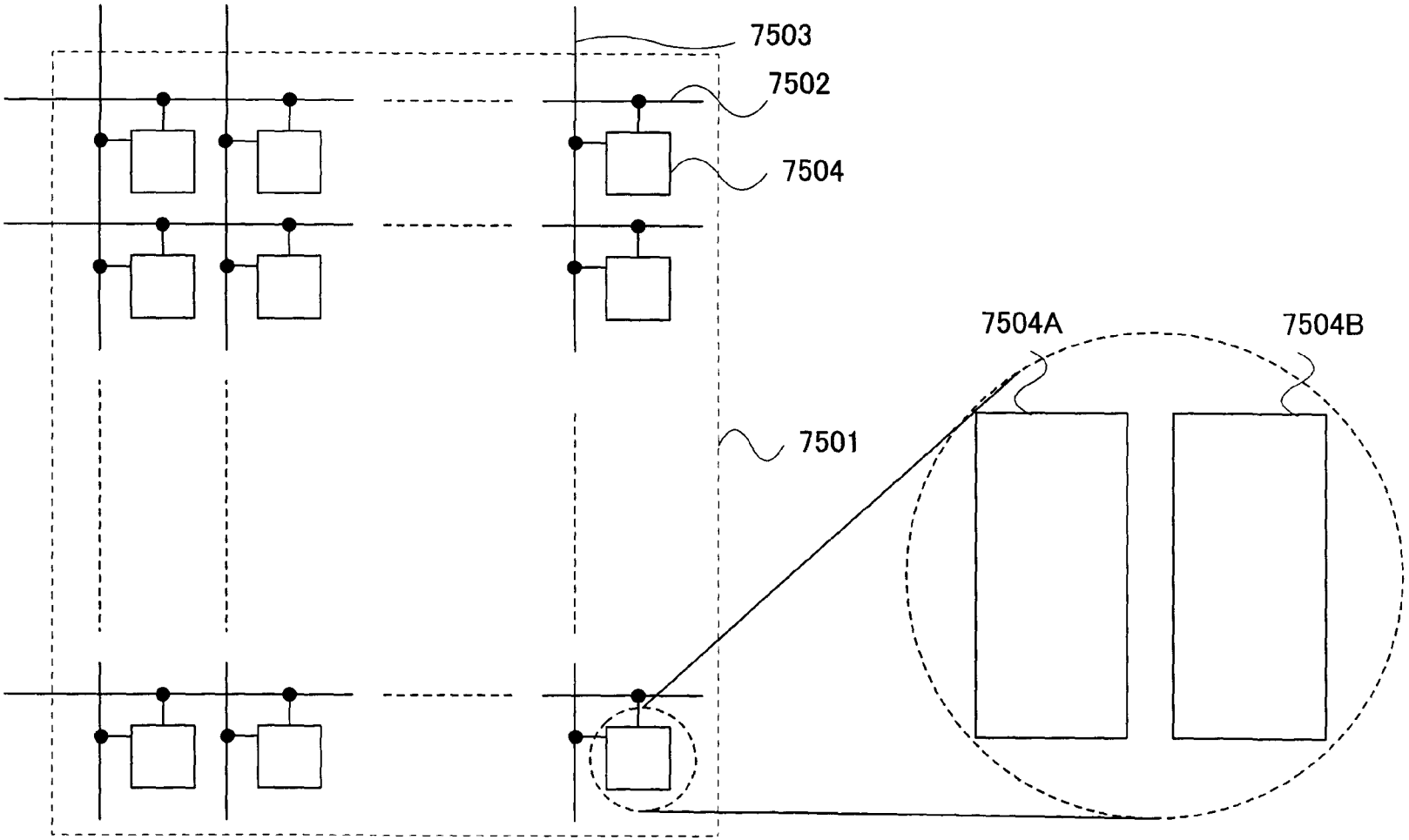
FIG. 75 is a diagram for describing a specific example of the present invention.

A plurality of pixels is provided in a display portion of a display device and is arranged in matrix as an example shown in FIG. 75. In FIG. 75, a plurality of pixels 7504 which is connected to a scanning line 7502 and a signal line 7503 is provided in a display portion 7501. One pixel includes one region or more regions (hereinafter, referred to as a sub-pixel). For example, as shown in FIG. 75, one pixel includes a first sub-pixel (sub-pixel A 7504A) and a second sub-pixel (sub-pixel B 7504B).

One pixel expresses grayscale of one pixel with the total amount of light to be transmitted through respective sub-pixels A and B. That is, the amount X of light to be transmitted corresponding to a level of grayscale expressed in one pixel is the sum of the amount XA of light to be transmitted through the sub-pixel A and the amount XB of light to be transmitted through the sub-pixel B. The amount X of light to be transmitted is controlled by the sum of the amount XA of light to be transmitted through the sub-pixel A and the amount XB of light to be transmitted through the sub-pixel B, and grayscale of one pixel is expressed.

Note that the amount of light to be transmitted through the pixel or the sub-pixel can be the luminance of the pixel or the sub-pixel, the amount of reflected light from the pixel or the sub-pixel, or the sum of the amount of the light to be transmitted through the pixel or the sub-pixel and the amount of reflected light from the pixel or the sub-pixel.

Figure 76A:
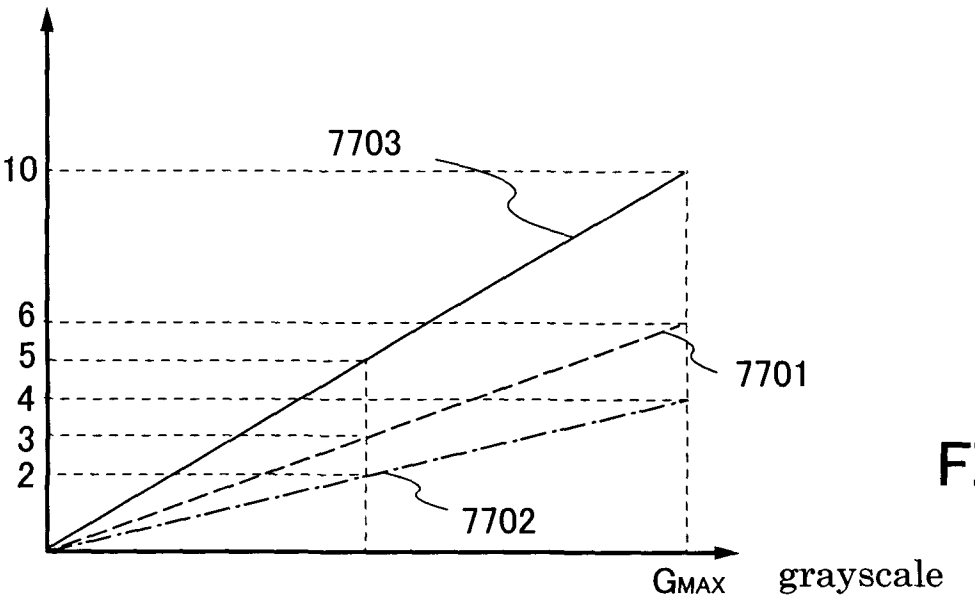
FIGS. 76A to 76C are diagrams for describing specific examples of the present invention.

The amount of light to be transmitted through one pixel and the amount of light to be transmitted through the sub-pixels A and B will be specifically described with reference to FIG. 76A. FIG. 76A illustrates the amount 7701 of light to be transmitted through the sub-pixel A, the amount 7702 of light to be transmitted through the sub-pixel B, and the sum 7703 of the amounts of light to be transmitted through one pixel, with respect to grayscale of one pixel. For example, as shown in FIG. 76A, when the amount of light to be transmitted through one pixel is 5, by setting the amounts of light to be transmitted through the sub-pixels A and B to be 2 and 3, respectively, the sum thereof is 5 and the amount of light to be transmitted through one pixel can be 5. Alternatively, when the amount of light to be transmitted through one pixel is 10, by setting the amounts of light to be transmitted through the sub-pixels A and B to be 4 and 6, respectively, the sum thereof is 10 and the amount of light to be transmitted through one pixel can be 10. In this manner, by changing the amounts of light to be transmitted through a plurality of sub-pixels, corresponding to the amount of light to be transmitted through one pixel, grayscale can be properly expressed.

Figure 76B:
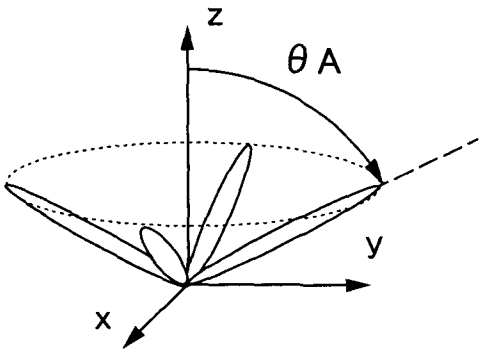
Figure 76C:
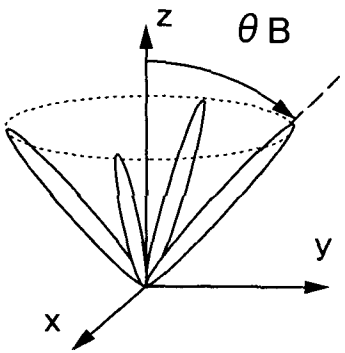

At that time, aligned states of liquid crystal molecules in the sub-pixels A and B may be different from each other. For example, as shown in FIG. 76B, the liquid crystal molecules in the sub-pixel A are made to be slanted by θA to orient, and as shown in FIG. 76C, the liquid crystal molecules in the sub-pixel B are made to be slanted by θB to orient. As a result, when an angle from which a viewer looked a display portion (also referred to as a screen) through which light transmits, is changed, a difference between grayscale which is perceived by viewer's eye and grayscale which is actually expressed can be suppressed. Therefore, viewing angle characteristics for a viewer can be improved.

As described above, by dividing grayscale expression of one pixel into sub-pixels, the viewing angle can be increased. However, if the amount of light to be transmitted through a pixel is determined, and the amounts of light to be transmitted through the sub-pixels A and B are fixed, grayscale is changed when the screen is looked from a particular angle.

In view of foregoing variation in grayscale, in a structure described in this embodiment mode, the amounts of light to be transmitted through the sub-pixels A and B are not fixed when the amount of light to be transmitted through a pixel is determined. Since the amounts of light to be transmitted through the sub-pixels A and B are not fixed, variation in grayscale, when the screen is looked from a particular angle, can be further suppressed.

The structure described in this embodiment mode is conceived by focusing on a plurality of combinations which can be made by the amount XA of light to be transmitted through the sub-pixel A and the amount XB of light to be transmitted through the sub-pixel B with respect to the amount X of light to be transmitted through one pixel. That is, a plurality of combinations of the amount of light to be transmitted through the sub-pixel A and the amount of light to be transmitted through the sub-pixel B, which determines the amount of light to be transmitted through one pixel, is employed. As a result, since the amounts of light to be transmitted through respective sub-pixels, which determine the amount of light to be transmitted through one pixel, are not fixed, variation in grayscale, when the screen is looked from a particular angle, can be suppressed.

For example, when the amount X of light to be transmitted through one pixel is 5, a combination of XA=1 (XA is the amount of light to be transmitted through the sub-pixel A) and XB=4 (XB is the amount of light to be transmitted through the sub-pixel B) can be made. Alternatively, a combination of XA=0 (XA is the amount of light to be transmitted through the sub-pixel A) and XB=5 (XB is the amount of light to be transmitted through the sub-pixel B) can be made. Alternatively, a combination of XA=3 (XA is the amount of light to be transmitted through the sub-pixel A) and XB=2 (XB is the amount of light to be transmitted through the sub-pixel B) can be made. Therefore, when the amounts of light to be transmitted through the sub-pixels A and B are expressed as (XA, XB), a plurality of combinations such as (0, 5), (1, 4), (2, 3), or (3, 2) can be made when the amount X of light to be transmitted through one pixel is 5. Note that the total sum of the amounts of light to be transmitted XA and XB is the amount X of light to be transmitted.

As a specific structure, a plurality of combinations of (XA, XB) is employed when the amount X of light to be transmitted through one pixel is required in order to obtain desired grayscale. For example, during a period (hereinafter, referred to as a first period), (XA1, XB1) is employed; and during another period (hereinafter, referred to as a second period), (XA2, XB2) is employed. As a result, during the total period of the first period and the second period, the amounts of light to be transmitted during the first period and the second period are averaged so that variation in grayscale, when the screen is looked from a particular angle, can be suppressed.

In the above description, although the relation of the amount X of light to be transmitted through one pixel, the amount XA of light to be transmitted through the sub-pixel A, and the amount XB of light to be transmitted through the sub-pixel B is shown as X=XA+XB, the present invention is not limited thereto. It is acceptable as long as the sum of the XA and XB is almost equal to X. Since the amounts X, XA, and XB of light to be transmitted slightly vary depending on an angle to be looked from, the sum of XA and XB can be different from X in some cases. However, as long as problems such as flicker and irregular grayscale are not recognized by a human eye, there is no problem. Difference between the sum of XA and XB and X is preferably about 10%, or more preferably, about 5%.

Next, a structure will be described in which a parameter different from the amount of light to be transmitted is used, and a relation between the different parameter and the amount of light to be transmitted will be explained. That is, an example is shown in which grayscale is controlled by controlling the amount of light to be transmitted through one pixel by using a parameter different from the amount of light to be transmitted.

For example, an area of a light-transmitting region in the sub-pixel A is SA, an area of a light-transmitting region in the sub-pixel B is SB, the amount of light to be transmitted through the sub-pixel A per unit area and unit time is TA, the amount of light to be transmitted through the sub-pixel B per unit area and unit time is TB, a time during which light is transmitted through the sub-pixel A is PA, and a time during which light is transmitted through the sub-pixel B is PB. By using the above-mentioned parameter, the amount XA of light to be transmitted through the sub-pixel A and the amount XB of light to be transmitted through the sub-pixel B is expressed by a relational formula, XA=SA×TA×PA and XB=SB×TB×PB. Therefore, by controlling at least one parameter such as the area of a light-transmitting region, the amount of light to be transmitted per unit area and unit time, and the time during which light is transmitted, the amount of light to be transmitted can be controlled.

Note that a light-transmitting region in a pixel or a sub-pixel may be a light-emitting region in a pixel or a sub-pixel, or a light-reflective region in a pixel or a sub-pixel. In addition, a light-transmitting region in a pixel or a sub-pixel may be the sum of a light-emitting region in a pixel or a sub-pixel, and a light-reflective region in a pixel or a sub-pixel. In addition, the amount of light to be transmitted per unit area and unit time may be the luminance of emitted light per unit time in a pixel or a sub-pixel, or the amount of reflected light per unit time in a pixel or a sub-pixel. In addition, the amount of light to be transmitted per unit area and unit time may be the sum of the amount of light to be transmitted per unit area and unit time in a pixel or a sub-pixel, and the amount of reflected light per unit area and unit time in a pixel or a sub-pixel. In addition, the time during which light is transmitted through a pixel or a sub-pixel may be a time during which light is emitted in a pixel or a sub-pixel, or a time during which light is reflected from a pixel or a sub-pixel. In addition, the time during which light is transmitted through a pixel or a sub-pixel may be the sum of a time during which light is transmitted through a pixel or a sub-pixel, or a time during which light is reflected from a pixel or a sub-pixel.

Moreover, the amounts TA and TB of light to be transmitted per unit area and per unit time through respective sub-pixels can be controlled by grayscale signals applied to the sub-pixels. Therefore, when grayscale signal in the sub-pixel A is EA, the amount of light to be transmitted per unit area and per unit time can be TA, and when grayscale signal in the sub-pixel B is EB, the amount of light to be transmitted per unit area and per unit time can be TB.

Further, the amounts TA and TB of light to be transmitted per unit area and per unit time through respective sub-pixels can be determined by the signals actually applied to display elements corresponding to grayscale signal. For example, in the case of a liquid crystal element, when a grayscale signal in the sub-pixel A is EA, a grayscale voltage VA applied to a pixel electrode of the sub-pixel A is subjected to gamma correction in accordance with characteristics of the liquid crystal element. In addition, since the liquid crystal element is driven by AC driving, a voltage for a positive electrode and a voltage for a negative electrode are necessary. Suppose the potential of a common electrode is 0 V, a grayscale voltage VA for a positive electrode and a grayscale voltage −VA for a negative electrode are applied to the pixel electrode. As a result, the amount TA of light to be transmitted per unit area and per unit time can be controlled to control the amount XA of light to be transmitted. Note that this is similar in the sub-pixel B.

Note that a grayscale voltage is determined in consideration for an area of a light-transmitting region in the sub-pixel, a time during which light is transmitted, a luminance of a backlight or the like, and the like. For example, when the sub-pixel A—to—the sub-pixel B ratio is 1:2 in the area of the light-transmitting region in the sub-pixel, even if the amount of light to be transmitted (XA, XB) is (2, 4), the same grayscale voltage is supplied to the sub-pixels A and B. This is because the areas of the light-transmitting regions are different even though the grayscale voltages are the same; and therefore, the amounts of light to be transmitted are different.

Although the case where the potential of the common electrode is 0 V is shown, the present invention is not limited thereto. In the case where the potential of the common electrode is not 0, the grayscale voltages for the positive electrode and the negative electrode are shifted corresponding thereto. In addition, although the potential of the common electrode is 0 V, absolute values of the grayscale voltages for the positive electrode and the negative electrode are not always the same. In some cases, the grayscale voltage for the positive electrode and the grayscale voltage for the negative electrode may be different due to noise or the like.

In the case of a display device using a liquid crystal element, light comes from a backlight, front light, or the like, and the proportion of light to be transmitted is controlled by the liquid crystal element. That is, the transmittance of light is controlled by the liquid crystal element. Therefore, the amount of light to be transmitted per unit area and unit time can be controlled by the intensity of light which comes from the backlight, front light or the like, and the transmittance of light which is controlled by the liquid crystal element.

As described above, the amount of light to be transmitted can be controlled by using various parameters. Among the above-described parameters, which parameter is used for control can be decided at will. In addition, a parameter is not limited to the area of the light-transmitting region, the amount of light to be transmitted per unit area and per unit time, the time during which light is transmitted, and the like. Various parameters can be used as long as the amount of light to be transmitted can be controlled.

When the amount X of light to be transmitted through one pixel is required, a plurality of combinations of parameters is used corresponding to the amounts of light to be transmitted through respective sub-pixels. Since the amount of light to be transmitted is controlled by the parameters such as the area of the light-transmitting region, the amount of light to be transmitted per unit area and per unit time, the time during which light is transmitted, the grayscale signals, the grayscale voltage, transmittance, the luminance of a backlight or the like, or the like, at least one parameter is selected from these parameters. Then, in that parameter, a plurality of combinations of values is used and the amount X of light to be transmitted through one pixel is controlled. One parameter is preferably used for controlling the amount of light to be transmitted because one parameter is easy to use for control. However, the present invention is not limited thereto and a plurality of parameters can be combined.

For example, in the case where the sub-pixels A and B are provided, the amount X of light to be transmitted can be controlled by using a grayscale signal EA of the sub-pixel A, a time PA during which light is transmitted through the sub-pixel A, a grayscale signal EB of the sub-pixel B, and a time PB during which light is transmitted through the sub-pixel B, as parameters to obtain a plurality of combinations of values, (EA, PA, EB, PB). Alternatively, the amount X of light to be transmitted can be controlled by using the grayscale signal EA of the sub-pixel A and the grayscale signal EB of the sub-pixel B, as parameters to obtain a plurality of combinations of values, (EA, EB). In addition, this is similar in the case where the number of sub-pixels which are included in one pixel is not two.

Note that the amount of light to be transmitted, the area of the light-transmitting region, the amount of light to be transmitted per unit area and per unit time, the time during which light is transmitted, the grayscale signal, the grayscale voltage, transmittance, the luminance of a backlight or the like, and the like can be analog quantity or digital quantity. In the case where gamma correction is performed in the display device, and AC driving of the liquid crystal element is considered, the grayscale voltage is preferably analog quantity. On the other hand, in the case where the grayscale signal does not include information about gamma correction or AC driving of the liquid crystal element, the grayscale signal is preferably a signal of digital quantity (hereinafter, referred to as a digital signal). Since the digital signal can hold or process signals easily, the grayscale signal is preferably the digital signal. Therefore, starting as the digital signal, it is preferably converted to a signal of analog quantity (hereinafter, referred to as an analog signal) just before the signal is applied to the liquid crystal element in the display portion. Since information about gamma correction or AC driving of the liquid crystal element is added when such digital-analog conversion is performed, the grayscale signal can be input efficiently to the display portion.

When the amount X of light to be transmitted through one pixel, for example, in the case where the sub-pixels A and B are provided and the combination of the amount XA of light to be transmitted through the sub-pixel A and the amount XB of light to be transmitted through the sub-pixel B, (XA, XB) is used, each of a plurality of combinations of (XA, XB) can be pre-arranged as data, can be made by calculation or the like as needed, or can be partly pre-arranged and partly made by calculation.

In the case where the plurality of combinations of (XA, XB) is used, there is no particular limitation on an order or a period in/during which data of these combinations are used. For example, the plurality of combinations of (XA, XB) can be pre-arranged as data in a memory. Alternatively, the plurality of combinations of (XA, XB) can be made by arithmetic processing in an arithmetic logical unit as needed. Alternatively, part of the plurality of combinations of (XA, XB) can be pre-arranged in the memory, and part of the plurality of combinations of (XA, XB) can be made by arithmetic processing in the arithmetic logical unit.

Note that in the case where data of the plurality of combinations of (XA, XB) is pre-arranged in the memory, for example, when the amount X of the light to be transmitted through one pixel is 5, four data can be arranged supposing that four combinations, (0, 5), (1, 4), (2, 3), and (3, 2) are used. When data is pre-arranged, it can be stored as a LUT (a look up table) in the memory. That is, when the amount of light to be transmitted is X, data of (XA, XB) is stored as a LUT, and the plurality of combinations of (XA, XB) can be used by reading the data as needed with reference to the LUT.

Note that in the case where the data is stored as the LUT in the memory, various parameters such as the amount of transmission, the area of the light-transmitting region, the amount of light to be transmitted per unit area and per unit time, the time during which light is transmitted, the grayscale signal, the grayscale voltage, transmittance, and the luminance of a backlight or the like, can be stored. However, in general, a specification of the LUT to be stored in the memory is determined at the stage of designing the display device. For that reason, it is not necessary to store parameters, which do not contribute to actual display, as the LUT in the memory.

Note that in the case where the data of the plurality of combinations (XA, XB) is stored as the LUT in the memory, the plurality of combinations (XA, XB) is preferably used in order so that data can be thoroughly used to increase the viewing angle. For example, when the amount X of light to be transmitted through one pixel is 5, as the combination (XA, XB), when four combinations of data (0, 5), (1, 4), (2, 3), and (3, 2) are stored as the LUT, the data is used in order of from (0, 5), (1, 4), (2, 3), and (3, 2). When the combination (3, 2) is finished, the order returns to (0, 5) and similarly repeated.

However, there is no particular limitation on how the above-described combination of the data (hereinafter, referred to as combination data) which controls the amount X of light to be transmitted through one pixel is used. Data including an order of using the combination data can be stored in the memory with the LUT in advance. In this manner, the data including the order of using the combination data can be used by being read out from the memory. The combination data can be used in random order. In the case where the data is used in random order, random numbers are generated when the data is selected from the LUT and combination data corresponding to the random number can be used.

Next, a detailed structural example is shown in which a plurality of sub-pixels is provided in one pixel and a grayscale signal (hereinafter, referred to as a sub-grayscale signal) which controls the amount of light to be transmitted with respect to each sub-pixel is stored as data in a LUT.

FIG. 1 illustrates a structural example of a block diagram of a liquid crystal display device. The liquid crystal display device shown in FIG. 1 includes a grayscale data conversion portion 101, a driving portion 102, a display portion 103, and a grayscale data memory portion 104.

In FIG. 1, the grayscale signal 100 is input to the grayscale data memory portion 104. The grayscale data memory portion 104 refers a LUT stored in the grayscale data memory portion 104 in accordance with a level of grayscale of the grayscale signal 100 input. Then, the grayscale data memory portion 104 outputs combination data 106 based on the LUT to the grayscale data conversion portion 101. The grayscale data conversion portion 101 outputs a sub-grayscale signal 105 based on the combination data 106 to the driving portion 102. A control signal 107 for controlling display of the display portion 103 is input to the driving portion 102. The driving portion 102 outputs a signal for display of the display portion 103 in accordance with a plurality of sub-grayscale signals 105 and the control signal 107. In addition, the driving portion 102 has functions of D/A conversion of a signal to be output to the display portion 103, gamma correction, and polarity inversion.

Note that the sub-grayscale signal 105 corresponds to image data (moving image, still image, or the like) supplied to each pixel in the display portion 103. In addition, as described above, the display portion 103 includes the plurality of sub-pixels and the sub-grayscale signal 105 is a signal for controlling grayscale of each sub-pixel. The control signal 107 is a signal of reference for a clock pulse, a start pulse, and the like for controlling the driving portion 102.

The grayscale signal 100 is preferably a digital signal. If the grayscale signal 100 is the digital signal, the grayscale data memory portion 104 can easily perform conversion of the grayscale signal 100 to the combination data 106 in accordance with a level of grayscale of the grayscale signal 100. In addition, the grayscale signal 100 can be easily stored. Alternatively, the sub-grayscale signal 105 output to the driving portion 102 by the grayscale data conversion portion 101 is preferably a digital signal. If the sub-grayscale signal 105 is the digital signal, a normal signal which is less likely to be influenced by noise can be sent. In the driving portion 102, the digital signal is converted into an analog signal which is subjected to gamma correction, adjustment of polarity (selection of a positive signal or a negative signal), and the like. Then, the analog signal is supplied to a pixel of the display portion 103.

Figure 57:
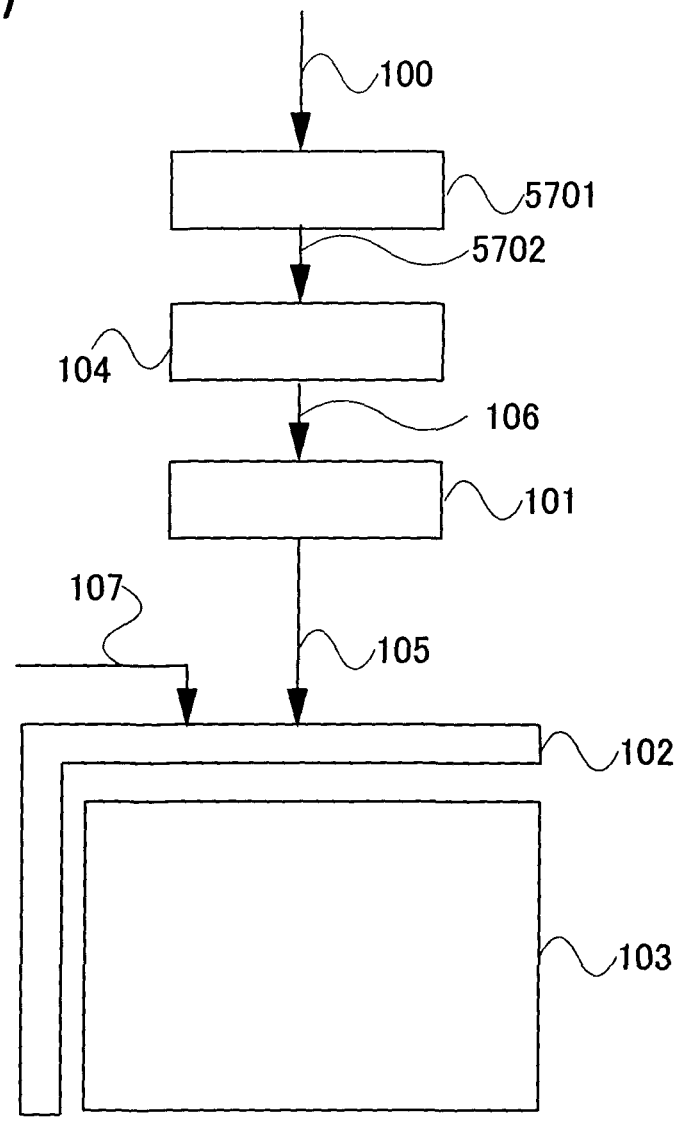
FIG. 57 is a diagram for describing a specific example of the present invention.
Figure 58:
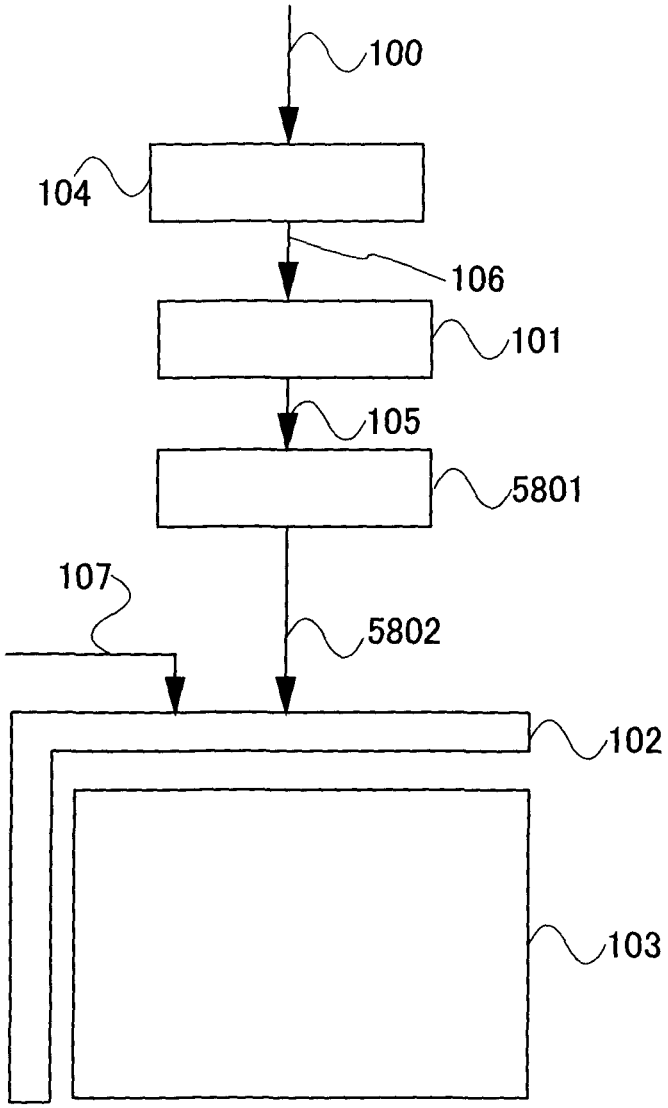
FIG. 58 is a diagram for describing a specific example of the present invention.

In the structure of the block diagram of the liquid crystal display device described in FIG. 1, the example is shown in which the grayscale signal 100 is the digital signal. However, the present invention is not limited thereto. In the case where the grayscale signal 100 is an analog signal, as shown in FIG. 57, an A/D conversion circuit 5701 is provided on the side where the grayscale signal is input to the grayscale data conversion portion 101 so that the grayscale signal 100 of the analog signal may be converted into a digital signal 5702 with appropriate bit number. In addition, in the case where a sub-grayscale signal of the analog signal is output to the driving portion 102, as shown in FIG. 58, a D/A conversion circuit 5801 is provided on the side where the sub-grayscale signal is input to the driving portion 102 and the sub-grayscale signal of the digital signal is converted into an analog signal 5802 to be output to the driving portion 102. In this case, gamma correction, adjustment of polarity (selection of a positive signal or a negative signal), and the like are performed in the D/A conversion circuit 5801 in many cases. Therefore, such functions are often omitted from the driving portion 102. When the analog signal is supplied to the driving portion 102, since the structure of the driving portion 102 can be simple, the display portion 103 and the driving portion 102 can be provided over one substrate. In this manner, a narrower frame, improved reliability, the reduced number of parts can be achieved.

Although the analog signal is supplied as the sub-grayscale signal 105 to the display portion 103 in many cases, the present invention is not limited thereto. The digital signal can be supplied as the grayscale signal to the display portion 103 and display can be performed by a time grayscale method or an area grayscale method.

The grayscale data conversion portion 101 read the combination data 106 corresponding to the grayscale signal 100 from the grayscale data memory portion 104. In this embodiment mode, a level of grayscale of the grayscale signal is n (n is a natural number including 0). In the description below, the grayscale data memory portion 104 stores the combination data 106 as a LUT corresponding to a level of grayscale. The combination data 106 is output from the grayscale data memory portion 104 with reference to the LUT in accordance with the level of grayscale of the grayscale signal 100. Note that the LUT is arrangement of data of the estimated amount of light to be transmitted which is expressed by the sub-grayscale signal 105 output from the grayscale data conversion portion 101 in accordance with the level of grayscale of the grayscale signal 100.

The LUT includes combination data corresponding to the level of grayscale of the grayscale signal 100. During a different given period, one combination data is selected from the plurality of combination data and the combination data 106 corresponding to the level of grayscale of the grayscale signal 100 is output to the grayscale data conversion portion 101.

The LUT includes the plurality of the combination data each corresponding to the level of grayscale of the same grayscale signal 100. FIG. 2 schematically illustrates the LUT stored in the grayscale data memory portion 104. In this embodiment mode, during the first period, a first combination data is output as the combination data 106 to the grayscale data conversion portion 101, and during the second period, a second combination data is output as the combination data 106 to the grayscale data conversion portion 101. As described above, although the combination data correspond to the level of grayscale of the same grayscale signal 100, the combination data from the first combination data, and the combination data from the second combination data each generate the sub-grayscale signal 105 having a different voltage in the grayscale data conversion portion 101.

In addition, the display portion of the display device described in this embodiment mode includes a plurality of pixels each including a sub-pixel. Each sub-pixel includes a liquid crystal element. The sub-grayscale signal 105 is supplied to the liquid crystal element included in each sub-pixel. In general, different grayscale voltage is supplied to each sub-pixel in order to increase the viewing angle and transmittance of light is controlled by the liquid crystal element. However, the present invention is not limited thereto. There is the case where the same grayscale voltage is applied to some sub-pixels. Each of the plurality of pixels is in an effort to improve the viewing angle characteristics for a viewer by increasing directions of alignment by making liquid crystal molecules slanted to different directions in every sub-pixel, and the display device performs display in accordance with the image data. In this embodiment mode, a structure of one pixel is described including the first sub-pixel (also referred to as the sub-pixel A) and the second sub-pixel (also referred to as the sub-pixel B).

The LUT shown in FIG. 2 includes a first combination data 201 which corresponds to a sub-grayscale signal (also referred to as a first sub-grayscale signal or a sub-grayscale signal A: hereinafter, referred to as the sub-grayscale signal A) input to the sub-pixel A, and a sub-grayscale signal (also referred to as a second sub-grayscale signal or a sub-grayscale signal B: hereinafter, referred to as the sub-grayscale signal B) input to the sub-pixel B. In addition, the LUT shown in FIG. 2 further includes a second combination data 202 which corresponds to the sub-grayscale signal A and the sub-grayscale signal B. In FIG. 2, when the level of grayscale of the grayscale signal 100 is 0, combination data (a0, b0) corresponding to the sub-grayscale signals A and B is referred as the first combination data 201, and combination data (c0, d0) corresponding to the sub-grayscale signals A and B is referred as the second combination data 202. Similarly, when the level of grayscale of the grayscale signal 100 is 1 to (n−1), combination data (a1, b1) to (a(n−1), b(n−1)) corresponding to the sub-grayscale signals A and B is referred as the first combination data 201, and combination data (c1, d1) to (c(n−1), d(n−1)) corresponding to the sub-grayscale signals A and B is referred as the second combination data 202.

Note that in the example of the LUT shown in FIG. 2, the case where two kinds of combination data are included with respect to one grayscale is described; however, the present invention is not limited thereto. Further, although the case where the number of kinds of combination data is the same in all the levels of grayscale is described, the present invention is not limited thereto. Depending on the level of grayscale of the grayscale signal 100, the number of kinds of combination data may be different. For example, as for a level of grayscale in which variation in grayscale is obvious when the screen is seen from a particular angle, more combination data can be included in the LUT. In this manner, variation in grayscale when the screen is seen from a particular angle can be suppressed so that the viewing angle characteristics are improved.

The liquid crystal element included in each of the above-described sub-pixels includes two electrodes. For example, the case where transmittance is 0% (hereinafter referred to as normally black) when a potential difference between two electrodes is 0 V (hereinafter referred to as a time of voltage-stop or a state of voltage-stop) is described. Note that the present invention is not limited thereto and an element which has transmittance of 100% at the time of voltage-stop can be used as the liquid crystal element (hereinafter referred to as normally white).

Here, operation of each block and combination data of the LUT in above-described FIG. 1 is described with reference to a specific example. The pixel in the display portion 103 is divided into two sub-pixels of the sub-pixel A and the sub-pixel B by way of example; and the sub-pixel A and the sub-pixel B have the same area of light-transmitting region of each pixel in the display portion 103. First, for example, when the display portion 103 performs display in 256 grayscale, as the grayscale signal 100, the level of grayscale is (138). During a given period, that is, a given frame period here, the grayscale signal 100 with the level of grayscale (138) is input to the grayscale data conversion portion 101. In the case of the level of grayscale is (138), a plurality of combination data corresponding to two sub-pixels is stored as the LUT in the grayscale data memory portion. The case where two combination data of (50, 88) and (90, 48) is described as an example. Note that combination data in sub-pixels each have the same sum of the combination data. That is, 50+88=138 and 90+48=138. Corresponding to the grayscale signal 100 input to the grayscale data conversion portion 101, the combination (50, 88), which is the first one, is selected by the LUT and input as the combination data 106 to the grayscale data conversion portion 101. Then, as the sub-grayscale signal 105 of the sub-pixel A, (50) is output and as the sub-grayscale signal 105 of the sub-pixel B, (88) is output to the driving portion 102 from the grayscale data conversion portion 101. In the driving portion 102, the plurality of sub-grayscale signals 105 are subjected to a D/A conversion process, gamma correction, polarity inversion of the signal, or the like as appropriate, and the signals are input to the display portion 103. In each sub-pixel of the display portion 103, light is transmitted whose amounts of transmission are (50) and (88). As one pixel, display is performed in the level of grayscale (138).

Next, in the next frame period, the grayscale signal 100 with a level of grayscale of (138) is input as the grayscale signal 100 to the grayscale data conversion portion 101 again. Here, by way of example, the same grayscale is expressed although a frame period is changed. In response to the grayscale signal 100 input to the grayscale data conversion portion 101, the combination (90, 48), which is the second one, is selected by the LUT and input as the combination data 106 to the grayscale data conversion portion 101. Then, as the sub-grayscale signal 105 of the sub-pixel A, (90) is output and as the sub-grayscale signal 105 of the sub-pixel B, (48) is output to the driving portion 102 from the grayscale data conversion portion 101. In the driving portion 102, the plurality of sub-grayscale signals 105 is subjected to a D/A conversion process, gamma correction, polarity inversion of the signal, or the like, and the signals are input to the display portion 103. In each sub-pixel of the display portion 103, light is transmitted with the amount of transmission in (90) and (48). As one pixel, display is performed at a level of grayscale of (138).

As described above, although the same level of grayscale as that of the previous frame period is displayed in one pixel, the amount of light to be transmitted through each sub-pixel is different from that in the previous frame period. Therefore, aligned state of liquid crystal molecules in each sub-pixel can be different in every frame period. That is, in the display portion 103, the amounts of light to be transmitted are averaged when the screen is seen from a particular angle so that the viewing angle is increased.

Note that, in the further next frame period, the first combination (50, 88) is selected again from the LUT in accordance with the grayscale signal 100 input to the grayscale data conversion portion 101.

In the case where respective pixels, the sub-pixel A and the sub-pixel B here, have different areas of light-transmitting regions, a difference between the sub-pixel A and the sub-pixel B in the area of light-transmitting regions is needed to be considered. In the case where the difference between the sub-pixel A and the sub-pixel B in the area of light-transmitting regions is considered, at the time of storing combination data in the LUT in advance, the combination data which is considered in advance can be stored; or when grayscale voltage is generated from the sub-grayscale signal, the sub-grayscale signal can be processed in consideration for the difference in the area.

As the grayscale data memory portion 104, RAM (random access memory), ROM (read only memory), or the like can be used. As the RAM, SRAM (static RAM), DRAM (dynamic RAM), VRAM (video RAM), DPRAM (dual port RAM), NOVRAM (non-volatile RAM), PRAM (pseudo RAM), FERAM (ferroelectric RAM), or the like can be used. As the ROM, EPROM (electrically programmable ROM), one time programmable ROM, EEPROM (electrically erasable and programmable ROM), flash memory, mask ROM, or the like can be used.

In the pixel of the display portion 103, transmittance of the liquid crystal element is controlled by applying a constant voltage to a first electrode (also referred to as a common electrode) of the liquid crystal element, and applying a grayscale voltage (hereinafter referred to as a sub-grayscale voltage) generated in the driving portion 102 in accordance with the sub-grayscale signal 105 to a second electrode (also referred to as a pixel electrode). In a display device of this embodiment mode, an example is described in which transmittance of light is controlled by the liquid crystal element by applying the constant voltage to the first electrode of the liquid crystal element, and applying the sub-grayscale voltage, which is different from that applied to the first electrode even though display is based on the same image data, to the second electrode of each sub-pixel. Specifically, in the display device of this embodiment mode, different sub-grayscale voltages are applied to respective second electrodes of the sub-pixels in the first period and the second period so that the amounts of light to be transmitted during the first period and the second period (total transmittance of the liquid crystal element) are controlled. In addition, the grayscale voltage which is generated based on the sub-grayscale signal A is referred to as a sub-grayscale voltage A (also referred to as a first sub-grayscale voltage), and the grayscale voltage which is generated based on the sub-grayscale signal B is referred to as a sub-grayscale voltage B (also referred to as a second sub-grayscale voltage)

Note that since the sub-grayscale voltage which is generated based on the sub-grayscale signal 105 in the driving portion 102 is used by being converted into a signal applied to an electrode which controls the liquid crystal molecules of the sub-pixel, a different denotation from the sub-grayscale signal 105 is given. However, since the sub-grayscale voltage is generated by performing gamma correction and polarity inversion to the sub-grayscale signal 105 in order to be input to the sub-pixel, the sub-grayscale voltage corresponds to the sub-grayscale signal. Therefore, in this specification, a signal applied to the electrode which controls the liquid crystal molecules of the sub-pixel is called the sub-grayscale voltage, and a signal which controls transmittance of light in the sub-pixel is called the sub-grayscale signal.

Next, the structure and operation of the display portion 103 shown in FIG. 1 will be described with reference to FIG. 3. Note that the structure and operation of the driving portion 102 will be simply described.

Figure 3:
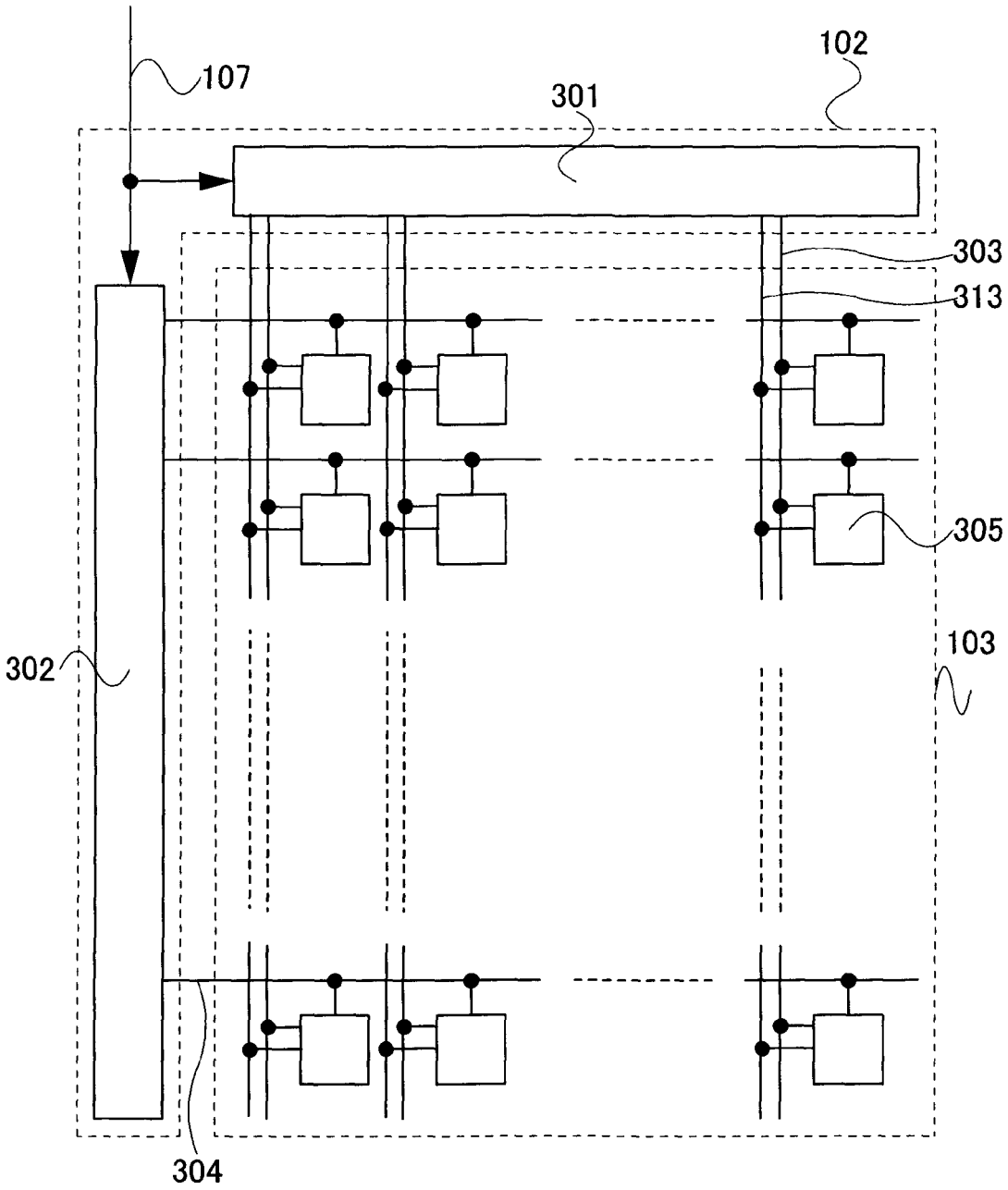
FIG. 3 is a diagram for describing a display portion of the present invention.

FIG. 3 illustrates the structure of the driving portion 102 and the display portion 103 in a display device used for the present invention. The driving portion 102 includes a source driver 301, a gate driver 302, and the like. In the display portion 103, a plurality of pixels 305 are provided in matrix.

In FIG. 3, the gate driver 302 supplies respective scanning signals to a plurality of wirings 304. By using the scanning signal, whether the pixels 305 are selected or not selected is determined in every row. In addition, the gate driver 302 supplies the scanning signal so that the pixels 305 turns to selected state in order from a first row. In addition, the source driver 301 supplies the sub-grayscale signal A, which is input to the sub-pixel A in the pixel 305, to a wiring 303 which is selected by the scanning signal, and supplies the sub-grayscale signal B, which is input to the sub-pixel B in the pixel, to a wiring 313. The sub-grayscale signal is supplied sequentially to the pixels 305 which are in selected state.

An exemplary structure of the source driver 301 and the gate driver 302 shown in FIG. 3 will be described with reference to FIGS. 22 and 23.

First, the structure of the source driver 301 will be described with reference to FIG. 22. The source driver 301 in FIG. 22 includes a shift register 2201, a level shifter 2202, sampling circuits 2203, and the like.

A source driver start pulse (SSP), a source driver clock signal (SCK), inverted source driver clock signal (SCKB), and the like are supplied to the shift register 2201. Then the shift register 2201 select the sampling circuits 2203 one by one through the level shifter 2202.

The level shifter 2202 level-shifts a selected signal, which is supplied to the sampling circuit 2203, from the shift register 2201. Then, the level shifter 2202 outputs the selected signal, which is level-shifted, to the sampling circuit 2203.

An output terminal of the shift register 2201, a wiring to which the sub-grayscale signal A is input, and a wiring to which the sub-grayscale signal B is input are connected to an input terminal of each of the sampling circuits 2203. Output terminals of the sampling circuit 2203 are connected to wirings S(A1) . . . S(An) and S(B1) . . . S(Bn) (n is a natural number), respectively.

The sampling circuit 2203 sequentially samples the first sub-grayscale signal and the second sub-grayscale signal in accordance with an output signal from the shift register 2201. In FIG. 22, although two wirings of the wiring to which the first sub-grayscale signal is input and the wiring to which the second sub-grayscale signal is input are provided, the present invention is not limited thereto. The wirings can be provided in accordance with the number of sub-pixels. In addition, although FIG. 22 shows an example in which sub-pixel signals are supplied to the pixel in the display portion by dot sequential driving, a latch circuit may be provided and each pixel in the display portion can be driven by a line sequential driving.

Figure 22:
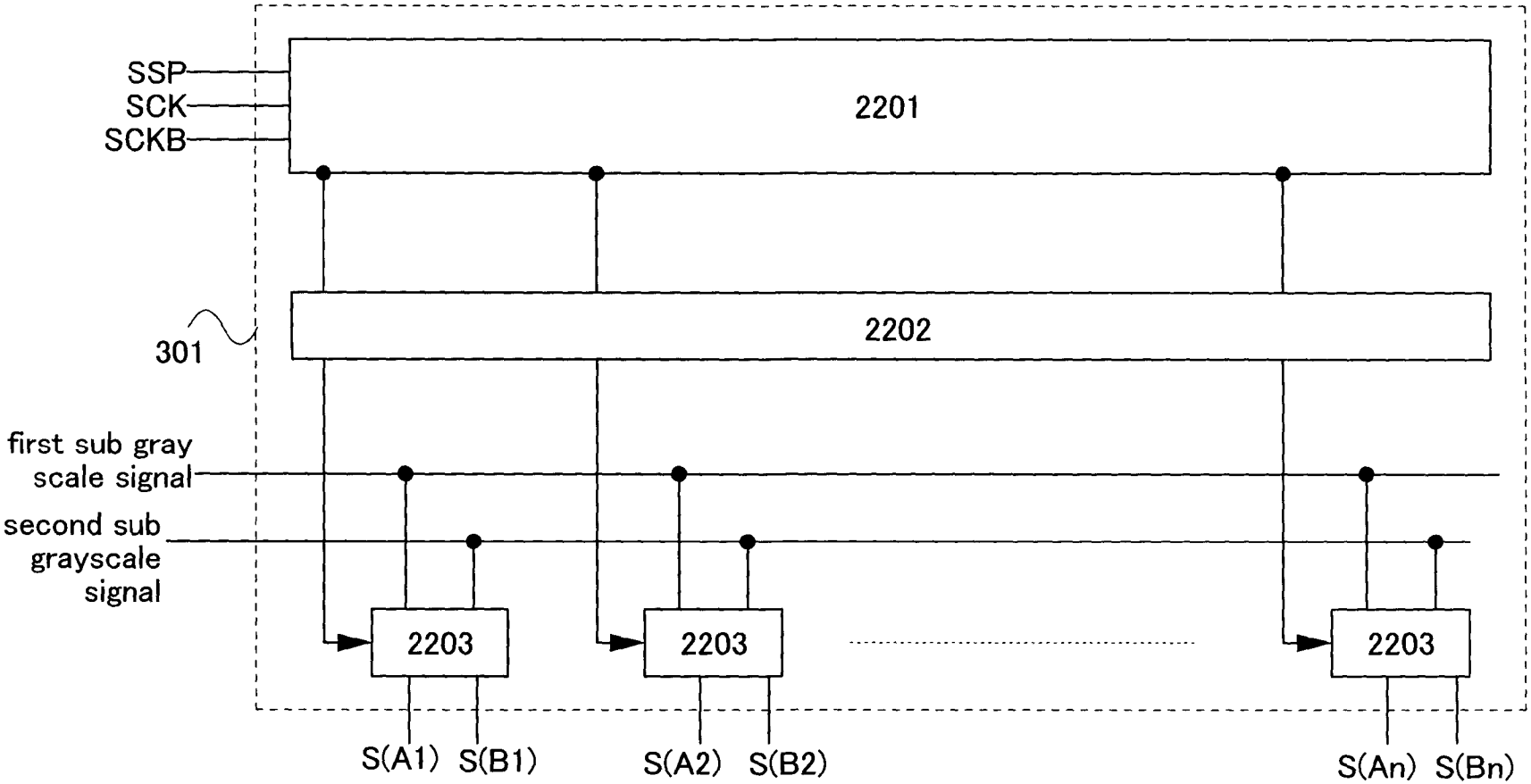
FIG. 22 is a diagram for describing a specific example of the present invention.
Figure 23:
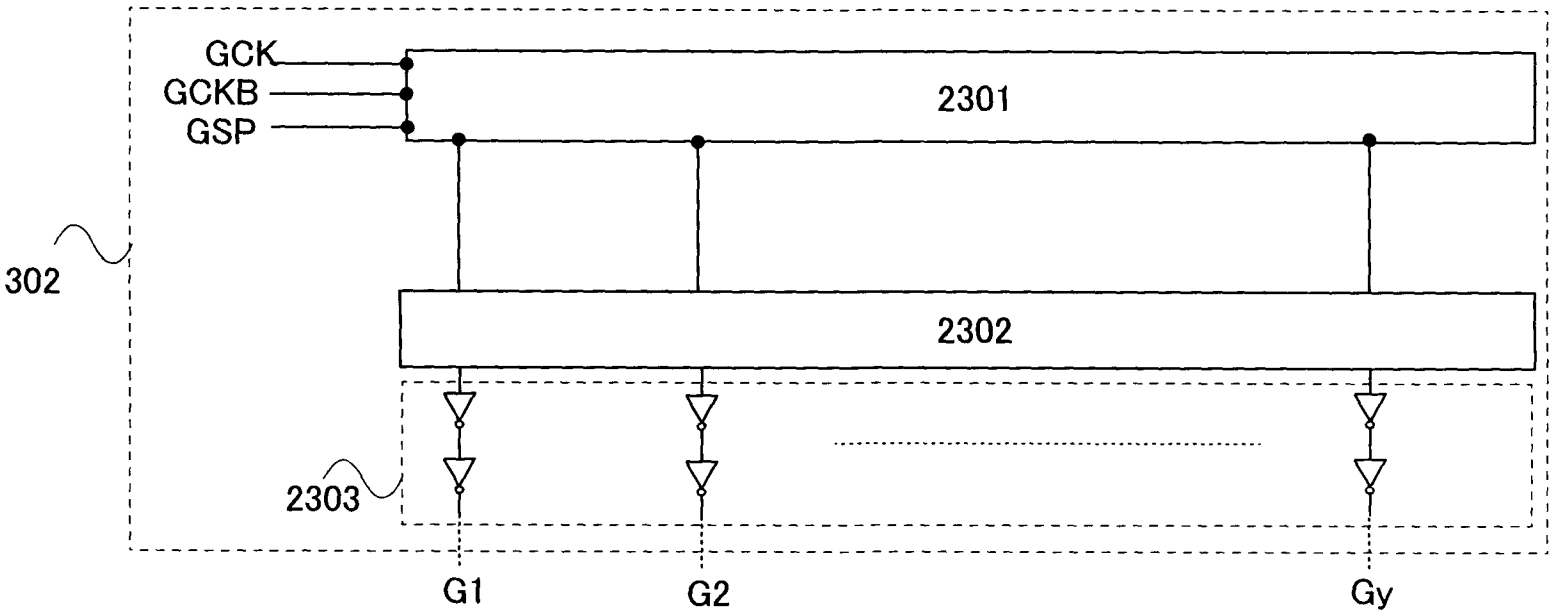
FIG. 23 is a diagram for describing a specific example of the present invention.

Note that, although not shown in FIG. 22, the source driver 301 may include a D/A conversion circuit which converts the sub-grayscale signal A and the sub-grayscale signal B which are output to the sub pixel A and the sub pixel B, respectively, a gamma correction circuit which performs gamma correction, and a circuit which performs polarity inversion.

A structure of a gate driver is described with reference to FIG. 23. The gate driver 302 includes a shift register 2301, a level shifter 2302, a buffer circuit 2303, and the like.

A gate driver start pulse (GSP), a gate driver clock signal (GCK), inverted gate driver clock signal (GCKB), and the like are supplied to the shift register 2301. Then the shift register 2301 selects wirings one by one which are connected to the pixel through the level shifter 2302 and the buffer circuit 2303.

The level shifter 2302 level-shifts the scanning signal, which is supplied to the buffer circuit 2303, from the shift register 2301. Then, the level shifter 2302 outputs the scanning signal, which is level-shifted, to the buffer circuit 2303.

The buffer circuit 2303 enhances drive capability of the scanning signal, which is level-shifted by the level shifter 2302, from the shift register 2301. By enhancing drive capability of the scanning signal in the buffer circuit 2303, delay time of a signal due to resistance and the like of a wiring which scans a pixel can be improved.

In FIG. 3, as described above, the plurality of pixels 305 are provided in matrix for the display portion 103. Note that, the pixels 305 are not necessarily provided in matrix and may be provided in a delta pattern, or Bayer arrangement. In addition, the wirings 303, 313, and 304 are connected to each of the plurality of pixels 305. As a display method of the display portion 103, a progressive method or an interlace method can be employed. Note that by employing the interlace method to supply a signal to a plurality of pixels and perform display, driving frequency can be suppressed and low power consumption can be achieved.

Next, a structure of the pixel 305 provided for the display portion 103 will be described with reference to FIGS. 4A and 4B.

Figure 4A:
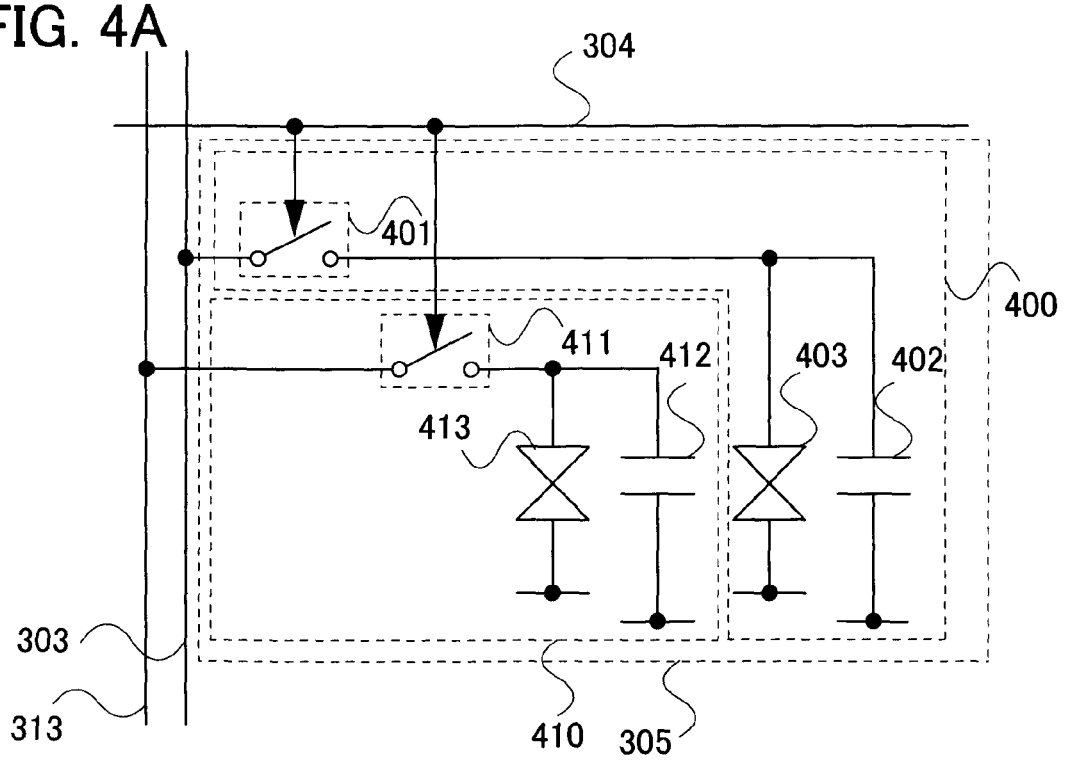
FIGS. 4A and 4B are diagrams for describing structures of a pixel of a display portion.
Figure 4B:
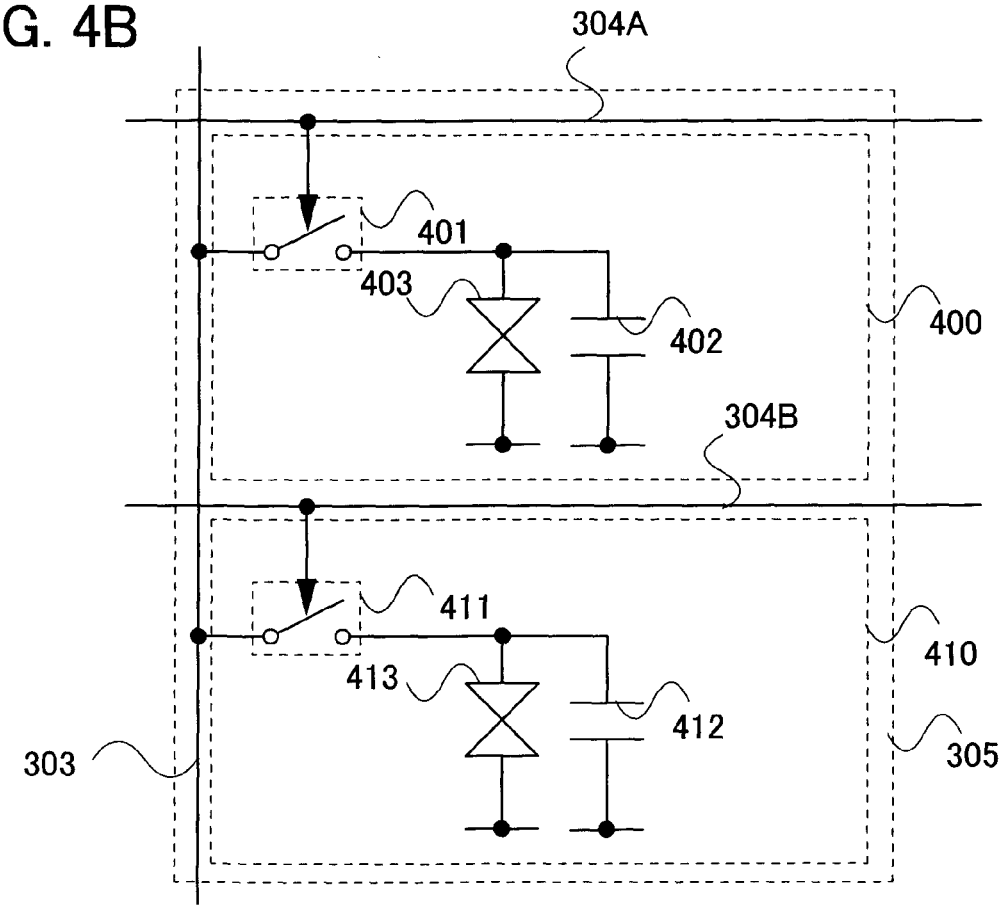

First, the structure of the pixel 305 is shown in FIG. 4A. As a pixel in this embodiment mode, the pixel 305 includes a sub-pixel A 400 and a sub-pixel B 410. The sub-pixel A includes a switch 401, a capacitor element 402 having two electrodes, and a liquid crystal element 403 having two electrodes. A first terminal of the switch 401 is connected to the wiring 303 and the second terminal of the switch 401 is connected to the capacitor element 402 and the liquid crystal element 403. In addition, the wiring 304 controls whether the switch 401 is on or off. The sub-pixel B includes a switch 411, a capacitor element 412 having two electrodes, and a liquid crystal element 413 having two electrodes. A first terminal of the switch 411 is connected to the wiring 313 and a second terminal of the switch 411 is connected to the capacitor element 412 and the liquid crystal element 413. In addition, the wiring 304 controls whether the switch 411 is on or off.

As another structure of the pixel 305 which is different from that shown in FIG. 4A will be described with reference to FIG. 4B. Similarly to FIG. 4A, the pixel 305 shown in FIG. 4B includes the sub-pixel A 400 and the sub-pixel B 410. The sub-pixel A includes a switch 401, a capacitor element 402 having two electrodes, and a liquid crystal element 403 having two electrodes. A first terminal of the switch 401 is connected to the wiring 303 and the second terminal of the switch 401 is connected to the capacitor element 402 and the liquid crystal element 403. In addition, a wiring 304A controls whether the switch 401 is on or off. The sub-pixel B includes a switch 411, a capacitor element 412 having two electrodes, and a liquid crystal element 413 having two electrodes. A first terminal of the switch 411 is connected to the wiring 303 and the second terminal of the switch 411 is connected to the capacitor element 412 and the liquid crystal element 413. In addition, a wiring 304B controls whether the switch 411 is on or off. The difference between FIG. 4A and FIG. 4B is that whether the plurality of wirings which control the switch is provided, and whether the plurality of wirings which supply the sub-grayscale voltage is provided. Either structure can be applied to this embodiment mode. For that reason, in this embodiment mode, FIG. 4A is described hereinafter.

As a liquid crystal mode of the liquid crystal elements 403 and 413, a TN mode, an STN mode, an IPS mode, a VA mode, a ferroelectric liquid crystal mode, an antiferroelectric liquid crystal mode, an OCB mode, or the like can be applied.

As a switch 401 and a switch 411, an n-channel transistor or p-channel transistor can be used. In the case where the n-channel transistor or the p-channel transistor is used as the switch 401, a gate of the transistor is connected to the wiring 304, a first terminal of the transistor is connected to the wiring 303, and a second terminal of the transistor is connected to the capacitor element 402 and the liquid crystal element 403. In the case where the n-channel transistor or the p-channel transistor is used as the switch 411, a gate of the transistor is connected to the wiring 304, a first terminal of the transistor is connected to the wiring 313, and a second terminal of the transistor is connected to the capacitor element 412 and the liquid crystal element 413.

Next, basic operation of the sub-pixel A 400 and the sub-pixel B 410 which are included in the pixel 305 provided for the display portion 103 will be described. When the pixel 305 is selected, the switch 401 is turned on and a sub-grayscale voltage A 501 which is to be supplied to the liquid crystal element 403 is supplied to the capacitor element 402 and the liquid crystal element 403 of the sub-pixel A 400 through the wiring 303. At that time, the capacitor element 402 holds the sub-grayscale voltage A 501 which is applied to the liquid crystal element 403. At the same time, when the pixel 305 is selected, the switch 411 is turned on and a sub-grayscale voltage B 502 which is to be supplied to the liquid crystal element 413 is supplied to the capacitor element 412 and the liquid crystal element 413 of the sub-pixel B 410 through the wiring 313. At that time, the capacitor element 412 holds the sub-grayscale voltage B 502 which is applied to the liquid crystal element 413.

When the pixel 305 is not selected, the switch 401 is turned off and the sub-grayscale voltage A 501 and the sub-grayscale voltage B 502 stop to be supplied to the pixel 305. Here, the capacitor element 402 and the capacitor element 412 hold the sub-grayscale voltage A 501 applied to the liquid crystal element 403 and the sub-grayscale voltage B 502 applied to the liquid crystal element 413, respectively. Therefore, the sub-grayscale voltage A 501 and the sub-grayscale voltage B 502 are kept being applied to the liquid crystal element 403 and the liquid crystal element 413, respectively.

Figure 5:
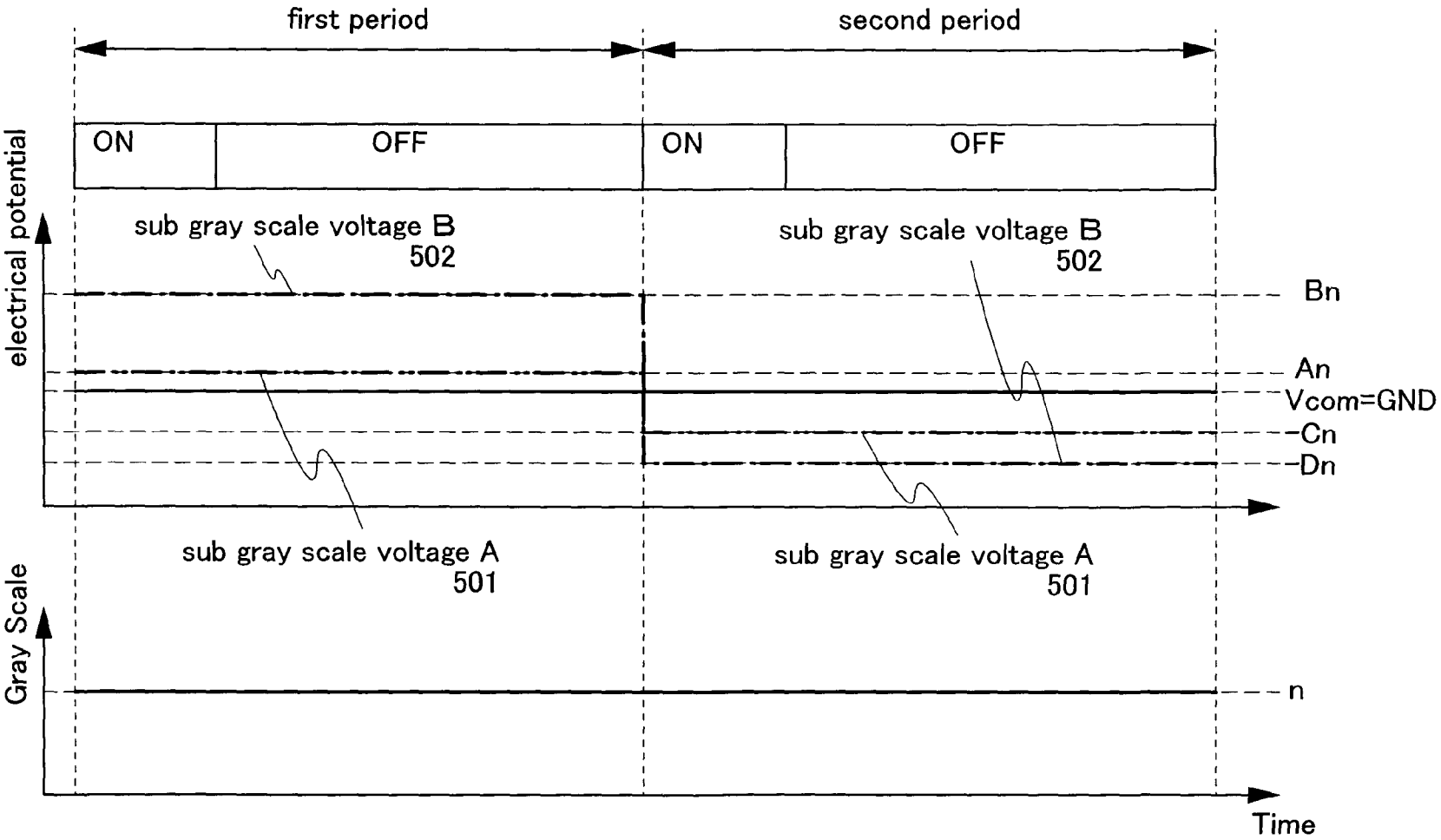
FIG. 5 is a timing charts for describing the present invention.

Further, operation of the sub-pixel A 400 and the sub-pixel B 410 which are included in the pixel 305 provided for the display portion 103 will be described in detail with reference to FIG. 5. When an n-channel transistor is used for the switch 401 and the switch 411, the scanning signal becomes H level with the pixel 305 in selected state, and becomes L level with the pixel 305 in non-selected state. FIG. 5 illustrates control of the switches 401 and 411 by switch ON and switch OFF during the first period and the second period. Moreover, FIG. 5 illustrates potential change of the sub-grayscale voltage A 501 input to the pixel electrode of the sub-pixel A, and the sub-grayscale voltage B 502 input to a pixel electrode of the sub-pixel B, and time change of grayscale of the pixel during the first period and the second period. Note that a potential with respect to a common potential of the sub-grayscale voltage A during the first period is referred to as An, and a potential with respect to a common potential of the sub-grayscale voltage B during the first period is referred to as Bn. Further, by setting a potential with respect to the common potential of the sub-grayscale voltage A during the second period as Cn, and a potential with respect to the common potential of the sub-grayscale voltage B during the second period as Dn, grayscale n (n is a natural number including 0) is expressed. The common potential is referred to as $V_{com}$ in FIG. 5. Note that the potentials An, Bn, Cn, and Dn are different from each other.

Note that in the liquid crystal element, the amount of light to be transmitted is determined in accordance with the difference between the potential of the sub-grayscale voltage and the common potential. Here, the common potential is a GND potential, the potential difference between the potential of the sub-grayscale voltage and the GND potential is the same as the sub-grayscale voltage, and the common potential $V_{com}$ is the GND potential. In addition, in the example shown in FIG. 5, the case where each of the first period and the second period is referred to as one frame period and driving in which polarity of the sub-grayscale voltage is inverted every one frame period, that is, inversion driving is performed will be described.

In FIG. 5, when the switch 401 and the switch 411 are turned on during the first period, the potential An with respect to the GND potential of the sub-grayscale voltage A 501 and the potential Bn with respect to the GND potential of the sub-grayscale voltage B 502 are input to the pixel 305, so that the level of grayscale of n is expressed. When the switch 401 and the switch 411 are turned off, the potential An with respect to the GND potential of the sub-grayscale voltage A 501 is held in the capacitor element 402 provided for the sub-pixel 400 in the pixel 305, and the potential Bn with respect to the GND potential of the sub-grayscale voltage B 502 is held in the capacitor element 412 provided for the sub-pixel 410 provided for the pixel 305, so that the pixel 305 holds display of the level of grayscale n. During the second period, when the switch 401 and the switch 411 are turned on, a potential −Cn with respect to the GND potential of the sub-grayscale voltage A 501 whose polarity is inverted by inversion driving is input to the pixel 305, and a potential −Dn with respect to the GND potential of the sub-grayscale voltage B 502 whose polarity is inverted by inversion driving is input to the pixel 305, so that the level of grayscale of n can be expressed. When the switch 401 and the switch 411 are turned off, the potential −Cn with respect to the GND potential of the sub-grayscale voltage A 501 is held in the capacitor element 402 provided for the sub-pixel 410 in the pixel 305, and the potential −Dn with respect to the GND potential of the sub-grayscale voltage B 502 is held in the capacitor element 412 provided for the sub-pixel 410 in the pixel 305, so that the pixel 305 continues to hold display of the level of grayscale of n.

In the case where inversion driving is performed as described in FIG. 5, the sub-grayscale voltages input to respective sub-pixels included in one pixel are preferably subjected to the same polarity inversion during the same period. In the example of FIG. 5, the potential An and the potential Bn preferably have the same polarity, and the potential −Cn and the potential −Dn preferably have the same polarity. By setting the polarities of the sub-grayscale voltages input to the sub-pixels included in one pixel to be the same, the amplitude width of the amplitude of the sub-grayscale voltage input to the adjacent sub-pixels can be small, so that parasitic capacitance between the adjacent sub-pixels, and between the wirings for inputting the sub-grayscale voltage can be suppressed. Therefore, fine display can be achieved. Note that the polarities of the sub-grayscale voltages input to respective sub-pixels included in one pixel can opposite from each other.

An advantage when the potential An and the potential −Cn, and the potential Bn and the potential −Dn, which are applied to the electrode which controls the liquid crystal molecules of each sub-pixel as shown in FIG. 5 are different from each other in the first period and the second period will be described with reference to FIGS. 6A to 6D. FIGS. 6A to 6D schematically illustrate difference of radial gradient manner of MVA mode liquid crystal, PVA mode liquid crystal, or ASV mode liquid crystal corresponding to the potential applied to the electrode which controls the liquid crystal molecules. For example, in FIGS. 6A to 6D, radial gradient manner shown in FIG. 6A appears when the potential An is applied to the electrode which controls the liquid crystal molecules in the case where the potential |An|<the potential |−Cn|<the potential |−Dn|<the potential |Bn|. Similarly, when the potential Bn is applied to the electrode which controls the liquid crystal molecules, the liquid crystal molecules are aligned in a radial gradient manner shown in FIG. 6B, when the potential −Cn is applied to the electrode which controls the liquid crystal molecules, the liquid crystal molecules are aligned in a radial gradient manner shown in FIG. 6C, and when the potential −Dn is applied to the electrode which controls the liquid crystal molecules, the liquid crystal molecules are aligned in a radial gradient manner shown in FIG. 6D. Note that gradient angles of the liquid crystal molecules shown in FIGS. 6A to 6D have the relationship where θa<θb<θc<θd as similar to the relationship of potentials where the potential |An|<the potential |−Cn|<the potential |−Dn|<the potential |Bn|.

The liquid crystal molecules aligned in a radial manner shown in FIGS. 6A to 6D can be made slanted to a plurality of directions in accordance with the difference between the potentials applied to the electrodes which control the liquid crystal molecules during the first period and the second period, and the difference between the potentials applied to the electrodes which control the liquid crystal molecules of respective sub-pixels.

Figure 6A:
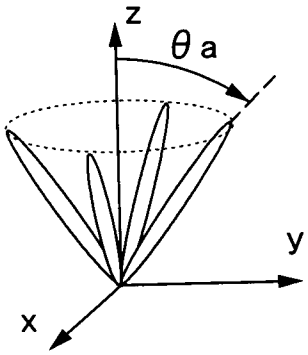
FIGS. 6A to 6D are diagrams for describing alignment of liquid crystal molecules in the present invention
Figure 6B:
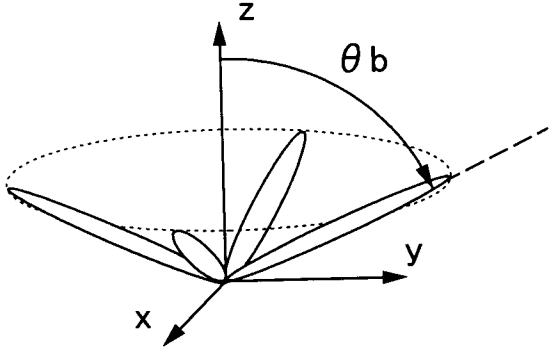
Figure 6C:
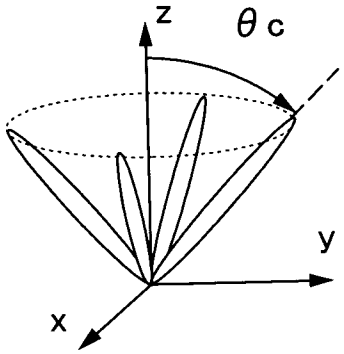

Therefore, in the sub-pixel A, appearance of the liquid crystal molecules can be averaged by making the liquid crystal molecules aligned at the gradient angle θa shown in FIG. 6A during the first period, and by making the liquid crystal molecules aligned at the gradient angle θc shown in FIG. 6C during the second period. Similarly, in the sub-pixel B, appearance of the liquid crystal molecules can be averaged by making the liquid crystal molecules aligned at the gradient angle θb shown in FIG. 6B during the first period, and by making the liquid crystal molecules aligned at the gradient angle θd shown in FIG. 6D during the second period. In addition, appearance of the liquid crystal molecules can be averaged during the first period by making the liquid crystal molecules aligned at the gradient angle θa shown in FIG. 6A in the sub-pixel A, and by making the liquid crystal molecules aligned at the gradient angle θb shown in FIG. 6B in the sub-pixel B. Similarly, appearance of the liquid crystal molecules can be averaged during the second period by making the liquid crystal molecules aligned at the gradient angle θc shown in FIG. 6C in the sub-pixel A, and by making the liquid crystal molecules aligned at the gradient angle θd shown in FIG. 6D in the sub-pixel B. Therefore, in a liquid crystal display device of the present invention, as transmittance of light is controlled, appearance of the liquid crystal molecules can be averaged from any angle, so that the viewing angle characteristics can be improved. Note that by controlling transmittance of light, the pixel can express a desired level of grayscale.

As described above, if the sub-grayscale voltage which differs every desired period, here, every one frame period, is supplied to the sub-pixel, flickers may be generated in display of the display portion. Therefore, a frame frequency which is input to the driving portion is preferably high. In general, although a frequency which is input to the driving portion is 60 Hz (or 50 Hz), a frequency is preferably more than twice that frequency (120 Hz), or more preferably, a frequency is tripled (180 Hz). By increasing the frame frequency which is input to the driving portion, display quality of a moving image can be improved. In the case where display is performed with an increased frame frequency, smooth display can be performed and afterimages can be reduced by interpolating data other than original data of the screen by using a motion vector or the like.

Note that in the case where the sub-grayscale voltage is supplied to each sub-pixel, overdrive is preferably performed in which a voltage higher or lower than the voltage which is normally supplied. Since response speed of the liquid crystal molecules is low, the liquid crystal molecules are less likely to change. By supplying a voltage higher or lower than the voltage which is normally supplied, the liquid crystal molecules can respond quickly. In this manner, display quality of a moving image can be improved and afterimages can be reduced.

Figure 6D:
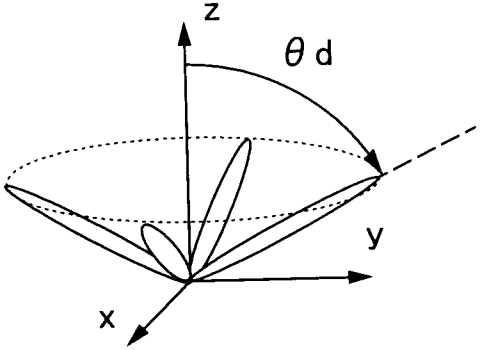
Figure 7A:
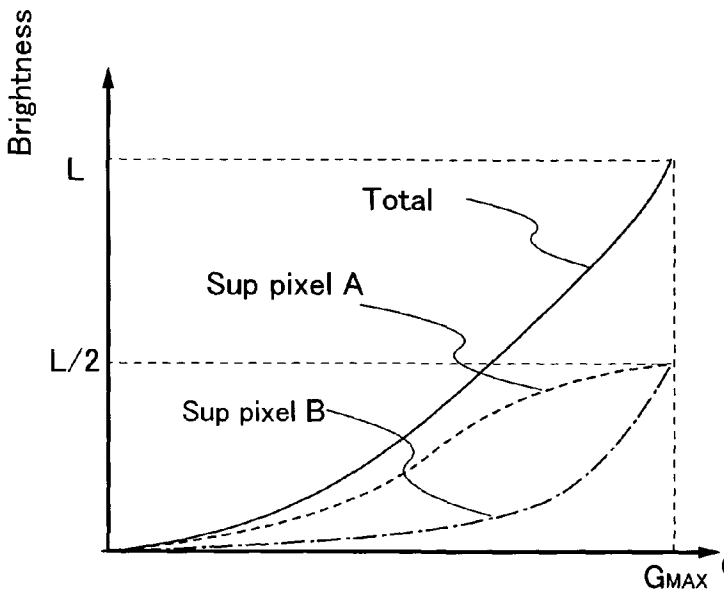
FIGS. 7A and 7B are diagrams illustrating a relation between grayscale and luminance for describing the present invention.
Figure 7B:
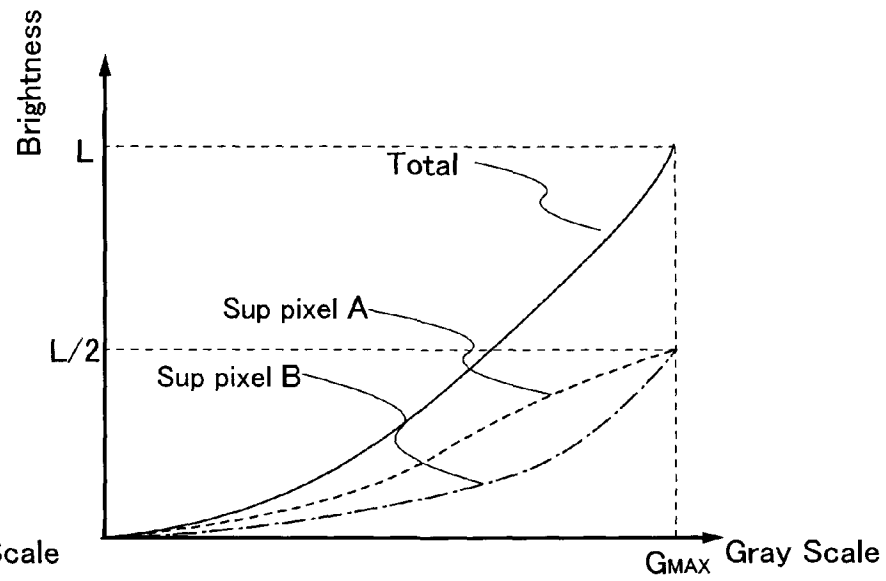

Correlation between grayscale of the pixel which constitute the sub-pixel A and sub-pixel B during the first period and the second period described in FIGS. 5 to 6D, and the amount of light to be transmitted (luminance) through the pixel will be described with reference to FIGS. 7A and 7B. FIGS. 7A and 7B each show the sub-pixel A, the sub-pixel B, and the sum of the sub-pixel A and the sub-pixel B.

Note that luminance shown in each of FIGS. 7A and 7B is the amount of light to be transmitted in the front of the liquid crystal display device. That is, luminance each shown in FIGS. 7A and 7B is brightness of light emitted from unit area, which is light emitted from a backlight portion in the liquid crystal display device, passes through a panel and the like including the liquid crystal element and is transmitted to the front of the liquid crystal display device.

FIG. 7A shows the luminance of the sub-pixel A, the luminance of the sub-pixel B, and the sum of the luminances of the sub-pixel A and the sub-pixel B in the case where the pixel including the sub-pixel A and the sub-pixel B displays a desired level of grayscale during the first period. FIG. 7B shows luminance of the sub-pixel A, luminance of the sub-pixel B, and the sum of the luminances of the sub-pixel A and the sub-pixel B in the case where the pixel including the sub-pixel A and the sub-pixel B displays a desired level of grayscale during the second period.

FIGS. 7A and 7B will be described. Horizontal axes in FIGS. 7A and 7B represent a level of grayscale of the pixel including the sub-pixel A and the sub-pixel B and the maximum value of grayscale is $G_{MAX}$. Vertical axes in FIGS. 7A and 7B represent the luminance of the sub-pixel A, the luminance of the sub-pixel B, and the sum of the luminance of the sub-pixel A and the sub-pixel B, and the maximum value of the sum of the luminance of the sub-pixel A and the sub-pixel B is the sum L of the sub-pixel A and the sub-pixel B. Note that the maximum value of the luminance of the sub-pixel A and the luminance of the sub-pixel B is half the sum of the luminances of the sub-pixel A and the sub-pixel B, L/2 because each area of the sub-pixel A and the sub-pixel B is half the area of the pixel.

Luminance for displaying a desired level of grayscale increases in almost proportion to grayscale as represented by a curve of the sum of the sub-pixel A and the sub-pixel B in FIG. 7A corresponding to the first period. On the other hand, the luminance of the sub-pixel A and the luminance of the sub-pixel B are based on the sub-grayscale signal which is a signal corresponding to luminance. As described above, the sub-grayscale signal is a signal which can be obtained when the grayscale data conversion portion refers to the LUT which is stored in the grayscale data memory portion in advance. Then, in accordance with the LUT stored in the grayscale data memory portion, the grayscale data memory portion outputs combination data which can output a sub-grayscale signal which differs in the sub-pixel A and the sub-pixel B. In this manner, curves of the luminance of the sub-pixel A and the luminance of the sub-pixel B with respect to grayscale shown in FIG. 7A are different from the curve of the sum of the luminances of the sub-pixel A and the sub-pixel B with respect to grayscale. In addition, the curve of the sub-pixel A and the curve of the sub-pixel B are different from each other.

Similarly to FIG. 7A, luminance for displaying a desired level of grayscale increases in almost proportion to grayscale as represented by a curve of the sum of the sub-pixel A and the sub-pixel B in FIG. 7B corresponding to the second period. In addition, similarly to FIG. 7A, curves of the luminance of the sub-pixel A and the luminance of the sub-pixel B with respect to grayscale shown in FIG. 7B are different from the curve of the sum of the luminance of the sub-pixel A and the sub-pixel B with respect to a level of grayscale. In addition, the curve of the sub-pixel A and the curve of the sub-pixel B are different from each other.

Figure 8:
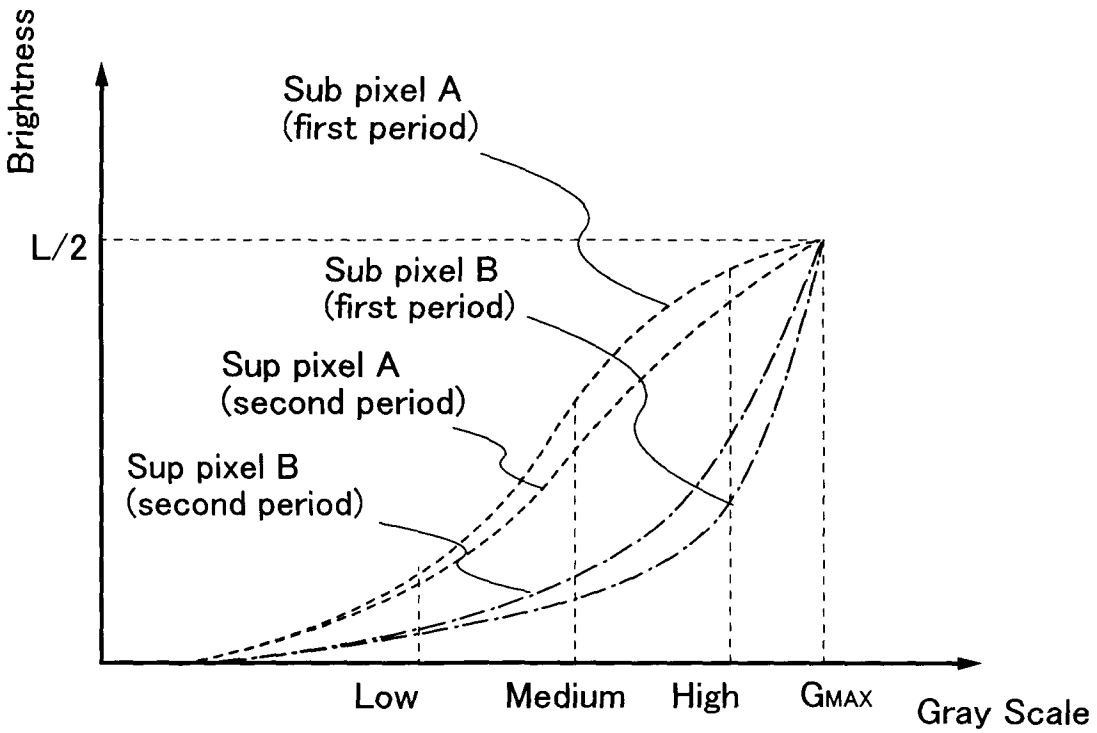
FIG. 8 is a diagram illustrating a relation between grayscale and luminance for describing the present invention.

FIG. 8 is a diagram in which FIG. 7A which shows correlation between a level of grayscale of the pixel, the sub-pixel A, and the sub-pixel B, and the luminance of the pixel, the sub-pixel A, and the sub-pixel B during the first period, and FIG. 7B which shows correlation between a level of each of grayscale of the pixel, the sub-pixel A, and the sub-pixel B, and the luminance of each of the pixel, the sub-pixel A, and the sub-pixel B during the second period are shown together. FIG. 8 shows curves of the luminance of the sub-pixel A and the luminance of the sub-pixel B during the first period and the second period with respect to a level of grayscale of the pixel, shown in FIGS. 7A and 7B. Similarly to FIGS. 7A and 7B, the maximum value of the luminance of the sub-pixel A and the luminance of the sub-pixel B is half the sum of luminances of the sub-pixel A and the sub-pixel B, L/2.

Figure 9:
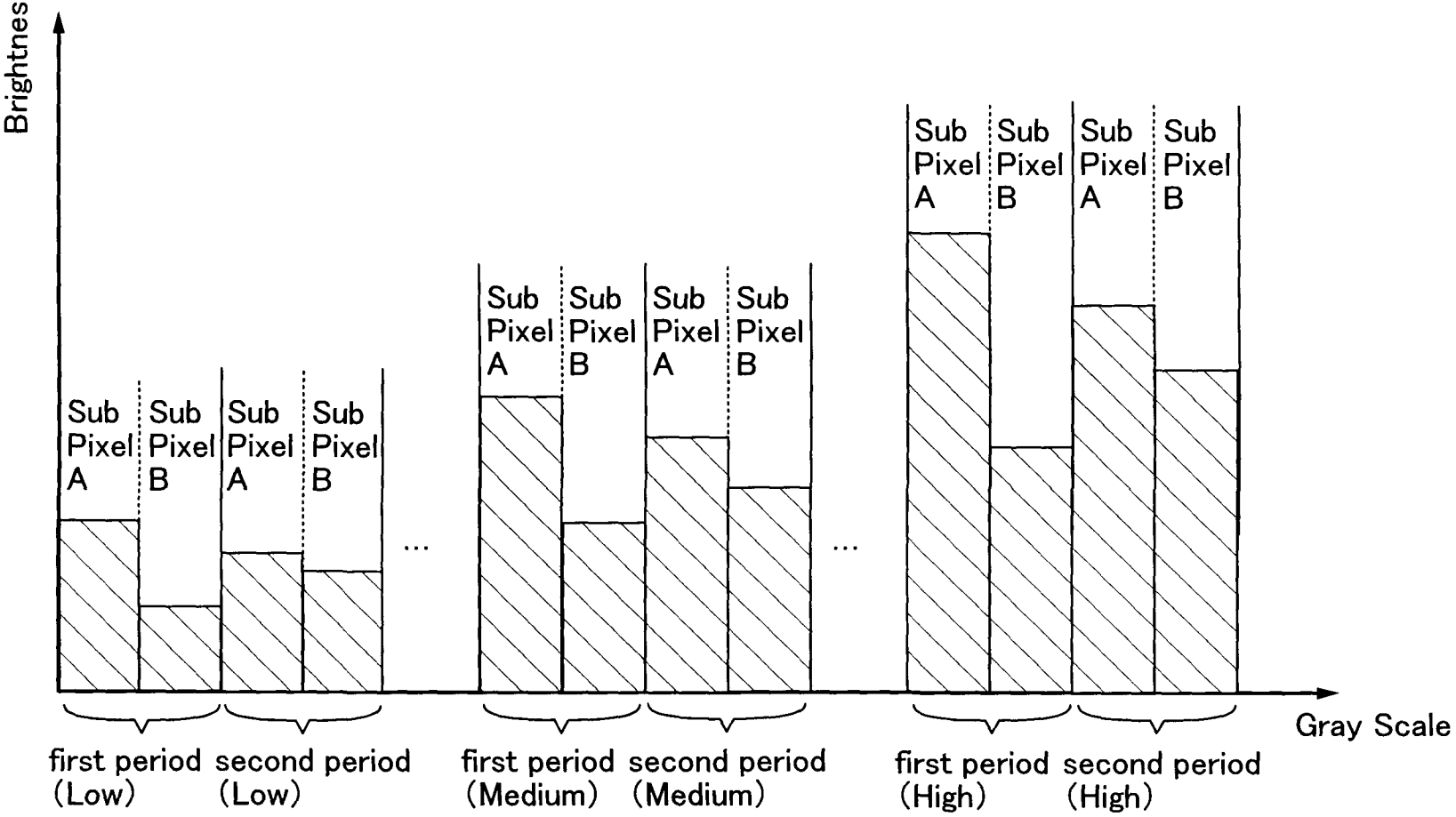
FIG. 9 is a diagram illustrating a relation between grayscale and luminance for describing the present invention.

In a liquid crystal display device of the present invention, potentials applied to the electrodes which control the liquid crystal molecules are different in the sub-pixel A during the first period, the sub-pixel B during the first period, the sub-pixel A during the second period, and the sub-pixel B during the second period, so that gradient angles of the liquid crystal molecules are changed to average appearance of the liquid crystal molecules. Here, FIG. 9 shows each luminance of the sub-pixel A during the first period, the sub-pixel B during the first period, the sub-pixel A during the second period, and the sub-pixel B during the second period in a low level of grayscale, a middle level of grayscale, and a high level of grayscale.

In the present invention, the sub-grayscale signal which is a signal input to the sub-pixel during the first period and the second period can be obtained when the grayscale data conversion portion refers to the LUT stored in the grayscale data memory portion. In accordance with the LUT stored in the grayscale data memory portion, the grayscale data memory portion outputs the combination data which can output the combination data which can output sub-grayscale signal which differs in the sub-pixel A and the sub-pixel B. Therefore, as shown in FIG. 9, the luminance of the sub-pixel A and the luminance of the sub-pixel B with respect to a level of grayscale can be different from each other during the first period and the second period. In a liquid crystal display device of the present invention, the liquid crystal molecules in the display portion appear to be averaged from any angle and the viewing angle characteristics can be improved.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with another content (can be part of the content) described in a diagram of the other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 2

In this embodiment mode, the liquid crystal display device of the present invention described in Embodiment Mode 1 will be further described. Specifically, in this embodiment mode, a structure of the sub-pixel which constitutes the pixel will be described.

Figure 10A:
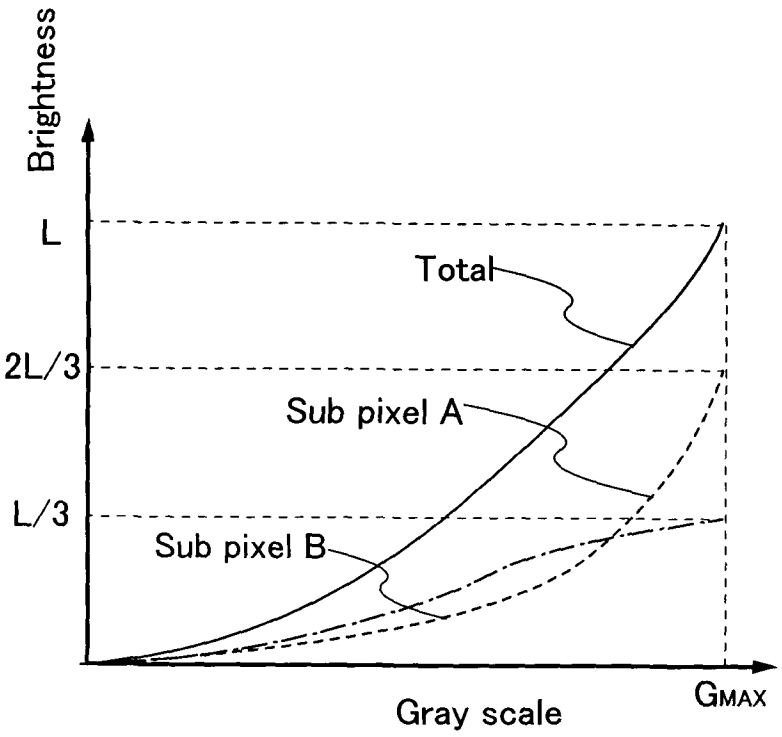
FIGS. 10A and 10B are diagrams illustrating a relation between grayscale and luminance for describing the present invention.
Figure 10B:
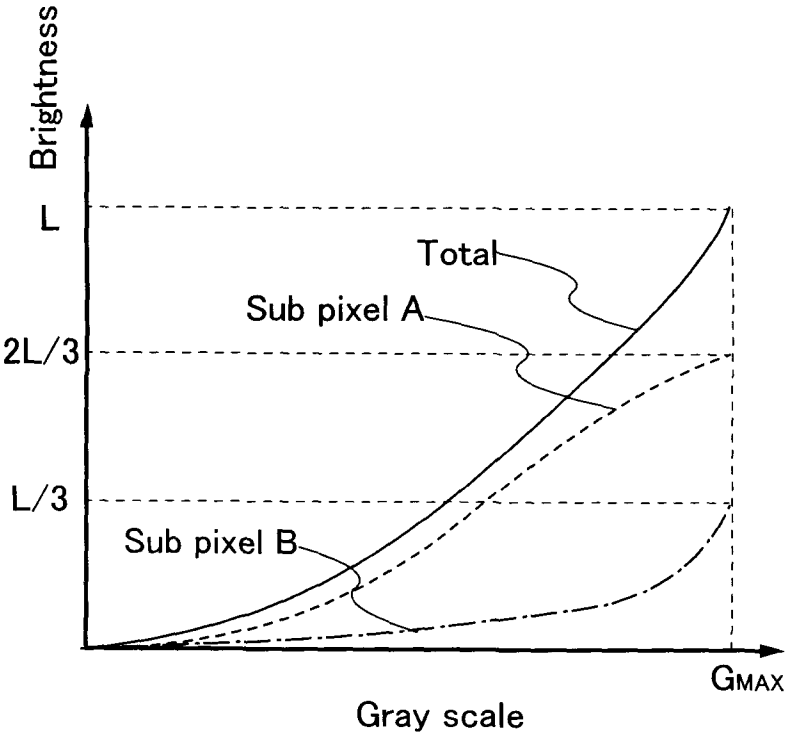

In FIGS. 7A and 7B in Embodiment Mode 1, the structure is described in which each of the areas of the sub-pixel A and the sub-pixel B is half the area of the pixel. In FIGS. 10A and 10B, a structure will be described in which the areas of the sub-pixel A and the sub-pixel B are different from each other. Horizontal axes and vertical axes in FIGS. 10A and 10B are the same as those in FIGS. 7A and 7B. Note that the area of the sub-pixel A is two thirds of the area of one pixel and the area of the sub-pixel B is one thirds of the area of one pixel. Therefore, in FIGS. 10A and 10B, when the sum of the luminance of the sub-pixel A and the sub-pixel B is L, the maximum value of the luminance of the sub-pixel A is 2L/3 and that of the sub-pixel B is L/3.

Similarly to FIG. 7A, in FIG. 10A corresponding to the first period, luminance for displaying a desired level of grayscale increases in almost proportion to grayscale as represented by a curve of the sum of the sub-pixel A and the sub-pixel B in FIG. 10A corresponding to the first period. The luminance of the sub-pixel A and the luminance of the sub-pixel B are based on the sub-grayscale signal which is a signal corresponding to luminance. As described above, the sub-grayscale signal is a signal which can be obtained when the grayscale data conversion portion refers to the LUT which is stored in the grayscale data memory portion in advance. Then, in accordance with the LUT stored in the grayscale data memory portion, the grayscale data memory portion outputs combination data which can output a sub-grayscale signal which differs in the sub-pixel A and the sub-pixel B. In this manner, curves of the luminance of the sub-pixel A and the luminance of the sub-pixel B with respect to grayscale shown in FIG. 10A are different from the curve of the sum of the luminance of the sub-pixel A and the sub-pixel B with respect to a level of grayscale. In addition, the curve of the sub-pixel A and the curve of the sub-pixel B are different from each other.

Similarly to FIG. 10A, luminance for displaying a desired level of grayscale increases in almost proportion to grayscale as represented by a curve of the sum of the sub-pixel A and the sub-pixel B in FIG. 10B corresponding to the second period. In addition, similarly to FIG. 10A, curves of the luminance of the sub-pixel A and the luminance of the sub-pixel B with respect to grayscale shown in FIG. 10B are different from the curve of the sum of the luminance of the sub-pixel A and the sub-pixel B with respect to a level of grayscale. In addition, the curve of the sub-pixel A and the curve of the sub-pixel B are different from each other.

Figure 11:
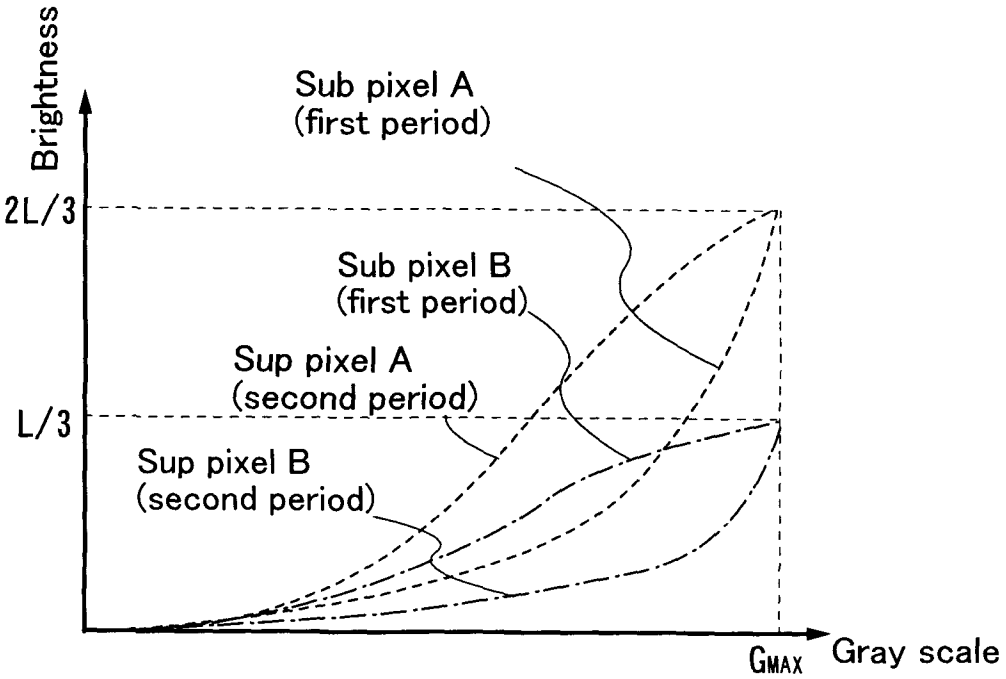
FIG. 11 is a diagram illustrating a relation between grayscale and luminance for describing the present invention.

FIG. 11 is a diagram in which FIG. 10A which shows correlation between a level of each of grayscale of the pixel, the sub-pixel A, and the sub-pixel B, and the luminance of each of the pixel, the sub-pixel A, and the sub-pixel B during the first period, and FIG. 10B which shows correlation between a level of grayscale of each of the pixel, the sub-pixel A, and the sub-pixel B, and the luminance of each of the pixel, the sub-pixel A, and the sub-pixel B during the second period are shown together. FIG. 11 shows curves of the luminance of the sub-pixel A and the luminance of the sub-pixel B during the first period and the second period with respect to a level of grayscale of the pixel, shown in FIGS. 10A and 10B. Similarly to FIGS. 10A and 10B, when the sum of the luminances of the sub-pixel A and the sub-pixel B is L, the maximum value of the luminance of the sub-pixel A is 2L/3, and that of the sub-pixel B is L/3. As shown in FIG. 11, even though the areas of the sub-pixels are different from each other, change of luminance corresponding to a level of grayscale of the pixel can be different in each of the sub-pixel A during the first period, the sub-pixel B during the first period, the sub-pixel A during the second period, and the sub-pixel B during the second period.

In a liquid crystal display device of the present invention, potentials applied to the electrodes which control the liquid crystal molecules are different in the sub-pixel A during the first period, the sub-pixel B during the first period, the sub-pixel A during the second period, and the sub-pixel B during the second period, so that gradient angles of the liquid crystal molecules are changed to average appearance of the liquid crystal molecules. As shown in FIGS. 10A to 11, the present invention is also applicable in the case where the areas of the sub-pixel A and the sub-pixel B are different from each other to form the pixel in the display portion. In this manner, in the liquid crystal display device of the present invention, the liquid crystal molecules in the display portion appear to be averaged from any angle and the viewing angle characteristics can be improved.

Figure 13:
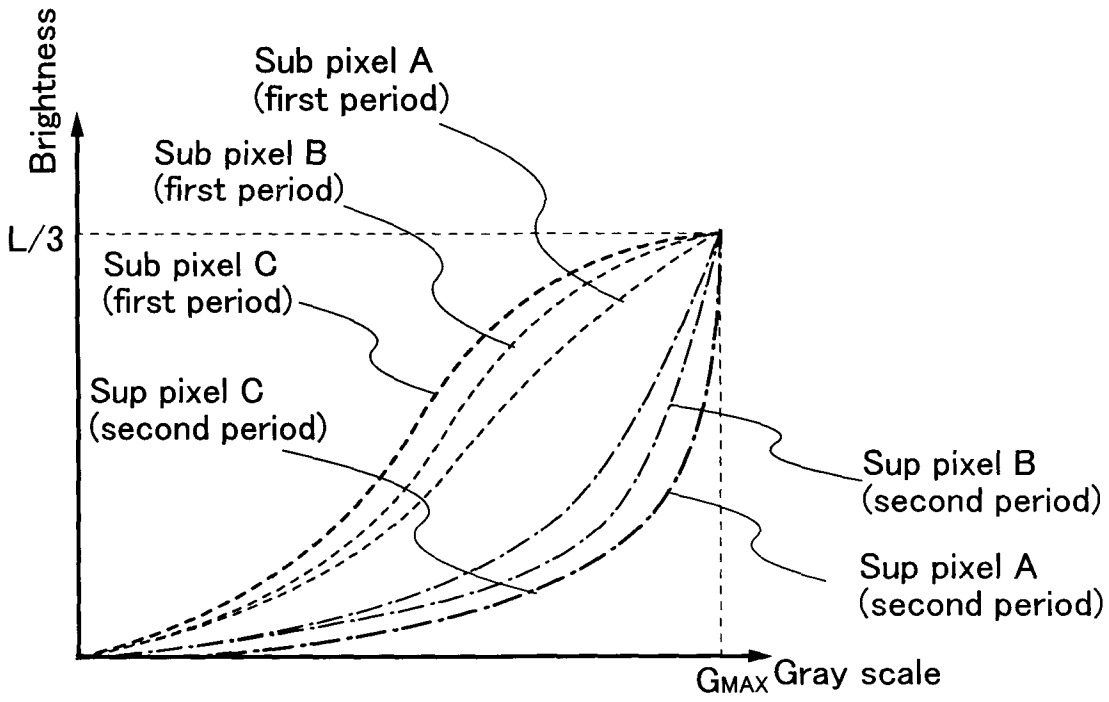
FIG. 13 is a diagram illustrating a relation between grayscale and luminance for describing the present invention.

In addition, in the liquid crystal display device of the present invention, even if one pixel includes three or more sub-pixels, the viewing angle characteristics can be improved as similar to the aforementioned case where one pixel includes the sub-pixel A and the sub-pixel B. FIGS. 12 and 13 show an example in the case where one pixel includes three sub-pixels. Note that three pixels shown in FIGS. 12 and 13 are a first sub-pixel (also referred to as a sub-pixel A), a second sub-pixel (also referred to as a sub-pixel B), and a third sub-pixel (also referred to as a sub-pixel C).

FIG. 12 schematically illustrates a LUT which is stored in the grayscale data memory portion in the liquid crystal display device including the display portion in which each of the plurality of pixels includes the sub-pixel A, the sub-pixel B and the sub-pixel C. The LUT includes a plurality of combination data corresponding to a level of grayscale of the grayscale signal as similar to the LUT shown in FIG. 2A in Embodiment Mode 1. The LUT shown in FIG. 12 includes first combination data 1201 corresponding to the sub-grayscale signal A input to the sub-pixel A, the sub-grayscale signal B input to the sub-pixel B, and a sub-grayscale signal (also referred to as a third sub-grayscale signal or a sub-grayscale signal C; hereinafter referred to as the sub-grayscale signal C) input to the sub-pixel C. In addition, the LUT includes second combination data 1202 corresponding to the sub-grayscale signal A, the sub-grayscale signal B, and the sub-grayscale signal C. In FIG. 12, when the level of grayscale of the grayscale signal is 0, as the first combination data 1201, combination data corresponding to the sub-grayscale signal A, the sub-grayscale signal B, and the sub-grayscale signal C, (a0, b0, c0) is referred to, and as the second combination data 1202, combination data corresponding to the sub-grayscale signal A, the sub-grayscale signal B, and the sub-grayscale signal C, (d0, e0, f0) is referred to. Similarly, when the level of grayscale of the grayscale signal is 1 to (n−1), as the first combination data 1201, combination data corresponding to the sub-grayscale signal A, the sub-grayscale signal B, and the sub-grayscale signal C, (a1, b1, c1) to (a(n−1), b(n−1), c(n−1)) is referred to, and as the second combination data 1202, combination data corresponding to the sub-grayscale signal A, the sub-grayscale signal B, and the sub-grayscale signal C, (d1, e1, f1) to (d(n−1), e(n−1), f(n−1)) is referred to.

Here, the first combination data 1201 and the second combination data 1202 in the LUT will be described with a specific example.

For example, each one pixel in the display portion is divided into three sub-pixels of the sub-pixel A, the sub-pixel B, and the sub-pixel C. When the display portion displays 256 grayscale, the level of grayscale is (138) as the grayscale signal. Then, the grayscale signal with a level of grayscale of (138) is input to the grayscale data conversion portion during a given period, here, a given frame period. In the grayscale data memory portion, when the level of grayscale is (138), the plurality of combination data corresponding to three sub-pixels is stored as the LUT. For example, two combination data of (10, 40, 88) and (30, 60, 48) are stored. Note that the sum of each combination data in each sub-pixel is equal. That is, 10+40+88=138 and 30+60+48=138. In response to the grayscale signal input to the grayscale data conversion portion, the combination (10, 40, 88), which is the first one, is selected from the LUT and input as the combination data to the grayscale data conversion portion. Then, as the sub-grayscale signal of the sub-pixel A, (10), as the sub-grayscale signal of the sub-pixel B, (40), and as the sub-grayscale signal of the sub-pixel C, (88) are output to the driving portion from the grayscale data conversion portion. In the driving portion, the plurality of sub-grayscale signals are subjected to a D/A conversion process, gamma correction, polarity inversion of the signal, or the like as appropriate, and the signals are input to the display portion. In each sub-pixel of the display portion, light is transmitted with the transmission amounts of (10), (50), and (88). As one pixel, display is performed at a level of grayscale of (138).

Next, in the next frame period, the grayscale signal with a level of grayscale of (138) is input as the grayscale signal to the grayscale data conversion portion again. Here, by way of example, the same grayscale is expressed although a frame period is changed. In response to the grayscale signal input to the grayscale data conversion portion, the combination (30, 60, 48), which is the second one, is selected by the LUT and input as the combination data to the grayscale data conversion portion. Then, as the sub-grayscale signal of the sub-pixel A, (30), as the sub-grayscale signal of the sub-pixel B, (60), and as the sub-grayscale signal of the sub-pixel C, (48) are output to the driving portion from the grayscale data conversion portion. In the driving portion, the plurality of sub-grayscale signals is subjected to a D/A conversion process, gamma correction, polarity inversion of the signal, or the like, and the signals are input to the display portion. In each sub-pixel of the display portion, light is transmitted with the transmission amounts of (30), (60), and (48). As one pixel, display is performed at a level of grayscale of (138).

Note that, in the further next frame period, the first combination (10, 40, 88) is selected again from the LUT in accordance with the grayscale signal input to the grayscale data conversion portion.

In the case where respective pixels, the sub-pixel A and the sub-pixel B here, have different areas of light-transmitting regions, a difference between the sub-pixel A and the sub-pixel B in the area of light-transmitting regions is needed to be considered. In the case where the difference between the sub-pixel A and the sub-pixel B in the area of light-transmitting regions is considered, at the time of storing combination data in the LUT in advance, the combination data which is considered in advance can be stored; or when grayscale voltage is generated from the sub-grayscale signal, the sub-grayscale signal can be processed in consideration for the difference in the area.

As described above, any one combination data is selected from combination data corresponding to the same level of grayscale of the grayscale signal every desired period and the sub-grayscale signal is generated in the grayscale data conversion portion based on the combination data, so that display of the display portion is performed. Therefore, even if display is performed with the same level of grayscale, the liquid crystal molecules are made slanted in different directions every desired period to increase directions of alignment, so that the viewing characteristics of a viewer can be improved.

Next, FIG. 13 shows correlation between the level of grayscale of the pixel, and the amount of light to be transmitted (luminance) through the pixel during the first period and the second period as for the sub-pixel A, the sub-pixel B, and the sub-pixel C. Note that FIG. 13 shows the structure in which each of the areas of the sub-pixel A, the sub-pixel B, and the sub-pixel C are one third of the pixel. Horizontal axes and vertical axes in FIG. 13 are the same as those in FIGS. 7A and 7B in Embodiment Mode 1. Note that each of the areas of the sub-pixel A, the sub-pixel B, and the sub-pixel C are one third of the pixel. Therefore, when the sum of the luminance of the sub-pixel A, the sub-pixel B, and the sub-pixel C is L, the maximum value of each of the luminances of the sub-pixel A, the sub-pixel B, and the sub-pixel C is L/3. FIG. 13 shows curves of the luminances of the sub-pixel A, the luminances of the sub-pixel B, and luminances of the sub-pixel C during the first period and the second period with respect to the level of grayscale of the pixel. As shown in FIG. 13, similarly to the aforementioned FIGS. 8 and 11, even if the number of sub-pixels is three or more, change of luminance corresponding to the level of grayscale of the pixel can be different in each of the sub-pixel A during the first period, the sub-pixel B during the first period, the sub-pixel C during the first period, the sub-pixel A during the second period, the sub-pixel B during the second period, and the sub-pixel C during the second period. As shown in FIGS. 12 and 13, the present invention is also applicable in the case where each pixel in the display portion includes three or more sub-pixels of the sub-pixel A, the sub-pixel B, and the sub-pixel C. Specifically, since voltage-applied state to the liquid crystal element in one frame period can be changed, burn-in of the liquid crystal element can be prevented. In this manner, in the liquid crystal display device of the present invention, the liquid crystal molecules in the display portion appear to be averaged from any angle, so that the viewing angle characteristics can be improved.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 3

In this embodiment mode, the liquid crystal display device of the present invention described in Embodiment Modes 1 and 2 will be further described. In this embodiment mode, the aforementioned first period and second period will be specifically described.

During the first period and the second period described in FIG. 5 in Embodiment Mode 1, any one combination data in the LUT is referred to and the sub-grayscale signal generated in the grayscale data conversion portion is output to each sub-pixel. Even if display is performed with the same level of grayscale, by generating the sub-grayscale signal in the grayscale data conversion portion to perform display of the display portion, the liquid crystal molecules are made slanted in different directions every desired period to increase directions of alignment, so that the viewing characteristics of a viewer can be improved.

Figure 14A:
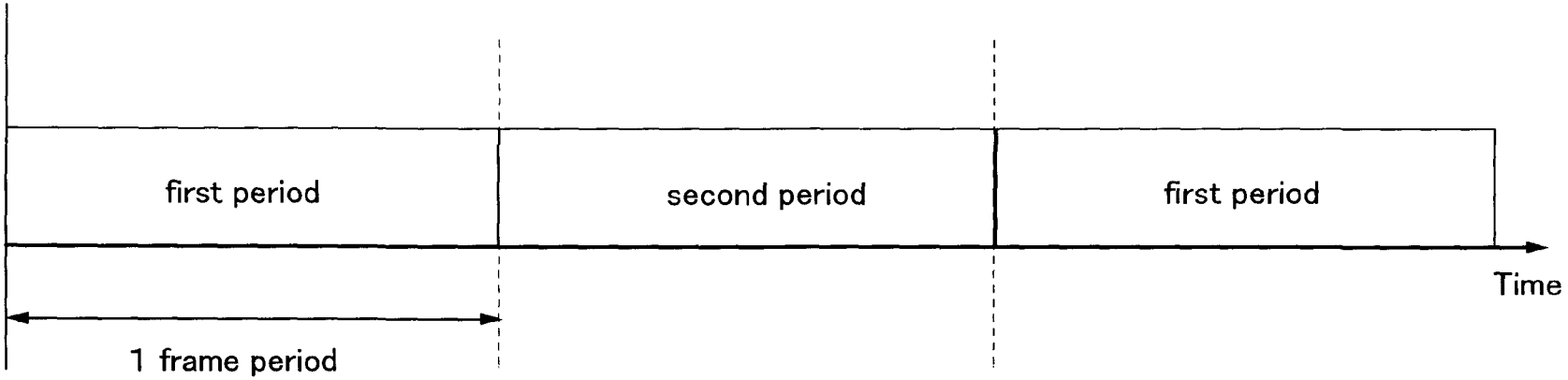
FIGS. 14A and 14B are diagrams for describing specific examples of the present invention.

As shown in FIG. 14A, the first period and the second period of the present invention described in Embodiment Modes 1 and 2 are exchanged to each other every one frame period by selecting combination data which are alternately referred to. When an image such as a moving image is displayed, different image data are displayed for dozens of times (for example, 30 times, 60 times, or 120 times) in one second. In the present invention, as the first period and the second period which are different period, an n-th frame (n is a natural number) is the first period, and an (n+1)th frame is the second period and the first period and the second period are exchanged to each other. By displaying many different image data in one second, flickers of display and afterimages of a moving image can be reduced. In addition, even if display is performed with the same level of grayscale, the liquid crystal molecules are made slanted in different directions every desired period to increase directions of alignment, so that the viewing characteristics of a viewer can be improved.

In the case of a still image or the like, the same image data is displayed during a plurality of frame periods. In the present invention, even when the same image data is displayed, different combination data is referred to every desired period to generate the sub-grayscale signal, and the liquid crystal molecules are made slanted in different directions every desired period to increase directions of alignment, so that the viewing characteristics of a viewer can be improved.

Figure 14B:
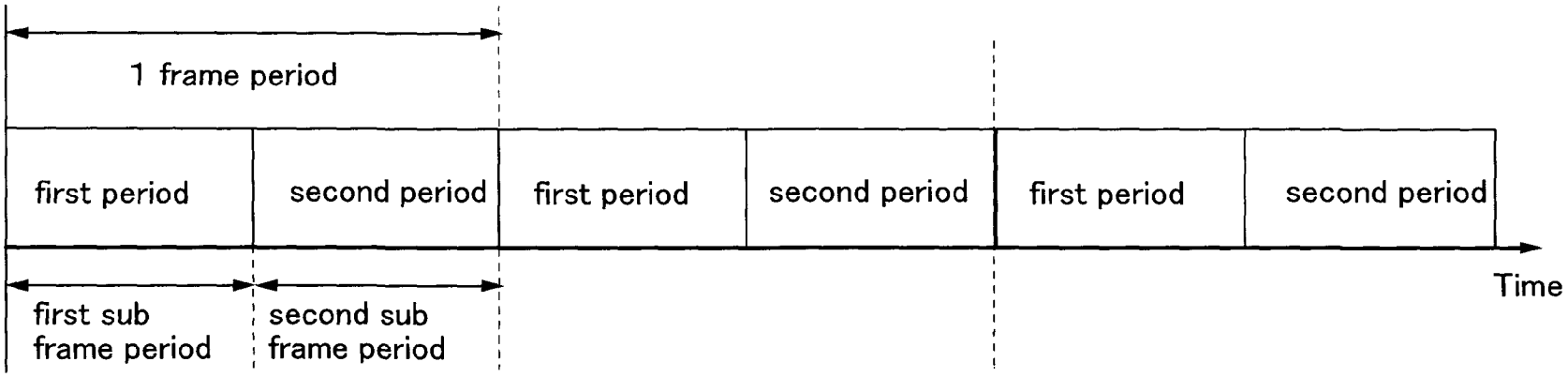
Figure 15A:
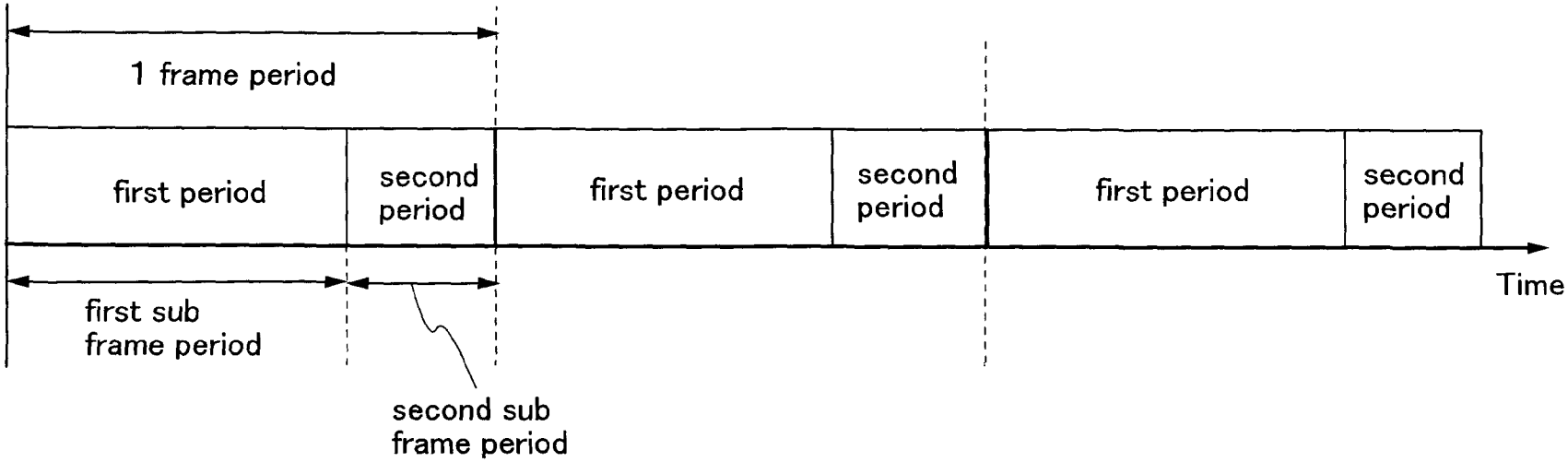
FIGS. 15A and 15B are diagrams for describing specific examples of the present invention.
Figure 15B:
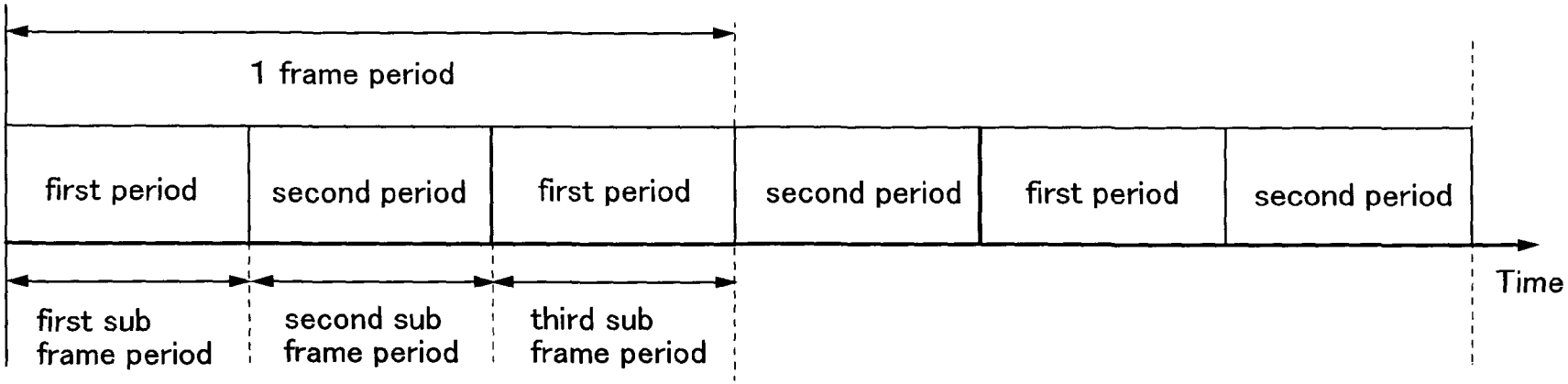

In addition, as shown in FIG. 14B, the first period and second period of the present invention described in Embodiment Modes 1 and 2 can be exchanged to each other by selecting combination data every sub-frame period. A sub-frame is each of a plurality of divided periods of one frame period. As shown in FIG. 14B, one frame period can be divided into equal periods of a first sub-frame and a second sub-frame. Alternatively, as shown in FIG. 15A, one frame period can be divided into unequal periods of a first sub-frame and a second sub-frame. Alternatively, as shown in FIG. 15B, one frame period can be divided into equal periods of first to third sub-frames, and the first period and the second period can be exchanged to each other. In the present invention, as the different periods of the first period and the second period, since the first period and the second period are exchanged to each other every sub-frame period, and each cycle of the sub-frame period is equal or different, the liquid crystal molecules are made slanted in different directions to increase directions of alignment in one frame period, so that the viewing characteristics of a viewer can be improved. In the present invention, similarly in the case where one frame period is divided into equal periods of the first to third sub-frames, and the first period and the second period are exchanged to each other, the liquid crystal molecules are made slanted in different directions to increase directions of alignment in one frame period, so that the viewing characteristics of a viewer can be improved. Further, by dividing each sub-frame period into a plurality of periods, display can be performed in which flickering display and afterimages of a moving image are reduced.

The present invention is not limited to the first period and the second period described in Embodiment Modes 1 and 2, and a plurality of periods, e.g., first to third periods, can be switched by selecting different combination data from the LUT every frame period or every sub-frame period.

FIG. 16 shows an example of the LUT by which the first to third periods select different combination data every frame period or every sub-frame period. The LUT shown in FIG. 16 includes first combination data 1601 corresponding to a sub-grayscale signal (also referred to as a first sub-grayscale signal or a sub-grayscale signal A; hereinafter referred to as the sub-grayscale signal A) input to the sub-pixel A, and a sub-grayscale signal (also referred to as a second sub-grayscale signal or a sub-grayscale signal B; hereinafter referred to as the sub-grayscale signal B) input to the sub-pixel B. In addition, the LUT shown in FIG. 16 includes second combination data 1602 corresponding to the sub-grayscale signal A and the sub-grayscale signal B. Also, the LUT shown in FIG. 16 includes third combination data 1603 corresponding to the sub-grayscale signal A and the sub-grayscale signal B. In FIG. 16, when the level of grayscale of the grayscale signal is 0, as the first combination data 1601, combination data corresponding to the sub-grayscale signal A and the sub-grayscale signal B, (a0, b0) is referred to, and as the second combination data 1602, combination data corresponding to the sub-grayscale signal A, and the sub-grayscale signal B, (c0, d0) is referred to, and as the third combination data 1603, combination data corresponding to the sub-grayscale signal A and the sub-grayscale signal B, (e0, f0) is referred to. Similarly, when the level of grayscale of the grayscale signal is 1 to (n−1), as the first combination data 1601, combination data corresponding to the sub-grayscale signal A and the sub-grayscale signal B, (a1, b1) to (a(n−1), b(n−1)) is referred to, and as the second combination data 1602, combination data corresponding to the sub-grayscale signal A and the sub-grayscale signal B, (c1, d1) to (c(n−1), d(n−1)) is referred to, and as the third combination data 1603, combination data corresponding to the sub-grayscale signal A and the sub-grayscale signal B, (e1, f1) to (e(n−1), f(n−1)) is referred to.

Here, the first combination data 1601, the second combination data 1602, and the third combination data 1603 in the LUT will be described with a specific example.

For example, the pixel in the display portion is divided into two sub-pixels of the sub-pixel A and the sub-pixel B, and the areas of light-transmitting regions of the sub-pixel A and the sub-pixel B are equal in each pixel of the display portion 103. When the display portion displays 256 grayscale, the level of grayscale is (138) as the grayscale signal. Then, the grayscale signal with a level of grayscale of (138) is input to the grayscale data conversion portion during a given period, here, a given frame period. In the grayscale data memory portion, when the level of grayscale is (138), the plurality of combination data corresponding to two sub-pixels is stored as the LUT. For example, three combination data of (50, 88), (90, 48), (20, 118) are stored. Note that the sum of each combination data in each sub-pixel is equal. That is, 50+88=138, 90+48=138, and 20+118=138. In response to the grayscale signal input to the grayscale data conversion portion, the combination (50, 88), which is the first one, is selected from the LUT and input as the combination data to the grayscale data conversion portion. Then, as the sub-grayscale signal of the sub-pixel A, (50), and as the sub-grayscale signal of the sub-pixel B, (88) are output to the driving portion from the grayscale data conversion portion. In the driving portion, the plurality of sub-grayscale signals are subjected to a D/A conversion process, gamma correction, polarity inversion of the signal, and the like as appropriate, and the signals are input to the display portion. In each sub-pixel of the display portion, light is transmitted with the transmission amount of (50) and (88). As one pixel, display is performed at a level of grayscale of (138).

Next, in the next frame period, the grayscale signal with a level of grayscale of (138) is input as the grayscale signal to the grayscale data conversion portion again. Here, by way of example, the same grayscale is expressed although a frame period is changed. In response to the grayscale signal input to the grayscale data conversion portion, the combination (90, 48), which is the second one, is selected from the LUT and input as the combination data to the grayscale data conversion portion. Then, as the sub-grayscale signal of the sub-pixel A, (90), and as the sub-grayscale signal of the sub-pixel B, (48) are output to the driving portion from the grayscale data conversion portion. In the driving portion, the plurality of sub-grayscale signals is subjected to a D/A conversion process, gamma correction, polarity inversion of the signal, or the like, and the signals are input to the display portion. In each sub-pixel of the display portion, light is transmitted with the transmission amounts of (90) and (48). As one pixel, display is performed at a level of grayscale of (138).

Next, similarly in the frame period after the aforementioned frame period, the grayscale signal with the level of grayscale of (138) is input as the grayscale signal to the grayscale data conversion portion. In response to the grayscale signal input to the grayscale data conversion portion, the combination (20, 118), which is the third one, is selected from the LUT and input as the combination data to the grayscale data conversion portion. Then, as the sub-grayscale signal of the sub-pixel A, (20), and as the sub-grayscale signal of the sub-pixel B, (118) are output to the driving portion from the grayscale data conversion portion. In the driving portion, the plurality of sub-grayscale signals is subjected to a D/A conversion process, gamma correction, polarity inversion of the signal, or the like, and the signals are input to the display portion. In each sub-pixel of the display portion, light is transmitted with the transmission amount of (20) and (118). As one pixel, display is performed at a level of grayscale of (138).

Note that, in the frame period after the aforementioned frame period, the first combination (50, 88) is selected again from the LUT in accordance with the grayscale signal input to the grayscale data conversion portion.

As described above, any one combination data is selected from three or more combination data corresponding to the same number of grayscale of the grayscale signal every desired period and the sub-grayscale signal is generated in the grayscale data conversion portion based on the combination data, so that display of the display portion is performed. Therefore, even if display is performed with the same level of grayscale, the liquid crystal molecules are made slanted in different directions every desired period to increase directions of alignment, so that the viewing characteristics of a viewer can be improved.

In the case where respective pixels, the sub-pixel A and the sub-pixel B here, have different areas of light-transmitting regions, a difference between the sub-pixel A and the sub-pixel B in the area of light-transmitting regions is needed to be considered. In the case where the difference between the sub-pixel A and the sub-pixel B in the area of light-transmitting regions is considered, the combination data which is considered in advance can be stored at the time of storing combination data in the LUT in advance; or the sub-grayscale signal can be processed in consideration for the difference in the area when grayscale voltage is generated from the sub-grayscale signal.

Figure 17A:
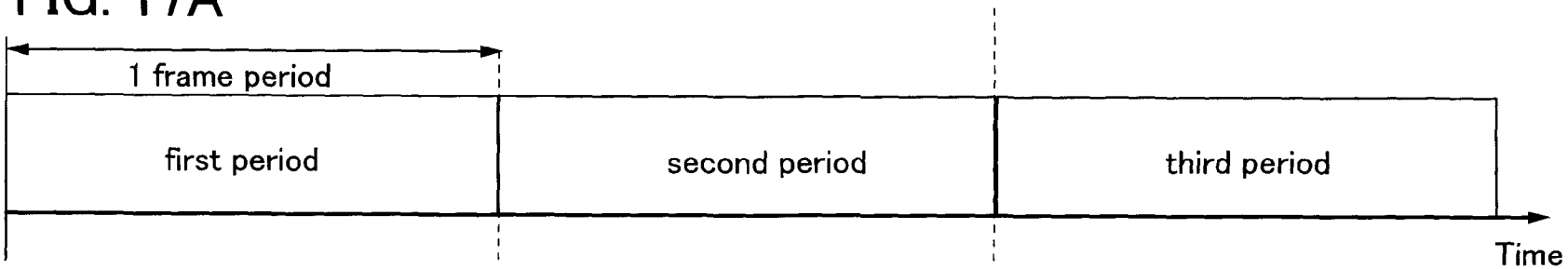
FIGS. 17A to 17C are diagrams for describing specific examples of the present invention.
Figure 17B:
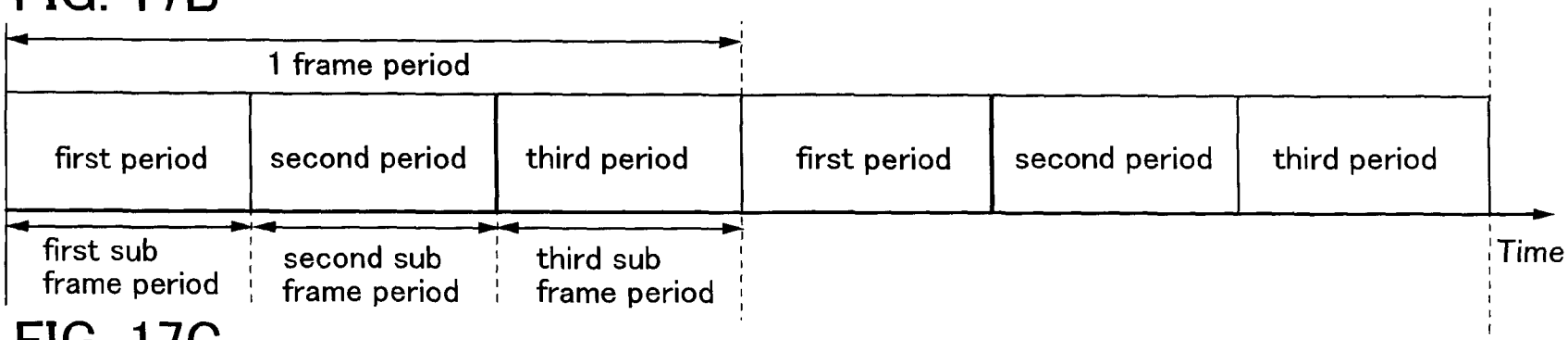
Figure 17C:
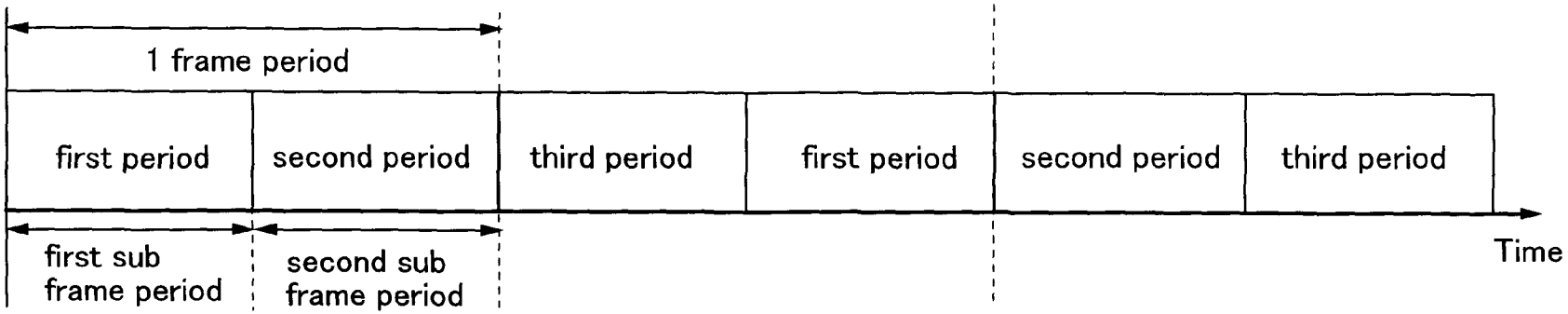

Any one combination data from the first to third combination data shown in FIG. 16 is referred to every single period of the first to third periods. The sub-grayscale signal generated in the grayscale data conversion portion in accordance with any selected one of the first to third combination data is output to each sub-pixel. As shown in FIG. 17A, the first to third periods can be switched every one frame period. Therefore, even if display is performed with the same level of grayscale, flickering display and afterimages of a moving image can be reduced, and the liquid crystal molecules are made slanted in different directions every desired period to increase directions of alignment, so that the viewing characteristics of a viewer can be improved. Moreover, as shown in FIG. 17B, the first to third periods can be switched every sub-frame period. Therefore, even if display is performed with the same level of grayscale, flickering display and afterimages of a moving image can be reduced, and by increasing the number of sub-frames in one frame period, the liquid crystal molecules are made slanted in different directions every desired period to increase directions of alignment, so that the viewing characteristics of a viewer can be improved. Moreover, as shown in FIG. 17C, the first to third periods can be switched every sub-frame period during a plurality of frame periods. Therefore, even if display is performed with the same level of grayscale, flickering display and afterimages of a moving image can be reduced, and the liquid crystal molecules are made slanted in different directions every desired period to increase directions of alignment, so that the viewing characteristics of a viewer can be improved.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 4

In this embodiment mode, a structure which is different from the liquid crystal display device of the present invention described in Embodiment Modes 1 to 3 will be described. In Embodiment Modes 1 to 3 described above, the structure is described in which each of the first period and the second period select a different LUT from the plurality of combination data stored in the grayscale data memory portion. In this embodiment mode, a structure will be described in which the sub-grayscale signal generated in the grayscale data conversion portion by referring to any one of the plurality of combination data with respect to each pixel included in the display portion is output to each sub-pixel. For example, as for one pixel (first pixel), first combination data is input to the sub-pixel A and the sub-pixel B, and as for the other pixel (second pixel), second combination data is input to the sub-pixel A and the sub-pixel B. As a result, in a region including two pixels, the amounts of light to be transmitted can be averaged by the first pixel and the second pixel. Therefore, by generating the sub-grayscale signal in the grayscale data conversion portion and performing display of the display portion, even if display is performed with the same level of grayscale, the liquid crystal molecules are made slanted in different directions with respect to each pixel which constitutes the display portion to increase directions of alignment, so that the viewing characteristics for a viewer can be improved.

An example in which display is performed by referring to any one of the combination data from the LUT with respect to each pixel which constitutes the display portion will be described with reference to FIGS. 18 and 19. In FIGS. 18 and 19, an example is specifically described in which either one of the first combination data and the second combination data is selected from the plurality of LUTs to perform display of a pixel.

Figure 18A:
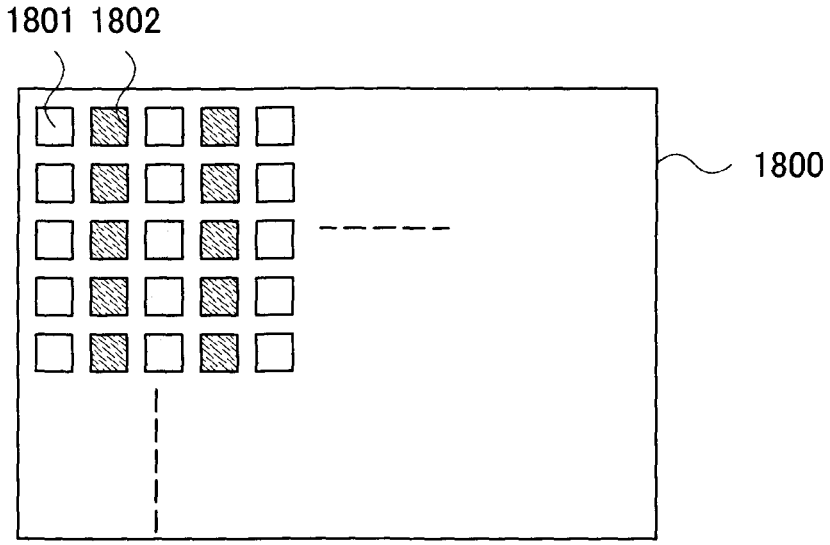
FIGS. 18A to 18C are diagrams for describing specific examples of the present invention.
Figure 18B:
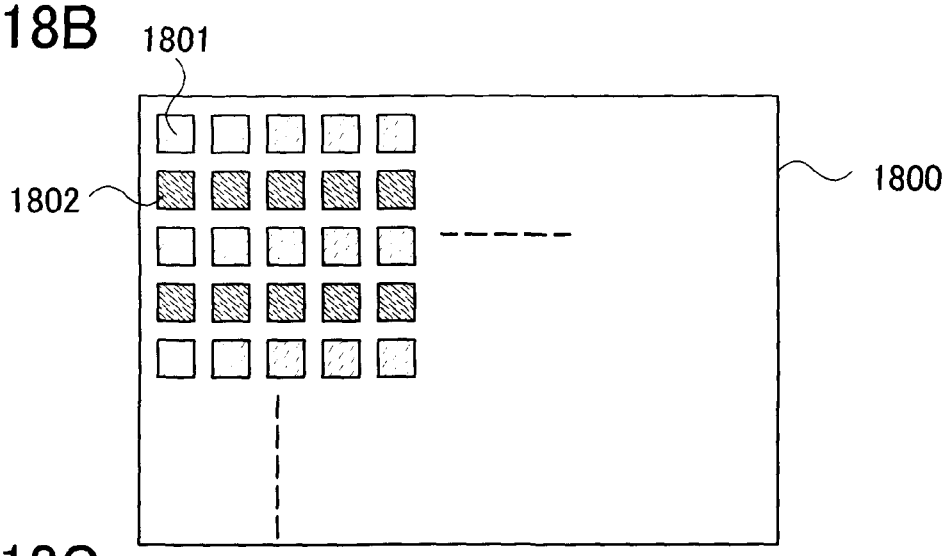
Figure 18C:
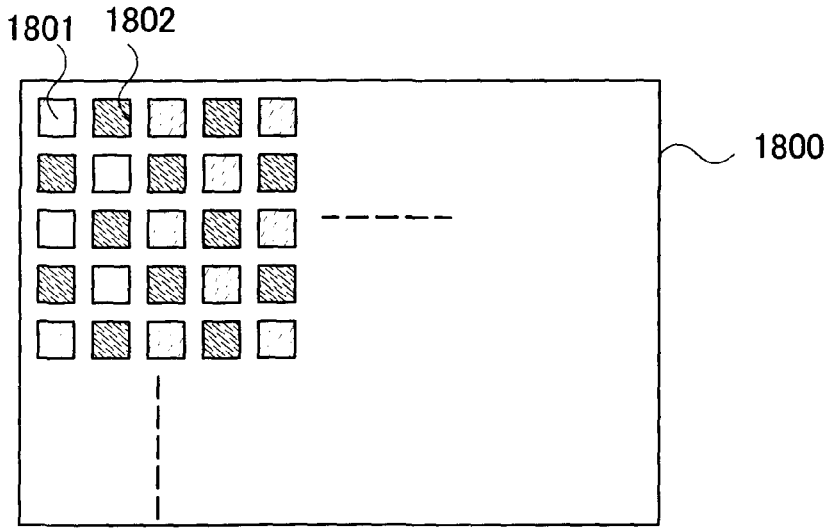

FIGS. 18A to 18C includes a display portion 1800, a pixel region (hereinafter referred to as a first region 1801) which refers to one of the first combination data and the second combination data, and a pixel region (hereinafter referred to as second region 1802) which refers to the other of the first combination data and the second combination data. As shown in FIG. 18A, pixels in the odd number of columns in the pixel region can be referred to as the first region 1801 and pixels in the even number of columns in the pixel region can be referred to as the second region 1802. Alternatively, as shown in FIG. 18B, pixels in the odd number of rows in the pixel region can be referred to as the first region 1801 and pixels in the even number of rows in the pixel region can be referred to as the second region 1802. Alternatively, as shown in FIG. 18C, pixels in the odd number of columns and the odd number of rows in the pixel region can be referred to as the first region 1801, and pixels in the even number of columns and the even number of rows in the pixel region can be referred to as the second region 1802; the pixels can be arranged in a so-called checkered pattern.

Figure 19A:
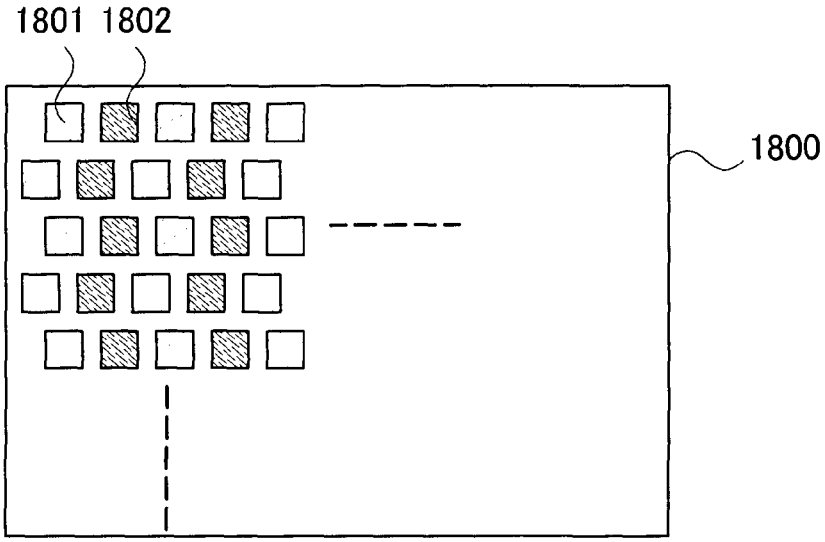
FIGS. 19A to 19C are diagrams for describing specific examples of the present invention.
Figure 19B:
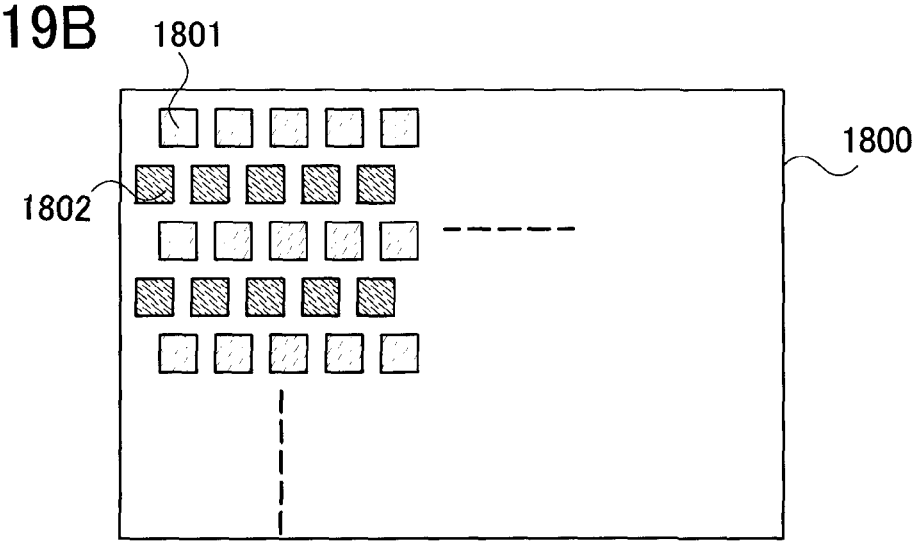
Figure 19C:
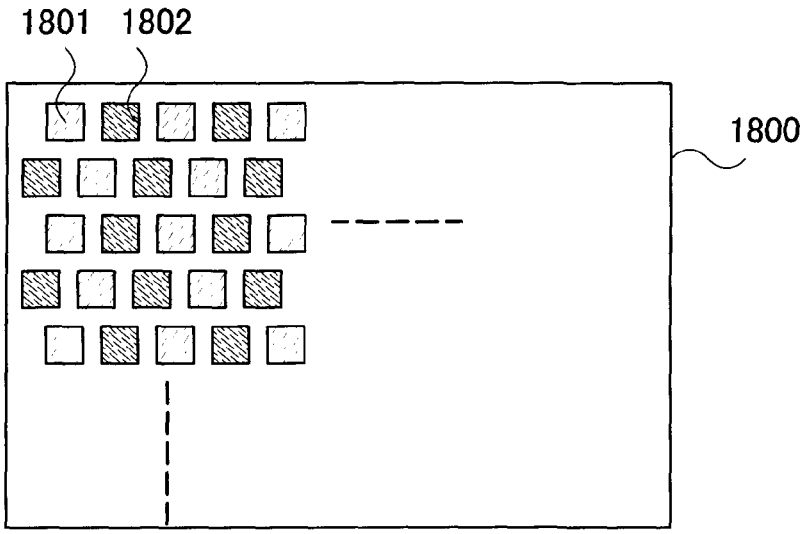

FIGS. 19A to 19C are diagrams in which respective pixels in the odd number of columns or the even number of columns shown in FIGS. 18A to 18C are provided as being shifted in the row direction (the direction in which pixels in the row direction are provided in addition) by half a pixel; the pixels can be arranged in a so-called delta pattern. As shown in FIG. 19A, pixels corresponding to the odd number of columns in the pixel region can be referred to as the first region 1801 and pixels corresponding to the even number of columns in the pixel region can be referred to as the second region 1802. Alternatively, as shown in FIG. 19B, pixels in the odd number of rows in the pixel region can be referred to as the first region 1801 and pixels in the even number of rows in the pixel region can be referred to as the second region 1802. Alternatively, as shown in FIG. 19C, in the odd number of rows in the pixel region, pixels corresponding to the odd number of columns can be referred to as the first region 1801, and pixels corresponding to the even number of columns can be referred to as the second region 1802; in the even number of rows in the pixel region, pixels corresponding to the odd number of columns are referred to as the second region 1802 and pixels corresponding to the even number of columns can be referred to as the first region 1801.

Also in FIGS. 18A to 19C, the sub-grayscale signal generated in the grayscale data conversion portion by referring to any one of the first combination data and the second combination data with respect to each pixel included in the display portion can be output to each sub-pixel. By generating the sub-grayscale signal in the grayscale data conversion portion and performing display of the display portion, even if display is performed with the same level of grayscale, the liquid crystal molecules are made slanted in different directions with respect to each pixel which constitutes the display portion to increase directions of alignment, so that the viewing characteristics for a viewer can be improved.

Note that the polarity of the sub-grayscale voltage input to each sub-pixel is preferably inverted every desired period; so-called inversion driving is preferably performed. The sub-grayscale voltages input to each sub-pixel included in one pixel preferably have the same polarity. By setting the polarities of the sub-grayscale voltages input to the sub-pixels which constitute one pixel to be the same, the amplitude width of the amplitude of the sub-grayscale voltage input to the adjacent sub-pixels can be small, so that parasitic capacitance between the adjacent sub-pixels, and between the wirings for inputting the sub-grayscale voltage can be reduced. Therefore, fine display can be achieved. As inversion driving, for example, frame inversion driving in which video signals having the same polarity are input to all the pixels every one frame period, source line inversion driving, gate line inversion driving, dot inversion driving, or other inversion driving can be employed.

Figure 20:
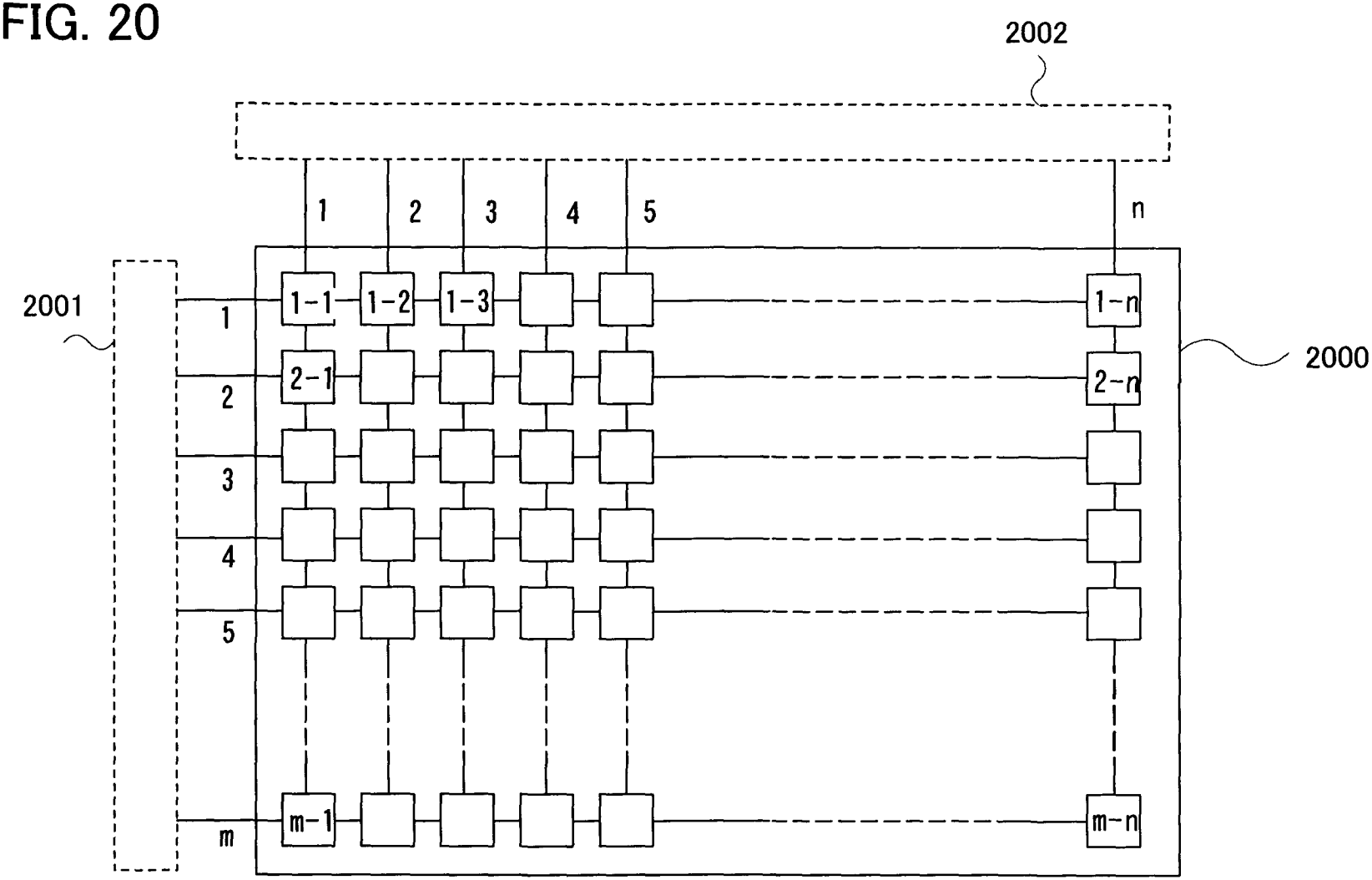
FIG. 20 is a diagram for describing a specific example of the present invention.
Figure 21A:
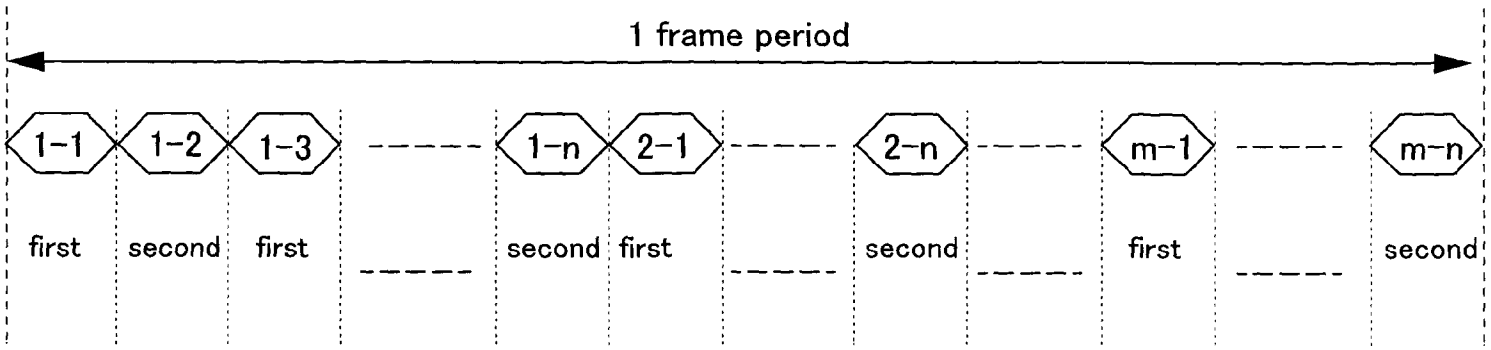
FIGS. 21A to 21C are diagrams for describing specific examples of the present invention.
Figure 21B:
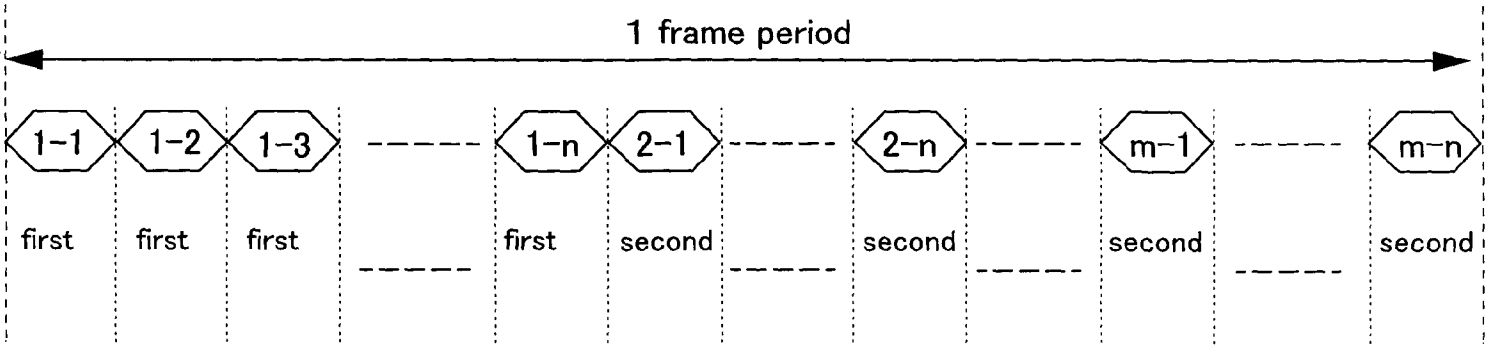
Figure 21C:
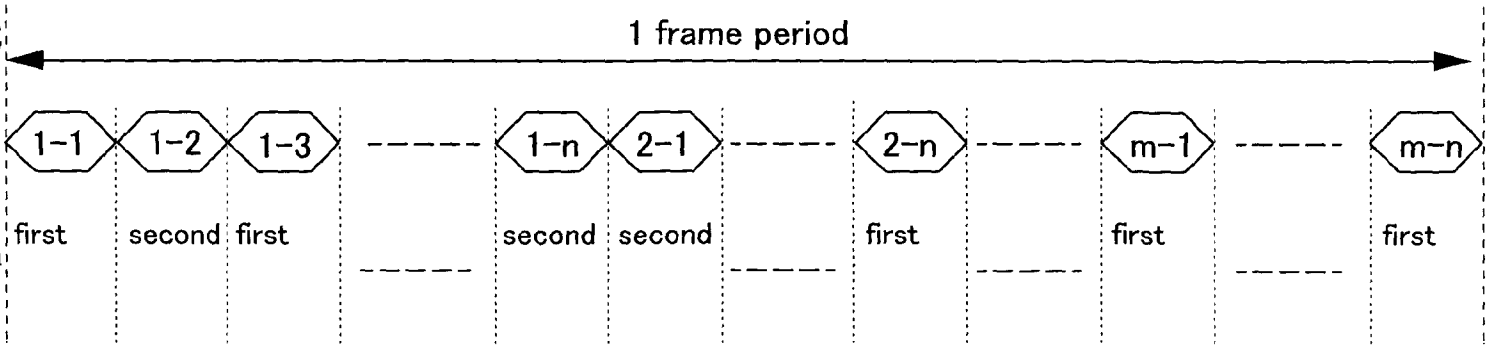

In, FIGS. 20 to 21C, an operation example of the structure described in FIGS. 18A to 19C will be specifically described. In FIG. 20, a display portion 2000 including a plurality of pixels and a gate driver 2001 and a source driver 2002 which operates the plurality of pixels are shown. The plurality of pixels is arranged in m rows and n columns (m and n are natural numbers). From the gate driver 2001, m wirings for controlling operation of the pixels, and from the source driver 2002, n wirings for controlling operation of the pixels are extended. In FIG. 20, among the plurality of pixels in the display portion 2000, a pixel in a first row and a first column is referred to as (1-1), a pixel in the first row and a second column is referred to as (1-2), a pixel in the first row and n-th column is referred to as (1-n), and a pixel in m-th row and n-th column is referred to as (m-n). In this manner, the plurality of pixels in the display portion 2000 is numbered and FIGS. 21A to 21C will be described.

FIGS. 21A to 21C are diagrams for describing a process in which a grayscale signal corresponding to each pixel of the display portion 2000 shown in FIG. 20 selects the first combination data or the second combination data to generate a sub-grayscale signal in one frame period. FIG. 21A shows an example in which a grayscale signal input in serial in order of pixels in the row direction to the grayscale data conversion portion selects the first combination data or the second combination data alternately. By selecting the first combination data or the second combination data alternately with respect to a grayscale signal of one pixel, in each pixel in the display portion, the sub-grayscale signal can be output to each sub-pixel as similar to FIG. 18A or FIG. 19A. FIG. 21B shows an example in which a grayscale signal input in serial in order of pixels in row direction to the grayscale data conversion portion selects the first combination data or the second combination data alternately with respect to grayscale signals in one row (that is, with respect to n pixels). By selecting the first combination data or the second combination data alternately with respect to grayscale signals of pixels in one row, in each pixel in the display portion, the sub-grayscale signal can be output to each sub-pixel as similar to FIG. 18B or FIG. 19B. FIG. 21C shows an example in which a grayscale signal input in serial in order of pixels in row direction to the grayscale data conversion portion selects the first combination data or the second combination data alternately with respect to each row, and the odd number of rows and the even number of rows select combination data of the first combination data and the second combination data so as to select combination data different from each other. Since the first combination data and the second combination data is alternately selected by the odd number of rows and the even number of rows with respect to a pixel, in each pixel in the display portion, the sub-grayscale signal can be output to each sub-pixel as shown in FIG. 18C or FIG. 19C.

Although selection of the combination data from the LUT corresponding to the grayscale signal in one frame is described with reference to FIGS. 21A to 21C, display can also be performed by selection corresponding to each pixel even in one sub-frame period.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 5

In this embodiment mode, a structure which is different from the liquid crystal display device of the present invention described in Embodiment Modes 1 to 4 will be described. In Embodiment Modes 1 to 4, the structure is described in which the viewing angle characteristics can be improved by using the LUT including the plurality of combination data stored in the grayscale data memory portion. In this embodiment mode, a structure will be described in which the plurality of combination data is obtained by arithmetic processing based on the level of grayscale of the grayscale signal. For example, in the case where the combination data is calculated by arithmetic processing, the combination data can be evenly output by using the random number. As a result, the amounts of light to be transmitted can be averaged in each pixel of the display portion. Therefore, by generating the sub-grayscale signal in the grayscale data conversion portion and performing display of the display portion, even if display is performed with the same level of grayscale, the liquid crystal molecules are made slanted in different directions with respect to each pixel included in the display portion to increase directions of alignment, so that the viewing characteristics for a viewer can be improved. Moreover, in this embodiment mode, in addition to the aforementioned effect, since the LUT is not needed to be stored in the grayscale data memory portion, memory capacitance of the grayscale data memory portion can be reduced, so that cost-cutting and miniaturization of a display device can be achieved.

Hereinafter, a specific example will be described in which the combination data corresponding to the grayscale signal, which is referred to with respect to a pixel included in the display portion, is obtained by arithmetic processing.

For example, the pixel in the display portion is divided into two sub-pixels of the sub-pixel A and the sub-pixel B. When the display portion displays 256 grayscale, the level of grayscale is (X) (X is a natural number of from 0 to 255) as the grayscale signal. Then, the grayscale signal with a level of grayscale of (X) is input to the grayscale data conversion portion during a desired period, here, a desired frame period. In the grayscale data memory portion, when the combination data corresponding to the sub-grayscale signal A input to the sub-pixel A is XA, the combination data corresponding to the sub-grayscale signal B input to the sub-pixel B is XB, and the random number generated is $\alpha$ ($\alpha$ is the number of from 0 to 1), the plurality of combination data is calculated by two formulas, $XA=X\times\alpha$ and $XB=X-XA$. More specifically, when the level of grayscale is (120) and the random number $\alpha$ is 0.75, the combination data corresponding to two sub-pixels are found by $XA=120\times 0.75=90$ and $XB=120-90=30$ so that the combination data (90, 30) corresponding to the sub-grayscale signal A and the sub-grayscale signal B is obtained. Note that the sum of the combination data in respective sub-pixels is the same as the level of grayscale. That is, 90+30=120. Then, the combination data (90, 30) corresponding to the grayscale signal input to the grayscale data conversion portion is input to the grayscale conversion portion. Then, as the sub-grayscale signal of the sub-pixel A, (90), and as the sub-grayscale signal of the sub-pixel B, (30) are output to the driving portion from the grayscale data conversion portion. In the driving portion, the plurality of sub-grayscale signals are subjected to a D/A conversion process, gamma correction, polarity inversion of the signal, or the like as appropriate, and the signals are input to the display portion. In each sub-pixel of the display portion, light is transmitted with the transmission amounts of (90) and (30). As one pixel, display is performed at a level of grayscale of (120).

Next, in the next frame period, the grayscale signal with a level of grayscale of (120) is input as the grayscale signal to the grayscale data conversion portion. Here, by way of example, the same level of grayscale is expressed even if a frame period is changed. In the grayscale data memory portion, the random number is generated in accordance with input of the grayscale signal to the grayscale data memory portion. When the random number is 0.40, the combination data corresponding to two sub-pixels is found by $XA=120\times 0.40=48$ and $XB=120-48=72$ so that the combination data (48, 72) corresponding to the sub-grayscale signal A and the sub-grayscale signal B is obtained. Note that the sum of the combination data in respective sub-pixels is equal to the level of grayscale. That is, 48+72=120. Then, the combination data (48, 72) corresponding to the grayscale signal input to the grayscale data conversion portion is input to the grayscale conversion portion. Then, as the sub-grayscale signal of the sub-pixel A, (48), and as the sub-grayscale signal of the sub-pixel B, (72) are output to the driving portion from the grayscale data conversion portion. In the driving portion, the plurality of sub-grayscale signals is subjected as appropriate to a D/A conversion process, gamma correction, polarity inversion of the signal, or the like, and the signals are input to the display portion. In each sub-pixel of the display portion, light is transmitted with the transmission amounts of (48) and (72). For one pixel, display is performed at a level of (120).

When the combination data is found by arithmetic processing using the random number, a higher value than the level of grayscale which can be displayed in each sub-pixel is found in some cases. For example, in the case where 256 grayscale is displayed and the areas of light-transmitting regions of the sub-pixel A and the sub-pixel B are equal, when the level of grayscale displayed in one pixel is (200) and the random number $\alpha$ is 0.75, $XA=200\times0.75=150$. However, the sub-pixel A can only displays up to a level of 128. This is because since one pixel includes the sub-pixel A and the sub-pixel B whose light-transmitting regions are equal, the area of the light-transmitting region of the sub-pixel A is halved. Thus, in the case where the combination data is obtained by arithmetic processing using the random number, when the combination data is higher than the maximum level of grayscale which can be displayed in the sub-pixel A, the maximum level of grayscale is the level of grayscale in the sub-pixel A. This enables one pixel to perform display correctly.

Alternatively, as another method, the combination data can be obtained by arithmetic processing using the random number again. By obtaining the combination data by arithmetic processing using the random number until the combination data becomes smaller than the maximum level of grayscale, one pixel can perform display correctly.

Alternatively, as another method, when the combination data is higher than the maximum level of grayscale, as another formula for calculating the combination data using the random number, $XA=X\times\alpha\times\alpha$ is used. Since $\alpha$ is 1 or less, XA can be small. In this manner, XA can be equal to or lower than the maximum level of grayscale which can be displayed in the sub-pixel A. Note that if XA is higher than the maximum level of grayscale which can be displayed in the sub-pixel A, X can be multiplied by $\alpha$ until XA becomes equal to or lower than the maximum level of grayscale which can be displayed in the sub-pixel A. That is, XA can be lower than the maximum level of grayscale which can be displayed in the sub-pixel A by a formula $XA=X\times\alpha^N$ (N is an integer of 1 or more).

Similarly, when the level of grayscale which is displayed in one pixel is (200) and the random number $\alpha$ is 0.1, $XA=200\times0.1=20$ and $XB=200-20=180$. However, the sub-pixel B can only display up to a level of 128 of grayscale. This is because since one pixel is formed of the sub-pixel A and the sub-pixel B whose light-transmitting regions are equal, the area of the light-transmitting region of the sub-pixel B is halved. Thus, in the case where the combination data is obtained by arithmetic processing using the random number, when the combination data is higher than the maximum level of grayscale which can be displayed in the sub-pixel B, the maximum level of grayscale is the level of grayscale in the sub-pixel B. In the sub-pixel A, XA is calculated again by using another formula, $XA=X-XB$. This enables one pixel to perform display correctly.

Alternatively, as another method, the combination data can be obtained by arithmetic processing using the random number again. By obtaining the combination data by arithmetic processing using the random number until the combination data becomes smaller than the maximum level of grayscale, one pixel can perform display correctly.

Alternatively, as another method, when the combination data is higher than the maximum level of grayscale, as another formula for calculating the combination data using the random number, $X=X\times(1-\alpha)$ is used. Since $\alpha$ is 1 or less, XA can be increased. In this manner, XB can be equal to or lower than the maximum level of grayscale which can be displayed in the sub-pixel B. Note that if XB is higher than the maximum level of grayscale which can be displayed in the sub-pixel B, $\alpha$ to the power of N can be subtracted from 1 until XB becomes lower than the maximum level of grayscale which can be displayed in the sub-pixel B. That is, XB can be lower than the maximum level of grayscale which can be displayed in the sub-pixel B by a formula $XA=X\times(1-\alpha^N)$ (N is an integer of 1 or more).

In this manner, by performing various kinds of arithmetic processing, calculation of the combination data using the random number can be normally performed. However, the present invention is not limited to this and various kinds of calculation methods of the combination data using the random number can be employed.

As described above, although the same level of grayscale as that in the previous frame period is displayed in one pixel, the amount of light to be transmitted in each sub-pixel is different from that in the previous frame period. Therefore, an aligned state of the liquid crystal molecules in each sub-pixel can be made different every frame period. Thus, when the screen of the display portion is seen from a certain angle, the amounts of light to be transmitted are averaged, so that the viewing angle can be increased.

Note that in the further next frame period, the random number is generated again in accordance with input of the grayscale signal to the grayscale data memory portion, and the combination data is obtained by arithmetic processing. Thus, the LUT does not need to be stored in the grayscale data memory portion and memory capacitance of the grayscale data memory portion can be reduced, so that cost-cutting and miniaturization of a display device can be achieved.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 6

In this embodiment mode, a display method which can be applied to the liquid crystal display device of the present invention will be described with reference to FIGS. 24A to 25B.

Figure 24A:
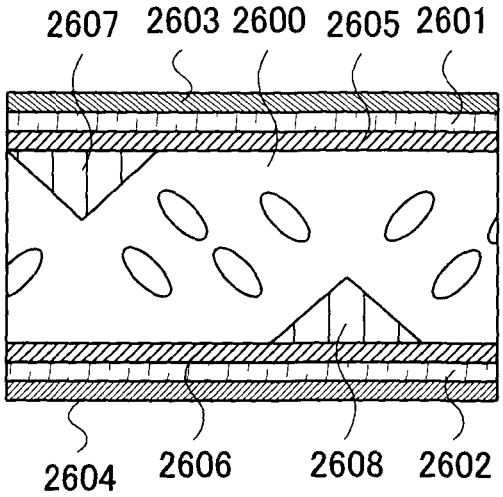
FIGS. 24A and 24B are diagrams for describing specific examples of the present invention.
Figure 24B:
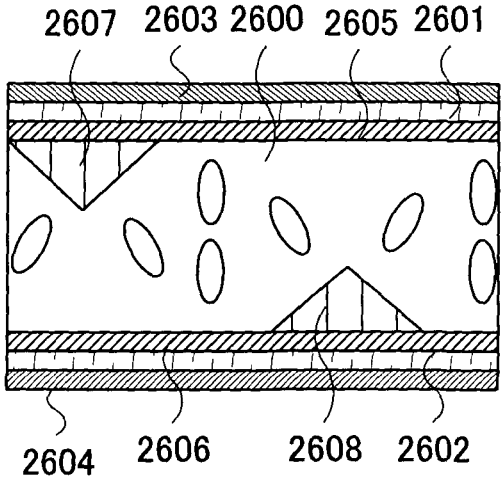

As for alignment of liquid crystal molecules in a display mode which can be applied to the present invention, a MVA mode can be employed and the MVA mode is shown in FIGS. 24A and 24B. The MVA mode is a mode in which alignment of liquid crystal molecules are divided into a plurality of directions, so that viewing angle dependence in respective parts are compensated with each other. In FIGS.

24A and 24B, a layer 2600 including a liquid crystal element is interposed between a first substrate 2601 and a second substrate 2602 which are provided so as to face each other. A layer 2603 including a first polarizer is stacked on the first substrate 2601 side, and a layer 2604 including a second polarizer is provided for the second substrate 2602 side. Note that the layer 2603 including the first polarizer and the layer 2604 including the second polarizer are provided so as to be in crossed Nicols.

Although not shown, a backlight or the like is provided outside a layer including a second polarizer. A first electrode 2605 is provided on the first substrate 2601, and a second electrode 2606 is provided over the second substrate 2602.

As shown in FIG. 24A, in the MVA mode, a protrusion 2607 whose cross section is a triangle is provided on the first electrode 2605 and a protrusion 2608 whose cross section is a triangle is provided over the second electrode 2606 for controlling alignment. As shown in FIG. 24A, when a voltage is applied to the first electrode 2605 and the second electrode 2606, the liquid crystal elements are turned to be an on state which performs white display. At that time, liquid crystal molecules are aligned lying down to the protrusions 2607 and 2608. Thus, light from a backlight can pass through a pair of the layers including polarizers (the layer 2603 including the first polarizer and the layer 2604 including the second polarizer) which is provided so as to be in crossed Nicols, so that predetermined image display is performed. By providing a color filter, full color display can be performed. The color filter can be provided on the first substrate 2601 side or the second substrate 2602 side. In addition, as shown in FIG. 24B, when a voltage is not applied to the first electrode 2605 and the second electrode 2606, the liquid crystal elements are turned to be an off state which performs black display. At that time, liquid crystal molecules are aligned vertically. Thus, light from the backlight cannot pass through the substrate, which leads to black display.

Figure 60A:
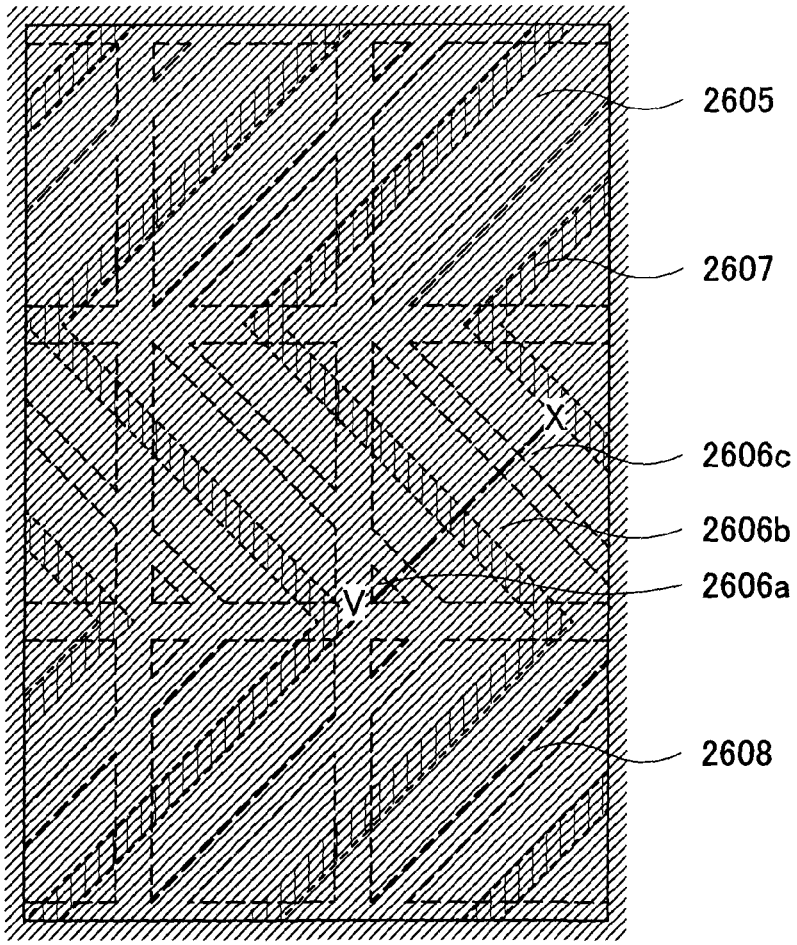
FIGS. 60A and 60B are diagrams for describing specific examples of the present invention.
Figure 60B:
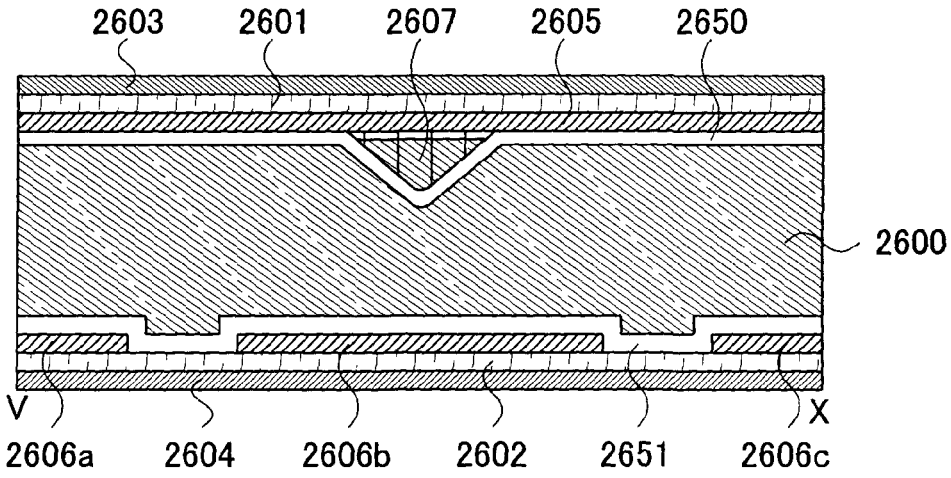

As an example of the MVA mode, a top view and a cross-sectional view are shown in FIGS. 60A and 60B. In FIG. 60A, the second electrode is formed in a V-like shape and referred to as a second electrodes 2606*a*, 2606*b*, and 2606*c*. An insulating layer 2651 which is an alignment film is provided over the second electrodes 2606*a*, 2606*b*, and 2606*c*. As shown in FIG. 60B, the protrusion 2607 is formed on the first electrode 2605 so as to corresponds to the second electrodes 2606*a*, 2606*b*, and 2606*c* and is covered with the insulating layer 2650 which is the alignment film. Opening portions of the second electrodes 2606*a*, 2606*b*, and 2606*c* function like protrusions and can move the liquid crystal molecules. Note that the first electrode 2605 can be formed on the protrusion 2607.

Figure 25A:
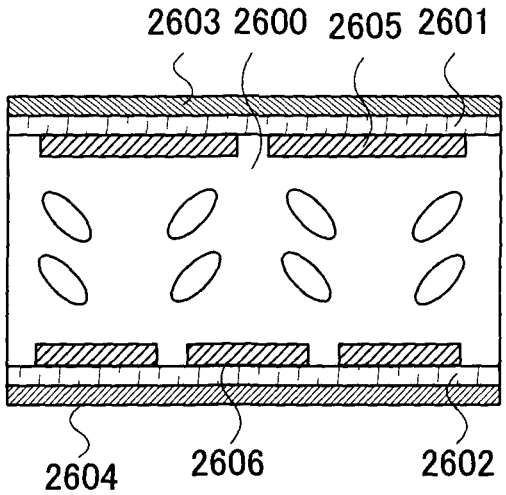
FIGS. 25A and 25B are diagrams for describing specific examples of the present invention.
Figure 25B:
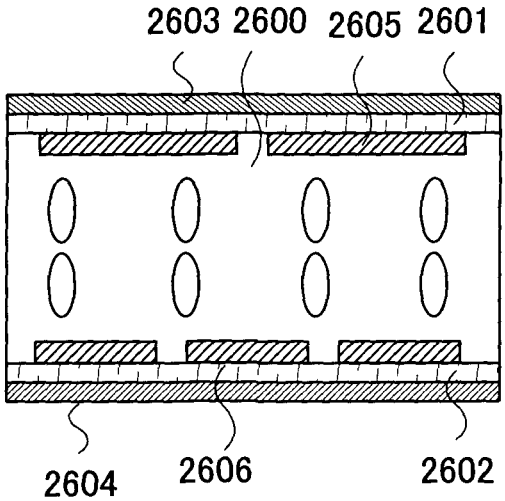

In addition, as for alignment of liquid crystal molecules in a display mode which can be applied to the present invention, a PVA mode can be employed and the PVA mode is shown in FIGS. 25A and 25B. Similarly to the MVA mode, the PVA mode is a mode in which alignment of liquid crystal molecules are divided into a plurality of directions, so that viewing angle dependence in respective parts are compensated with each other. In FIGS. 25A and 25B, the layer 2600 including a liquid crystal element is interposed between the first substrate 2601 and the second substrate 2602 which are provided so as to face each other. The layer 2603 including the first polarizer is stacked on the first substrate 2601 side, and the layer 2604 including the second polarizer is provided for the second substrate 2602 side. Note that the layer 2603 including the first polarizer and the layer 2604 including the second polarizer are provided so as to be in crossed Nicols.

Although not shown, a backlight and the like are provided outside the layer including the second polarizer. A first electrode 2605 is provided on the first substrate 2601, and a second electrode 2606 is provided over the second substrate 2602.

As shown in FIG. 25A, in the a PVA mode, slits (also referred to as a gap provided for an electrode or a tear portion of an electrode) with different patterns are provided for the first electrode 2605 and the second electrode 2606 for controlling alignment. As shown in FIG. 25A, when a voltage is applied to the first electrode 2605 and the second electrode 2606, the liquid crystal elements are turned to be an on state which performs white display. At that time, the liquid crystal molecules are aligned lying down over the slits of the first electrode 2605 and the second electrode 2606. Thus, light from a backlight can pass through a pair of the layers including polarizers (the layer 2603 including the first polarizer and the layer 2604 including the second polarizer) which is provided so as to be in crossed Nicols, so that predetermined image display is performed. By providing a color filter, full color display can be performed. The color filter can be provided to the first substrate 2601 side or the second substrate 2602 side. In addition, as shown in FIG. 25B, when a voltage is not applied between the first electrode 2605 and the second electrode 2606, the liquid crystal elements are turned to be an off state which performs black display. At that time, the liquid crystal molecules are aligned vertically. As a result, light from the backlight can not pass through the substrate and black display is performed.

Note that by employing the MVA mode or the PVA mode for a liquid crystal display device of the present invention, and forming one pixel with a plurality of sub-pixels, the viewing angle characteristics for a viewer can be improved. In the present invention, a display mode which performs display by aligning the liquid crystal molecules in a gradient manner or a radial gradient manner in sub-pixels included in one pixel can be employed. For example, a ferroelectric liquid crystal or an antiferroelectric liquid crystal can be employed. In addition, as a driving mode of liquid crystal, without limitation to the MVA mode or the PVA mode, a TN (twisted nematic) mode, an IPS (in-plane-switching) mode, an FFS (fringe field switching) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used. In addition, the present invention is not limited to liquid crystal elements and a light-emitting element (including organic EL or inorganic EL) can also be used.

Figure 59A:
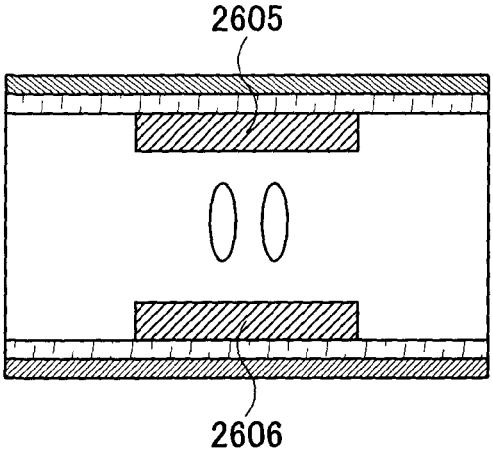
FIGS. 59A to 59D are diagrams for describing specific examples of the present invention.
Figure 59B:
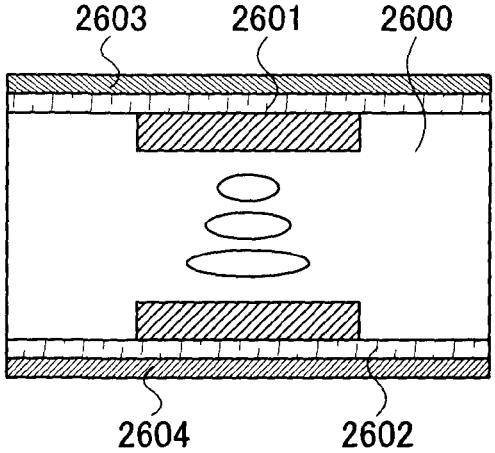

As an example, FIGS. 59A and 59B show schematic views of a liquid crystal display device of a TN mode.

The layer 2600 including a display element is interposed between the first substrate 2601 and the second substrate 2602 which are provided so as to face each other. The layer 2603 including the first polarizer is stacked on the first substrate 2601 side, and the layer 2604 including the second polarizer is provided for the second substrate 2602 side. Note that the layer 2603 including the first polarizer and the layer 2604 including the second polarizer are provided so as to be in crossed Nicols.

Although not shown, a backlight or the like is provided outside a layer including a second polarizer. A first electrode 2605 is provided on the first substrate 2601, and a second electrode 2606 is provided over the second substrate 2602.

The first electrode 2605, which is an electrode on the opposite side to the backlight, that is, on the viewing side, is formed so as to have at least a light-transmitting property.

In the case where a liquid crystal display device having such a structure is in a normally white mode, when a voltage is applied to the first electrode 2605 and the second electrode 2606 (referred to as a vertical electric field method), black display is performed as shown in FIG. 59A. At that time, liquid crystal molecules are aligned vertically. Thus, light from the backlight cannot pass through the substrate, which leads to black display.

As shown in FIG. 59B, when a voltage is not applied between the first electrode 2605 and the second electrode 2606, white display is performed. At that time, liquid crystal molecules are aligned horizontally while rotated on a plane surface. As a result, light from the backlight can pass through a pair of the layers (the layer 2603 including the first polarizer and the layer 2604 including the second polarizer), which is provided so as to be in a cross nicol state, including polarizers, so that predetermined image display is performed.

By providing a color filter at that time in a reflective region, full-color display can be performed. The color filter can be provided on either the first substrate 2601 side or the second substrate 2602 side.

A known material may be used for a liquid crystal material of the TN mode.

Figure 59C:
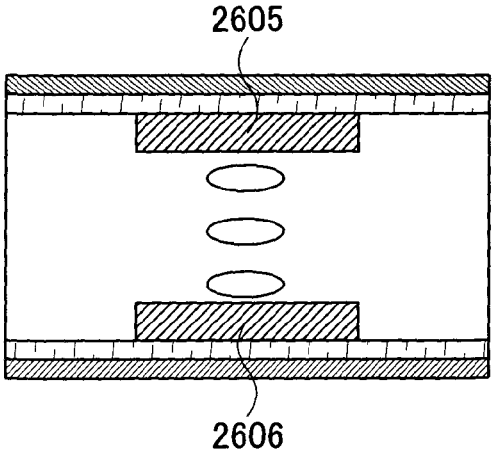

FIG. 59C shows a schematic view of a liquid crystal display device of a VA mode. The VA mode is a mode in which liquid crystal molecules are aligned perpendicularly to a substrate when no electric field is applied.

Similarly to FIGS. 59A and 59B, over the first substrate 2601 and the second substrate 2602, the first electrode 2605 and the second electrode 2606 are provided, respectively. Further, the first electrode 2605 on the opposite side to the backlight, that is, on the viewing side, is formed so as to have at least a light-transmitting property. Then, the layer 2603 including the first polarizer is stacked on the first substrate 2601 side and the layer 2604 including the second polarizer is provided on the second substrate 2602 side. Note that the layer 2603 including the first polarizer and the layer 2604 including the second polarizer are provided in crossed Nicols.

When a voltage is applied to the first electrode 2605 and the second electrode 2606 (vertical electric field method) in a liquid crystal display device having such a structure, white display is performed, which means an on state, as shown in FIG. 59C. At that time, liquid crystal molecules are aligned horizontally. Thus, light from the backlight can pass through a pair of the layers (the layer 2603 including the first polarizer and the layer 2604 including the second polarizer), which is provided so as to be in a cross nicol state, including polarizers, so that predetermined image display is performed. By providing a color filter at that time, full-color display can be performed. The color filter can be provided on either the first substrate 2601 side or the second substrate 2602 side.

Figure 59D:
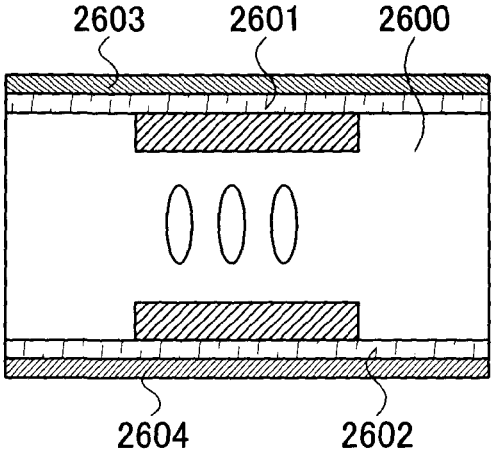

As shown in FIG. 59D, when no voltage is applied between the first electrode 2605 and the second electrode 2606, black display is performed, which means an off state. At that time, liquid crystal molecules are aligned vertically. Thus, light from the backlight cannot pass through a substrate, which leads to black display.

Thus, in an off state, liquid crystal molecules are perpendicular to the substrate, whereby black display is performed. Meanwhile, in an on state, liquid crystal molecules are parallel to the substrate, whereby white display is performed. In an off state, liquid crystal molecules rise; therefore, polarized light from the backlight passes through a cell without being affected by birefringence of the liquid crystal molecules and can be completely blocked by polarizer-including layers on the opposite substrate side.

Figure 61A:
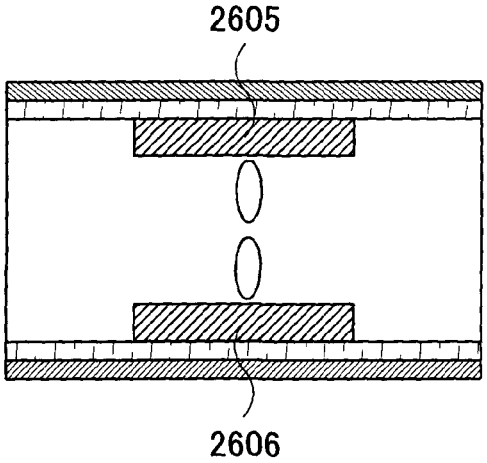
FIGS. 61A to 61D are diagrams for describing specific examples of the present invention.
Figure 61B:
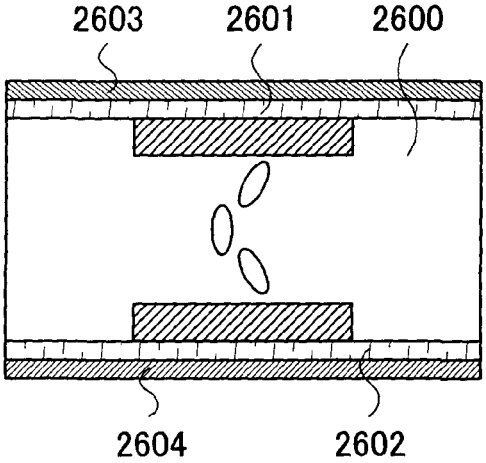

As an example, FIGS. 61A and 61B show schematic views of a liquid crystal display device of an OCB mode. In the OCB mode, alignment of liquid crystal molecules form an optical compensated state in a liquid crystal layer. This alignment is referred to as a bend alignment.

Similarly to FIGS. 59A and 59B, over the first substrate 2601 and the second substrate 2602, the first electrode 2605 and the second electrode 2606 are provided, respectively. Although not shown, a backlight and the like are provided outside the layer 2604 including the second polarizer. Further, the first electrode 2605 on the opposite side to the backlight, that is, on the viewing side, is formed so as to have at least a light-transmitting property. Then, the layer 2603 including the first polarizer is stacked on the first substrate 2601 side and the layer 2604 including the second polarizer is provided on the second substrate 2602 side. Note that the layer 2603 including the first polarizer and the layer 2604 including the second polarizer are provided in crossed Nicols.

In a liquid crystal display device having such a structure, when a certain on-voltage is applied to the first electrode 2605 and the second electrode 2606 (referred to as a vertical electric field method), black display is performed as shown in FIG. 61A. At that time, liquid crystal molecules are aligned vertically. Thus, light from the backlight cannot pass through the substrate, which leads to black display.

As shown in FIG. 61B, when a certain off-voltage is applied between the first electrode 2605 and the second electrode 2606, white display is performed. At that time, liquid crystal molecules are aligned in a bend alignment. As a result, light from the backlight can pass through a pair of the layers including polarizers (the layer 2603 including the first polarizer and the layer 2604 including the second polarizer), which is provided so as to be in a cross nicol state, so that predetermined image display is performed. By providing a color filter at that time, full-color display can be performed. The color filter can be provided on either the first substrate 2601 side or the second substrate 2602 side.

In the OCB mode, since alignment of the liquid crystal molecules can be optically compensated in a liquid crystal layer, viewing angle dependency is low. In addition, a contrast ratio can be increased by a pair of stacked layers including polarizers.

Figure 61C:
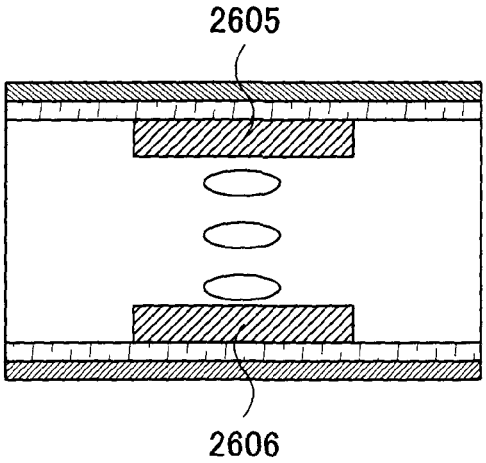
Figure 61D:
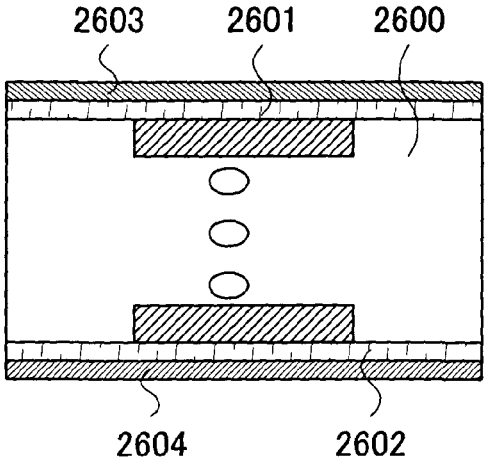

FIGS. 61C and 61D show schematic views of a liquid crystal display device of an FLC mode and an AFL mode.

Similarly to FIGS. 59A and 59B, over the first substrate 2601 and the second substrate 2602, the first electrode 2605 and the second electrode 2606 are provided, respectively. Further, the first electrode 2605 on the opposite side to the backlight, that is, on the viewing side, is formed so as to have at least a light-transmitting property. Then, the layer 2603 including the first polarizer is stacked on the first substrate 2601 side and the layer 2604 including the second polarizer is provided for the second substrate 2602 side. Note that the layer 2603 including the first polarizer and the layer 2604 including the second polarizer are provided in crossed Nicols.

In a liquid crystal display device having such a structure, when a voltage is applied to the first electrode 2605 and the second electrode 2606 (referred to as a vertical electric field method), white display is performed as shown in FIG. 61C. At that time, liquid crystal molecules are aligned horizontally in a direction deviated from a rubbing direction. As a result, light from the backlight can pass through a pair of the layers including polarizers (the layer 2603 including the first polarizer and the layer 2604 including the second polarizer) which is provided so as to be in a cross nicol state, so that predetermined image display is performed.

As shown in FIG. 61D, when a voltage is not applied between the first electrode 2605 and the second electrode 2606, black display is performed. At that time, liquid crystal molecules are aligned horizontally along the rubbing direction. Thus, light from the backlight cannot pass through a substrate, which leads to black display.

By providing a color filter at that time, full-color display can be performed. The color filter can be provided on either the first substrate 2601 side or the second substrate 2602 side.

A known material may be used for a liquid crystal material of the FLC mode and the AFLC mode.

Figure 62A:
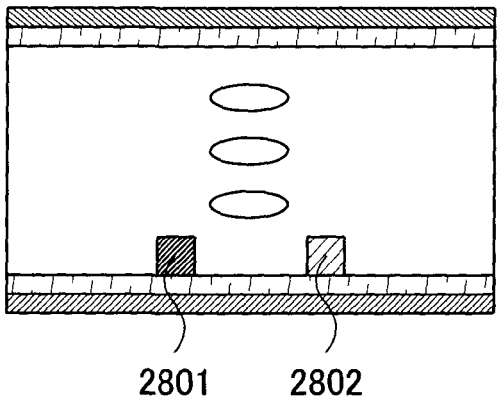
FIGS. 62A to 62D are diagrams for describing specific examples of the present invention.
Figure 62B:
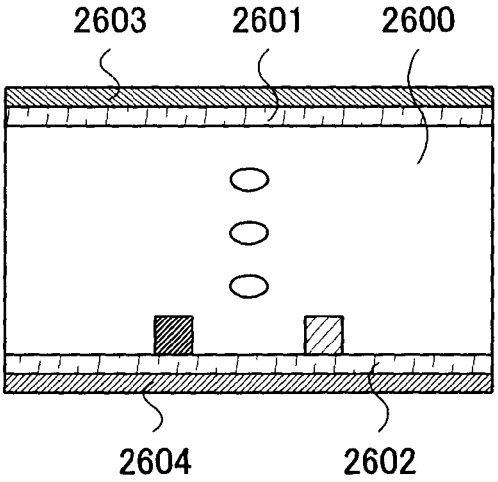

For example, FIGS. 62A and 62B show schematic views of a liquid crystal display device of an IPS mode. The IPS mode is a mode in which liquid crystal molecules are rotated always in a plane parallel to a substrate and a horizontal electric field mode in which electrodes are provided for only one substrate side is employed.

Liquid crystals are controlled by a pair of electrodes provided for one substrate in the IPS mode. Thus, a pair of electrodes 2801 and 2802 is provided over the second substrate 2602. The pair of the electrodes 2801 and 2802 may have a light-transmitting property. The layer 2603 including the first polarizer is stacked on the first substrate 2601 side, and the layer 2604 including the second polarizer is stacked on the second substrate 2602 side. Note that the layer 2603 including the first polarizer and the layer 2604 including the second polarizer are provided in crossed Nicols.

When a voltage is applied to the pair of the electrodes 2801 and 2802 in a liquid crystal display device having such a structure, the liquid crystal molecules are aligned along an electric line of force which is deviated from the rubbing direction and white display is performed, which means an on state, as shown in FIG. 62A. Then, light from the backlight can pass through a pair of the layers including polarizers (the layer 2603 including the first polarizer and the layer 2604 including the second polarizer) which is provided so as to be in crossed Nicols, so that predetermined image display is performed.

By providing a color filter at that time, full-color display can be performed. The color filter can be provided on either the first substrate 2601 side or the second substrate 2602 side.

As shown in FIG. 62B, when voltage is not applied between the pair of the electrodes 2801 and 2802, black display is performed, which means an off state. At that time, liquid crystal molecules are aligned horizontally along the rubbing direction. Thus, light from the backlight cannot pass through a substrate, which leads to black display.

Figure 63A:
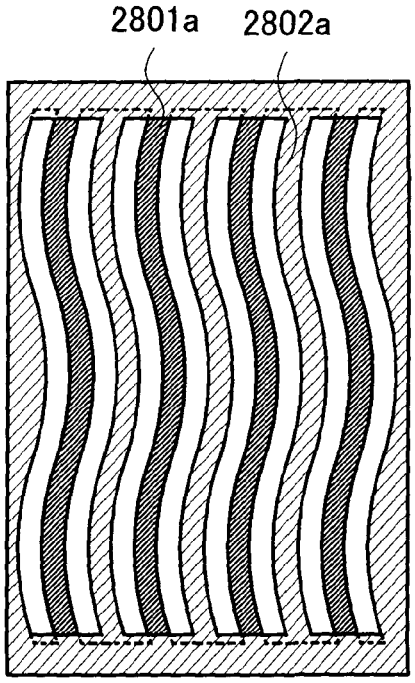
FIGS. 63A to 63D are diagrams for describing specific examples of the present invention.
Figure 63B:
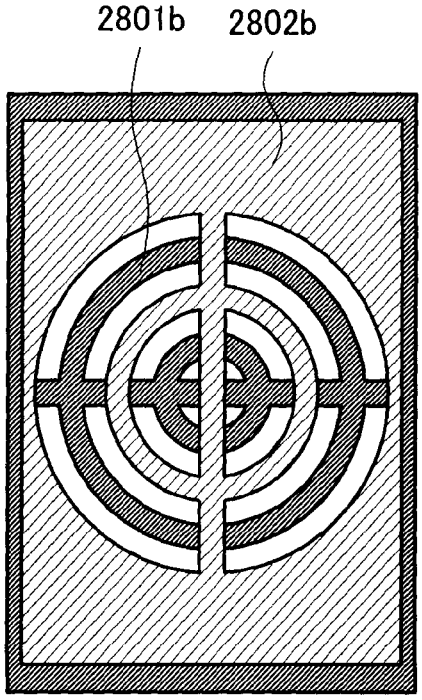
Figure 63C:
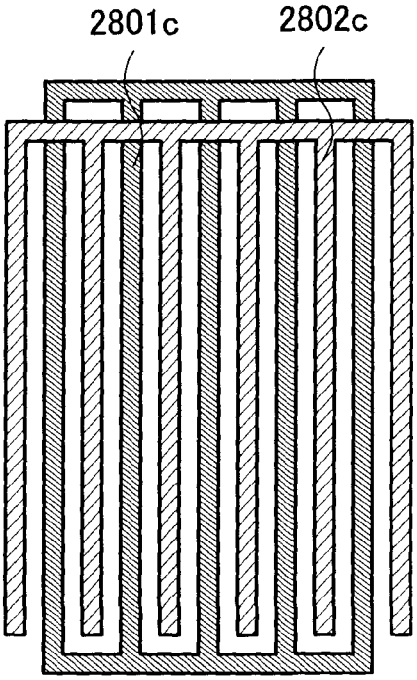
Figure 63D:
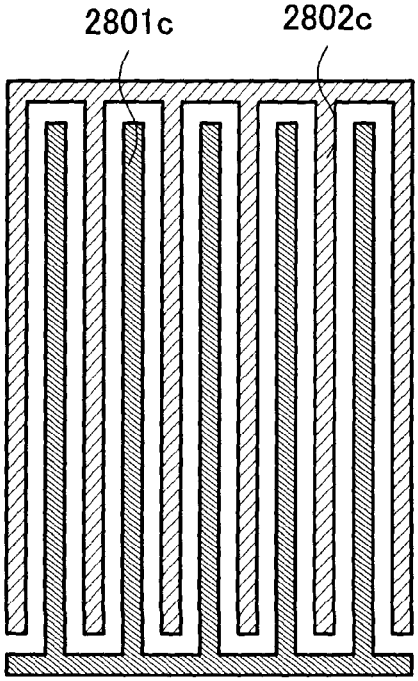

Examples of the pair of electrodes 2801 and 2802 which can be used in the IPS mode are shown in FIGS. 63A to 63D. As shown in top views in FIGS. 63A to 63D, the pair of the electrodes 2801 and 2802 is formed so as to alternate with each other. In FIG. 63A, electrodes 2801*a* and 2802*a* have a wavelike shape with curves, in FIG. 63B, electrodes 2801*b* and 2802*b* have a form having an opening portion of a concentric circle, in FIG. 63C, electrodes 2801*c* and 2802*c* have a comb shape and partly overlap with each other, and in FIG. 63D, electrodes 2801*d* and 2802*d* have a comb shape and are engaged with each other.

Figure 62C:
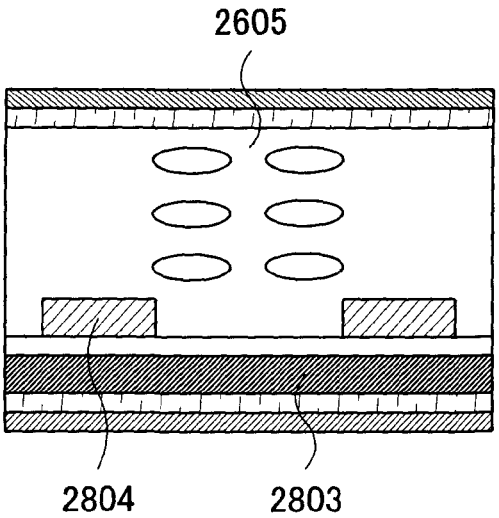
Figure 62D:
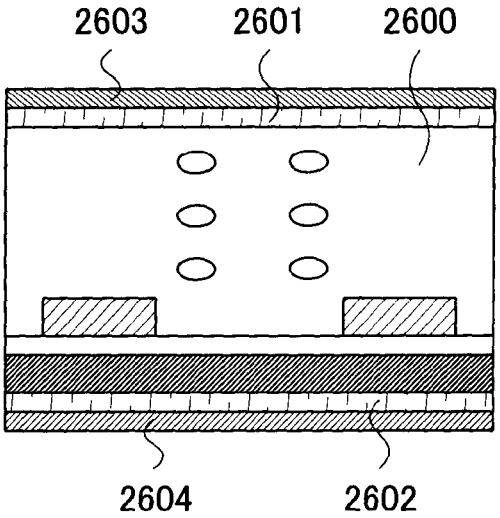

As an example, an FFS mode can also be used in addition to the IPS mode. As compared to the IPS mode in which the pair of electrodes is formed in the same surface, in the FFS mode, the pair of the electrodes is not formed over the same layer. As shown in FIGS. 62C and 62D, an electrode 2804 is formed over the electrode 2803 with an insulating film interposed therebetween in the FFS mode.

In a liquid crystal display device having such a structure, when a voltage is applied to a pair of electrodes 2803 and 2804, white display is performed which means an on state as shown in FIG. 62C. Thus, light from the backlight can pass through the pair of the layers including polarizers (the layer 2603 including the first polarizer and the layer 2604 including the second polarizer) which is provided so as to be in crossed Nicols, so that predetermined image display is performed.

By providing a color filter at that time, full-color display can be performed. The color filter can be provided on either the first substrate 2601 side or the second substrate 2602 side.

As shown in FIG. 62D, when a voltage is not applied between the pair of the electrodes 2803 and 2804, black display is performed which means an off state. At that time, liquid crystal molecules are aligned horizontally and rotated in a plane. As a result, light from the backlight cannot pass through a substrate, which leads to black display.

Figure 64A:
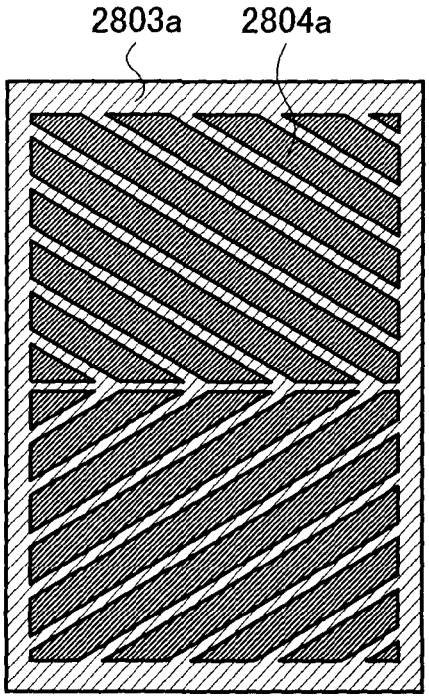
FIGS. 64A to 64D are diagrams for describing specific examples of the present invention.
Figure 64B:
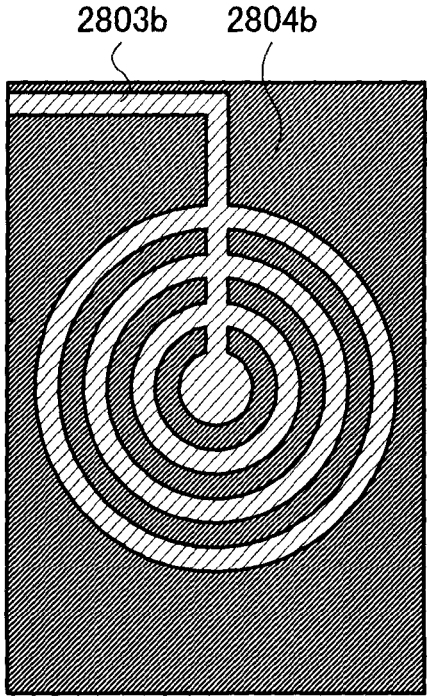
Figure 64C:
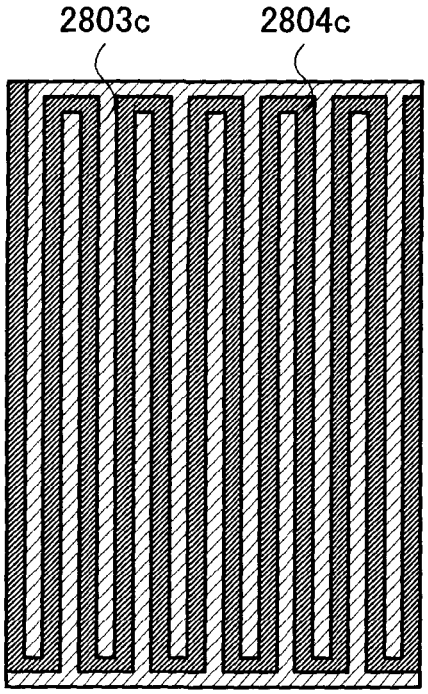
Figure 64D:
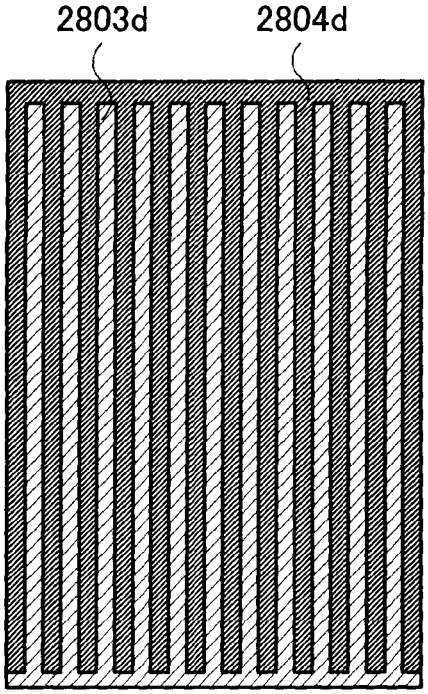

Examples of the pair of the electrodes 2803 and 2804 which can be used in the FFS mode are shown in FIGS. 64A to 64D. As shown in top views in FIGS. 64A to 64D, the electrode 2804 is formed in various shapes over the electrode 2803. In FIG. 64A, an electrode 2804*a* is formed in a V-like shape over the electrode 2803*a*, in FIG. 64B, the electrode 2804*b* is formed in a concentric circular shape over the electrode 2803*b*, in FIG. 64C, the electrode 2804*c* is formed in a comb shape over the electrode 2803*c* and electrodes 2803*c* and 2804*c* are engaged with each other, and in FIG. 64D, the electrode 2804*d* is formed in a comb shape over the electrode 2803*d*.

A known material may be used for a liquid crystal material of the IPS mode and the FFS mode.

Note that although this embodiment mode describes the content with reference to various diagrams, the content described in each diagram can be freely applied to, combined or replaced with the content (can be part of the content) described in a different diagram. Further, as for the diagrams described so far, each portion therein can be combined with another portion, so that more and more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 7

Figures 26A, 26B:
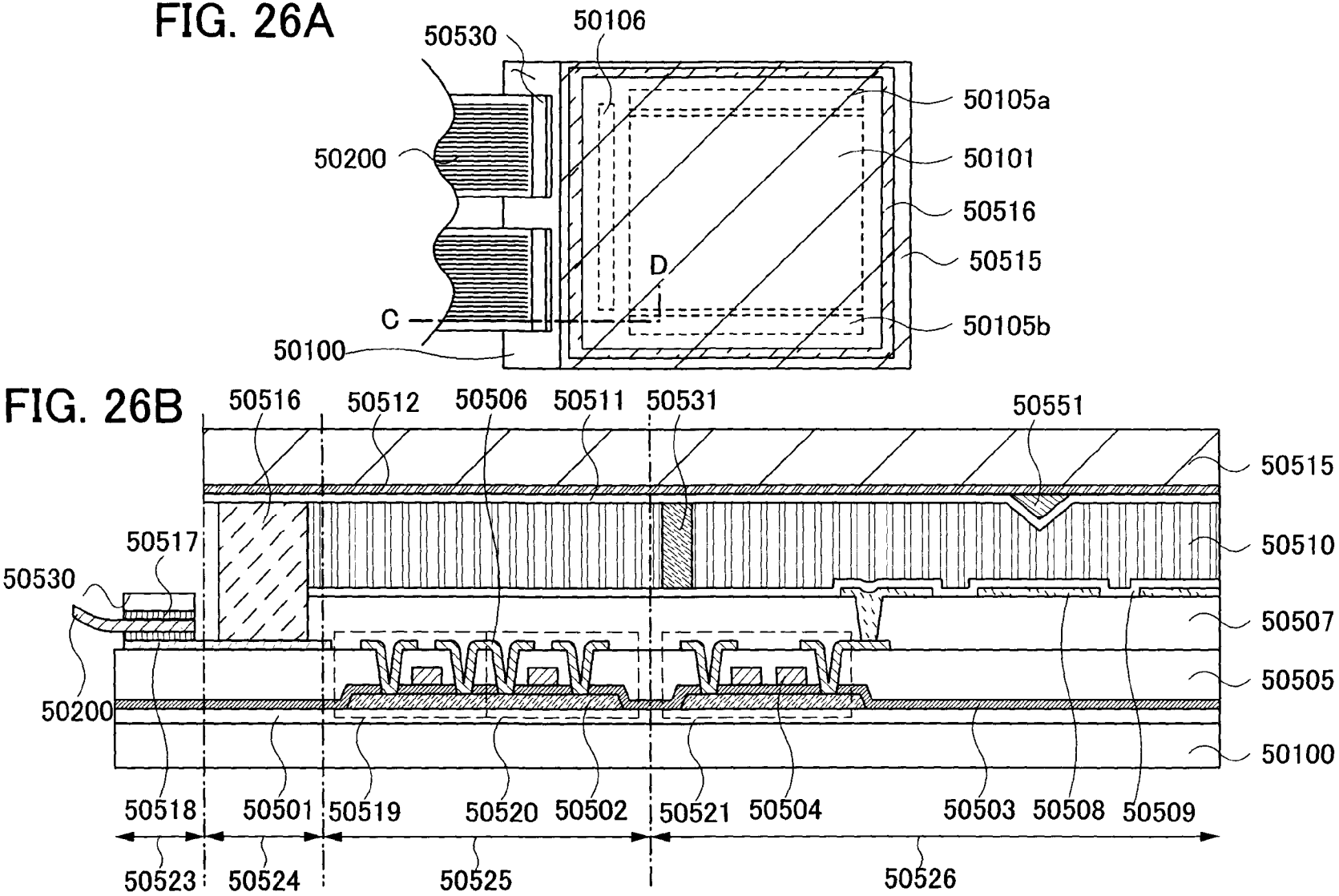
FIGS. 26A and 26B are diagrams for describing specific examples of the present invention.

In this embodiment mode, a structure of a liquid crystal panel included in a display portion of a liquid crystal display device of the present invention will be explained with reference to FIGS. 26A and 26B. Specifically, a structure of a liquid crystal panel including a TFT substrate, a counter substrate, and a liquid crystal layer interposed between the counter substrate and the TFT substrate will be explained. FIG. 26A is a top view of the liquid crystal panel. FIG. 26B is a cross-sectional view taken along a line C-D of FIG. 26A. It is to be noted that FIG. 26B is a cross-sectional view of a top-gate transistor in a case where a crystalline semiconductor film (polysilicon film) is formed as a semiconductor film over a substrate 50100 and a display mode is an MVA mode.

The liquid crystal panel shown in FIG. 26A includes, over the substrate 50100, a pixel portion 50101, a scanning line driver circuit 50105*a*, a scanning line driver circuit 50105*b*, and a signal line driver circuit 50106. The pixel portion 50101, the scanning line driver circuit 50105*a*, the scanning line driver circuit 50105*b*, and the signal line driver circuit 50106 are sealed between the substrate 50100 and a substrate 50515 with a sealant 50516. In addition, an FPC 50200 and an IC chip 50530 are provided over the substrate 50100 by a TAB method.

Circuits similar to those explained in Embodiment Mode 1 can be used as the scanning line driver circuit (gate driver) 50105*a*, the scanning line driver circuit 50105*b*, and the signal line driver circuit (source driver) 50106.

A cross-sectional structure taken along the line C-D of FIG. 26A will be explained with reference to FIG. 26B. Over the substrate 50100, the pixel portion 50101 and a peripheral driver circuit portion thereof (the scanning line driver circuit 50105*a*, the scanning line driver circuit 50105*b*, and the signal line driver circuit 50106) are formed. Here, a driver circuit region 50525 (the scanning line driver circuit 50105*b*) and a pixel region 50526 (the pixel portion 50101) are shown.

First, an insulating film 50501 is formed over the substrate 50100 as a base film. As the insulating film 50501, a single layer of an insulating film such as a silicon oxide film, a silicon nitride film, or a silicon oxynitride film ($SiO_xN_y$), or a stacked layer including at least two of these films is used. It is to be noted that a silicon oxide film is preferably used for a portion in contact with a semiconductor. Accordingly, an electron trap in the base film or hysteresis in transistor characteristics can be suppressed. Further, at least one film containing a large amount of nitrogen is preferably provided as the base film. By this film, impurities from glass can be reduced.

A semiconductor film 50502 is formed over the insulating film 50501 by a photolithography method, an inkjet method, a printing method, or the like.

Next, an insulating film 50503 is formed over the semiconductor film 50502 as a gate insulating film. As the insulating film 50503, a single layer structure or a stacked layer structure of a thermal oxide film, a silicon oxide film, a silicon nitride film, a silicon oxynitride film, or the like can be used. A silicon oxide film is preferably used for the insulating film 50503 which is in contact with the semiconductor film 50502. This is because a trap level at an interface between the gate insulating film and the semiconductor film 50502 can be lowered with use of a silicon oxide film. Further, when a gate electrode is formed using Mo, a silicon nitride film is preferably used for the gate insulating film which is in contact with the gate electrode. This is because Mo is not oxidized by a silicon nitride film. Here, as the insulating film 50503, a silicon oxynitride film (composition ratio: Si=32%, O=59%, N=7%, and H=2%) having a thickness of 115 nm is formed by a plasma CVD method.

Next, a conductive film 50504 is formed over the insulating film 50503 as a gate electrode by a photolithography method, an inkjet method, a printing method, or the like. As the conductive film 50504, Ti, Mo, Ta, Cr, W, Al, Nd, Cu, Ag, Au, Pt, Nb, Si, Zn, Fe, Ba, Ge, or the like, an alloy of these elements, or the like is used. Alternatively, a stacked layer of these elements or alloys thereof may be used. Here, the gate electrode is formed using Mo. Mo is preferable because it can be easily etched and is resistant to heat. It is to be noted that the semiconductor film 50502 is doped with an impurity element using the conductive film 50504 or a resist as a mask in order to form a channel formation region and impurity regions functioning as a source region and a drain region. It is to be noted that the impurity concentration in the impurity region may be controlled to form a high-concentration impurity region and a low-concentration impurity region. The conductive film 50504 in a transistor 50521 is formed to have a dual-gate structure. When the transistor 50521 has a dual-gate structure, off-current of the transistor 50521 can be reduced. The dual-gate structure has two gate electrodes. A plurality of gate electrodes may also be provided over a channel formation region in a transistor. Alternatively, the conductive film 50504 in the transistor 50521 may have a single gate structure. Further, a transistor 50519 and a transistor 50520 can be manufactured in the same process as the transistor 50521.

As an interlayer film, an insulating film 50505 is formed over the insulating film 50503 and the conductive film 50504 formed over the insulating film 50503. As the insulating film 50505, an organic material, an inorganic material, or a stacked layer structure thereof can be used. For example, the insulating film 50505 can be formed using a material such as silicon oxide, silicon nitride, silicon oxynitride, silicon nitride oxide, aluminum nitride, aluminum oxynitride, aluminum nitride oxide containing more nitrogen than oxygen, aluminum oxide, diamond like carbon (DLC), polysilazane, nitrogen-containing carbon (CN), PSG (phosphosilicate glass), BPSG (boro-phosphosilicate glass), alumina, or other substances containing an inorganic insulating material. Alternatively, an organic insulating material may also be used. The organic material may be either photosensitive or nonphotosensitive, and polyimide, acrylic, polyamide, polyimide amide, resist, benzocyclobutene, a siloxane resin, or the like can be used. It is to be noted that the siloxane resin corresponds to a resin including a Si—O—Si bond. Siloxane has a skeleton structure of a bond of silicon (Si) and oxygen (O). As for a substituent, an organic group containing at least hydrogen (such as an alkyl group or aromatic hydrocarbon) is used. As for a substituent, a fluoro group may be used. Further, as for a substituent, a fluoro group and an organic group containing at least hydrogen may be used. In addition, contact holes are selectively formed in the insulating film 50503 and the insulating film 50505. For example, a contact hole is formed on the upper surface of the impurity region of each transistor.

Next, over the insulating film 50505, conductive films 50506 are formed as a drain electrode, a source electrode, and a wiring by a photolithography method, an inkjet method, a printing method, or the like. As a material of the conductive film 50506, Ti, Mo, Ta, Cr, W, Al, Nd, Cu, Ag, Au, Pt, Nb, Si, Zn, Fe, Ba, Ge, or the like, an alloy of these elements, or the like is used. Alternatively, a stacked layer structure of these elements or alloys thereof may be used.

Further, in a portion where contact holes are formed in the insulating film 50503 and the insulating film 50505, the conductive film 50506 is connected to the impurity region of the semiconductor film 50502 of the transistor.

An insulating film 50507 is formed as a planarizing film over the insulating film 50505 and the conductive film 50506 formed over the insulating film 50505. The insulating film 50507 preferably has good planarity and coverage, and thus the insulating film 50507 is formed using an organic material in many cases. A multi-layer structure in which an organic material is formed over an inorganic material (such as silicon oxide, silicon nitride, or silicon oxynitride) may be used. In addition, a contact hole is selectively formed in the insulating film 50507. For example, a contact hole is formed on the upper surface of the drain electrode of the transistor 50521.

A conductive film 50508 is formed over the insulating film 50507 as a pixel electrode by a photolithography method, an inkjet method, a printing method, or the like. An opening portion is formed in the conductive film 50508. The opening portion formed in the conductive film 50508 can have the same function as the protrusion used in the MVA mode which has been described in Embodiment Mode 6 with reference to FIG. 25, because the opening portion allows liquid crystal molecules to be slanted. As the conductive film 50508, a transparent electrode which transmits light therethrough can be used. For example, an indium tin oxide (ITO) film in which tin oxide is mixed in indium oxide, an indium tin silicon oxide (ITSO) film in which silicon oxide is mixed in indium tin oxide (ITO), an indium zinc oxide (IZO) film in which zinc oxide is mixed in indium oxide, a zinc oxide film, a tin oxide film, or the like can be used. It is to be noted that IZO is a transparent conductive material formed by a sputtering method using a material in which 2 to 20 wt % zinc oxide (ZnO) is mixed in ITO, but is not limited thereto. Alternatively, in the case of using a reflective electrode, for example, Ti, Mo, Ta, Cr, W, Al, Nd, Cu, Ag, Au, Pt, Nb, Si, Zn, Fe, Ba, Ge, or the like, or an alloy of these elements, or the like can be used. Alternatively, a two-layer structure in which Ti, Mo, Ta, Cr, or W and Al are stacked or a three-layer structure in which Al is interposed between metals such as Ti, Mo, Ta, Cr, and W may also be used.

An insulating film 50509 is formed as an alignment film over the insulating film 50507 and the conductive film 50508 formed over the insulating film 50507.

The sealant 50516 is formed around the pixel portion 50101, or around the pixel portion 50101 and the peripheral driver circuit portion thereof by an inkjet method or the like.

Then, the substrate 50515 on which a conductive film 50512, an insulating film 50511, a protrusion 50551, and the like are formed and the substrate 50100 are attached to each other with a spacer 50531 interposed therebetween, and a liquid crystal layer 50510 is provided between the two substrates. It is to be noted that the substrate 50515 serves as a counter substrate. The spacer 50531 may be formed by a method in which particles of several μm are dispersed or by a method in which a resin film is formed over the entire surface of the substrate and etched. The conductive film 50512 serves as a counter electrode. As the conductive film 50512, materials similar to those of the conductive film 50508 can be used. In addition, the insulating film 50511 serves as an alignment film.

The FPC 50200 is provided over the conductive film 50518 electrically connected to the pixel portion 50101 and the peripheral driver circuit portion thereof through an anisotropic conductor layer 50517. In addition, the IC chip 50530 is provided over the FPC 50200 through the anisotropic conductor layer 50517. That is, the FPC 50200, the anisotropic conductive film 50517, and the IC chip 50530 are electrically connected to one another.

It is to be noted that the anisotropic conductive film 50517 has a function of transmitting a signal and a potential input from the FPC 50200 to the pixel or the peripheral circuit. As the anisotropic conductive film 50517, a material similar to that of the conductive film 50506, a material similar to that of the conductive film 50504, a material similar to that of the impurity region of the semiconductor film 50502, or a film including two or more of the above may be used.

When a functional circuit (such as memory or buffer) is formed in the IC chip 50530, an area of the substrate can be efficiently utilized.

Figure 35:
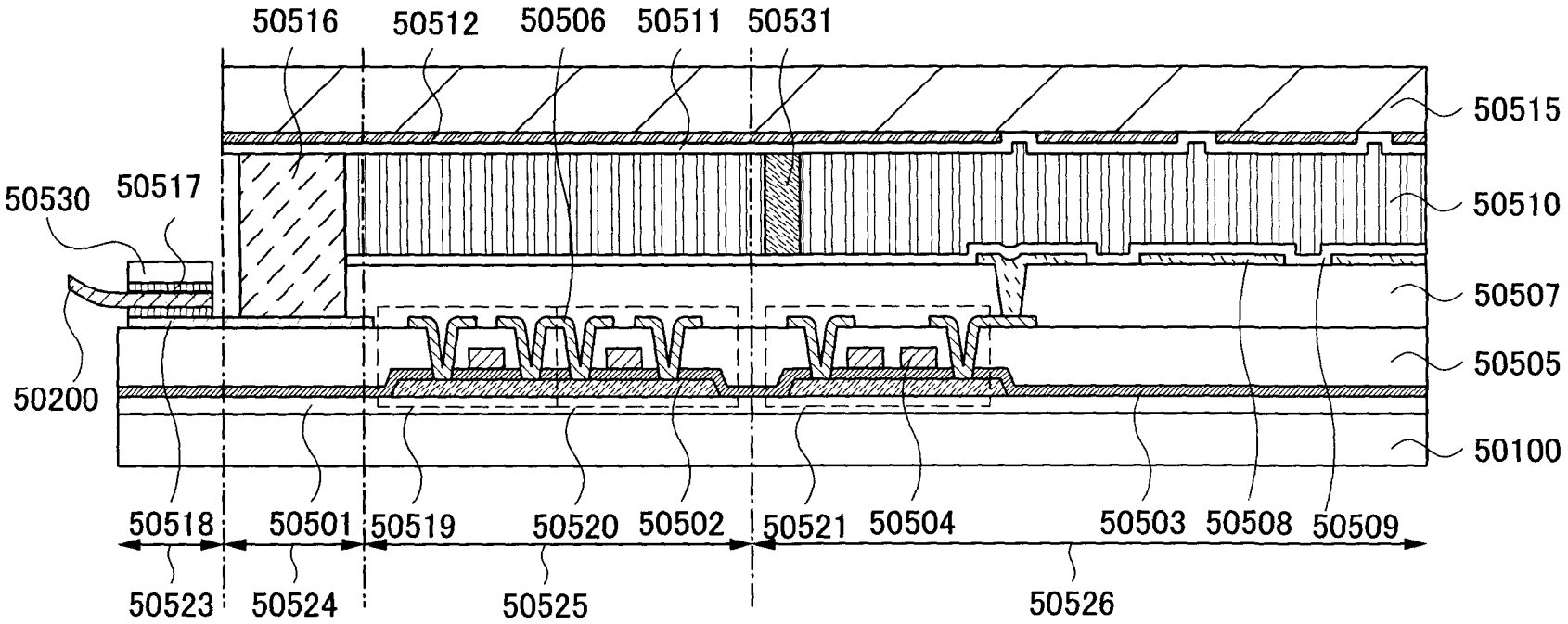
FIG. 35 is a diagram for describing a specific example of the present invention.
Figure 36:
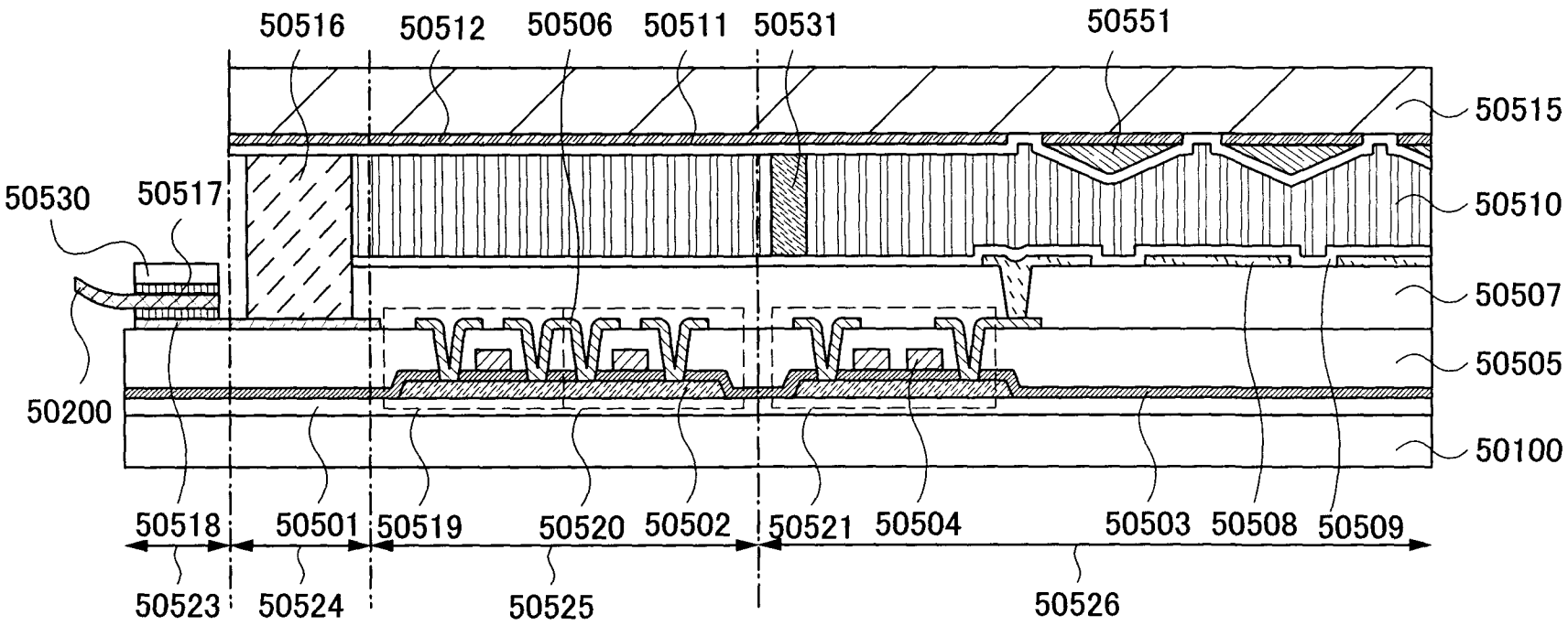
FIG. 36 is a diagram for describing a specific example of the present invention.

FIG. 26B shows the cross-sectional structure of the MVA display mode; however, display may be conducted with a PVA mode. In the case of using the PVA mode, a slit, as shown in Embodiment Mode 6 with reference to FIGS. 26A and 26B, may be provided for the conductive film 50512 formed over the substrate 50515, so that liquid molecules can be slanted to be aligned (FIG. 35). In FIG. 35, a structure is shown in which the slit is provided for the conductive film 50512. Further, a protrusion 50551 (also referred to an alignment control protrusion) is provided for a conductive film provided with a slit, so that liquid crystal molecules may be slanted to be aligned (FIG. 36).

Figure 27B:
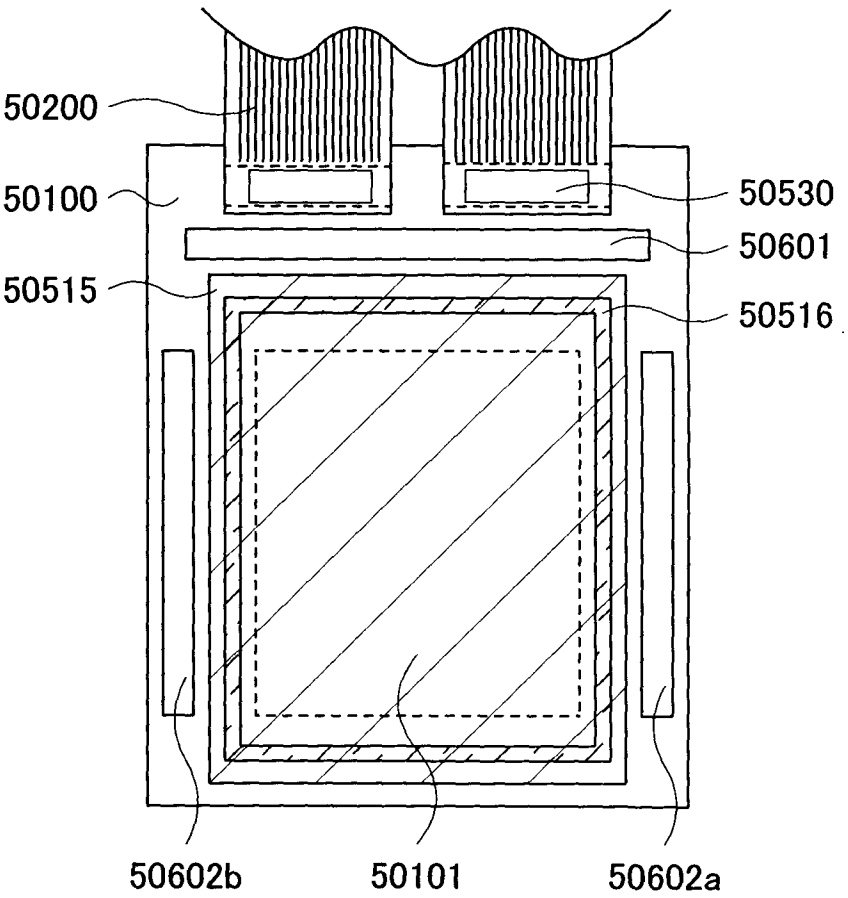
FIGS. 27A and 27B are diagrams for describing specific examples of the present invention.
Figure 27A:
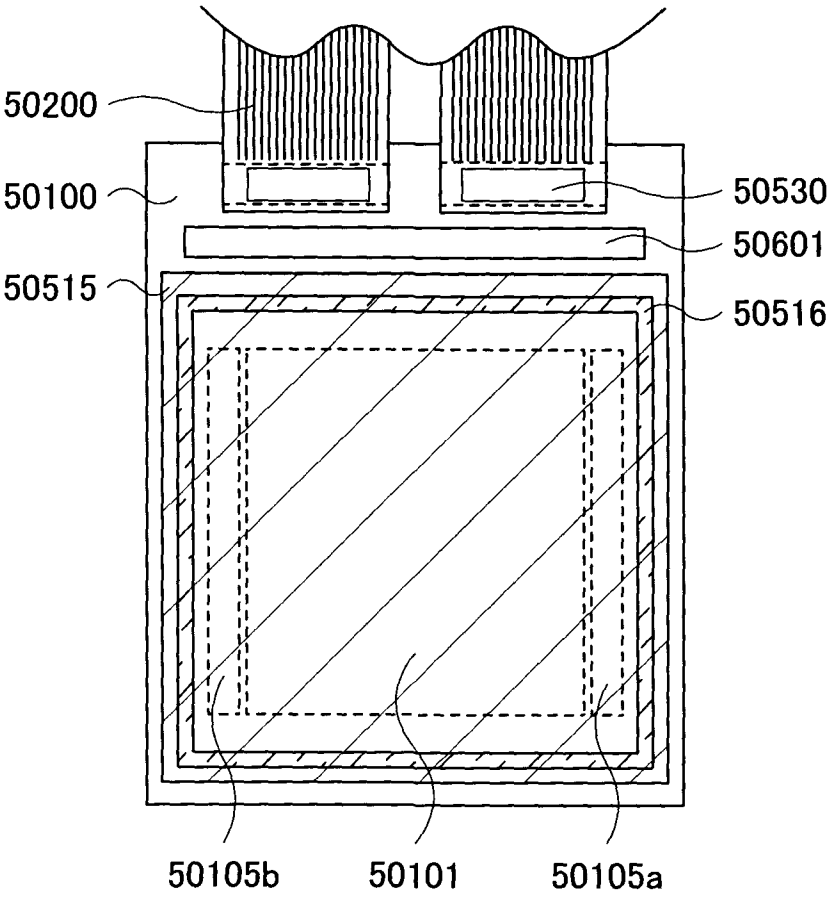

Although the scanning line driver circuit 50105*a*, the scanning line driver circuit 50105*b*, and the signal line driver circuit 50106 are formed over the substrate 50100 in the liquid crystal panel of FIGS. 26A and 26B, a driver circuit corresponding to the signal line driver circuit 50106 may be formed in a driver IC 50601 and mounted on a liquid crystal panel by a COG method as shown in the liquid crystal panel in FIG. 27A. When the signal line driver circuit 50106 is formed in the driver IC 50601, power savings can be achieved. In addition, when the driver IC 50601 is formed as a semiconductor chip such as a silicon wafer, a high speed operation and low power consumption of the liquid crystal panel in FIG. 27A can be achieved.

Similarly, as shown in a liquid crystal panel in FIG. 27B, driver circuits corresponding to the scanning line driver circuit 50105*a*, the scanning line driver circuit 50105*b*, and the signal line driver circuit 50106 may be formed in a driver IC 50602*a*, a driver IC 50602*b*, and a driver IC 50601, respectively, and mounted on the liquid crystal panel by a COG method. In addition, when the driver circuits corresponding to the scanning line driver circuit 50105*a*, the scanning line driver circuit 50105*b*, and the signal line driver circuit 50106 are formed in the driver IC 50602*a*, the driver IC 50602*b*, and the driver IC 50601, respectively, lower costs can be achieved.

Figure 28:
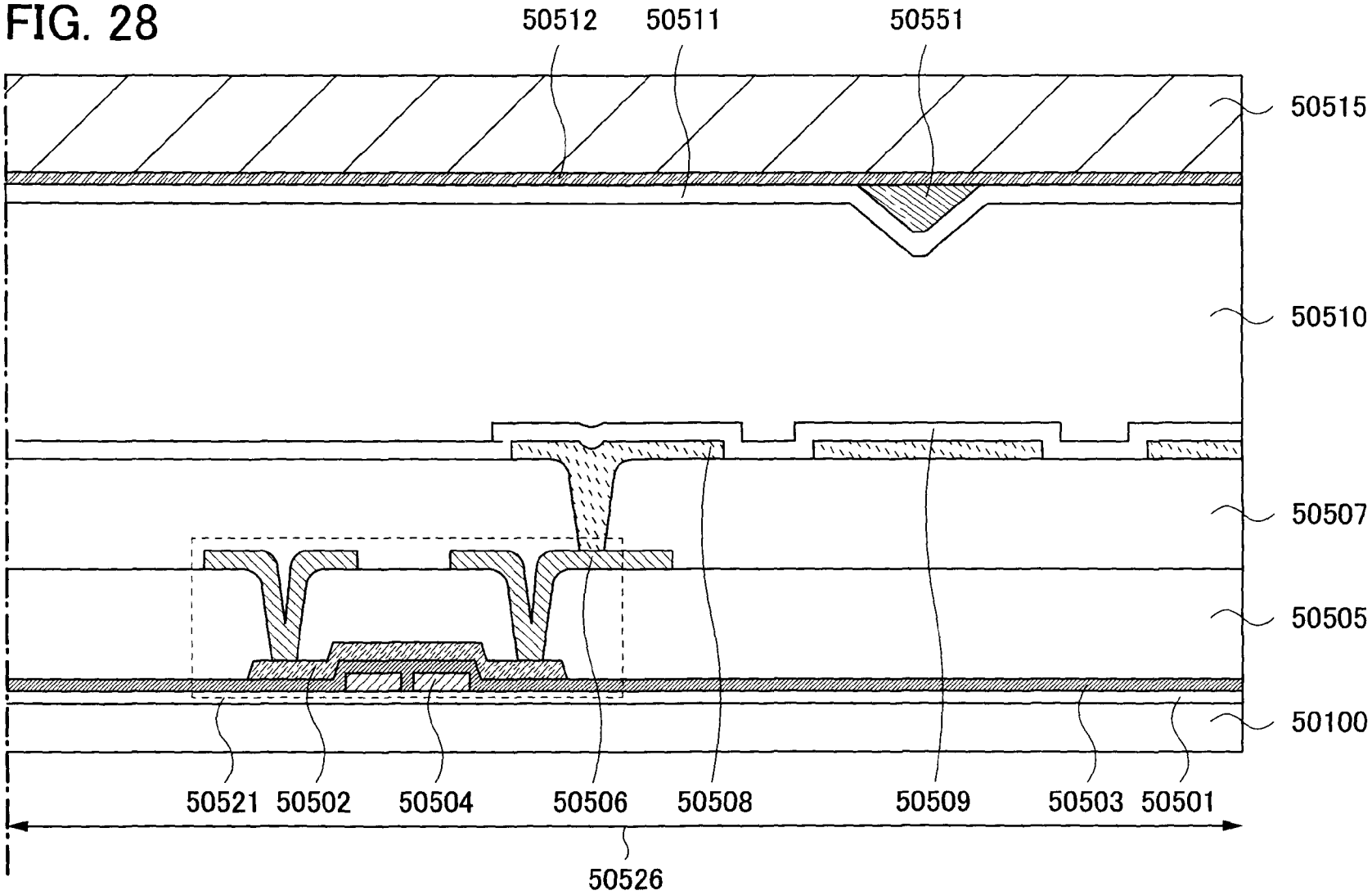
FIG. 28 is a diagram for describing a specific example of the present invention.

In FIGS. 26A and 26B, a cross-sectional view in a case where the top gate transistor is formed over the substrate 50100 is explained. Then, a cross-sectional view in a case where a bottom gate transistor is formed over the substrate 50100 and display is conducted with a MVA mode will be explained with reference to FIG. 28. It is to be noted that FIG. 28 shows only the pixel region 50526.

First, an insulating film 50501 is formed over the substrate 50100 as a base film.

Next, a conductive film 50504 is formed over the insulating film 50501 as a gate electrode by a photolithography method, an inkjet method, a printing method, or the like. The conductive film 50504 in a transistor 50521 has a dual-gate structure. This is because, as described above, when the transistor 50521 has a dual-gate structure, off-current of the transistor 50521 can be reduced. A plurality of gate electrodes may also be provided over a channel region in a transistor. Alternatively, the conductive film 50504 of the transistor 50521 may be formed to have a single gate structure.

An insulating film 50503 is formed as a gate insulating film over the insulating film 50501 and the conductive film 50504 formed over the insulating film 50501.

Over the insulating film 50503, a semiconductor film 50502 is formed by a photolithography method, an inkjet method, a printing method, or the like. It is to be noted that the semiconductor film 50502 is doped with an impurity element using a resist as a mask in order to form a channel formation region and impurity regions functioning as a source region and a drain region. It is to be noted that the impurity concentration in the impurity region may be controlled to form a high-concentration impurity region and a low-concentration impurity region.

As an interlayer film, an insulating film 50505 is formed over the insulating film 50503 and the semiconductor film 50502 formed over the insulating film 50503. It is to be noted that contact holes are selectively formed in the insulating film 50505. For example, a contact hole is formed on the upper surface of the impurity region of each transistor.

Next, over the insulating film 50505, conductive films 50506 are formed as a drain electrode, a source electrode, and a wiring by a photolithography method, an inkjet method, a printing method, or the like. Further, in a portion where a contact hole is formed in the insulating film 50505, the conductive film 50506 is connected to the impurity region of the semiconductor film 50502 of the transistor.

An insulating film 50507 is formed as a planarizing film over the insulating film 50505 and the conductive film 50506 formed over the insulating film 50505. It is to be noted that a contact hole is selectively formed in the insulating film 50507. For example, a contact hole is formed on the upper surface of the drain electrode of the transistor 50521.

A conductive film 50508 is formed over the insulating film 50507 as a pixel electrode by a photolithography method, an inkjet method, a printing method, or the like. An opening portion is formed in the conductive film 50508. The opening portion formed in the conductive film 50508 can have the same function as the protrusion used in the MVA mode which has been described in Embodiment Mode 6 with reference to FIGS. 25A and 25B, because the opening portion allows liquid crystal molecules to be slanted.

An insulating film 50509 is formed as an alignment film over the insulating film 50507 and the conductive film 50508 formed over the insulating film 50507.

Then, in a space between the substrate 50515 provided with a conductive film 50512, an insulating film 50511, a protrusion 50551, and the like and the substrate 50100, a liquid crystal layer 50510 is provided. In addition, the insulating film 50511 serves as an alignment film.

Figure 37:
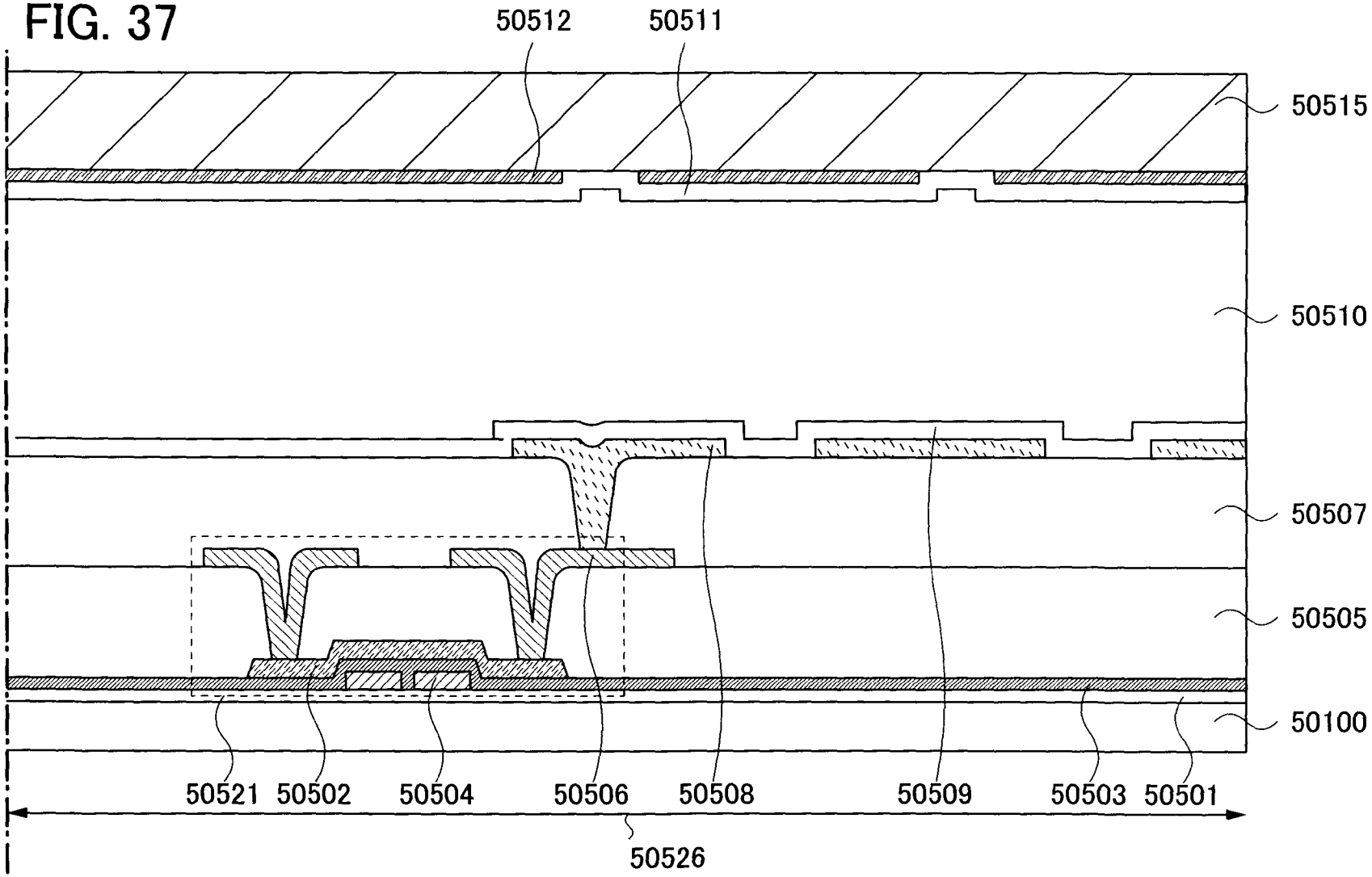
FIG. 37 is a diagram for describing a specific example of the present invention.

FIG. 28 shows a cross-sectional structure of the MVA display mode; however, display may be conducted with a PVA mode. FIG. 37 shows a cross-sectional structure of the PVA mode. The difference from that shown in FIG. 28 is that a slit is provided for the conductive film 50512, instead of the protrusion 50551. Due to the slit of the conductive film 50512, unevenness is generated on the surface of the insulating film 50511, and thus liquid crystal molecules can be slanted to be aligned, as in the MVA mode.

A cross-sectional view in which the insulating film 50507 is formed as a planarizing film over the insulating film 50505 and the conductive film 50506 formed over the insulating film 50505 is explained with reference to FIGS. 26A and 26B, and 28. However, as shown in FIG. 29, the insulating film 50507 is not always necessary.

Figure 29:
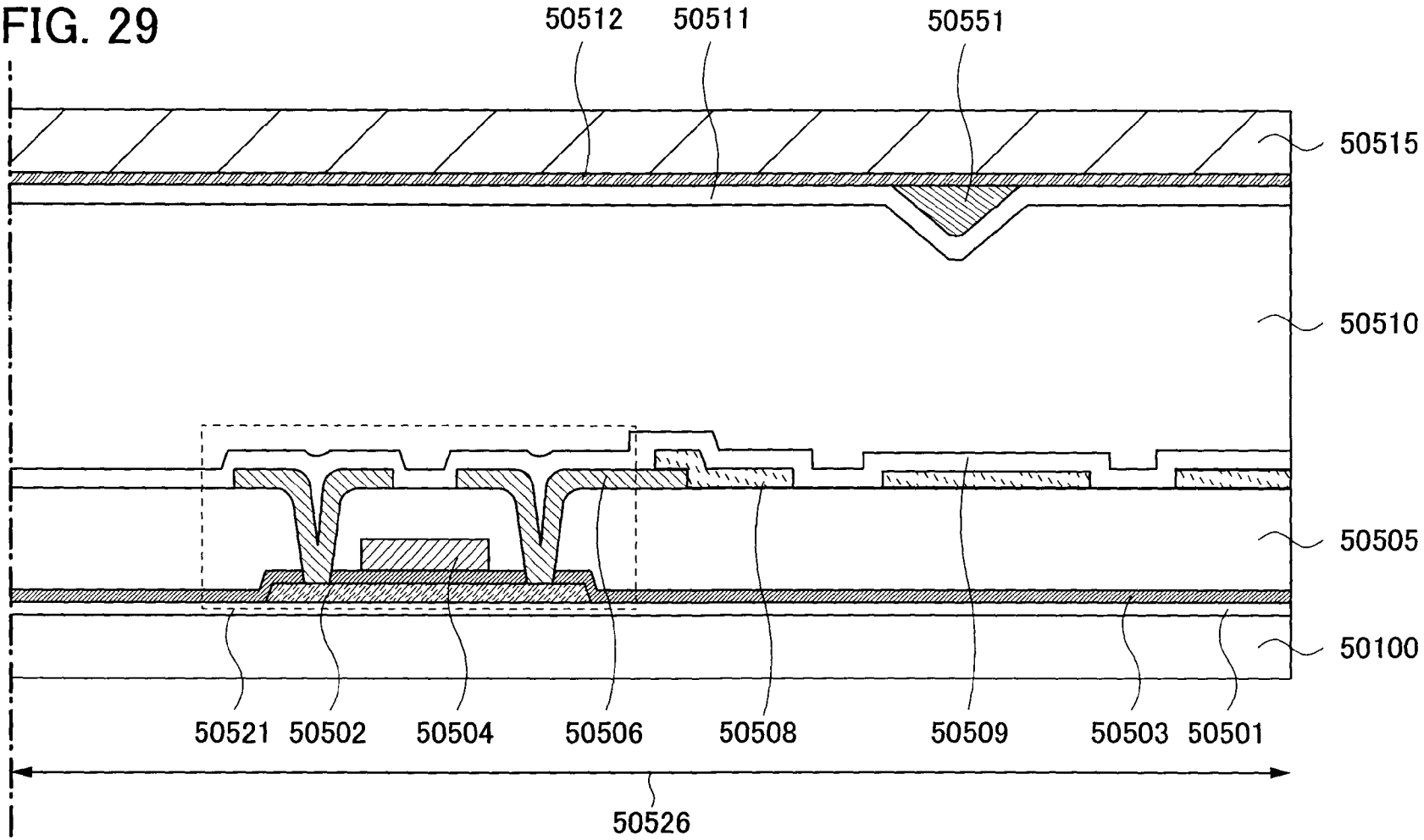
FIG. 29 is a diagram for describing a specific example of the present invention.

A cross-sectional view of FIG. 29 shows a top gate transistor, but a bottom gate transistor and a double gate transistor may also be used similarly.

Figure 38:
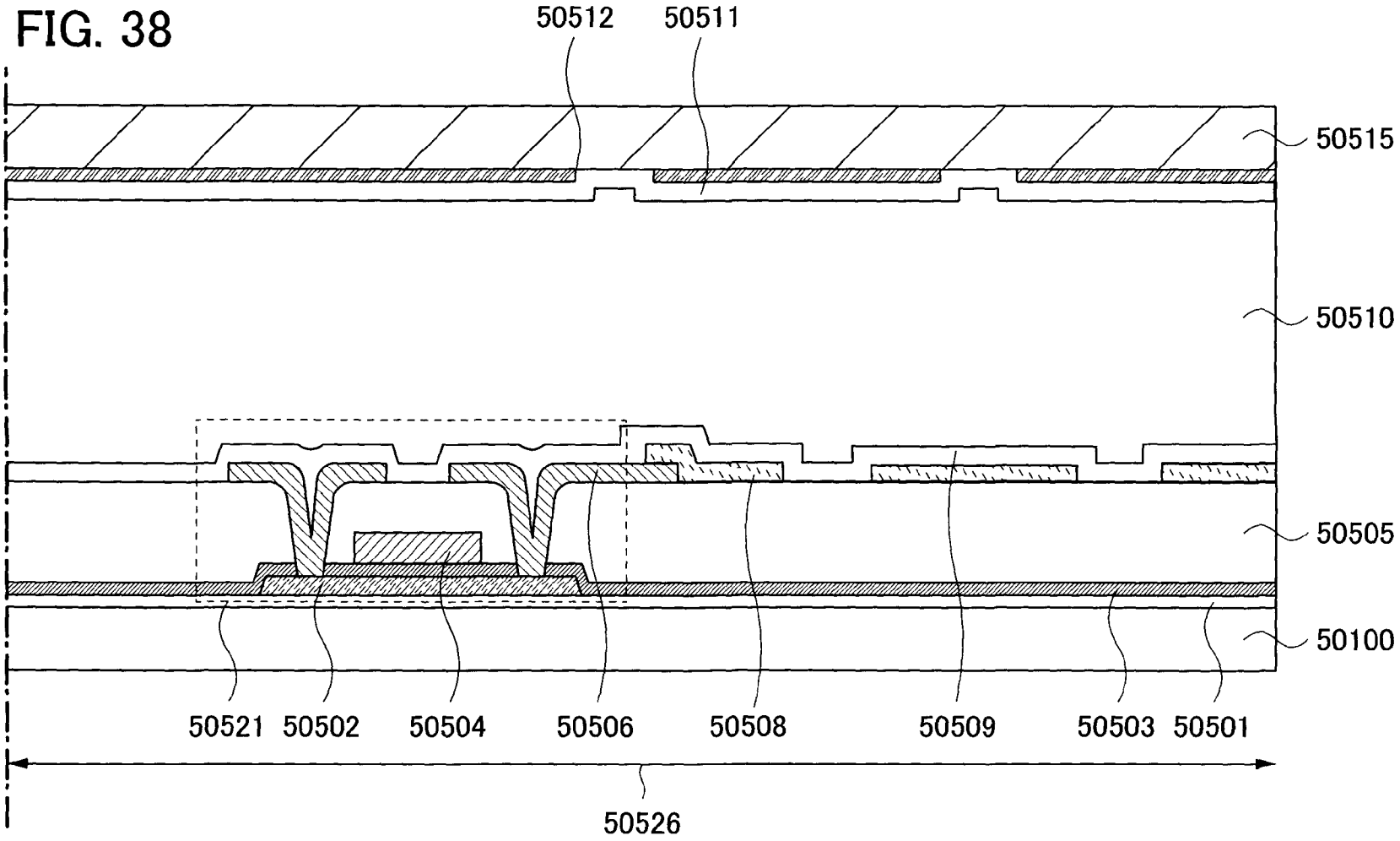
FIG. 38 is a diagram for describing a specific example of the present invention.

FIG. 29 shows the MVA display mode; however, display may be conducted with a PVA mode. FIG. 38 shows a cross-sectional structure of the PVA mode. The difference from that shown in FIG. 29 is that a slit is provided for the conductive film 50512, instead of the protrusion 50551. Due to the slit of the conductive film 50512, unevenness is generated on the surface of the insulating film 50511, and thus liquid crystal molecules can be slanted to be aligned, as in the MVA mode.

The cross-sectional views in which a transistor is formed using a crystalline semiconductor film (polysilicon film) as a semiconductor film over the substrate 50100 are shown in FIGS. 26A and 26B, 28, and 29. Next, a cross-sectional view in which a transistor is formed using an amorphous semiconductor film (amorphous silicon film) as a semiconductor film over the substrate 50100 will be explained with reference to FIG. 30.

Figure 30:
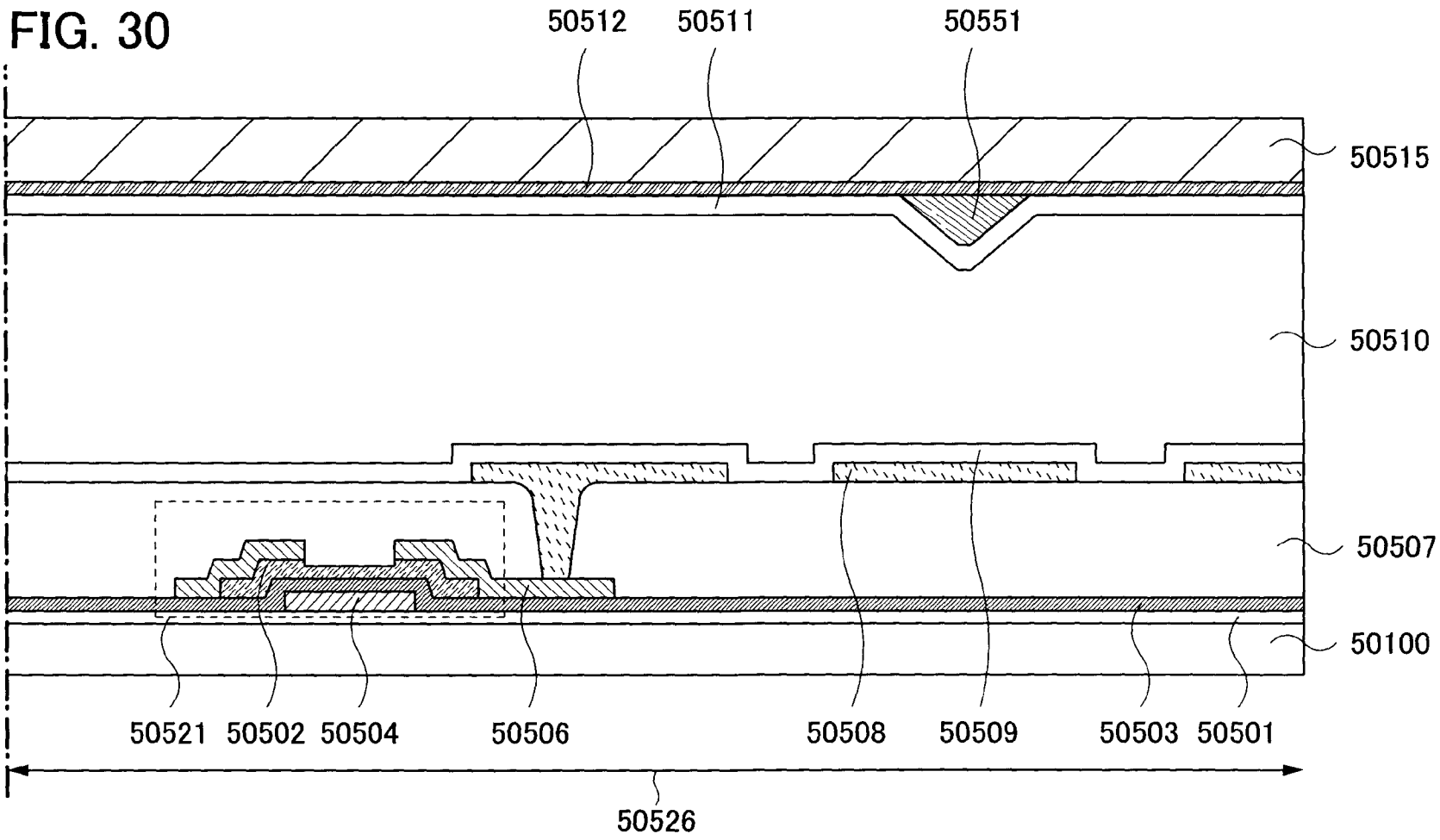
FIG. 30 is a diagram for describing a specific example of the present invention.

FIG. 30 is a cross-sectional view showing an inverse staggered channel-etched transistor.

First, an insulating film 50501 is formed over a substrate 50100 as a base film.

Next, a conductive film 50504 is formed over the insulating film 50501 as a gate electrode by a photolithography method, an inkjet method, a printing method, or the like.

An insulating film 50503 is formed as a gate insulating film over the insulating film 50501 and the conductive film 50504 formed over the insulating film 50501.

The semiconductor film 50502 is formed over the insulating film 50503 by a photolithography method, an inkjet method, a printing method, or the like. It is to be noted that the semiconductor film 50502 is doped with an impurity element in order to form an impurity region entirely in the semiconductor film 50502.

Next, a conductive film 50506 is formed over the insulating film 50503 and the semiconductor film 50502 formed over the insulating film 50503 by a photolithography method, an inkjet method, a printing method, or the like. The semiconductor film 50502 is etched using the conductive film 50506 as a mask to form a channel formation region and impurity regions functioning as a source region and a drain region.

An insulating film 50507 is formed as a planarizing film over the insulating film 50503, the semiconductor film 50502 formed over the insulating film 50503, and the conductive film 50506 formed over the insulating film 50503 and the semiconductor film 50502. In addition, a contact hole is selectively formed in the insulating film 50507. For example, a contact hole is formed on the upper surface of the drain electrode of the transistor 50521.

A conductive film 50508 is formed as a pixel electrode over the insulating film 50507 by a photolithography method, an inkjet method, a printing method, or the like. An opening portion is formed in the conductive film 50508. The opening portion formed in the conductive film 50508 can have the same function as the protrusion used in the MVA mode which has been described in Embodiment Mode 6 with reference to FIGS. 25A and 25B, because the opening portion allows liquid crystal molecules to be slanted.

An insulating film 50509 is formed as an alignment film over the insulating film 50507 and the conductive film 50508 formed over the insulating film 50507.

Then, in a space between a substrate 50515 provided with a conductive film 50512, an insulating film 50511, a protrusion 50551, and the like and the substrate 50100, a liquid crystal layer 50510 is provided. In addition, the insulating film 50511 serves as an alignment film.

The channel-etched transistor is described here, but a channel-protective transistor may also be used.

Figure 39:
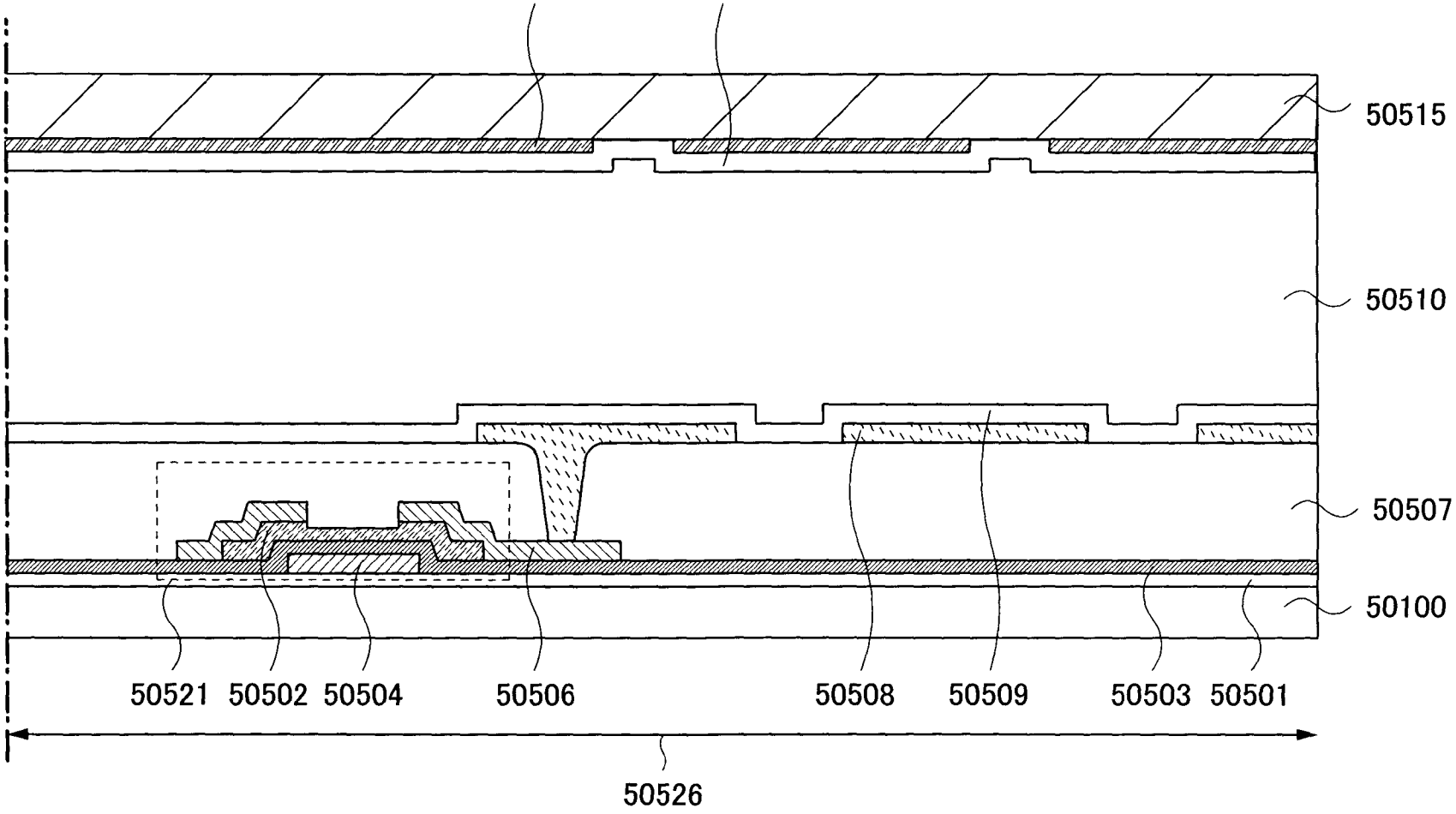
FIG. 39 is a diagram for describing a specific example of the present invention.

FIG. 30 shows a cross-sectional structure of the MVA display mode; however, display may be conducted with a PVA mode. FIG. 39 shows a cross-sectional structure of the PVA mode. The difference from that shown in FIG. 30 is that a slit is provided for the conductive film 50512, instead of the protrusion 50551. Due to the slit of the conductive film 50512, unevenness is generated on the surface of the insulating film 50511, and thus liquid crystal molecules can be slanted to be aligned, as in the MVA mode.

With reference to FIG. 30, the cross-sectional view in which an inverse staggered transistor is formed over the substrate 50100 is explained. Next, with reference to FIG. 31, a cross-sectional view in which a staggered transistor is formed over a substrate 50100 will be explained.

First, an insulating film 50501 is formed over the substrate 50100 as a base film.

Next, a conductive film 50506 is formed over the insulating film 50501 by a photolithography method, an inkjet method, a printing method, or the like.

Over the conductive film 50506, a semiconductor film 50502*a* is formed by a photolithography method, an inkjet method, a printing method, or the like. As the semiconductor film 50502*a*, a material and a structure similar to those of the semiconductor film 50502 can be used. In addition, the semiconductor film 50502*a* is doped with an impurity element in order to form impurity regions functioning as a source region and a drain region.

Over the insulating film 50501 and the semiconductor film 50502*a*, a semiconductor film 50502*b* is formed by a photolithography method, an inkjet method, a printing method, or the like. As the semiconductor film 50502*b*, a material and a structure similar to those of the semiconductor film 50502 can be used. In addition, the semiconductor film 50502*b* is not doped with an impurity element, and a channel formation region is formed in the semiconductor film 50502*b*.

An insulating film 50503 is formed as a gate insulating film over the insulating film 50501, the semiconductor film 50502*b*, and the conductive film 50506.

Next, a conductive film 50504 is formed over the insulating film 50503 as a gate electrode by a photolithography method, an inkjet method, a printing method, or the like.

As a planarizing film, an insulating film 50507 is formed over the insulating film 50503 and the conductive film 50504 formed over the insulating film 50503. It is to be noted that a contact hole may be selectively formed in the insulating film 50507. For example, a contact hole is formed on an upper surface of a drain electrode of a transistor 50521.

Next, over the insulating film 50507, a conductive film 50508 is formed as a pixel electrode by a photolithography method, an inkjet method, a printing method, or the like.

An insulating film 50509 is formed as an alignment film over the insulating film 50507 and the conductive film 50508 formed over the insulating film 50507. An opening portion is formed in the conductive film 50508. The opening portion formed in the conductive film 50508 can have the same function as the protrusion used in the MVA mode which has been described in Embodiment Mode 6 with reference to FIGS. 25A and 25B, because the opening portion allows liquid crystal molecules to be slanted.

Then, in a space between a substrate 50515 on which a conductive film 50512, an insulating film 50511, a protrusion 50551 and the like are formed and the substrate 50100, a liquid crystal layer 50510 is provided. In addition, the insulating film 50511 serves as an alignment film.

Figure 31:
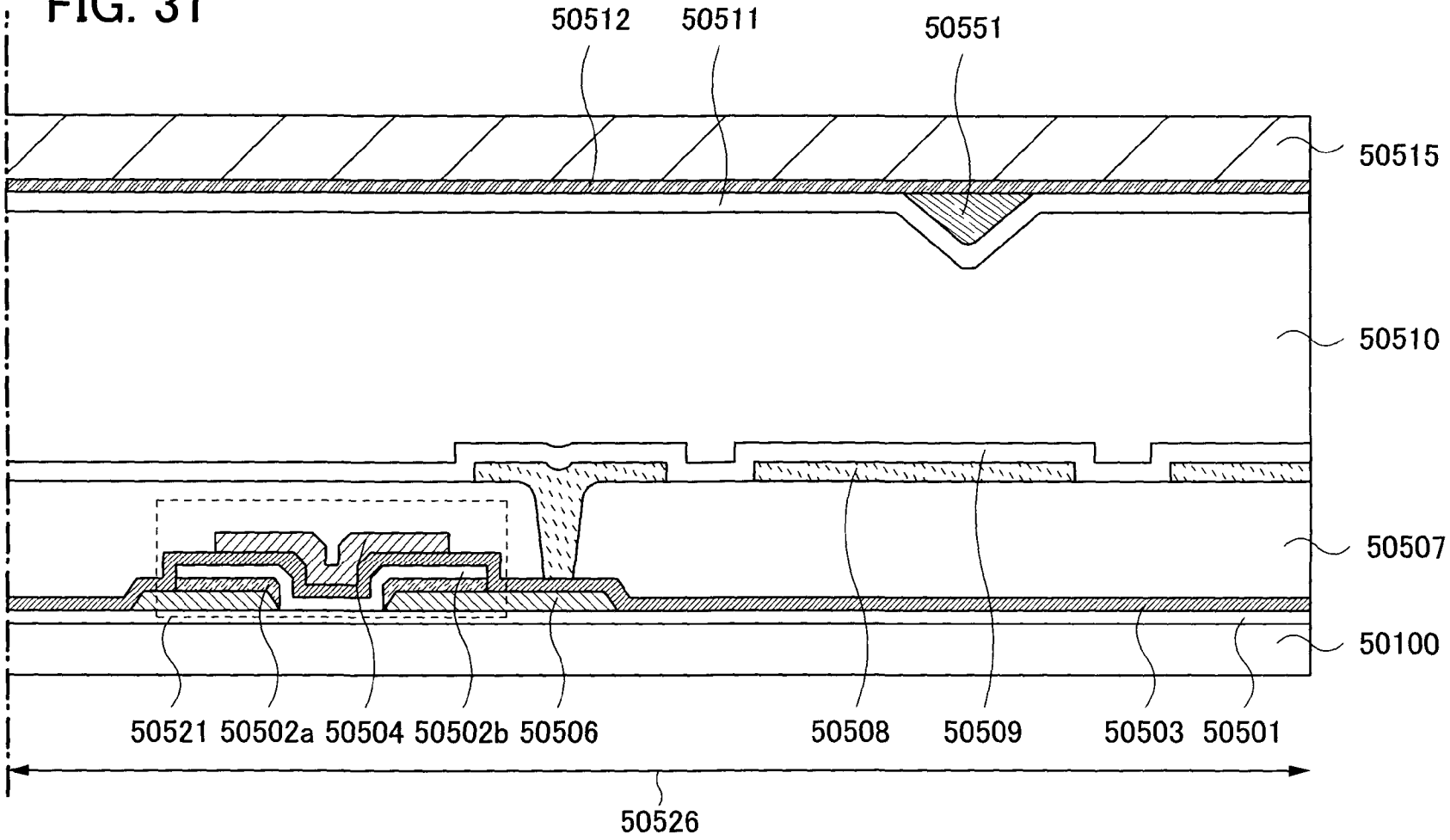
FIG. 31 is a diagram for describing a specific example of the present invention.
Figure 40:
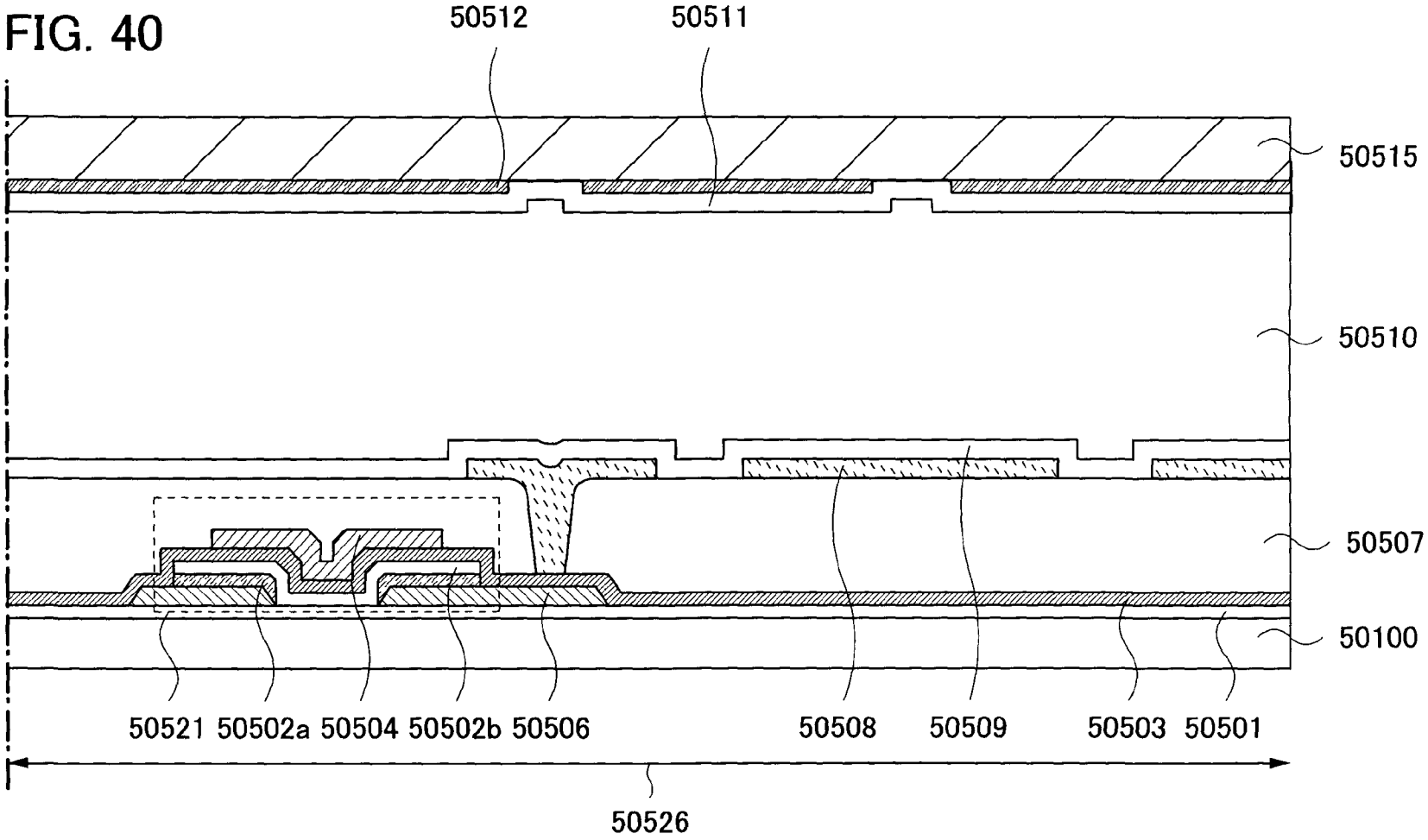
FIG. 40 is a diagram for describing a specific example of the present invention.

FIG. 31 shows a cross-sectional structure of the MVA display mode; however, display may be conducted with a PVA mode. FIG. 40 shows a cross-sectional structure of the PVA mode. The difference from that shown in FIG. 31 is that a slit is provided for the conductive film 50512, instead of the protrusion 50551. Due to the slit of the conductive film 50512, unevenness is generated on the surface of the insulating film 50511, and thus liquid crystal molecules can be slanted to be aligned, as in the MVA mode.

With reference to FIGS. 30 and 31, the cross-sectional view in which the insulating film 50507 is formed as a planarizing film over the insulating film 50505 and the conductive film 50506 formed over the insulating film 50505 is explained. However, as shown in FIG. 32, the insulating film 50507 is not always necessary.

Figure 32:
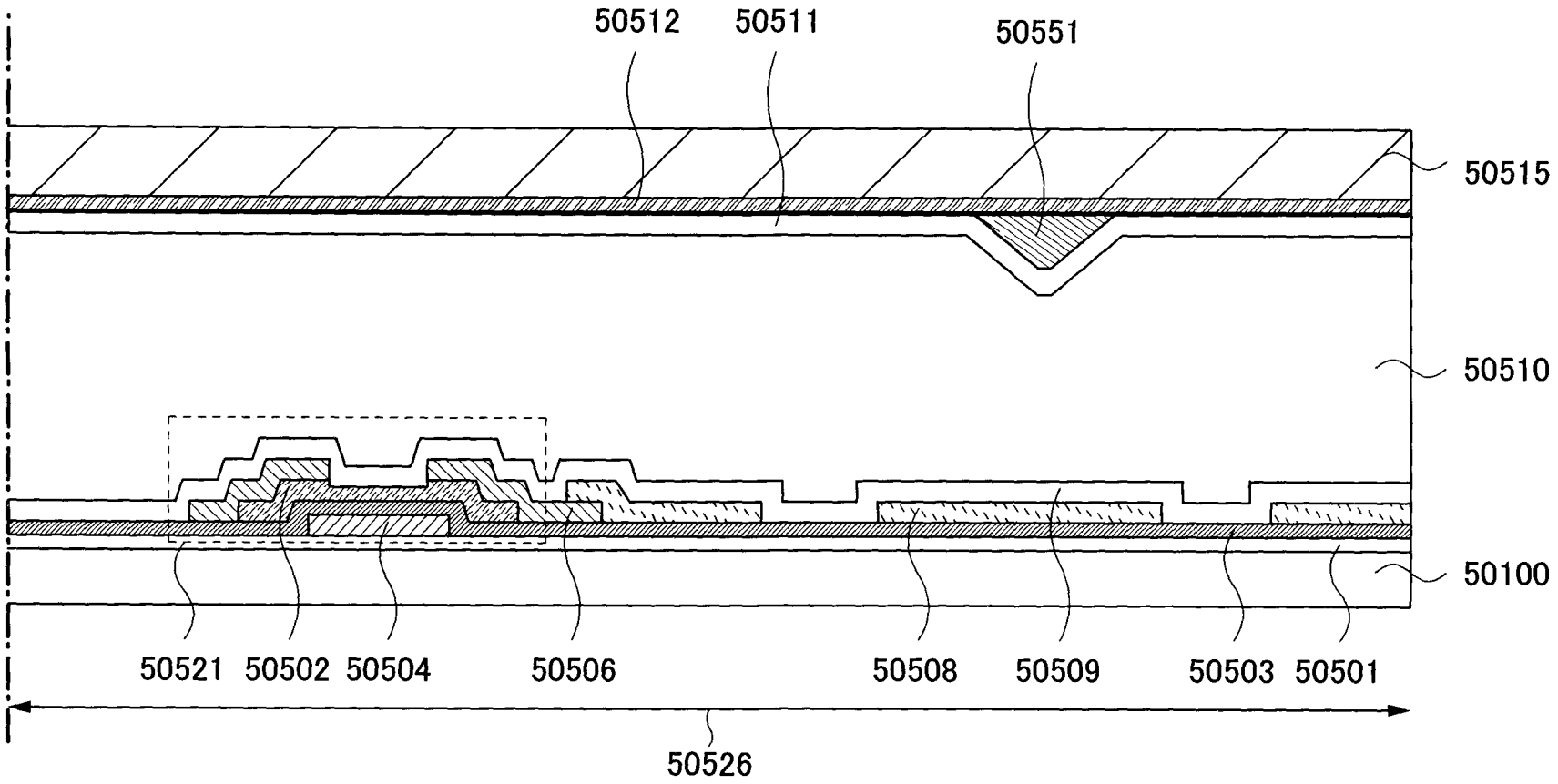
FIG. 32 is a diagram for describing a specific example of the present invention.

Although the inverse staggered channel-etched transistor is shown in a cross-sectional view of FIG. 32, an inverse staggered channel-protective transistor may also be used similarly.

Figure 41:
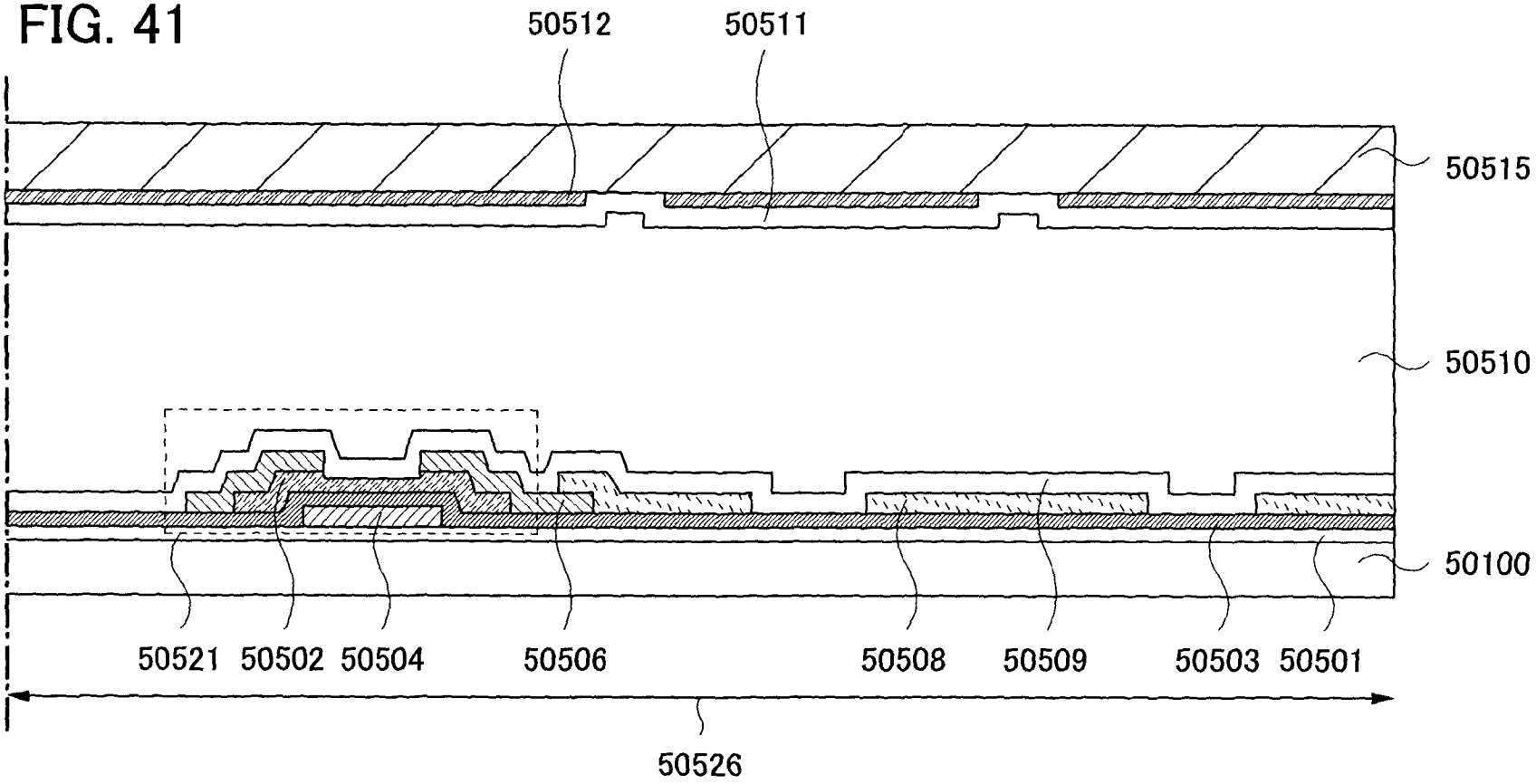
FIG. 41 is a diagram for describing a specific example of the present invention.

FIG. 32 shows a cross-sectional view of the MVA display mode; however, display may be conducted with a PVA mode. FIG. 41 shows a cross-sectional structure of the PVA mode. The difference from that shown in FIG. 32 is that a slit is provided for the conductive film 50512, instead of the protrusion 50551. Due to the slit provided for the conductive film 50512, unevenness is generated on the surface of the insulating film 50511, and thus liquid crystal molecules can be slanted to be aligned, as in the MVA mode.

Note that by employing the MVA mode or the PVA mode for a liquid crystal display device of the present invention, and forming one pixel with a plurality of sub-pixels, the viewing angle characteristics for a viewer can be improved. In the present invention, a display mode which performs display by aligning the liquid crystal molecules in a gradient manner or a radial gradient manner in sub-pixels included in one pixel can be employed. For example, a ferroelectric liquid crystal or an antiferroelectric liquid crystal can be employed. In addition, as a driving mode of liquid crystal, without limitation to the MVA mode or the PVA mode, a TN (twisted nematic) mode, an IPS (in-plane-switching) mode, an FFS (fringe field switching) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used. In addition, the present invention is not limited to liquid crystal elements and a light-emitting element (including organic EL or inorganic EL) can also be used.

In FIGS. 28 to 32, and FIGS. 37 to 41, cross-sectional views of reflective or transmissive liquid crystal panels are explained. However, the liquid crystal panel of this embodiment mode may also be a transflective type as described above. A cross-sectional view of a transflective liquid crystal panel will be explained with reference to FIG. 65.

Figure 65:
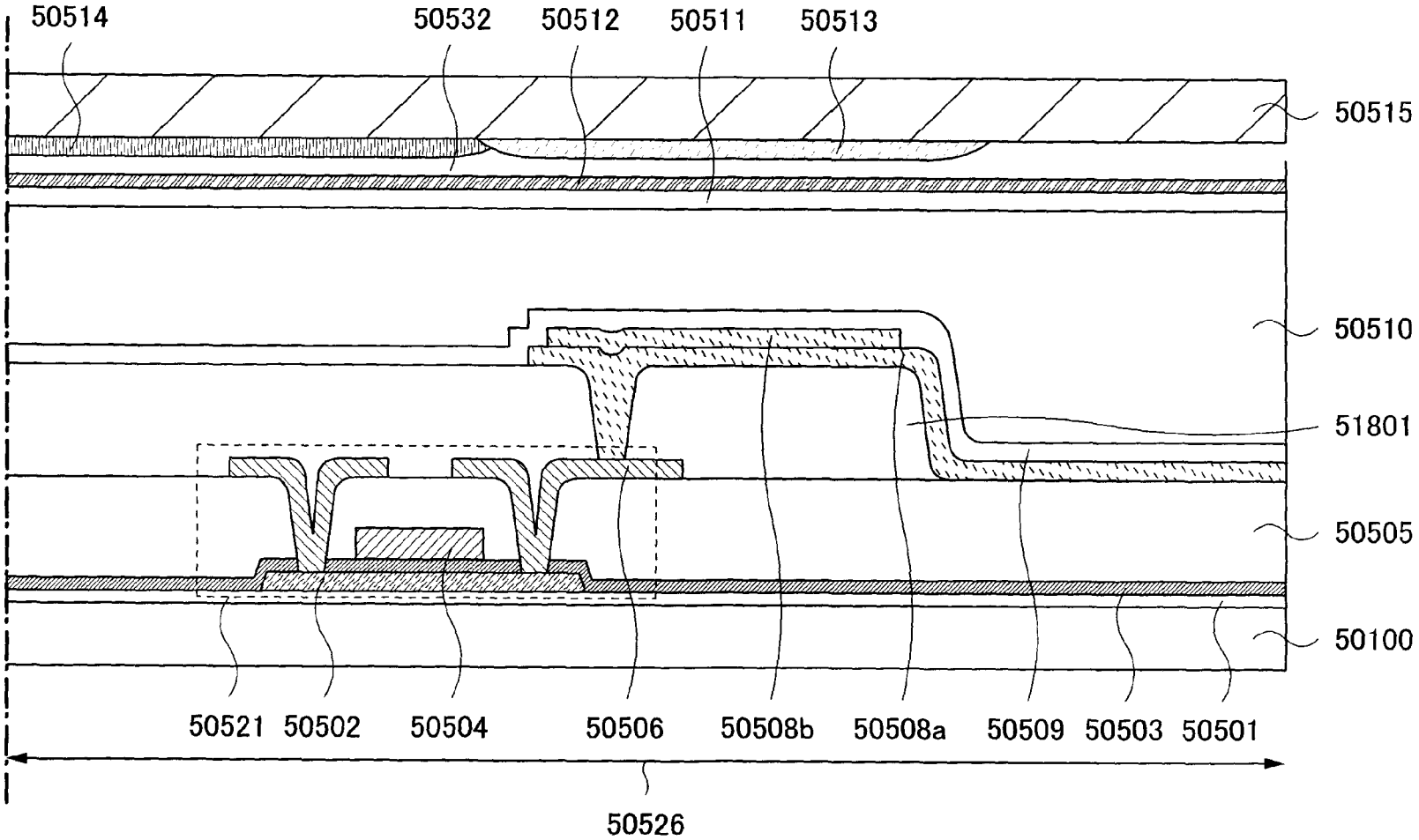
FIG. 65 is a diagram for describing a specific example of the present invention.

A cross-sectional view of FIG. 65 shows a liquid crystal panel in a case where a polycrystalline semiconductor is used as a semiconductor film of a transistor. The transistor may be either a bottom gate transistor or a double gate transistor. In addition, a gate electrode of the transistor may have a single gate structure or a dual gate structure.

It is to be noted that steps up to formation of the conductive film 50506 in FIG. 65 is similar to those of FIG. 28. Therefore, steps and a structure after formation of the conductive film 50506 will be explained.

First, an insulating film 51801 is formed over an insulating film 50505 and the conductive film 50506 formed over the insulating film 50505 by a photolithography method, an inkjet method, a printing method, or the like as a film which makes a thickness of a liquid crystal layer 50510 (so-called cell gap) thin. The insulating film 51801 preferably has good planarity and coverage, and the insulating film 51801 is formed using an organic material in many cases. A multilayer structure in which an organic material is formed over an inorganic material (such as silicon oxide, silicon nitride, or silicon oxynitride) may also be used. In addition, a contact hole is selectively formed in the insulating film 51801. For example, a contact hole is formed on an upper surface of a drain electrode of a transistor 50521.

Next, over the insulating film 50505 and the insulating film 51507, a conductive film 50508*a* is formed as a first pixel electrode by a photolithography method, an inkjet method, a printing method, or the like. As the conductive film 50508*a*, a transparent electrode which transmits light can be used, similar to the conductive film 50508.

Then, over the conductive film 50508*a*, a conductive film 50508*b* is formed as a second pixel electrode by a photolithography method, an inkjet method, a printing method, or the like. As the conductive film 50508*b*, a reflective electrode which reflects light can be used, similar to the conductive film 50508. It is to be noted that a region where the conductive film 50508*b* is formed is referred to as a reflective region, and a region where the conductive film 50508*b* is not formed over the conductive film 50508*a* in a region where the conductive film 50508*a* is formed is referred to as a transmissive region.

An insulating film 50509 is formed as an alignment film over the insulating film 51801, the conductive film 50508*a*, and the conductive film 50508*b*.

Then, in a space between a substrate 50515 provided with an insulating film 50514, an insulating film 50513, a conductive film 50512, an insulating film 50511, and the like are formed and the substrate 50100, a liquid crystal layer 50510 is provided. In addition, the insulating film 50511 serves as an alignment film. In addition, the insulating film 50513 is formed over the reflective region (over the conductive film 50508*b*).

In FIG. 65, although the conductive film 50508*b* is formed after the conductive film 50508*a* is formed, the conductive film 50508*a* may also be formed after the conductive film 50508*b* is formed.

Figure 66:
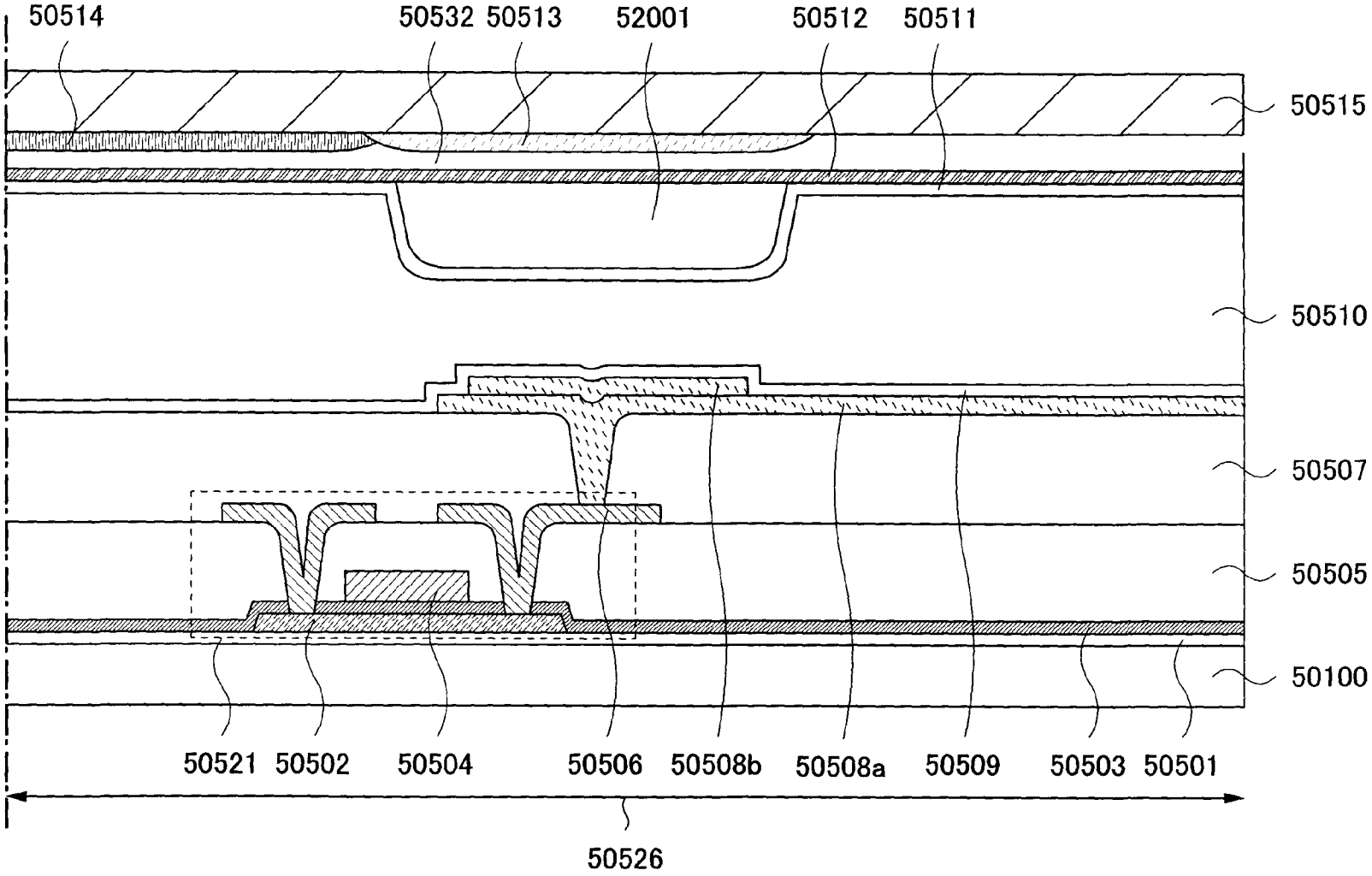
FIG. 66 is a diagram for describing a specific example of the present invention.

In FIG. 65, an insulating film for adjusting the thickness of the liquid crystal layer 50510 (cell gap) is formed below the conductive film 50508*a* and the conductive film 50508*b*. However, as shown in FIG. 66, an insulating film 52001 may also be formed on a substrate 50515 side. The insulating film 52001 is an insulating film for adjusting the thickness of the liquid crystal layer 50510 (cell gap), similar to the insulating film 51801.

In FIG. 66, the case where an insulating film 50507 is formed as a planarizing film is explained, but the insulating film 50507 is not necessarily formed.

In FIGS. 65 and 66, the case where a polycrystalline semiconductor is used as a semiconductor film of a transistor is explained. Then, FIG. 67 shows a cross-sectional view of a liquid crystal panel in which an amorphous semiconductor is used as a semiconductor film of a transistor.

Figure 67:
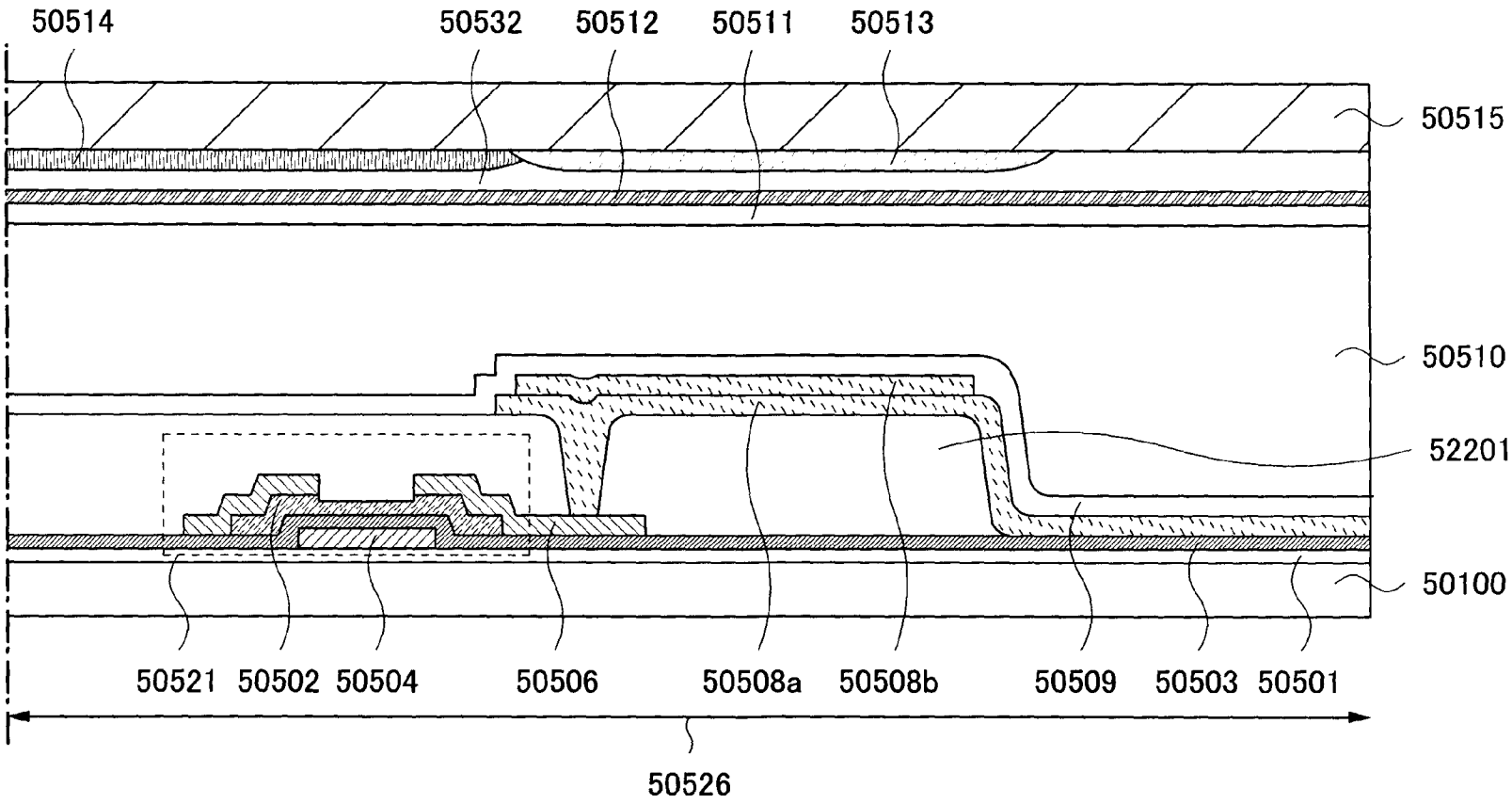
FIG. 67 is a diagram for describing a specific example of the present invention.

FIG. 67 is a cross-sectional view of a liquid crystal panel including an inverse staggered channel-etched transistor. It is to be noted that either a staggered or inverse staggered channel-protective transistor may also be used for the transistor.

It is to be noted that, in FIG. 67, steps up to formation of the conductive film 50506 is similar to those of FIG. 30. Therefore, steps and a structure after formation of the conductive film 50506 will be explained.

First, an insulating film 52201 is formed over a semiconductor film 50502, an insulating film 50503, and a conductive film 50506 by a photolithography method, an inkjet method, a printing method, or the like as a film which makes a thickness of a liquid crystal layer 505010 (so-called cell gap) thin. The insulating film 52201 preferably has good planarity and coverage, and the insulating film 52201 is formed using an organic material in many cases. A multilayer structure in which an organic material is formed over an inorganic material (such as silicon oxide, silicon nitride, or silicon oxynitride) may also be used. It is to be noted that a contact hole is selectively formed in the insulating film 52201. For example, a contact hole is formed on an upper surface of a drain electrode of a transistor 50521.

Next, over the insulating film 50503 and the insulating film 52201, a conductive film 50508*a* is formed as a first pixel electrode by a photolithography method, an inkjet method, a printing method, or the like.

Then, over the conductive film 50508*a*, a conductive film 50508*b* is formed as a second pixel electrode by a photolithography method, an inkjet method, a printing method, or the like. It is to be noted that a region where the conductive film 50508*b* is formed is referred to as a reflective region, and a region where the conductive film 50508*b* is not formed over the conductive film 50508*a* in a region where the conductive film 50508*a* is formed is referred to as a transmissive region.

An insulating film 50509 is formed as an alignment film over the insulating film 52201, the conductive film 50508*a*, and the conductive film 50508*b*.

Then, in a space between a substrate 50515 provided with an insulating film 50514, an insulating film 50513, a conductive film 50512, an insulating film 50511, and the like are formed and the substrate 50100, a liquid crystal layer 50510 is provided. In addition, the insulating film 50511 serves as an alignment film. In addition, the insulating film 50513 is formed over the reflective region (over the conductive film 50508*b*).

In FIG. 67, although the conductive film 50508*b* is formed after the conductive film 50508*a* is formed, the conductive film 50508*a* may also be formed after the conductive film 50508*b* is formed.

Figure 68:
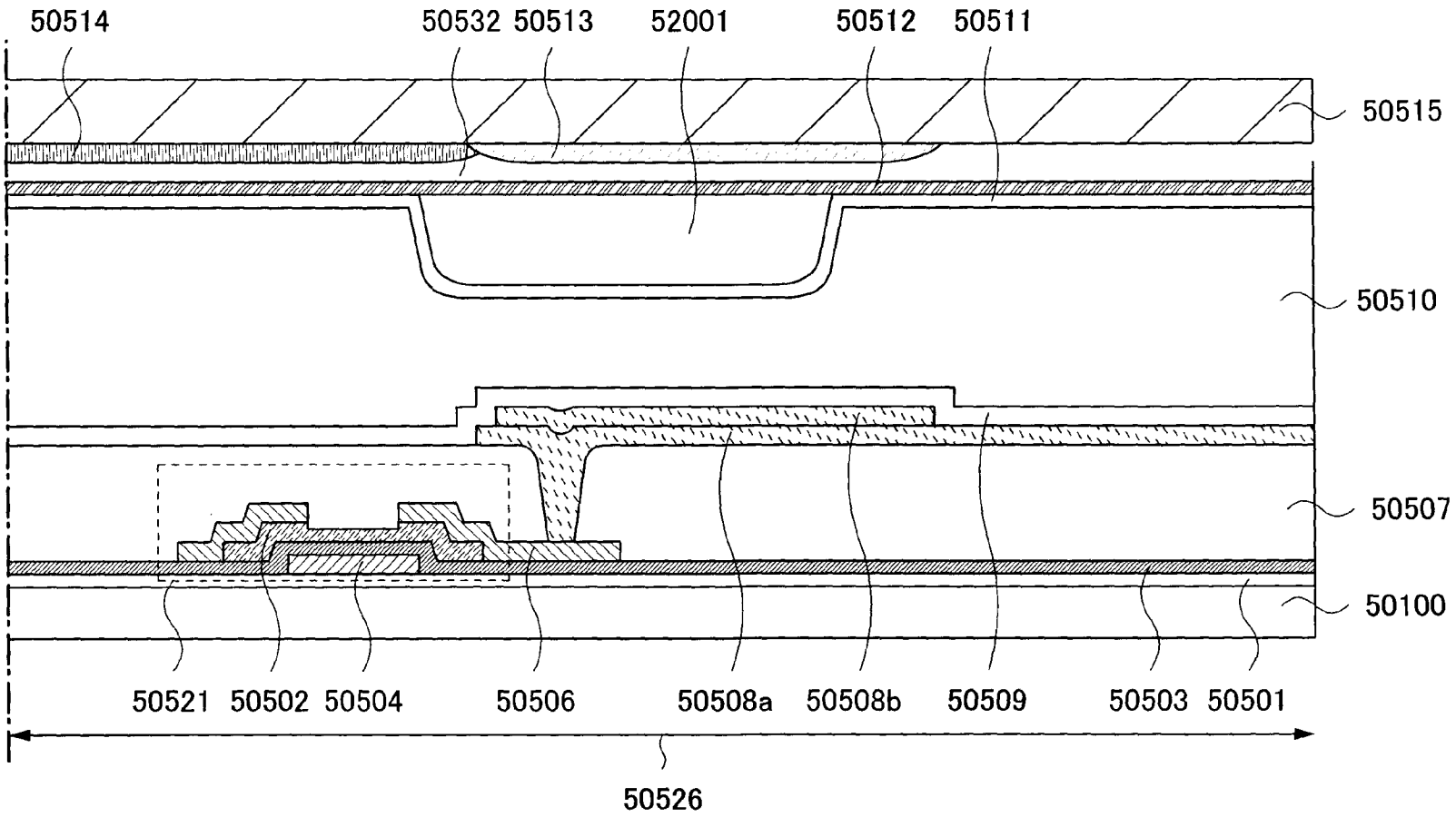
FIG. 68 is a diagram for describing a specific example of the present invention.

In FIG. 67, the insulating film for adjusting the thickness of the liquid crystal layer 50510 (cell gap) is formed below the conductive film 50508*a* and the conductive film 50508*b*. However, as shown in FIG. 68, an insulating film 52001 may also be formed on a substrate 50515 side. The insulating film 52001 is a film for adjusting the thickness of the liquid crystal layer 50510 (cell gap), similar to the insulating film 52201.

In FIG. 68, the case where an insulating film 50507 is formed as a planarizing film is explained, but the insulating film 50507 is not necessarily formed.

FIG. 32, FIGS. 34A and 34B, and FIGS. 35 to 42 each show an example in which a pair of electrodes (the conductive film 50508 and the conductive film 50512), which apply a voltage to the liquid crystal layer 50510, are formed over different substrates. However, the conductive film 50512 may also be provided over the substrate 50100. In such a manner, an IPS (In-Plane-Switching) mode may be used as a driving method of a liquid crystal. Depending on the liquid crystal layer 50510, a step of forming one or both of two alignment films (the insulating film 50509 and the insulating film 50511) can be omitted.

In FIGS. 28 to 32, FIGS. 37 to 41, and FIGS. 65 to 68, the conductive film (the conductive film 50508*b*) is formed as a reflective pixel electrode, and the conductive film 50508*b* is preferably uneven. This is because the reflective pixel electrode performs display by reflecting external light, and with the uneven shape, external light that is incident to the reflective electrode can be efficiently utilized and reflected diffusely, whereby display luminance is enhanced. When a film below the conductive film 50508*b* (the insulating film 50505, the insulating film 50507, the insulating film 51801, the insulating film 52201, or the like) is made uneven, the conductive film 50508*b* also becomes uneven.

As partially described above, the wiring and the electrode are formed using one or more elements of aluminum (Al), tantalum (Ta), titanium (Ti), molybdenum (Mo), tungsten (W), neodymium (Nd), chromium (Cr), nickel (Ni), platinum (Pt), gold (Au), silver (Ag), copper (Cu), magnesium (Mg), scandium (Sc), cobalt (Co), zinc (Zn), niobium (Nb), silicon (Si), phosphorus (P), boron (B), arsenic (As), gallium (Ga), indium (In), tin (Sn), and oxygen (O); a compound or alloy material containing one or more of the aforementioned elements (such as indium tin oxide (ITO), indium zinc oxide (IZO), indium tin oxide doped with silicon oxide (ITSO), zinc oxide (ZnO), aluminum neodymium (Al—Nd), or magnesium silver (Mg—Ag)); a substance obtained by combining such compounds; or the like. Alternatively, a compound (silicide) of silicon and the aforementioned material (such as aluminum silicon, molybdenum silicon, or nickel silicide) or a compound of nitrogen and the aforementioned material (such as titanium nitride, tantalum nitride, or molybdenum nitride) can be used. It is to be noted that silicon (Si) may contain a large amount of n-type impurities (phosphorus or the like) or p-type impurities (boron or the like). When such an impurity is contained, conductivity of silicon is improved and silicon functions similarly to normal conductor; therefore, it becomes easy to use silicon as a wiring or an electrode. Silicon may be single crystalline silicon, polycrystalline silicon (polysilicon), or amorphous silicon. When single crystalline silicon or polycrystalline silicon is used, resistance can be reduced. When amorphous silicon is used, a manufacturing process can be simplified. Aluminum and silver have high conductivity; thus, signal delay can be reduced, and minute processing is possible since they are easy to be etched and patterned. Since copper has high conductivity, signal delay can be reduced. Molybdenum is desirable because it can be used in manufacturing, without a problem such as a defect of a material even if molybdenum is in contact with an oxide semiconductor such as ITO or IZO, or silicon; because it is easily patterned and etched; and because it has high heat resistance. Titanium is desirable because it can be used in manufacturing, without a problem such as a defect of a material even if titanium is in contact with an oxide semiconductor such as ITO or IZO, or silicon; and because it has high heat resistance. Tungsten is desirable because it has high heat resistance. Neodymium is desirable because it has high heat resistance. In particular, an alloy of neodymium and aluminum is desirable because heat resistance is improved and hillocks of aluminum are hardly generated. Silicon is desirable because it can be manufactured at the same time as a semiconductor layer in a transistor and has high heat resistance. Indium tin oxide (ITO), indium zinc oxide (IZO), indium tin oxide doped with silicon oxide (ITSO), zinc oxide (ZnO), and silicon (Si) are desirable because they have a light-transmitting property and can be used for a portion which transmits light, such as a pixel electrode or a common electrode.

It is to be noted that the wiring and the electrode may have a single layer or multilayer structure of these materials. If a single-layer structure is employed, the manufacturing process can be simplified and the number of steps can be reduced; which leads to reduction in costs. If a multilayer structure is employed, advantage of a material can be provided and disadvantage of the material can be reduced, so that a wiring and an electrode with favorable characteristics can be formed. For example, when a material with low resistance (such as aluminum) is included in the multilayer structure, the resistance of the wiring can be reduced. In addition, if a material with high heat resistance is used, for example, so that a material having low heat resistance but another advantage is interposed between the materials with high heat resistance in a stacked-layer structure, the heat resistance of the wiring and the electrode as a whole can be improved. For example, a stacked layer structure in which a layer containing aluminum is interposed between layers containing molybdenum or titanium is desirable. In addition, there is a case in which a material is in direct contact with a wiring or an electrode of another material, and the materials adversely affect each other. For example, one material may enter the other material and change its characteristics; therefore, the material cannot accomplish its original purpose or a problem occurs in manufacturing and the material cannot be manufactured normally. In such a case, the problem can be solved when a layer is interposed between other layers or a layer is covered with another layer. For example, if indium tin oxide (ITO) and aluminum are desired to be in contact with each other, it is desirable that titanium or molybdenum is interposed therebetween. Also, if silicon and aluminum are desired to be in contact with each other, it is desirable that titanium or molybdenum is interposed therebetween.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 8

In this embodiment mode, a cross-sectional view and a top view of a pixel in a liquid crystal display device of the MVA mode or the PVA mode will be described in which the liquid crystal molecules are commanded to align in various directions by using protrusions for controlling alignment, so that a viewing angle is increased.

Figure 33A:
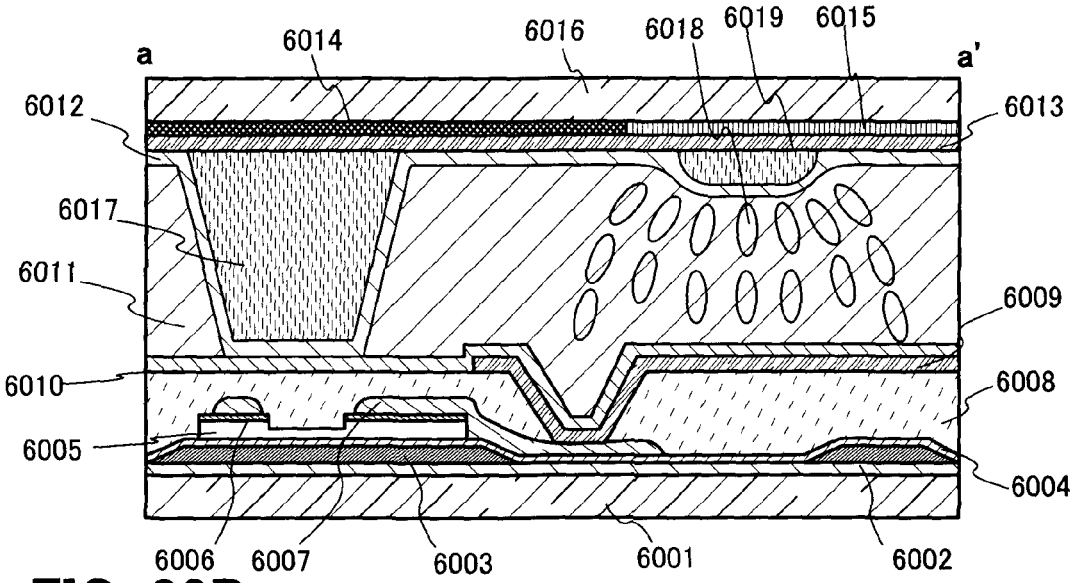
FIGS. 33A and 33B are diagrams for describing specific examples of the present invention.
Figure 33B:
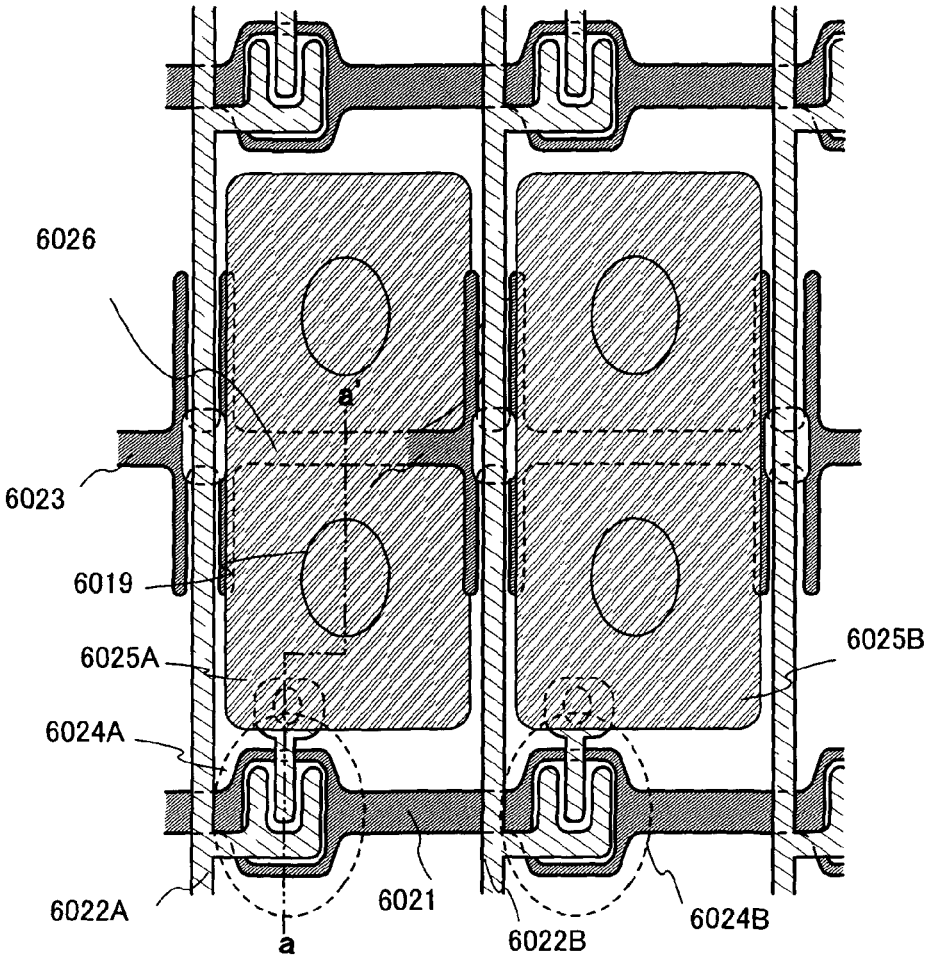

FIGS. 33A and 33B are a cross-sectional view and a top view of a pixel in the case where a thin film transistor (TFT) is combined in a liquid crystal display device of the MVA mode. FIG. 33A illustrates the cross-sectional view of the pixel, and FIG. 33B illustrates the top view of the pixel. The cross-sectional view of the pixel shown in FIG. 33A corresponds to a line a-a' in the top view of the pixel shown in FIG. 33B. By applying the present invention to a liquid crystal display device with a pixel structure shown in FIGS. 33A and 33B, a liquid crystal display device with a wide viewing angle, quick response speed, and high contrast can be obtained.

A pixel structure of the liquid crystal display device of the MVA mode will be described with reference to FIG. 33A. The liquid crystal display device includes a basis portion called a liquid crystal panel which displays an image. The liquid crystal panel is manufactured by attaching two processed substrates each other with a gap of several μm therebetween, and injecting a liquid crystal material between two substrates. In FIG. 33A, two substrates are a first substrate 6001, and a second substrate 6016. A TFT and a pixel electrode may be formed over the first substrate, and a light-shielding film 6014, a color filter 6015, a fourth conductive layer 6013, a spacer 6017, a second alignment film 6012, and a protrusion 6019 for controlling alignment can be provided with the second substrate.

Note that the present invention can be implemented without forming the TFT over a first substrate 6001. In the case where the present invention is implemented without forming the TFT, the number of steps can be reduced, so that a manufacturing cost can be reduced. In addition, since a structure is simple, yield can be improved. On the other hand, in the case where the present invention is implemented with the TFT, a display device of larger size can be obtained.

In addition, the TFT shown in FIGS. 33A and 33B is a bottom gate TFT using an amorphous semiconductor whose advantage is that the TFT can be manufactured at a low cost by using a large substrate. However, the present invention is not limited thereto. Usable structures of the TFT as a bottom gate TFT are a channel etched type, channel protective type, and the like. A top gate type can also be used. Further, not only an amorphous semiconductor but also a polycrystalline semiconductor can be used.

Note that the present invention can be implemented without forming the light-shielding film 6014 on the second substrate 6016. In the case where the present invention is implemented without forming the light-shielding film 6014, the number of steps can be reduced, so that a manufacturing cost can be reduced. In addition, since a structure is simple, yield can be improved. On the other hand, in the case where the present invention is implemented with the light-shielding film 6014, a display device in which light leakage is few during black display can be obtained.

Note that the present invention can be implemented without forming the color filter 6015 on the second substrate 6016. In the case where the present invention is implemented without forming the color filter 6015, the number of steps can be reduced, so that a manufacturing cost can be reduced. In addition, since a structure is simple, yield can be improved. On the other hand, in the case where the present invention is implemented with the color filter 6015, a display device which can perform color display can be obtained.

Note that the present invention can be implemented without forming the spacer 6017 on the second substrate 6016 but scattering a spherical spacer. In the case where the present invention is implemented by scattering the spherical spacer, the number of steps can be reduced, so that a manufacturing cost can be reduced. In addition, since a structure is simple, yield can be improved. On the other hand, in the case where the present invention is implemented with the spacer 6017, since positions of spacers do not have variations, the distance between two substrates can be even, so that a display device with less unevenness of display can be obtained.

Next processing for the first substrate 6001 will be described. A substrate having a light-transmitting property is preferable for the first substrate 6001. For example, a quartz substrate, a glass substrate, or a plastic substrate can be used. Note that the first substrate 6001 can be a substrate having a light-shielding property, and a semiconductor substrate, or SOI (silicon on insulator) substrate can be used.

First, a first insulating film 6002 can be formed over the first substrate 6001. The first insulating film 6002 may be an insulating film such as a silicon oxide film, a silicon nitride film, or a silicon oxynitride film ($SiO_xN_y$). Alternatively, an insulating film of a stacked layer of at least two films formed of the aforementioned materials can be used. In the case where the present invention is implemented by forming the first insulating film 6002, since a semiconductor layer is prevented from being influenced by impurities from the substrate, change of properties of the TFT can be prevented, so that a display device with high reliability can be obtained. Note that in the case where the present invention is implemented without forming the first insulating film 6002, since the number of steps can be reduced, so that a manufacturing cost can be reduced. In addition, since a structure is simple, yield can be improved.

Next, a first conductive layer 6003 is formed over the first substrate 6001 or the first insulating film 6002. Note that the first conductive layer 6003 can be formed by processing a shape. A step for processing a shape is preferably performed as follows. First, a first conductive layer is formed over the entire surface. At that time, a film formation apparatus such as a sputtering apparatus, a CVD apparatus can be used. Next, a resist material having photosensitivity can be formed over the entire surface of the first conductive layer formed over the entire surface. Next, the resist material is exposed to light so as to have a shape which is desired to be formed by a photolithography method, a laser drawing method, or the like. Next, either of the resist material which is exposed to light or the resist material which is not exposed to light is removed by etching so that a mask for processing the shape of the first conductive layer 6003 can be obtained. Along a formed mask pattern, the first conductive layer 6003 is removed by etching so that the first conductive layer 6003 can be processed into a desired shape. As a method for etching the first conductive layer 6003, a chemical method (wet etching) and a physical method (dry etching) are given and selected as appropriate in consideration of a material of the first conductive layer 6003, properties of a material of a layer under the first conductive layer, and the like. As a material used for the first conductive layer 6003, Mo, Ti, Al, Nd, Cr, or the like is preferable. Alternatively, a stacked layer thereof can be used. Further, a single layer of a stacked layer of an alloy thereof can be formed as the first conductive layer 6003.

Next a second insulating film 6004 is formed. At that time, a film formation apparatus such as a sputtering apparatus, or a CVD apparatus can be used. As a material used for the second insulating film 6004, a thermal oxide film, a silicon oxide film, a silicon nitride film, a silicon oxynitride film, or the like is preferable. Alternatively, a stacked layer thereof can be used. As the second insulating film 6004 which is in contact with a first semiconductor layer 6005, a silicon oxide film is especially preferable. This is because the silicon oxide film can lower a trap level in the interface of the second insulating film 6004 and the first semiconductor layer 6005. In the case where the first conductive layer 6003 is formed of Mo, as the second insulating film 6004 which is in contact with the first conductive layer 6003, a silicon nitride film is preferable. This is because the silicon nitride film prevents Mo from being oxidized.

Next, the first semiconductor layer 6005 is formed. A second semiconductor layer 6006 is preferably formed in succession. Note that the first semiconductor layer 6005 and the second semiconductor layer 6006 can be formed by processing a shape. As a step for processing a shape, a method such as the aforementioned photolithography method is preferable. As a material for the first semiconductor layer 6005, silicon, silicon germanium (SiGe) is preferable. As a material for the second semiconductor layer 6006, silicon or the like containing phosphorus or the like is preferable.

Next, a second conductive layer 6007 is formed. At that time, a sputtering method or a printing method is preferably used. Note that a material for the second conductive layer 6007 may have transparency or reflectivity. In the case where a material having transparency is used, for example, an indium tin oxide (ITO) film formed by mixing tin oxide into indium oxide, an indium tin silicon oxide (ITSO) film formed by mixing silicon oxide into indium tin oxide (ITO), an indium zinc oxide (IZO) film formed by mixing zinc oxide into indium oxide, a zinc oxide film, or a tin oxide film can be used. Note that IZO is a light-transmitting conductive material formed by sputtering using a target in which zinc oxide (ZnO) is mixed into ITO at 2 to 20 wt %. On the other hand, in the case of having reflectivity, Ti, Mo, Ta, Cr, W, Al, or the like can be used. Alternatively, a two-layer structure in which Al and Ti, Mo, Ta, Cr, or W are stacked, or a three-layer structure in which Al is interposed between metals such as Ti, Mo, Ta, Cr, and W may be used. Note that the second conductive layer 6007 can be formed by processing a shape. As a method for processing a shape, a method such as the aforementioned photolithography method is preferable. As an etching method, dry etching is preferable. Dry etching can be performed by using a dry etching apparatus using a high-density plasma source such as ECR (electron cyclotron resonance) or ICP (inductive coupled plasma).

Next, a channel region of the TFT is formed. The second semiconductor layer 6006 can be etched by using the second conductive layer 6007 as a mask. In this manner, the number of masks can be reduced and a manufacturing cost can be reduced. By etching the second semiconductor layer 6006 having conductivity, a removed portion is used as a channel region of the TFT. Note that the first semiconductor layer 6005 and the second semiconductor layer 6006 need not to be formed in succession. After the first semiconductor layer 6005 is formed, a film used as a stopper is formed in a spot which is to be the channel region of the TFT and is patterned, and then the second semiconductor layer 6006 may be formed. In this manner, since the channel region of the TFT can be formed without using the second conductive layer 6007 as a mask, a degree of freedom of a layout pattern is increased which is advantageous. In addition, when the second semiconductor layer 6006 is etched, the first semiconductor layer 6005 is not etched, so that the channel region of the TFT can be surely formed without causing an etching defect, which is also an advantage.

Next, a third insulating film 6008 is formed. The third insulating film 6008 preferably has transparency. As a material used for the third insulating film 6008, an inorganic material (e.g., silicon oxide, silicon nitride, or silicon oxynitride), an organic compound material having a low dielectric constant (e.g., a photosensitive or nonphotosensitive organic resin material), or the like is preferable. Alternatively, a material containing siloxane may be used. Note that siloxane is a material in which a skeleton structure is formed by a bond of silicon (Si) and oxygen (O). As a substitute, an organic group containing at least hydrogen (such as an alkyl group or aromatic hydrocarbon) is used. Alternatively, a fluoro group, or a fluoro group and an organic group containing at least hydrogen may be used as a substituent. Note that the second conductive layer 6007 can be formed by processing a shape. As a method for processing a shape, a method such as the aforementioned photolithography method is preferable. By etching the second insulating film 6004 at the same time, a contact hole through not only the second conductive layer 6007 but also the first conductive layer 6003 can be formed. Note that the surface of the third insulating film 6008 is preferably as smooth as possible. This is because alignment of the liquid crystal molecules is influenced by unevenness on a surface with which liquid crystals are in touch.

Next, a third conductive layer 6009 is formed. At that time, a sputtering method or a printing method is preferably used. Note that a material for the third conductive layer 6009 may have transparency or reflectivity. As a material for the third conductive layer 6009, the same material as the second conductive layer 6007 can be used. The third conductive layer 6009 can be formed by processing a shape. As a method for processing a shape, the same method as the second conductive layer 6007 can be used.

Next, a first alignment film 6010 is formed. As the first alignment film 6010, a high polymer film such as polyimide can be used. Although not shown, a protrusion for controlling alignment can be provided on the first substrate side. Alternatively, instead of the protrusion for controlling alignment, slits may be provided for the third conductive layer 6009 to form unevenness on the surface of the first alignment film 6010. In this manner, alignment of the liquid crystal molecules can be controlled more surely. The first alignment film 6010 and the second alignment film 6012 can be vertical alignment films so that liquid crystal molecules 6018 can be aligned vertically.

By attaching the first substrate 6001 which is manufactured as above, and the second substrate 6016 provided with the light-shielding film 6014, the color filter 6015, the fourth conductive layer 6013, the spacer 6017, and the second alignment film 6012 to each other with a gap of several μm and injecting the liquid crystal material between two substrates, a liquid crystal panel can be manufactured. In the liquid crystal panel of the MVA mode shown in FIGS. 33A and 33B, the fourth conductive layer 6013 can be formed on the entire surface of the second substrate 6016. In addition, a protrusion 6019 for controlling alignment can be formed being in contact with the fourth conductive layer 6013. Although there are no limitations on the shape of the protrusion 6019 for controlling alignment, a shape having a smooth curved surface is preferable. In this manner, alignment of the adjacent liquid crystal molecules 6018 is extremely similar, so that an alignment defect is reduced. Further, a defect of the alignment film caused by breaking of the second alignment film 6012 due to the protrusion 6019 for controlling alignment can be reduced.

Features of the pixel structure of the liquid crystal panel of the MVA mode shown in FIG. 33A will be described. Liquid crystal molecules 6018 shown in FIG. 33A are long and narrow molecules each having a major axis and a minor axis. In FIG. 33A, direction of each of the liquid crystal molecules 6018 is expressed by the length thereof. That is, the direction of the major axis of the liquid crystal molecule 6018, which is expressed as long, is parallel to the page, and as the liquid crystal molecule 6018 is expressed to be shorter, the direction of the major axis becomes closer to a normal direction of the page. That is, each of the liquid crystal molecules 6018 shown in FIG. 33A is aligned such that the direction of the major axis is normal to the alignment film. Thus, the liquid crystal molecules 6018 at a position where the protrusion 6019 for controlling alignment is formed are aligned radially with the protrusion 6019 for controlling alignment as a center. With this state, a liquid crystal display device having a wide viewing angle can be obtained.

Next, an example of a layout of the pixel in the liquid crystal display device of the MVA mode will be described with reference to FIG. 33B. By way of example, the pixel in the liquid crystal display device of the MVA mode to which the present invention is applied includes a scanning line 6021, a first video signal line 6022A, a second video signal line 6022B, a capacitor line 6023, a first TFT 6024A, a second TFT 6024B, a first pixel electrode 6025A, a second pixel electrode 6025B, a pixel capacitor 6026, and the protrusion 6019 for controlling alignment. Note that the first pixel electrode 6025A and the second pixel electrode 6025B form one pixel. Thus, the first pixel electrode 6025A corresponds to the sub pixel A mentioned in the above embodiment mode, and the second pixel electrode 6025B corresponds to the sub pixel B mentioned in the above embodiment mode. The sub-pixel A is driven by a set of operation in which a sub-pixel signal from the first video signal line 6022A is input to the first pixel electrode 6025A through the first TFT 6024A. Similarly, the sub-pixel B is driven by a set of operation in which a sub-pixel signal from the second video signal line 6022B is input to the second pixel electrode 6025B through the second TFT 6024B. Since operation of the sub-pixel A and the sub-pixel B are the same, only a structure of the sub-pixel A will be described as follows.

Since the scanning line 6021 is electrically connected to a gate electrode of the first TFT 6024A, the scanning line 6021 is preferably formed of the first conductive layer 6003.

Since the first video signal line 6022A is electrically connected to a source electrode or a drain electrode of the first TFT 6024A, the first video signal line 6022A is preferably formed of the second conductive layer 6007. In addition, since the scanning line 6021 and the first video signal line 6022A are arranged in matrix, the scanning line 6021 and the first video signal line 6022A are preferably formed of at least different conductive films.

The capacitor line 6023 is provided in parallel with the first pixel electrode 6025A to function as a wiring for forming the pixel capacitor 6026, and is preferably formed of the first conductive layer 6003. As shown in FIG. 33B, the capacitor line 6023 may be provided along the first video signal line 6022A so as to surround the first video signal line 6022A. In this manner, a phenomenon in which the potential of an electrode which is supposed to hold a potential is changed with potential change in the first video signal line 6022A, so-called cross talk can be reduced. In order to reduce intersection capacitance between the capacitor line 6023 and the first video signal line 6022A, the first semiconductor layer 6005 may be provided in cross regions of the capacitor line 6023 and the first video signal line 6022A as shown in FIG. 33B.

The first TFT 6024A has a function as a switch which turns on the first video signal line 6022A and the first pixel electrode 6025A. Note that one of a source region and a drain region of the first TFT 6024A is provided so as to be surrounded by the other of the source region and the drain region of the first TFT 6024A as shown in FIG. 33B. Thus, a channel of the first TFT 6024A can be large in width in a small area, so that switching capability can be improved. Note that the gate electrode of the first TFT 6024A is provided so as to surround the first semiconductor layer 6005 as shown in FIG. 33B.

The first pixel electrode 6025A is electrically connected to one of a source electrode and a drain electrode of the first TFT 6024A. The first pixel electrode 6025A is an electrode for applying signal voltage which is transmitted by the first video signal line 6022A to a liquid crystal element. In addition, the capacitor line 6023 and the pixel capacitor 6026 can be provided. In this manner, the first pixel electrode 6025A can also hold the signal voltage transmitted through the first video signal line 6022A. Note that the first pixel electrode 6025A may have a rectangular shape as shown in FIG. 33B. In this manner, an aperture ratio of the pixel can be increased, so that the efficiency of the liquid crystal display device is improved. In the case where the first pixel electrode 6025A is formed by using a material with transparency, a transmissive liquid crystal display device can be obtained. The transmissive liquid crystal display device has high color reproductivity and can display an image with high image quality. In the case where the first pixel electrode 6025A is formed by using a material with reflectivity, a reflective liquid crystal display device can be obtained. Since the reflective liquid crystal display device has high visibility in a lighted environment such as the outdoors and a backlight is not necessary, power consumption can be extremely reduced. In the case where the first pixel electrode 6025A is formed by using both the material with transparency and the material with reflectivity, a semi-transmissive liquid crystal display device with advantages of both materials can be obtained. In the case where the first pixel electrode 6025A is formed by using a material with reflectivity, the surface of the first pixel electrode 6025A may be uneven. Thus, light is reflected irregularly and angular dependency of intensity distribution of reflected light is reduced which is advantage. That is, the reflective liquid crystal display device whose brightness is constant from any angle, can be obtained.

Figure 34A:
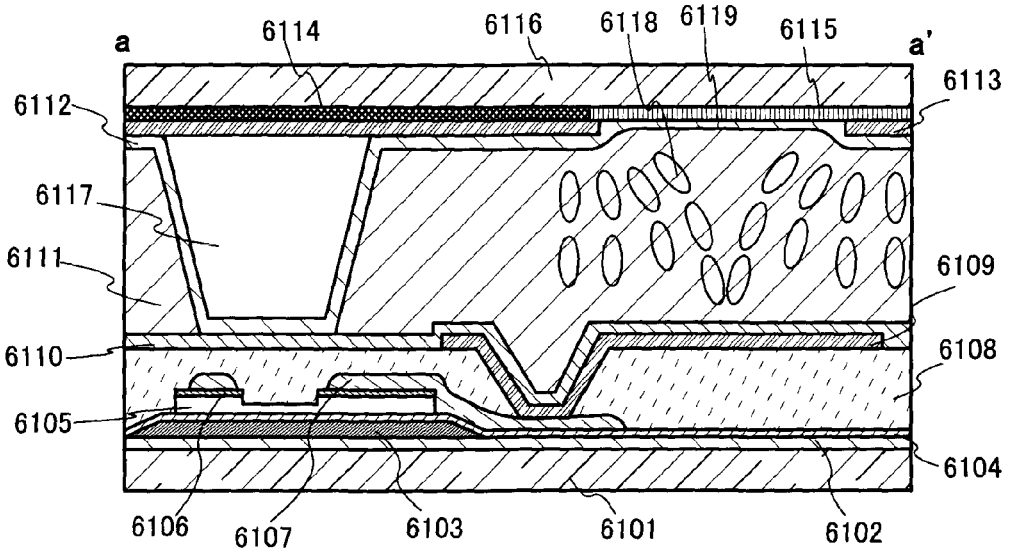
FIGS. 34A and 34B are diagrams for describing specific examples of the present invention.
Figure 34B:
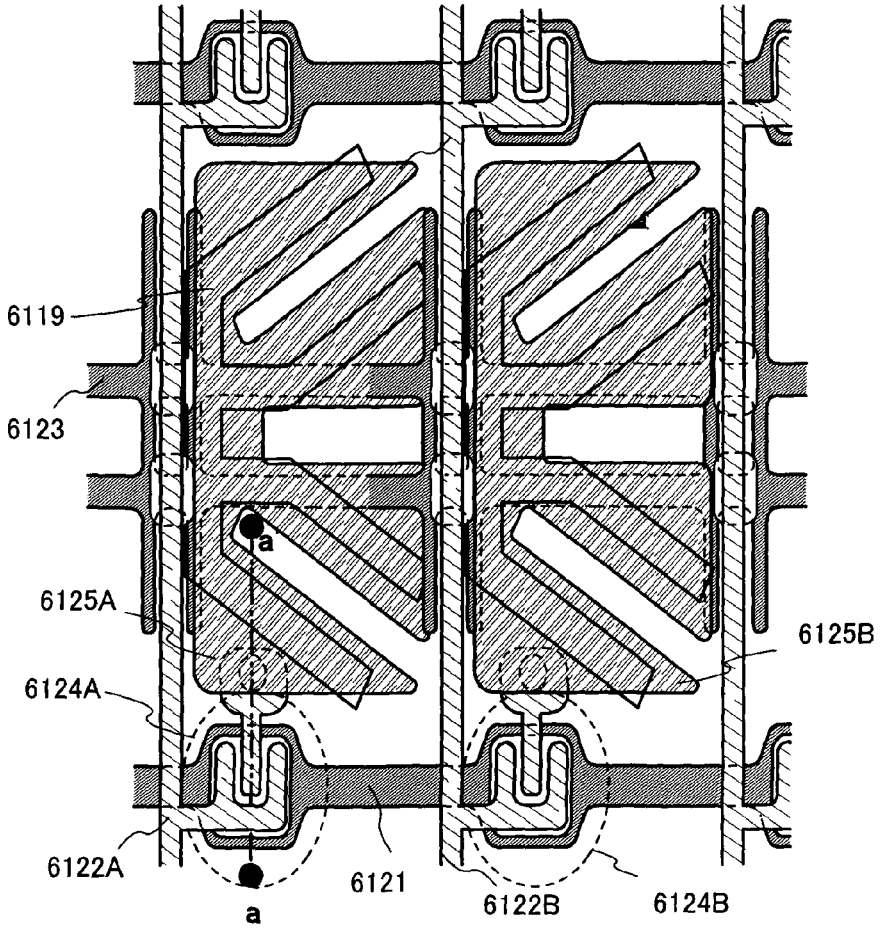

FIGS. 34A and 34B are a cross-sectional view and a top view of a pixel in the case where a thin film transistor (TFT) is provided in a liquid crystal display device of the PVA mode. FIG. 34A illustrates the cross-sectional view of the pixel, and FIG. 34B illustrates the top view of the pixel. The cross-sectional view of the pixel shown in FIG. 34A corresponds to a line a-a' in the top view of the pixel shown in FIG. 34B. By applying the present invention to a liquid crystal display device with a pixel structure shown in FIGS. 34A and 34B, a liquid crystal display device with a wide viewing angle, quick response speed, and high contrast can be obtained.

A pixel structure of the liquid crystal display device of the PVA mode will be described with reference to FIG. 34A. The liquid crystal display device includes a basis portion called a liquid crystal panel which displays an image. The liquid crystal panel is manufactured by attaching two processed substrates each other with a gap of several μm therebetween, and injecting a liquid crystal material between two substrates. In FIG. 34A, two substrates are a first substrate 6101, and a second substrate 6116. A TFT and a pixel electrode may be formed over the first substrate and a light-shielding film 6114, a color filter 6115, a fourth conductive layer 6113, a spacer 6117, and a second alignment film 6112 can be provided with the second substrate.

Note that the present invention can be implemented without forming the TFT over a first substrate 6101. In the case where the present invention is implemented without forming the TFT, the number of steps can be reduced, so that a manufacturing cost can be reduced. In addition, since a structure is simple, yield can be improved. On the other hand, in the case where the present invention is implemented with the TFT, a display device of larger size can be obtained.

In addition, the TFT shown in FIGS. 34A and 34B is a bottom gate TFT using an amorphous semiconductor whose advantage is that the TFT can be manufactured at a low cost by using a large substrate. However, the present invention is not limited thereto. Usable structures of the TFT as a bottom gate TFT are a channel etched type, channel protective type, and the like. A top gate type can also be used. Further, not only an amorphous semiconductor but also a polycrystalline semiconductor can be used.

Note that the present invention can be implemented without forming the light-shielding film 6114 on the second substrate 6116. In the case where the present invention is implemented without forming the light-shielding film 6114, the number of steps can be reduced, so that a manufacturing cost can be reduced. In addition, since a structure is simple, yield can be improved. On the other hand, in the case where the present invention is implemented with the light-shielding film 6114, a display device in which light leakage is few during black display can be obtained.

Note that the present invention can be implemented without forming the color filter 6115 on the second substrate 6116. In the case where the present invention is implemented without forming the color filter 6115, the number of steps can be reduced, so that a manufacturing cost can be reduced. In addition, since a structure is simple, yield can be improved. On the other hand, in the case where the present invention is implemented with the color filter 6115, a display device which can perform color display can be obtained.

Note that the present invention can be implemented without forming the spacer 6117 over the second substrate 6116 but scattering a spherical spacer. In the case where the present invention is implemented by scattering the spherical spacer, the number of steps can be reduced, so that a manufacturing cost can be reduced. In addition, since a structure is simple, yield can be improved. On the other hand, in the case where the present invention is implemented with the spacer 6117, since positions of spacers do not have variations, the distance between two substrates can be even, so that a display device with less unevenness of display can be obtained.

A process performed to the first substrate 6101 can be omitted here because the methods described in FIGS. 33A and 33B can be used. Here, the first substrate 6101, a first insulating film 6102, a first conductive layer 6103, a second insulating film 6104, a first semiconductor layer 6105, a second semiconductor layer 6106, a second conductive layer 6107, a third insulating film 6108, a third conductive layer 6109, and a first alignment film 6110 correspond to the first substrate 6001, the first insulating film 6002, the first conductive layer 6003, the second insulating film 6004, the first semiconductor layer 6005, the second semiconductor layer 6006, the second conductive layer 6007, the third insulating film 6008, the third conductive layer 6009, and the first alignment film 6010 shown in FIGS. 33A and 33B, respectively. A tear portion of an electrode can be provided for the third conductive layer 6109 on the first substrate 6101 side. In this manner, alignment of the liquid crystal molecules can be controlled more surely. The first alignment film 6110 and the second alignment film 6112 can be vertical alignment films so that liquid crystal molecules 6118 can be aligned vertically.

By attaching the first substrate 6101 which is manufactured as above, and the second substrate 6116 provided with the light-shielding film 6114, the color filter 6115, the fourth conductive layer 6113, the spacer 6117, and the second alignment film 6112 to each other with a gap of several μm and injecting the liquid crystal material between two substrates, a liquid crystal panel can be manufactured. In the liquid crystal panel of the PVA mode shown in FIGS. 34A and 34B, the fourth conductive layer 6113 can be patterned and a tear portion 6119 of the electrode can be provided. Although there are no limitations on the shape of the tear portion 6119 of the electrode, a shape with different directions in which a plurality of rectangular shape is combined is preferably employed. In this manner, a plurality of regions with different alignment can be formed, so that a liquid crystal display device with a large viewing angle can be obtained. The fourth conductive layer 6113 on the border between the tear portion 6119 of the electrode and the fourth conductive layer 6113 preferably has a smooth curve. In this manner, alignment of the adjacent liquid crystal molecules 6118 is extremely similar, so that an alignment defect is reduced. Further, a defect of the alignment film caused by breaking of the second alignment film 6112 due to the tear portion 6119 of the electrode can be reduced.

Features of the pixel structure of the liquid crystal panel of the PVA mode shown in FIG. 34A will be described. Liquid crystal molecules 6118 shown in FIG. 34A are long and narrow molecules each having a major axis and a minor axis. In FIG. 34A, direction of each of the liquid crystal molecules 6118 is expressed by the length thereof. That is, the direction of the major axis of the liquid crystal molecule 6118, which is expressed as long, is parallel to the page, and as the liquid crystal molecule 6118 is expressed to be shorter, the direction of the major axis becomes closer to a normal direction of the page. That is, each of the liquid crystal molecules 6118 shown in FIG. 34A is aligned such that the direction of the major axis is normal to the alignment film. Thus, the liquid crystal molecules 6118 at a position where the tear portion 6119 of the electrode is formed are aligned radially with a boundary of the tear portion 6119 of the electrode for controlling alignment and the fourth conductive layer 6113 as a center. With this state, a liquid crystal display device having a wide viewing angle can be obtained.

Next, an example of a layout of the pixel in the liquid crystal display device of the PVA mode will be described with reference to FIG. 34B. By way of example, the pixel in the liquid crystal display device of the PVA mode to which the present invention is applied includes a scanning line 6121, a first video signal line 6122A, a second video signal line 6122B, a capacitor line 6123, a first TFT 6124A, a second TFT 6124B, a first pixel electrode 6125A, a second pixel electrode 6125B, a pixel capacitor 6126, and the tear portion 6119 of the electrode. Note that the first pixel electrode 6125A and the second pixel electrode 6125B form one pixel. Thus, the first pixel electrode 6125A corresponds to the sub pixel A mentioned in the above embodiment mode, and the second pixel electrode 6125B corresponds to the sub pixel B mentioned in the above embodiment mode. The sub-pixel A is driven by a set of operation in which a sub-pixel signal from the first video signal line 6122A is input to the first pixel electrode 6125A through the first TFT 6124A. Similarly, the sub-pixel B is driven by a set of operation in which a sub-pixel signal from the second video signal line 6122B is input to the second pixel electrode 6125B through the second TFT 6124B. Since operation of the sub-pixel A and the sub-pixel B are the same, only a structure of the sub-pixel A will be described as follows.

Since the scanning line 6121 is electrically connected to a gate electrode of the first TFT 6124A, the scanning line 6121 is preferably formed of the first conductive layer 6103.

Since the first video signal line 6122A is electrically connected to a source electrode or a drain electrode of the first TFT 6124A, the first video signal line 6122A is preferably formed of the second conductive layer 6107. In addition, since the scanning line 6121 and the first video signal line 6122A are arranged in matrix, the scanning line 6121 and the first video signal line 6122A are preferably formed of at least different conductive films.

The capacitor line 6123 is provided in parallel with the first pixel electrode 6125A to function as a wiring for forming the pixel capacitor 6126, and is preferably formed of the first conductive layer 6103. As shown in FIG. 34B, the capacitor line 6123 may be provided along the first video signal line 6122A so as to surround the first video signal line 6122A. In this manner, a phenomenon in which the potential of an electrode which is supposed to hold a potential is changed with potential change in the first video signal line 6122A, so-called cross talk can be reduced. In order to reduce intersection capacitance between the capacitor line 6123 and the first video signal line 6122A, the first semiconductor layer 6105 may be provided in cross regions of the capacitor line 6123 and the first video signal line 6122A as shown in FIG. 34B.

The first TFT 6124A has a function as a switch which turns on the first video signal line 6122A and the first pixel electrode 6125A. Note that one of a source region and a drain region of the first TFT 6124A is provided so as to be surrounded by the other of the source region and the drain region of the first TFT 6124A as shown in FIG. 34B. Thus, a channel of the first TFT 6124A can be large in width in a small area, so that switching capability can be improved. Note that the gate electrode of the first TFT 6124A is provided so as to surround the first semiconductor layer 6105 as shown in FIG. 34B.

The first pixel electrode 6125A is electrically connected to one of a source electrode and a drain electrode of the first TFT 6124A. The first pixel electrode 6125A is an electrode for applying signal voltage which is transmitted by the first video signal line 6122A to a liquid crystal element. In addition, the capacitor line 6123 and the pixel capacitor 6126 can be provided. In this manner, the first pixel electrode 6125A can also hold the signal voltage transmitted through the first video signal line 6122A. Note that with respect to the shape of the tear portion 6119 of the fourth conductive layer 6113, tear portions are preferably formed in the portion where the tear portion 6119 are not formed in the first pixel electrode 6125A as shown in FIG. 34B. In this manner, a plurality of regions with different alignments of the liquid crystal molecules 6118 can be formed, so that a liquid crystal display device with large viewing angle can be obtained. In the case where the first pixel electrode 6125A is formed by using a material with transparency, a transmissive liquid crystal display device can be obtained. The transmissive liquid crystal display device has high color reproductivity and can display an image with high image quality. In the case where the first pixel electrode 6125A is formed by using a material with reflectivity, a reflective liquid crystal display device can be obtained. Since the reflective liquid crystal display device has high visibility in a lighted environment such as the outdoors and a backlight is not necessary, power consumption can be extremely reduced. In the case where the first pixel electrode 6125A is formed by using both the material with transparency and the material with reflectivity, a semi-transmissive liquid crystal display device with advantages of both materials can be obtained. In the case where the first pixel electrode 6125A is formed by using a material with reflectivity, the surface of the first pixel electrode 6125A may be uneven. Thus, light is reflected irregularly and angular dependency of intensity distribution of reflected light is reduced which is advantage. That is, the reflective liquid crystal display device whose brightness is constant from any angle, can be obtained.

Note that by employing the MVA mode or the PVA mode for a liquid crystal display device of the present invention, and forming one pixel with a plurality of sub-pixels, the viewing angle characteristics for a viewer can be improved. In the present invention, a display mode which performs display by aligning the liquid crystal molecules in a gradient manner or a radial gradient manner in sub-pixels included in one pixel can be employed. For example, a ferroelectric liquid crystal or an antiferroelectric liquid crystal can be employed. In addition, as a driving mode of liquid crystal, without limitation to the MVA mode or the PVA mode, a TN (twisted nematic) mode, an IPS (in-plane-switching) mode, an FFS (fringe field switching) mode, an ASM (axially symmetric aligned micro-cell) mode, an OCB (optical compensated birefringence) mode, an FLC (ferroelectric liquid crystal) mode, an AFLC (antiferroelectric liquid crystal) mode, or the like can be used. In addition, the present invention is not limited to liquid crystal elements and a light-emitting element (including organic EL or inorganic EL) can also be used.

Figure 69A:
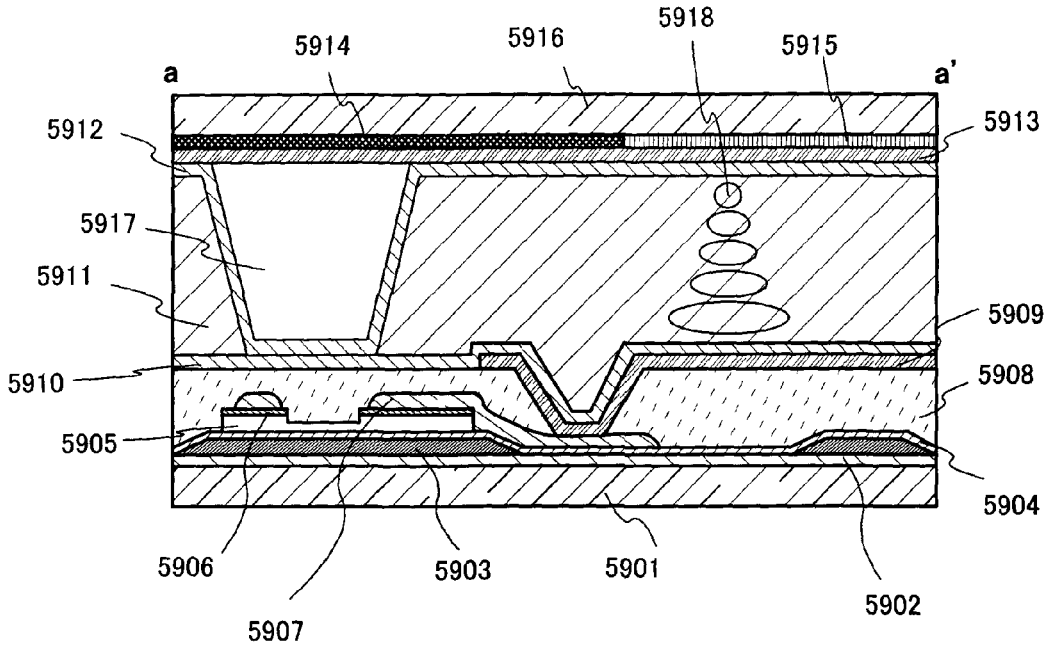
FIGS. 69A and 69B are diagrams for describing specific examples of the present invention.
Figure 69B:
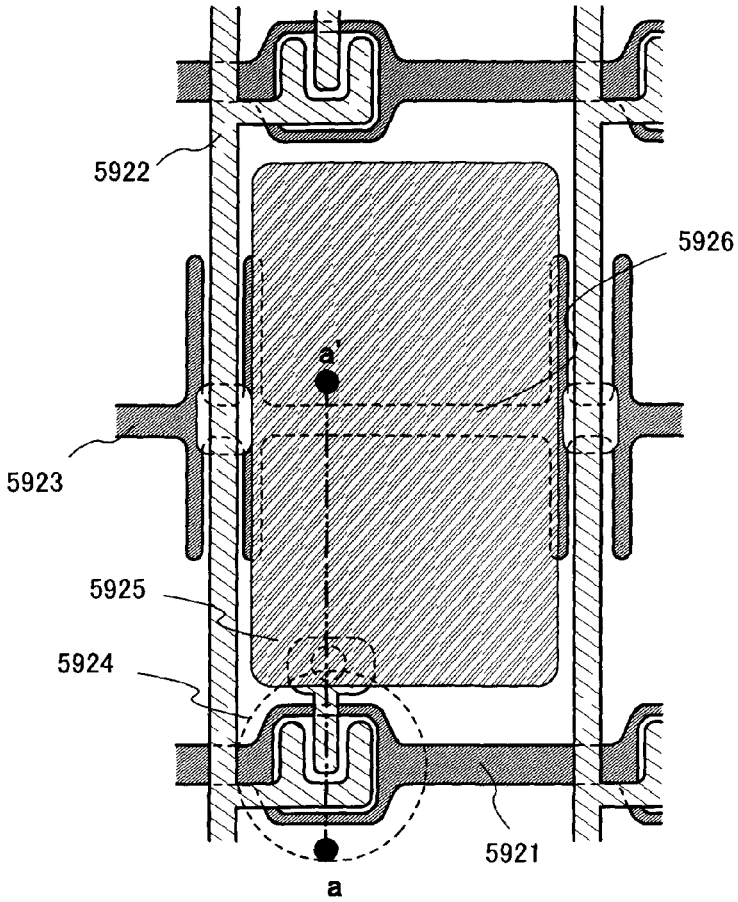

FIGS. 69A and 69B are a cross-sectional view and a top view of a pixel in the case where a thin film transistor (TFT) is combined in a pixel structure of a liquid crystal display device called a TN mode. FIG. 69A illustrates the cross-sectional view of the pixel, and FIG. 69B illustrates the top view of a sub-pixel which forms the pixel. The cross-sectional view of the pixel shown in FIG. 69A corresponds to a line a-a' in the top view of the sub-pixel shown in FIG. 69B.

A pixel structure of the liquid crystal display device of the TN mode will be described with reference to FIG. 69A. The liquid crystal display device includes a basis portion called a liquid crystal panel which displays an image. The liquid crystal panel is manufactured by attaching two processed substrates each other with a gap of several μm therebetween, and injecting a liquid crystal material between two substrates. In FIG. 69A, two substrates are a first substrate 5901, and a second substrate 5916. A TFT and a pixel electrode may be formed over the first substrate, and a light-shielding film 5914, a color filter 5915, a fourth conductive layer 5913, a spacer 5917, and a second alignment film 5912 can be formed over the second substrate.

Note that the present invention can be implemented without forming the TFT over a first substrate 5901. In the case where the present invention is implemented without forming the TFT, the number of steps can be reduced, so that a manufacturing cost can be reduced. In addition, since a structure is simple, yield can be improved. On the other hand, in the case where the present invention is implemented with the TFT, a display device of larger size can be obtained.

In addition, the TFT shown in FIGS. 69A and 69B is a bottom gate TFT using an amorphous semiconductor whose advantage is that the TFT can be manufactured at a low cost by using a large substrate. However, the present invention is not limited thereto. Usable structures of the TFT as a bottom gate TFT are a channel etched type, channel protective type, and the like. A top gate type can also be used. Further, not only an amorphous semiconductor but also a polycrystalline semiconductor can be used.

Note that the present invention can be implemented without forming the light-shielding film 5914 on the second substrate 5916. In the case where the present invention is implemented without forming the light-shielding film 5914, the number of steps can be reduced, so that a manufacturing cost can be reduced. In addition, since a structure is simple, yield can be improved. On the other hand, in the case where the present invention is implemented with the light-shielding film 5914, a display device in which light leakage is few during black display can be obtained.

Note that the present invention can be implemented without forming the color filter 5915 on the second substrate 5916. In the case where the present invention is implemented without forming the color filter 5915, the number of steps can be reduced, so that a manufacturing cost can be reduced. In addition, since a structure is simple, yield can be improved. On the other hand, in the case where the present invention is implemented with the color filter 5915, a display device which can perform color display can be obtained.

Note that the present invention can be implemented without forming the spacer 5917 over the second substrate 5916 but scattering a spherical spacer. In the case where the present invention is implemented by scattering the spherical spacer, the number of steps can be reduced, so that a manufacturing cost can be reduced. In addition, since a structure is simple, yield can be improved. On the other hand, in the case where the present invention is implemented with the spacer 5917, since positions of spacers do not have variations, the distance between two substrates can be even, so that a display device with less unevenness of display can be obtained.

A process performed to the first substrate 5901 can be omitted here because the methods described in FIGS. 33A and 33B can be used. Here, the first substrate 5901, a first insulating film 5902, a first conductive layer 5903, a second insulating film 5904, a first semiconductor layer 5905, a second semiconductor layer 5906, a second conductive layer 5907, a third insulating film 5908, a third conductive layer 5909, and a first alignment film 5910 correspond to the first substrate 6001, the first insulating film 6002, the first conductive layer 6003, the second insulating film 6004, the first semiconductor layer 6005, the second semiconductor layer 6006, the second conductive layer 6007, the third insulating film 6008, the third conductive layer 6009, and the first alignment film 6010 shown in FIGS. 33A and 33B, respectively.

By attaching the first substrate 5901 which is manufactured as above, and the second substrate 5916 provided with the light-shielding film 5914, the color filter 5915, the fourth conductive layer 5913, the spacer 5917, and the second alignment film 5912 to each other with a gap of several μm and injecting the liquid crystal material between two substrates, a liquid crystal panel can be manufactured. In the liquid crystal panel of the TN mode shown in FIGS. 69A and 69B, the fourth conductive layer 5913 can be formed on the entire surface of the second substrate 5916.

Features of the pixel structure of the liquid crystal panel of the TN mode shown in FIG. 69A will be described. Liquid crystal molecules 5918 shown in FIG. 69A are long and narrow molecules each having a major axis and a minor axis. In FIG. 69A, direction of each of the liquid crystal molecules 5918 is expressed by the length thereof. That is, the direction of the major axis of the liquid crystal molecule 5918, which is expressed as long, is parallel to the page, and as the liquid crystal molecule 5918 is expressed to be shorter, the direction of the major axis becomes closer to a normal direction of the page. That is, among the liquid crystal molecules 5918 shown in FIG. 69A, the direction of the major axis of the liquid crystal molecule 5918 which is close to the first substrate 5901 and the direction of the major axis of the liquid crystal molecule 5918 which is close to the second substrate 5916 are different from each other by 90 degrees, and the directions of the major axes of the liquid crystal molecules 5918 located therebetween are arranged so as to link the above two directions smoothly. That is, the liquid crystal molecules 5918 shown in FIG. 69A are aligned to be twisted by 90 degrees between the first substrate 5901 and the second substrate 5916.

Next, an example of a layout of a pixel when the present invention is applied to the liquid crystal display device of the TN mode will be described with reference to FIG. 69B. The pixel in the liquid crystal display device of the TN mode to which the present invention is applied includes a scanning line 5921, a video signal line 5922, a capacitor line 5923, a TFT 5924, a pixel electrode 5925, and a pixel capacitor 5926.

Since the scanning line 5921 is electrically connected to a gate electrode of the TFT 5924, the scanning line 5921 is preferably formed of the first conductive layer 5903.

Since the video signal line 5922 is electrically connected to a source electrode or a drain electrode of the TFT 5924, the video signal line 5922 is preferably formed of the second conductive layer 5907. In addition, since the scanning line 5921 and the video signal line 5922 are arranged in matrix, the scanning line 5921 and the video signal line 5922 are preferably formed of at least different conductive films.

The capacitor line 5923 is provided in parallel with the pixel electrode 5925 to function as a wiring for forming the pixel capacitor 5926, and is preferably formed of the first conductive layer 5903. As shown in FIG. 69B, the capacitor line 5923 may be provided along the video signal line 5922 so as to surround the video signal line 5922. In this manner, a phenomenon in which the potential of an electrode which is supposed to hold a potential is changed with potential change in the video signal line 5922, so-called cross talk can be reduced. In order to reduce intersection capacitance between the capacitor line 5923 and the video signal line 5922, the first semiconductor layer 5905 may be provided in cross regions of the capacitor line 5923 and the video signal line 5922 as shown in FIG. 69B.

The TFT 5924 has a function as a switch which turns on the video signal line 5922 and the pixel electrode 5925. Note that one of a source region and a drain region of the TFT 5924 is provided so as to be surrounded by the other of the source region and the drain region of the TFT 5924 as shown in FIG. 69B. Thus, a channel of the TFT 5924 can be large in width in a small area, so that switching capability can be improved. Note that the gate electrode of the TFT 5924 is provided so as to surround the first semiconductor layer 5905 as shown in FIG. 69B.

The pixel electrode 5925 is electrically connected to one of a source electrode and a drain electrode of the TFT 5924. The pixel electrode 5925 is an electrode for applying signal voltage which is transmitted by the video signal line 5922 to a liquid crystal element. In addition, the capacitor line 5923 and the pixel capacitor 5926 can be provided. In this manner, the pixel electrode 5925 can also hold the signal voltage transmitted through the video signal line 5922. Note that the pixel electrode 5925 may have a rectangular shape as shown in FIG. 69B. In this manner, an aperture ratio of the pixel can be increased, so that the efficiency of the liquid crystal display device is improved. In the case where the pixel electrode 5925 is formed by using a material with transparency, a transmissive liquid crystal display device can be obtained. The transmissive liquid crystal display device has high color reproductivity and can display an image with high image quality. In the case where the pixel electrode 5925 is formed by using a material with reflectivity, a reflective liquid crystal display device can be obtained. Since the reflective liquid crystal display device has high visibility in a lighted environment such as the outdoors and a backlight is not necessary, power consumption can be extremely reduced. In the case where the pixel electrode 5925 is formed by using both the material with transparency and the material with reflectivity, a semi-transmissive liquid crystal display device with advantages of both materials can be obtained. In the case where the pixel electrode 5925 is formed by using a material with reflectivity, the surface of the pixel electrode 5925 may be uneven. Thus, light is reflected irregularly and angular dependency of intensity distribution of reflected light is reduced which is advantage. That is, the reflective liquid crystal display device whose brightness is constant from any angle can be obtained.

Figure 70A:
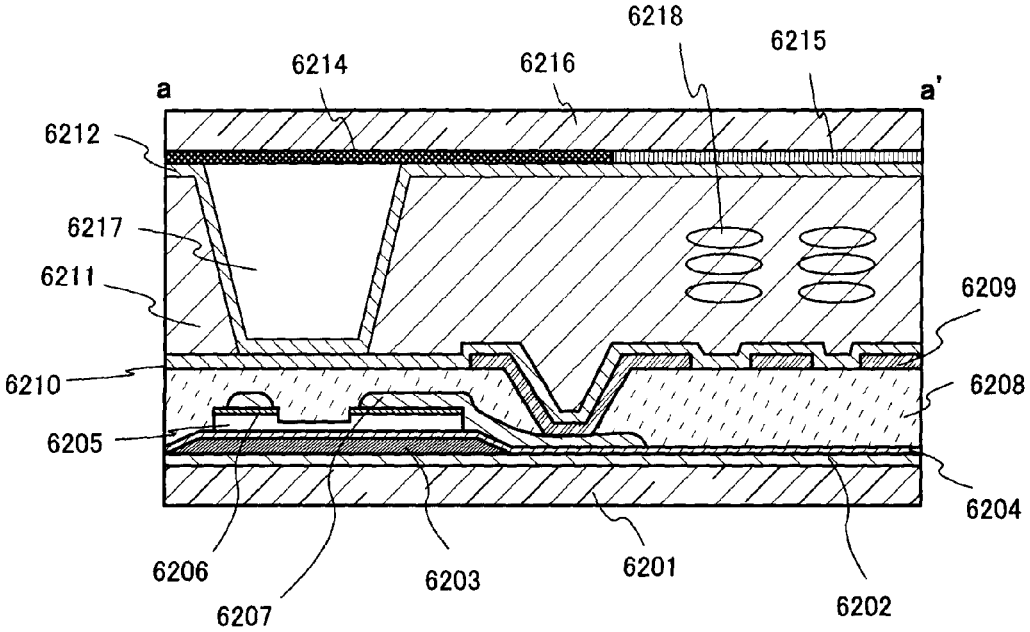
FIGS. 70A and 70B are diagrams for describing specific examples of the present invention.
Figure 70B:
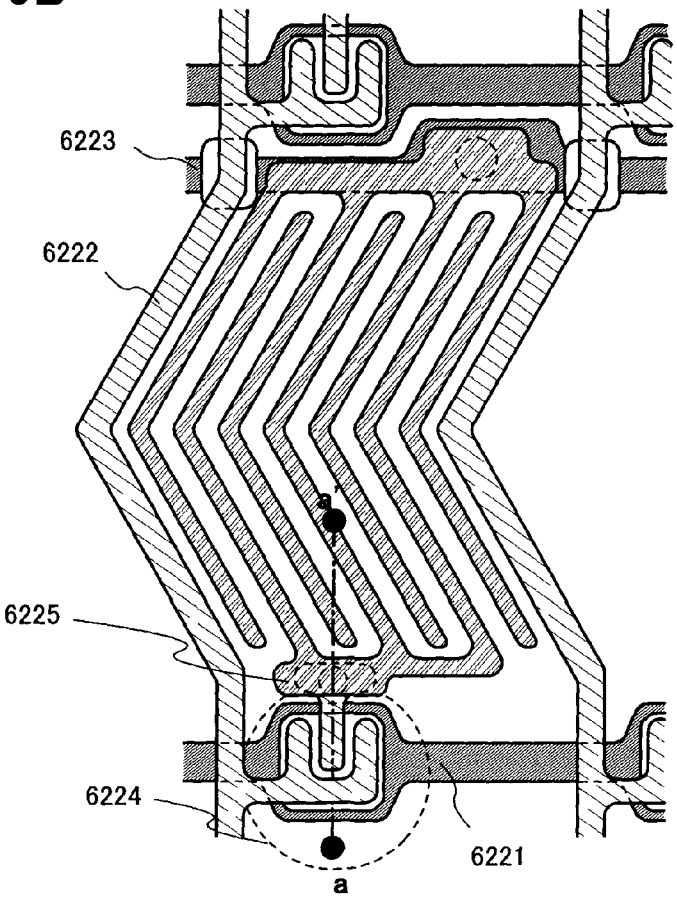

FIGS. 70A and 70B are a cross-sectional view and a top plan view of a pixel in which the present invention is applied to one of pixel structures of a lateral electric field-mode liquid crystal display device which performs switching so that alignment of liquid crystal molecules is always horizontal to a substrate, in which an electric field is applied laterally by patterning a pixel electrode 6225 and a common electrode 6223 into comb shapes, namely, a so-called IPS (In-Plane-Switching) mode. FIG. 70A is a cross-sectional view of the pixel and FIG. 70B is a top view of the pixel. Further, the cross-sectional view of the pixel shown in FIG. 70A corresponds to a line a-a' in the top plan view of the pixel shown in FIG. 70B. By applying the present invention to a liquid crystal display device having the pixel structure shown in FIGS. 70A and 70B, a liquid crystal display device having a theoretically wide viewing angle and response speed which has small dependency on a gray scale can be obtained.

A pixel structure of the liquid crystal display device of the IPS mode will be described with reference to FIG. 70A. The liquid crystal display device includes a basis portion called a liquid crystal panel which displays an image. The liquid crystal panel is manufactured by attaching two processed substrates each other with a gap of several μm therebetween, and injecting a liquid crystal material between two substrates. In FIG. 70A, two substrates are a first substrate 6201, and a second substrate 6216. A TFT and a pixel electrode may be formed over the first substrate, and a light-shielding film 6214, a color filter 6215, a spacer 6217, and a second alignment film 6212 can be formed over the second substrate 6216.

Note that the present invention can also be implemented without forming the TFT over the first substrate 6201. When the present invention is implemented without forming the TFT, the number of steps is reduced, so that manufacturing cost can be reduced. In addition, since the structure is simple, a yield can be improved. On the other hand, when the present invention is implemented by forming the TFT, a larger display device can be obtained.

The TFT shown in FIGS. 70A and 70B is a bottom-gate TFT using an amorphous semiconductor, which has an advantage that it can be manufactured at low cost by using a large substrate. However, the present invention is not limited to this. As a structure of a TFT which can be used, there are a channel-etched type, a channel-protective type, and the like as for a bottom-gate TFT. Alternatively, a top-gate type may be used. Further, not only an amorphous semiconductor but also a polycrystalline semiconductor may be used.

Note that the present invention can also be implemented without forming the light shielding film 6214 on the second substrate 6216. When the present invention is implemented without forming the light shielding film 6214, the number of steps is reduced, so that manufacturing cost can be reduced. In addition, since the structure is simple, the yield can be improved. On the other hand, when the present invention is implemented by forming the light shielding film 6214, a display device with little light leakage at the time of black display can be obtained.

Note that the present invention can also be implemented without forming the color filter 6215 on the second substrate 6216. When the present invention is implemented without forming the color filter 6215, the number of steps is reduced, so that manufacturing cost can be reduced. In addition, since the structure is simple, the yield can be improved. On the other hand, when the present invention is implemented by forming the color filter 6215, a display device which can perform color display can be obtained.

Note that the present invention can also be implemented by dispersing spherical spacers instead of providing the spacer 6217 on the second substrate 6216. When the present invention is implemented by dispersing the spherical spacers, the number of steps is reduced, so that manufacturing cost can be reduced. In addition, since the structure is simple, the yield can be improved. On the other hand, when the present invention is implemented by forming the spacer 6217, a position of the spacer is not varied, so that a distance between the two substrates can be uniformed and a display device with little display unevenness can be obtained.

A process performed to the first substrate 6201 can be omitted here because the methods described in FIGS. 33A and 33B can be used. Here, the first substrate 6201, a first insulating film 6202, a first conductive layer 6203, a second insulating film 6204, a first semiconductor layer 6205, a second semiconductor layer 6206, a second conductive layer 6207, a third insulating film 6208, a third conductive layer 6209, and a first alignment film 6210 correspond to the first substrate 6001, the first insulating film 6002, the first conductive layer 6003, the second insulating film 6004, the first semiconductor layer 6005, the second semiconductor layer 6006, the second conductive layer 6007, the third insulating film 6008, the third conductive layer 6009, and the first alignment film 6010 shown in FIGS. 33A and 33B, respectively. Note that the third conductive layer 6209 on the first substrate 6201 side may be patterned into two comb-shapes which engage with each other. In addition, one of the comb-shaped electrodes may be electrically connected to one of a source electrode and a drain electrode of the TFT 6224, and the other of the comb-shaped electrodes may be electrically connected to the common electrode 6223. Thus, a lateral electric field can be effectively applied to liquid crystal molecules 6218.

The first substrate 6201 formed as described above is attached to the second substrate 6216 provided with the light shielding film 6214, the color filter 6215, the spacer 6217, and the second alignment film 6212 with a sealant with a gap of several μm therebetween, and then, a liquid crystal material is injected between the two substrates, so that the liquid crystal panel can be manufactured. Note that although not shown in the drawings, a conductive layer may be formed on the second substrate 6216 side. By forming the conductive layer on the second substrate 6216 side, an adverse effect of electromagnetic wave noise from the outside can be reduced.

Next, a feature of the pixel structure of the IPS mode liquid crystal panel shown in FIGS. 70A and 70B is described. The liquid crystal molecules 6218 shown in FIG. 70A are long and thin molecules each having a major axis and a minor axis. In FIG. 70A, each of the liquid crystal molecules 6218 is expressed by its length to show a direction of each of the liquid crystal molecules. That is, a direction of the major axis of the liquid crystal molecule 6218 which is expressed to be long is parallel to the paper, and the direction of the major axis becomes closer to a normal direction of the paper as the liquid crystal molecule 6218 is expressed to be shorter. That is, each of the liquid crystal molecules 6218 shown in FIG. 70A is aligned so that the direction of the major axis is always horizontal to the substrate. Although FIG. 70A shows alignment in a condition where an electric field is not applied, when an electric field is applied to each of the liquid crystal molecules 6218, each of the liquid crystal molecules rotates in a horizontal plane while the direction of the major axis is kept always horizontal to the substrate. With this state, a liquid crystal display device having a wide viewing angle can be obtained.

Next, an example of pixel layout of an IPS mode liquid crystal display device to which the present invention is applied is described with reference to FIG. 70B. The pixel of the IPS mode liquid crystal display device to which the present invention is applied may include a scan line 6221, a video signal line 6222, the common electrode 6223, the TFT 6224, and the pixel electrode 6225.

Since the scan line 6221 is electrically connected to a gate electrode of the TFT 6224, it is preferable that the scan line 6221 be formed of the first conductive layer 6203.

Since the video signal line 6222 is electrically connected to the source electrode or the drain electrode of the TFT 6224, it is preferable that the video signal line 6222 be formed of the second conductive layer 6207. Further, since the scan line 6221 and the video signal line 6222 are arranged in matrix, it is preferable that the scan line 6221 and the video signal line 6222 be at least formed of conductive layers in different layers. Note that as shown in FIG. 70B, the video signal line 6222 may be formed so as to be bent along with the shapes of the pixel electrode 6225 and the common electrode 6223 in the pixel. Thus, an aperture ratio of the pixel can be increased, so that efficiency of the liquid crystal display device can be improved.

The common electrode 6223 is an electrode for generating a lateral electric field by being provided to be parallel to the pixel electrode 6225, and it is preferable that the common electrode 6223 be formed of the first conductive layer 6203 and the third conductive layer 6209. Note that the common electrode 6223 may be extended along the video signal line 6222 so as to surround the video signal line 6222 as shown in FIG. 70B. Thus, a phenomenon in which a potential of an electrode, which is supposed to be held, is changed in accordance with potential change in the video signal line 6222, namely, a so-called cross talk can be reduced. Note also that in order to reduce cross capacitance with the video signal line 6222, the first semiconductor layer 6205 may be provided in a cross region of the common electrode 6223 and the video signal line 6222 as shown in FIG. 70B.

The TFT 6224 operates as a switch which electrically connects the video signal line 6222 and the pixel electrode 6225. Note that as shown in FIG. 70B, one of a source region and a drain region of the TFT 6224 may be provided so as to surround the other of the source region and the drain region. Thus, wide channel width can be obtained in a small area and switching capability can be increased. Note also that as shown in FIG. 70B, the gate terminal of the TFT 6224 may be provided so as to surround the first semiconductor layer 6205.

The pixel electrode 6225 is electrically connected to one of the source electrode and the drain electrode of the TFT 6224. The pixel electrode 6225 is an electrode for applying signal voltage which is transmitted through the video signal line 6222 to the liquid crystal element. In addition, the pixel electrode 6225 and the common electrode 6223 may form a pixel capacitor. Thus, the pixel electrode 6225 can also have a function of holding the signal voltage which is transmitted through the video signal line 6222. Note that each of the pixel electrode 6225 and the comb-shaped common electrode 6223 may have a bent comb-shape as shown in FIG. 70B. Thus, since a plurality of regions having different alignment of the liquid crystal molecules 6218 can be formed, a liquid crystal display device having a wide viewing angle can be obtained. In addition, in the case where each of the pixel electrode 6225 and the comb-shaped common electrode 6223 is formed using a material having light-transmitting properties, a transmissive liquid crystal display device can be obtained. A transmissive liquid crystal display device has high color reproductivity and can display an image with high image quality. Alternatively, in the case where each of the pixel electrode 6225 and the comb-shaped common electrode 6223 is formed using a material having reflectiveness, a reflective liquid crystal display device can be obtained. A reflective liquid crystal display device has high visibility in a bright environment such as outside, and can extremely reduce power consumption because a backlight is not necessary. Note that in the case where each of the pixel electrode 6225 and the comb-shaped common electrode 6223 is formed using both a material having light-transmitting properties and a material having reflectiveness, a semi-transmissive liquid crystal display device which has advantages of both of the above can be obtained. Note also that in the case where each of the pixel electrode 6225 and the comb-shaped common electrode 6223 is formed using a material having reflectiveness, a surface of each of the pixel electrode 6225 and the comb-shaped electrode 6223 may have unevenness. Thus, since reflected light is reflected diffusely, an advantage that angular dependency of intensity distribution of reflected light is decreased can be obtained. That is, a reflective liquid crystal display device, brightness of which is uniform at any angle, can be obtained.

Although the comb-shaped pixel electrode 6225 and the comb-shaped common electrode 6223 are both formed of the third conductive layer 6209, a pixel structure to which the present invention can apply is not limited to this and can be selected appropriately. For example, the comb-shaped pixel electrode 6225 and the comb-shaped common electrode 6223 may be both formed of the second conductive layer 6207; the comb-shaped pixel electrode 6225 and the comb-shaped common electrode 6223 may be both formed of the first conductive layer 6203; one of them may be formed of the third conductive layer 6209 and the other thereof may be formed of the second conductive layer 6207; one of them may be formed of the third conductive layer 6209 and the other thereof may be formed of the first conductive layer 6203; or one of them may be formed of the second conductive layer 6207 and the other thereof may be formed of the first conductive layer 6203.

Figure 71A:
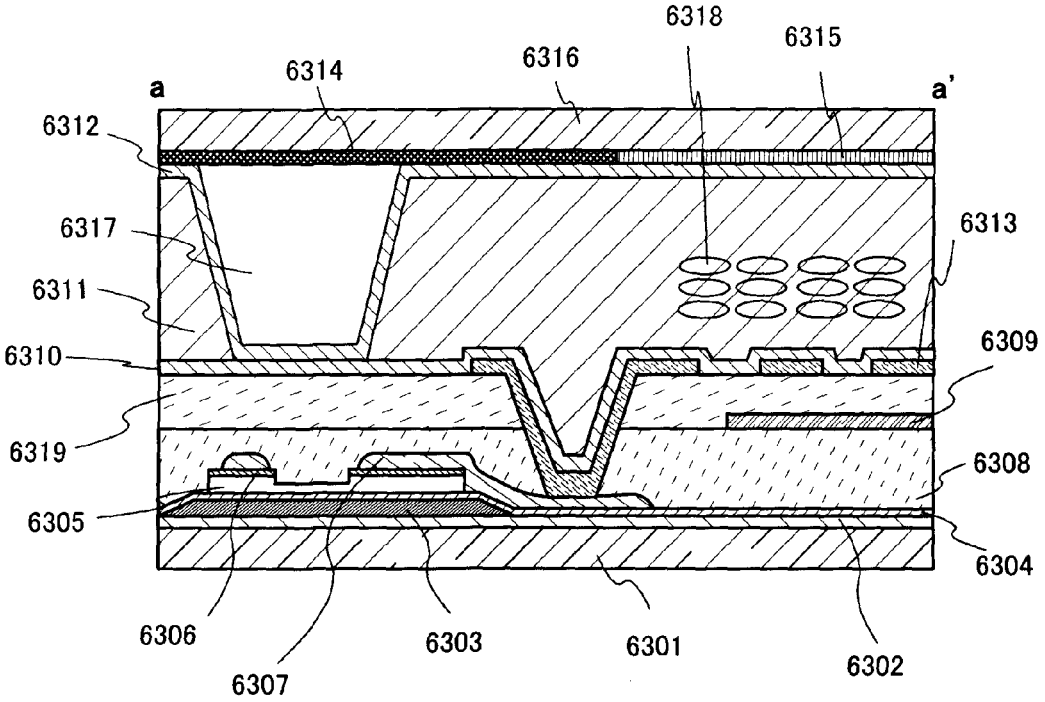
FIGS. 71A and 71B are diagrams for describing specific examples of the present invention.
Figure 71B:
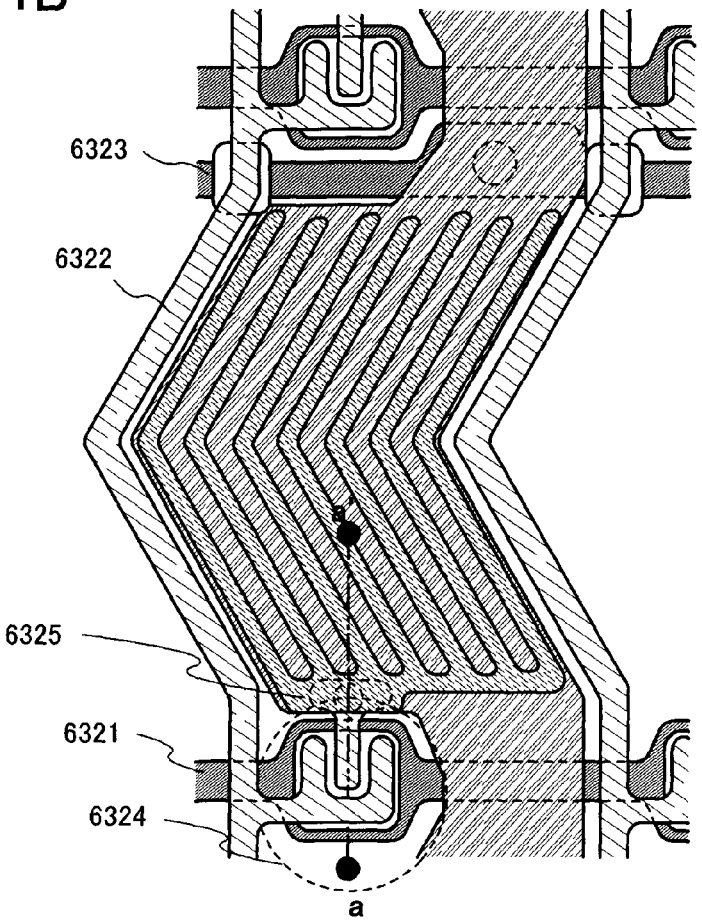

Next, another lateral electric field-mode liquid crystal display device to which the present invention is applied is described with reference to FIGS. 71A and 71B. FIGS. 71A and 71B are views of another pixel structure of a lateral electric field-mode liquid crystal display device which performs switching so that alignment of liquid crystal molecules is always horizontal to a substrate. More specifically, FIGS. 71A and 71B are a cross-sectional view and a top plan view of a pixel of a mode in which one of a pixel electrode 6225 and a common electrode 6223 is patterned into a comb-shape and the other thereof is formed into a planar-shape in a region overlapping with the comp shape, so that an electric field is applied laterally, a so-called FFS (Fringe Field Switching) mode to which the present invention is applied. FIG. 71A is a cross-sectional view of a pixel and FIG. 71B is a top plan view of the pixel. Further, the cross-sectional view of the pixel shown in FIG. 71A corresponds to a line a-a' in the top plan view of the pixel shown in FIG. 71B. By applying the present invention to a liquid crystal display device having the pixel structure shown in FIGS. 71A and 71B, a liquid crystal display device having a theoretically wide viewing angle and response speed which has small dependency on a gray scale can be obtained.

A pixel structure of an FFS mode liquid crystal display device is described with reference to FIG. 71A. The liquid crystal display device includes a basic portion which displays an image, which is called a liquid crystal panel. The liquid crystal panel is manufactured as follows: two processed substrates are attached to each other with a gap of several μm therebetween and a liquid crystal material is injected between the two substrates. In FIG. 71A, the two substrates correspond to a first substrate 6301 and a second substrate 6316. A TFT and a pixel electrode may be formed over the first substrate, and a light shielding film 6314, a color filter 6315, a spacer 6317, and a second alignment film 6312 may be formed on the second substrate.

Note that the present invention can also be implemented without forming the TFT over the first substrate 6301. When the present invention is implemented without forming the TFT, the number of steps is reduced, so that manufacturing cost can be reduced. In addition, since the structure is simple, a yield can be improved. On the other hand, when the present invention is implemented by forming the TFT, a larger display device can be obtained.

The TFT shown in FIGS. 71A and 71B is a bottom-gate TFT using an amorphous semiconductor, which has an advantage that it can be manufactured at low cost by using a large substrate. However, the present invention is not limited to this. As a structure of a TFT which can be used, there are a channel-etched type, a channel-protective type, and the like as for a bottom-gate TFT. Alternatively, a top-gate type may be used. Further, not only an amorphous semiconductor but also a polycrystalline semiconductor may be used.

Note that the present invention can also be implemented without forming the light shielding film 6314 on the second substrate 6316. When the present invention is implemented without forming the light shielding film 6314, the number of steps is reduced, so that manufacturing cost can be reduced. In addition, since the structure is simple, the yield can be improved. On the other hand, when the present invention is implemented by forming the light shielding film 6314, a display device with little light leakage at the time of black display can be obtained.

Note that the present invention can also be implemented without forming the color filter 6315 on the second substrate 6316. When the present invention is implemented without forming the color filter 6315, the number of steps is reduced, so that manufacturing cost can be reduced. In addition, since the structure is simple, the yield can be improved. On the other hand, when the present invention is implemented by forming the color filter 6315, a display device which can perform color display can be obtained.

Note that the present invention can also be implemented by dispersing spherical spacers instead of providing the spacer 6317 on the second substrate 6316. When the present invention is implemented by dispersing the spherical spacers, the number of steps is reduced, so that manufacturing cost can be reduced. In addition, since the structure is simple, the yield can be improved. On the other hand, when the present invention is implemented by forming the spacer 6317, a position of the spacer is not varied, so that a distance between the two substrates can be uniformed and a display device with little display unevenness can be obtained.

Next, as for a process to be performed to the first substrate 5501, the method described in FIGS. 71A and 71B may be used; therefore, description is omitted. Here, the first substrate 6301, a first insulating film 6302, a first conductive layer 6303, a second insulating film 6304, a first semiconductor layer 6305, a second semiconductor layer 6306, a second conductive layer 6307, a third insulating film 6308, a third conductive layer 6309, and a first alignment film 6310 correspond to the first substrate 6001, the first insulating film 6002, the first conductive layer 6003, the second insulating film 6004, the first semiconductor layer 6005, the second semiconductor layer 6006, the second conductive layer 6007, the third insulating film 6008, the third conductive layer 6009, and the first alignment film 6010 in FIG. 33A, respectively.

However, a fourth insulating film 6319 and a fourth conductive layer 6313 may be formed on the first substrate 6301 side, which is different from FIGS. 33A and 33B. More specifically, the fourth insulating film 6319 may be formed after the third conductive layer 6309 is patterned; the fourth conductive layer 6313 may be formed after the fourth insulating film 6319 is patterned so as to form a contact hole; and the first alignment film 6310 may be formed after the fourth conductive layer 6313 is similarly patterned. As materials and processing methods of the fourth insulating film 6319 and the fourth conductive layer 6313, materials and processing methods which are similar to those of the third insulating film 6308 and the third conductive layer 6309 can be used. Further, one comb-shaped electrode may be electrically connected to one of a source electrode and a drain electrode of the TFT 6324 and the other planar electrode may be electrically connected to the common electrode 6323. Thus, a lateral electric field can be effectively applied to the liquid crystal molecules 6318.

The first substrate 6301 formed as described above is attached to the second substrate 6316 provided with the light shielding film 6314, the color filter 6315, the spacer 6317, and the second alignment film 6312 with a sealant with a gap of several μm therebetween, and then, a liquid crystal material is injected between the two substrates, so that the liquid crystal panel can be manufactured. Note that although not shown in the drawings, a conductive layer may be formed on the second substrate 6316 side. By forming the conductive layer on the second substrate 6316 side, an adverse effect of electromagnetic wave noise from the outside can be reduced.

Next, a feature of the pixel structure of the FFS-mode liquid crystal panel shown in FIGS. 71A and 71B is described. The liquid crystal molecules 6318 shown in FIG. 71A are long and thin molecules each having a major axis and a minor axis. In FIG. 71A, each of the liquid crystal molecules 6318 is expressed by its length to show a direction of each of the liquid crystal molecules. That is, a direction of the major axis of the liquid crystal molecule 6318 which is expressed to be long is parallel to the paper, and the direction of the major axis becomes closer to a normal direction of the paper as the liquid crystal molecule 6318 is expressed to be shorter. That is, each of the liquid crystal molecules 6318 shown in FIG. 71A is aligned so that the direction of the major axis is always horizontal to the substrate. Although FIG. 71A shows alignment in a condition where an electric field is not applied, when an electric field is applied to each of the liquid crystal molecules 6318, each of the liquid crystal molecules rotates in a horizontal plane while the direction of the major axis is kept always horizontal to the substrate. With this state, a liquid crystal display device having a wide viewing angle can be obtained.

Next, an example of pixel layout of an FFS mode liquid crystal display device to which the present invention is applied is described with reference to FIG. 71B. The pixel of the FFS mode liquid crystal display device to which the present invention is applied may include a scan line 6321, a video signal line 6322, the common electrode 6323, the TFT 6324, and the pixel electrode 6325.

Since the scan line 6321 is electrically connected to a gate electrode of the TFT 6324, it is preferable that the scan line 6321 be formed of the first conductive layer 6303.

Since the video signal line 6322 is electrically connected to the source terminal or the drain terminal of the TFT 6324, it is preferable that the video signal line 6322 be formed of the second conductive layer 6307. Further, since the scan line 6321 and the video signal line 6322 are arranged in matrix, it is preferable that the scan line 6321 and the video signal line 6322 be at least formed of conductive layers in different layers. Note that as shown in FIG. 71B, the video signal line 6322 may be formed so as to be bent along with the shape of the pixel electrode 6325 in the pixel. Thus, an aperture ratio of the pixel can be increased, so that efficiency of the liquid crystal display device can be improved.

The common electrode 6323 is an electrode for generating a lateral electric field by being provided to be parallel to the pixel electrode 6325, and it is preferable that the common electrode 6323 be formed of the first conductive layer 6303 and the third conductive layer 6309. Note that the common electrode 6323 may be formed along the video signal line 6322 as shown in FIG. 71B. Thus, a phenomenon in which a potential of an electrode, which is supposed to be held, is changed in accordance with potential change in the video signal line 6322, namely, a so-called cross talk can be reduced. Note also that in order to reduce cross capacitance with the video signal line 6322, the first semiconductor layer 6305 may be provided in a cross region of the common electrode 6323 and the video signal line 6322 as shown in FIG. 71B.

The TFT 6324 operates as a switch which electrically connects the video signal line 6322 and the pixel electrode 6325. Note that as shown in FIG. 71B, one of a source region and a drain region of the TFT 6324 may be provided so as to surround the other of the source region and the drain region. Thus, wide channel width can be obtained in a small area and switching capability can be increased. Note also that as shown in FIG. 71B, the gate electrode of the TFT 6324 may be provided so as to surround the first semiconductor layer 6305.

The pixel electrode 6325 is electrically connected to one of the source electrode and the drain electrode of the TFT 6324. The pixel electrode 6325 is an electrode for applying signal voltage which is transmitted through the video signal line 6322 to the liquid crystal element. In addition, the pixel electrode 6325 and the common electrode 6323 may form a pixel capacitor. Thus, the pixel electrode 6325 can also have a function of holding the signal voltage which is transmitted through the video signal line 6322. Note that it is preferable that the pixel electrode 6325 be formed with a bent comb-shape as shown in FIG. 71B. Thus, since a plurality of regions having different alignment of the liquid crystal molecules 6318 can be formed, a liquid crystal display device having a wide viewing angle can be obtained. In addition, in the case where each of the pixel electrode 6325 and the comb-shaped common electrode 6323 is formed using a material having light-transmitting properties, a transmissive liquid crystal display device can be obtained. A transmissive liquid crystal display device has high color reproductivity and can display an image with high image quality. Alternatively, in the case where each of the pixel electrode 6325 and the comb-shaped common electrode 6323 is formed using a material having reflectiveness, a reflective liquid crystal display device can be obtained. A reflective liquid crystal display device has high visibility in a bright environment such as outside, and can extremely reduce power consumption because a backlight is not necessary. Note that in the case where each of the pixel electrode 6325 and the comb-shaped common electrode 6323 is formed using both a material having light-transmitting properties and a material having reflectiveness, a semi-transmissive liquid crystal display device which has advantages of both of the above can be obtained. Note also that in the case where each of the pixel electrode 6325 and the comb-shaped common electrode 6323 is formed using a material having reflectiveness, a surface of each of the pixel electrode 6325 and the comb-shaped electrode 6323 may have unevenness. Thus, since reflected light is reflected diffusely, an advantage that angular dependency of intensity distribution of reflected light is decreased can be obtained. That is, a reflective liquid crystal display device, brightness of which is uniform at any angle, can be obtained.

Although the comb-shaped pixel electrode 6325 is formed of the fourth conductive layer 6313 and the planar common electrode 6323 is formed of the third conductive layer 6309, a pixel structure to which the present invention can apply is not limited to this and can be appropriately selected as long as the structure satisfies a certain condition. More specifically, the comb-shaped electrode may be located closer to the liquid crystal than the planar electrode seeing from the first substrate 6301. This is because a lateral electric field is always generated on the side opposite to the planar electrode seeing from the comb-shaped electrode. That is, this is because the comb-shaped electrode is necessary to be located closer to the liquid crystal than the planar electrode in order to apply the lateral electric field to the liquid crystal.

In order to satisfy this condition, for example, the comb-shaped electrode may be formed of the fourth conductive layer 6313 and the planar electrode may be formed of the third conductive layer 6309; the comb-shaped electrode may be formed of the fourth conductive layer 6313 and the planar electrode may be formed of the second conductive layer 6307; the comb-shaped electrode may be formed of the fourth conductive layer 6313 and the planar electrode may be formed of the first conductive layer 6303; the comb-shaped electrode may be formed of the third conductive layer 6309 and the planar electrode may be formed of the second conductive layer 6307; the comb-shaped electrode may be formed of the third conductive layer 6309 and the planar electrode may be formed of the first conductive layer 6303; or the comb-shaped electrode may be formed of the second conductive layer 6307 and the planar electrode may be formed of the first conductive layer 6303. Although the comb-shaped electrode is electrically connected to one of the source region and the drain region of the TFT 6324 and the planar electrode is electrically connected to the common electrode 6323, the connections may be reversed. In that case, the planar electrode may be formed individually for each pixel.

Figure 72A:
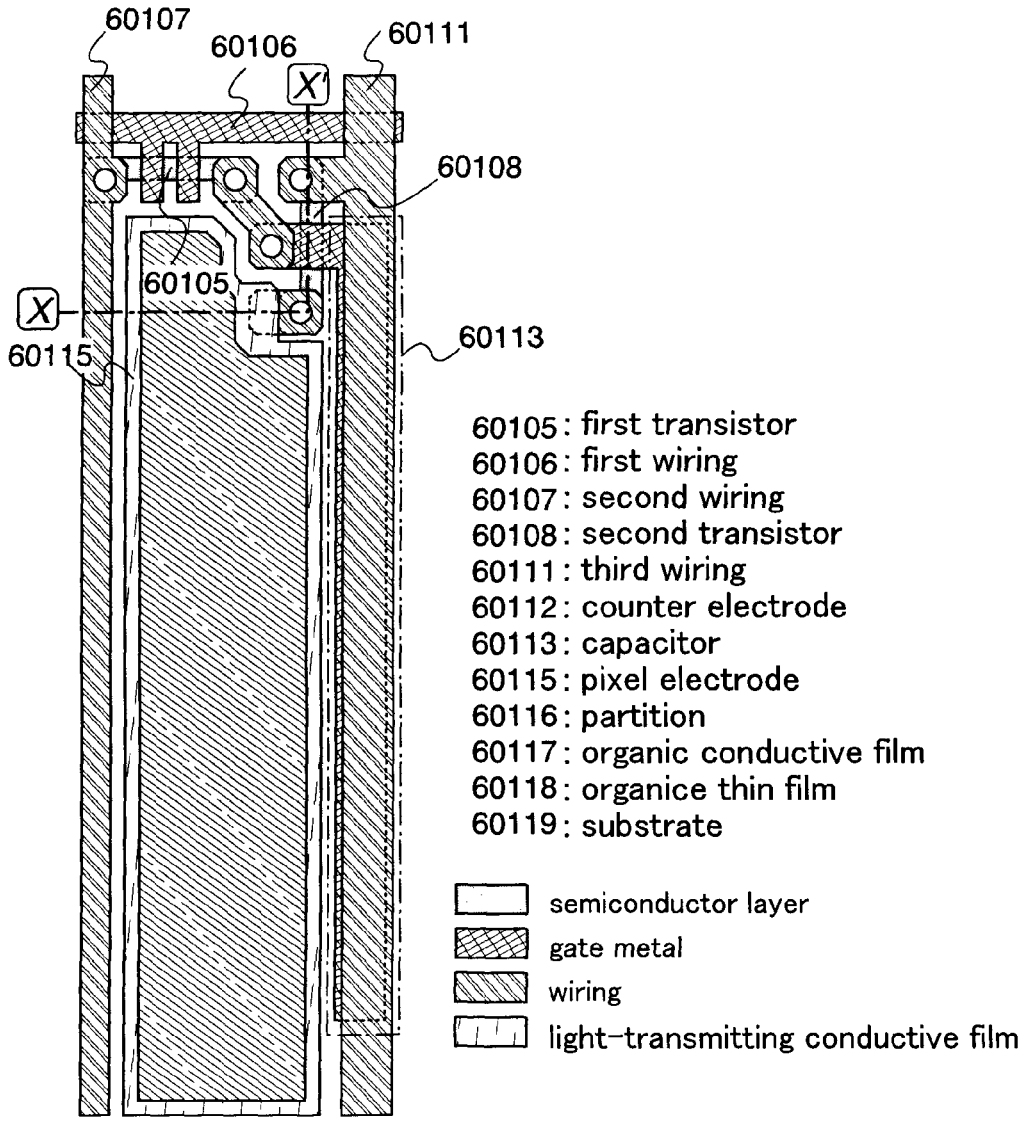
FIGS. 72A and 72B are diagrams for describing specific examples of the present invention.
Figure 72B:
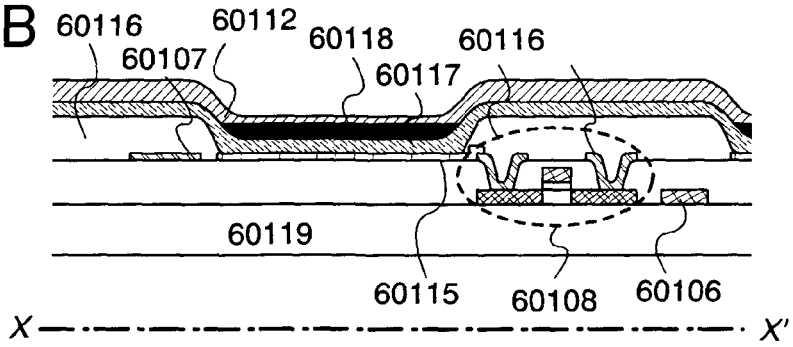

An example of a top view (a layout pattern) of a pixel including two transistors in one pixel is shown as a display device using a light-emitting device with reference to FIG. 72A. FIG. 72B is an example of a cross-sectional view along a line X-X' in FIG. 72A.

FIG. 72A shows a first transistor 60105, a first wiring 60106, a second wiring 60107, a second transistor 60108, a third wiring 60111, a counter electrode 60112, a capacitor 60113, a pixel electrode 60115, a partition 60116, an organic conductive film 60117, organic thin film 60118, and a substrate 60119. The first transistor 60105 is preferably used as a switching transistor, the first wiring 60106 is preferably used as a gate signal line, the second wiring 60107 is preferably used as a source signal line, the second transistor 60108 is preferably used as a driving transistor, and the third wiring 60111 is preferably used as a current supply line.

A gate electrode of the first transistor 60105 is electrically connected to the first wiring 60106, one of a source electrode or a drain electrode of the first transistor 60105 is electrically connected to the second wiring 60107, and the other of the source electrode or the drain electrode of the first 60105 is electrically connected to a gate electrode of the second transistor 60108 and one electrode of the capacitor 60113. Note that the gate electrode of the first transistor 60105 may include a plurality of gate electrodes. Accordingly, a leakage current in the off state of the first transistor 60105 can be reduced.

One of a source electrode or a drain electrode of the second transistor 60108 is electrically connected to the third wiring 60111, and the other of the source electrode or the drain electrode of the second transistor 60108 is electrically connected to the pixel electrode 60115. Accordingly, a current flowing to the pixel electrode 60115 can be controlled by the second transistor 60108.

The organic conductive film 60117 may be provided over the pixel electrode 60115, and the organic thin film (organic compound layer) 60118 may be further provided thereover. The counter electrode 60112 may be provided over the organic thin film (organic compound layer) 60118. Note that the counter electrode 60112 may be formed over an entire surface of all pixels to be commonly connected to all the pixels, or may be patterned using a shadow mask or the like.

Light emitted from the organic thin film (organic compound layer) 60118 is transmitted through either the pixel electrode 60115 or the counter electrode 60112.

In this case, in FIG. 72B, the case where light is emitted to the pixel electrode side, that is, a side on which the transistor and the like are formed is referred to as bottom emission; and the case where light is emitted to the opposite electrode side is referred to as top emission.

In the case of bottom emission, it is preferable that the pixel electrode 60115 be formed of a light-transmitting conductive film. In the case of top emission, it is preferable that the counter electrode 60112 be formed of a light-transmitting conductive film.

In a light-emitting device for color display, EL elements having respective light emission colors of RGB may be separately formed, or an EL element with a single color may be formed over an entire surface and light emission of RGB can be obtained by using a color filter.

Note that the structure shown in FIGS. 72A and 72B are examples, and various structures can be employed for a pixel layout, a cross-sectional structure, a stacking order of electrodes of an EL element, and the like, as well as the structures shown in FIGS. 72A and 72B. Further, as a light-emitting layer, various elements such as a crystalline element such as an LED, and an element formed of an inorganic thin film can be used as well as the element formed of the organic thin film shown in the drawing.

Note that although this embodiment mode describes the content with reference to various diagrams, the content described in each diagram can be freely applied to, combined or replaced with the content (can be part of the content) described in a different diagram. Further, as for the diagrams described so far, each portion therein can be combined with another portion, so that more and more diagrams can be provided.

Similarly, the content (can be part of the content) described with reference to each diagram in this embodiment mode can be freely applied to, combined or replaced with other contents (can be part of the contents) described in a diagram of other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 9

In this embodiment mode, a method for driving a display device is described. In particular, a method for driving a liquid crystal display device is described.

A liquid crystal display panel which can be used for the liquid crystal display device described in this embodiment mode has a structure in which a liquid crystal material is sandwiched between two substrates. An electrode for controlling an electric field applied to the liquid crystal material is provided in each of the two substrates. A liquid crystal material corresponds to a material the optical and electrical properties of which is changed by an electric field applied from outside. Therefore, a liquid crystal panel corresponds to a device in which desired optical and electrical properties can be obtained by controlling voltage applied to the liquid crystal material using the electrode included in each of the two substrates. In addition, a large number of electrodes are arranged in a planar manner, each of the electrodes corresponds to a pixel, and voltages applied to the pixels are individually controlled. Therefore, a liquid crystal display panel which can display a clear image can be obtained.

Here, response time of the liquid crystal material with respect to change in an electric field depends on a gap between the two substrates (a cell gap) and a type or the like of the liquid crystal material, but is generally several milli-seconds to several ten milli-seconds. Further, in the case where the amount of change in the electric field is small, the response time of the liquid crystal material is further lengthened. This characteristic causes a defect in image display such as an after image, a phenomenon in which traces can be seen, or decrease in contrast when the liquid crystal panel displays a moving image. In particular, when a half tone is changed into another half tone (change in the electric field is small), a degree of the above-described defect becomes high.

Meanwhile, as a particular problem of a liquid crystal panel using an active matrix method, fluctuation in writing voltage due to constant electric charge driving is given. Constant electric charge driving in this embodiment mode is described below.

A pixel circuit using an active matrix method includes a switch which controls writing and a capacitor which holds an electric charge. A method for driving the pixel circuit using the active matrix method corresponds to a method in which predetermined voltage is written in a pixel circuit by turning a switch on and immediately after that, an electric charge in the pixel circuit is held (a hold state) by turning the switch off. At the time of hold state, exchange of the electric charge between the inside and outside of the pixel circuit is not performed (a constant electric charge). Usually, a period in which the switch is in an off state is approximately several hundreds of times (the number of scanning lines) longer than a period in which the switch is in an on state. Therefore, it may be considered that the switch of the pixel circuit be almost always in an off state. As described above, constant electric charge driving in this embodiment mode corresponds to a driving method in which a pixel circuit is in a hold state in almost all periods in driving a liquid crystal panel.

Next, electrical properties of the liquid crystal material are described. A dielectric constant as well as optical properties of the liquid crystal material changed when an electric field applied from the outside is changed. That is, when it is considered that each pixel of the liquid crystal panel be a capacitor (a liquid crystal element) sandwiched between two electrodes, the capacitor corresponds to a capacitor, capacitance of which is changed in accordance with applied voltage. This phenomenon is called dynamic capacitance.

When a capacitor, capacitance of which is changed in accordance with applied voltage in this manner is driven by constant electric charge driving, the following problem occurs. That is, if capacitance of a liquid crystal element is changed in a hold state in which an electric charge is not moved, applied voltage is also changed. This is not difficult to understand from the fact that the amount of electric charges is constant in a relational expression of (the amount of electric charges)=(capacitance)×(applied voltage).

Figure 42A:
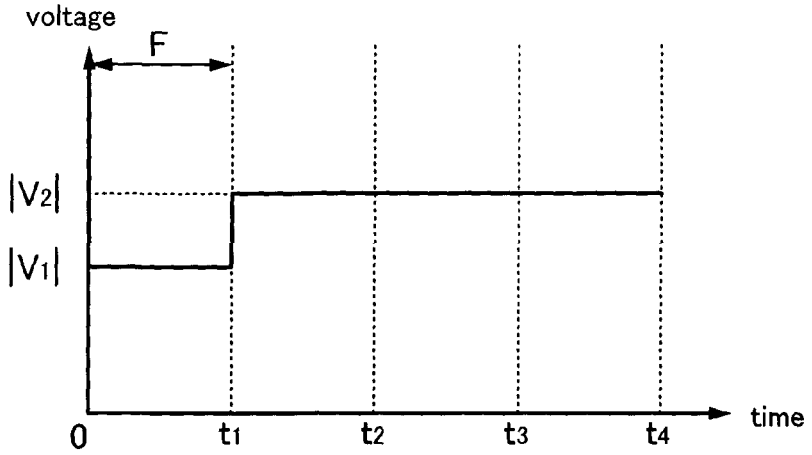
FIGS. 42A to 42C are diagrams for describing specific examples of the present invention.
Figure 42B:
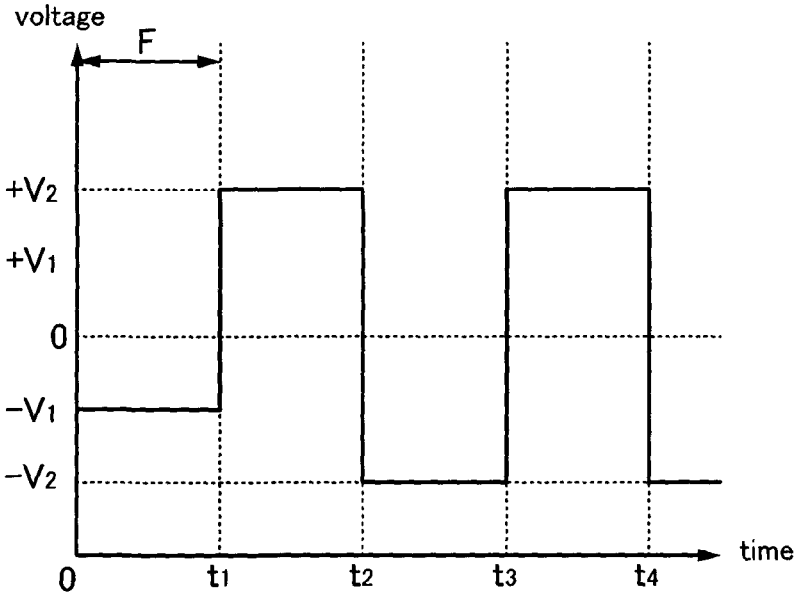
Figure 42C:
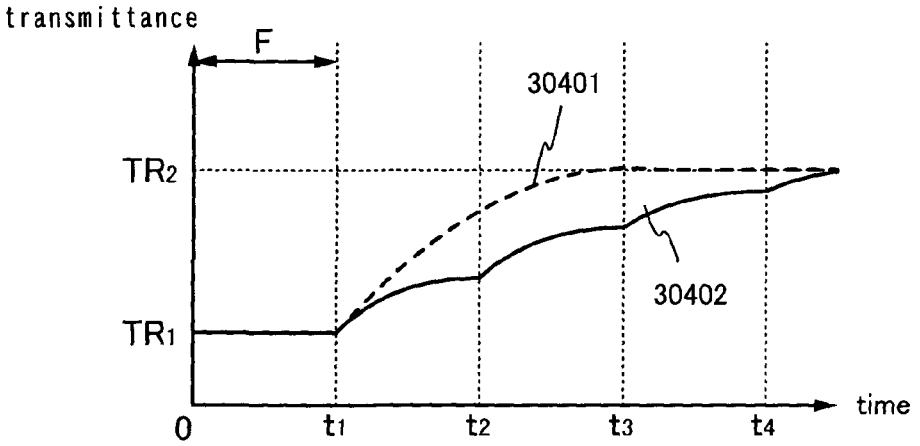

For the above-described reasons, voltage at the time of a hold state is changed from voltage at the time of writing because constant electric charge driving is performed in a liquid crystal panel using an active matrix method. Accordingly, change in transmittance of the liquid crystal element is different from change in a driving method which does not take a hold state. FIGS. 42A to 42C show this state. FIG. 42A shows an example of controlling voltage written in a pixel circuit in the case where time is represented by a horizontal axis and the absolute value of the voltage is represented by a vertical axis. FIG. 42B shows an example of controlling voltage written in the pixel circuit in the case where time is represented by a horizontal axis and the voltage is represented by a vertical axis. FIG. 42C shows time change in transmittance of the liquid crystal element in the case where the voltage shown in FIG. 42A or 42B is written in the pixel circuit when time is represented by a horizontal axis and transmittance of the liquid crystal element is represented by a vertical axis. In each of FIGS. 42A to 42C, a period F shows a period for rewriting the voltage and time for rewriting the voltage is described as $t_1$, $t_2$, $t_3$, and $t_4$.

Here, writing voltage corresponding to image data input to the liquid crystal display device corresponds to $|V_1|$ in rewriting at the time of 0 and corresponds to $|V_2|$ in rewriting at the time of $t_1$, $t_2$, $t_3$, and $t_4$ (see FIG. 42A).

Note that polarity of the writing voltage corresponding to image data input to the liquid crystal display device may be changed periodically (inversion driving: see FIG. 42B). Since direct voltage can be prevented from being applied to a liquid crystal as much as possible by using this method, burn-in or the like caused by deterioration of the liquid crystal element can be prevented. Note also that a period of changing the polarity (an inversion period) may be the same as a period of rewriting voltage. In this case, generation of a flicker caused by inversion driving can be reduced because the inversion period is short. Further, the inversion period may be a period which is integral times of the period of rewriting voltage. In this case, power consumption can be reduced because the inversion period is long and frequency of writing voltage can be decreased by changing the polarity.

FIG. 42C shows time change in transmittance of the liquid crystal element in the case where voltage as shown in FIG. 42A or 42B is applied to the liquid crystal element. Here, transmittance of the liquid crystal element corresponds to $TR_1$ in the case where the voltage $|V_1|$ is applied to the liquid crystal element and enough time passes. Similarly, transmittance of the liquid crystal element corresponds to $TR_2$ in the case where the voltage $|V_2|$ is applied to the liquid crystal element and enough time passes. When the voltage applied to the liquid crystal element is changed from $|V_1|$ to $|V_2|$ at the time of $t_1$, transmittance of the liquid crystal element does not immediately become $TR_2$ as shown by a dashed line 30401 but slowly changes. For example, when the period of rewriting voltage is the same as a frame period of an image signal of 60 Hz (16.7 milli-seconds), time for several frames is necessary until transmittance is changed to $TR_2$.

Note that smooth time change in transmittance as shown in the dashed line 30401 corresponds to time change in transmittance when the voltage $|V_2|$ is accurately applied to the liquid crystal element. In an actual liquid crystal panel, for example, a liquid crystal panel using an active matrix method, transmittance of the liquid crystal does not have time change as shown by the dashed line 30401 but has gradual time change as shown by a solid line 30402 because voltage at the time of a hold state is changed from voltage at the time of writing due to constant electric charge driving. This is because the voltage is changed due to constant electric charge driving, so that it is impossible to reach intended voltage only by one writing. Accordingly, the response time of transmittance of the liquid crystal element becomes further longer than original response time (the dashed line 30401) in appearance, so that a defect in image display such as an after image, a phenomenon in which traces can be seen, or decrease in contrast occurs.

Figure 43A:
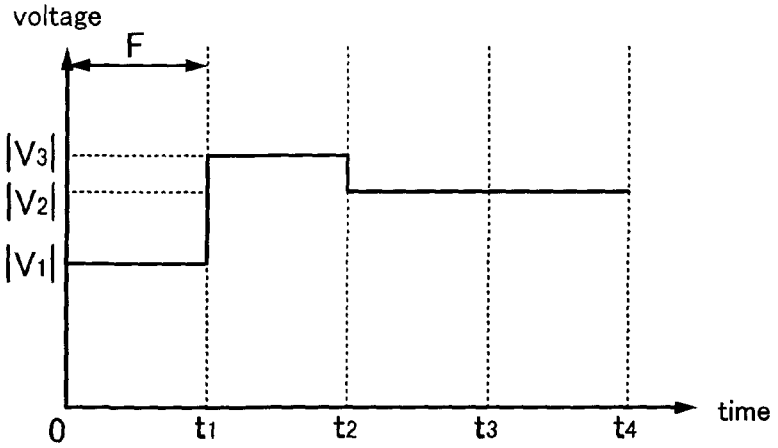
FIGS. 43A to 43C are diagrams for describing specific examples of the present invention.
Figure 43B:
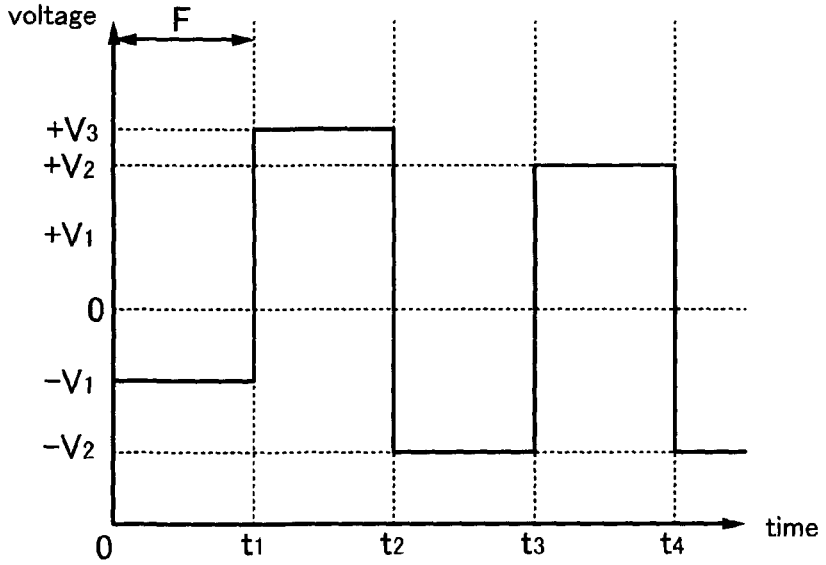
Figure 43C:
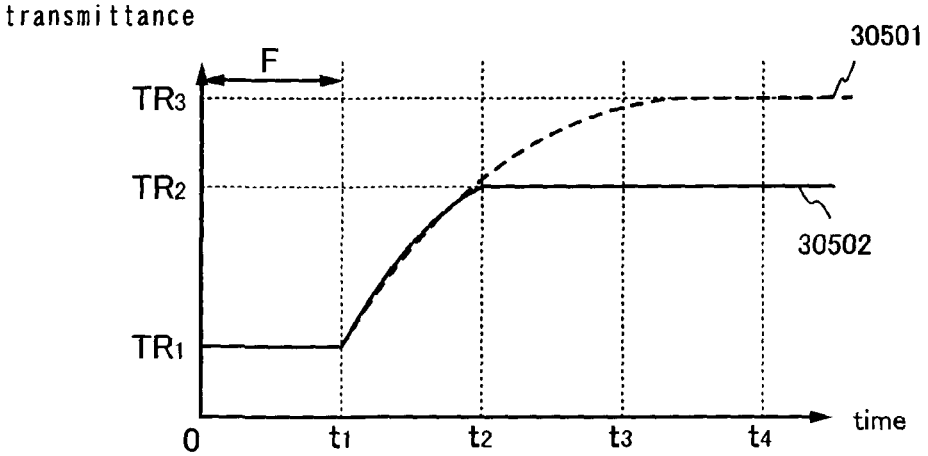

By using overdriving, it is possible to solve a phenomenon in which the response time in appearance becomes further longer because of shortage of writing by dynamic capacitance and constant electric charge driving, and the length of the original response time of the liquid crystal element at the same time. FIGS. 43A to 43C show this state. FIG. 43A shows an example of controlling voltage written in a pixel circuit in the case where time is represented by a horizontal axis and the absolute value of the voltage is represented by a vertical axis. FIG. 43B shows an example of controlling voltage written in the pixel circuit in the case where time is represented by a horizontal axis and the voltage is represented by a vertical axis. FIG. 43C shows time change in transmittance of the liquid crystal element in the case where the voltage shown in FIG. 43A or 43B is written in the pixel circuit when time is represented by a horizontal axis and the transmittance of the liquid crystal element is represented by a vertical axis. In each of FIGS. 43A to 43C, a period F shows a period for rewriting the voltage and time for rewriting the voltage is described as $t_1$, $t_2$, $t_3$, and $t_4$.

Here, writing voltage corresponding to image data input to the liquid crystal display device corresponds to $|V_1|$ in rewriting at the time of 0, corresponds to $|V_3|$ in rewriting at the time of $t_1$, and corresponds to $|V_2|$ in writing at the time of $t_2$, $t_3$, and $t_4$ (see FIG. 43A).

Note that polarity of the writing voltage corresponding to image data input to the liquid crystal display device may be changed periodically (inversion driving: see FIG. 43B). Since direct voltage can be prevented from being applied to a liquid crystal as much as possible by using this method, burn-in or the like caused by deterioration of the liquid crystal element can be prevented. Note also that a period of changing the polarity (an inversion period) may be the same as a period of rewriting voltage. In this case, generation of a flicker caused by inversion driving can be reduced because the inversion period is short. Further, the inversion period may be a period which is integral times of the period of rewriting voltage. In this case, power consumption can be reduced because the inversion period is long and frequency of writing voltage can be decreased by changing the polarity.

FIG. 43C shows time change in transmittance of the liquid crystal element in the case where voltage as shown in FIG. 43A or 43B is applied to the liquid crystal element. Here, transmittance of the liquid crystal element corresponds to $TR_1$ in the case where the voltage $|V_1|$ is applied to the liquid crystal element and enough time passes. Similarly, transmittance of the liquid crystal element corresponds to $TR_2$ in the case where the voltage $|V_2|$ is applied to the liquid crystal element and enough time passes. Similarly, transmittance of the liquid crystal element corresponds to $TR_3$ in the case where the voltage $|V_3|$ is applied to the liquid crystal element and enough time passes. When the voltage applied to the liquid crystal element is changed from $|V_1|$ to $|V_3|$ at the time of $t_1$, transmittance of the liquid crystal element is tried to be changed to $TR_3$ through several frames as shown by a dashed line 30501. However, application of the voltage $|V_3|$ is terminated at the time $t_2$ and the voltage $|V_2|$ is applied after the time $t_2$. Therefore, transmittance of the liquid crystal element does not become that as shown by the dashed line 30501 but becomes that as shown by a solid line 30502. Here, it is preferable that a value of the voltage $|V_3|$ be set so that transmittance is approximately $TR_2$ at the time of $t_2$. Here, the voltage $|V_3|$ is also referred to as overdriving voltage.

That is, the response time of the liquid crystal element can be controlled to some extent by changing $|V_3|$ which is the overdriving voltage. This is because the response time of the liquid crystals is changed by the electric field intensity. Specifically, the response time of the liquid crystal element becomes shorter as the electric field is stronger, and the response time of the liquid crystal element becomes longer as the electric field is weaker.

Note that it is preferable that $|V_3|$ which is the overdriving voltage be changed in accordance with the amount of change in the voltage, i.e., the voltage $|V_1|$ and the voltage $|V_2|$ which supply intended transmittance $TR_1$ and $TR_2$. This is because appropriate response time can be always obtained by changing $|V_3|$ which is the overdriving voltage, in accordance with the change in the response time of the liquid crystal element even when the response time of the liquid crystal element is changed by the amount of change in the voltage.

Note also that it is preferable that $|V_3|$ which is the overdriving voltage be changed depending on a mode of the liquid crystals such as a TN mode, a VA mode, an IPS mode, or an OCB mode. This is because appropriate response time can be always obtained by changing $|V_3|$ which is the overdriving voltage in accordance with the change in the response time of the liquid crystals even when the response time of the liquid crystal element is changed depending on the mode of the liquid crystal element.

Note also that the voltage rewriting period F may be the same as a frame period of an input signal. In this case, a liquid crystal display device with low manufacturing cost can be obtained because a peripheral driver circuit of the liquid crystal display device can be simplified.

Note also that the voltage rewriting period F may be shorter than the frame period of the input signal. For example, the voltage rewriting period F may be one half the frame period of the input signal, one third the frame period of the input signal, or one third or less the frame period of the input signal. It is effective to combine this method with a countermeasure against deterioration in quality of a moving image caused by hold driving of the liquid crystal display device such as black data insertion driving, backlight blinking, backlight scanning, or intermediate image insertion driving by motion compensation. That is, since required response time of the liquid crystal element is short in the countermeasure against deterioration in quality of a moving image caused by hold driving of the liquid crystal display device, the response time of the liquid crystal element can be relatively shortened easily by using overdriving described in this embodiment mode. Although the response time of the liquid crystals can be logically shortened by a cell gap, a liquid crystal material, a mode of the liquid crystal element, or the like, it is technically difficult to shorten the response time of the liquid crystal element. Therefore, it is very important to use a method for shortening the response time of the liquid crystal element by a driving method such as overdriving.

Note also that the voltage rewriting period F may be longer than the frame period of the input signal. For example, the voltage rewriting period F may be twice the frame period of the input signal, three times the frame period of the input signal, or three times or more the frame period of the input signal. It is effective to combine this method with a unit (a circuit) which determines whether voltage is not rewritten for a long period or not. That is, when the voltage is not rewritten for a long period, an operation of the circuit can be stopped during a period where no voltage is rewritten without performing a rewriting operation itself of the voltage. Therefore, a liquid crystal display device with low power consumption can be obtained.

Next, a specific method for changing $|V_3|$ which is the overdriving voltage in accordance with the voltage $|V_1|$ and the voltage $|V_2|$ which supply intended transmittance $TR_1$ and $TR_2$ is described.

Since an overdriving circuit corresponds to a circuit for appropriately controlling $|V_3|$ which is the overdriving voltage in accordance with the voltage $|V_1|$ and the voltage $|V_2|$ which supply intended transmittance $TR_1$ and $TR_2$, signals input to the overdriving circuit are a signal which is related to the voltage $|V_1|$ which supplies the transmittance $TR_1$ and a signal which is related to the voltage $|V_2|$ which supplies the transmittance $TR_2$, and a signal output from the overdriving circuit is a signal which is related to $|V_3|$ which is the overdriving voltage. Here, each of these signals may have an analog voltage value such as the voltage applied to the liquid crystal element (e.g., $|V_1|$, $|V_2|$, or $|V_3|$) or may be a digital signal for supplying the voltage applied to the liquid crystal element. Here, the signal which is related to the overdriving circuit is described as a digital signal.

Figure 44A:
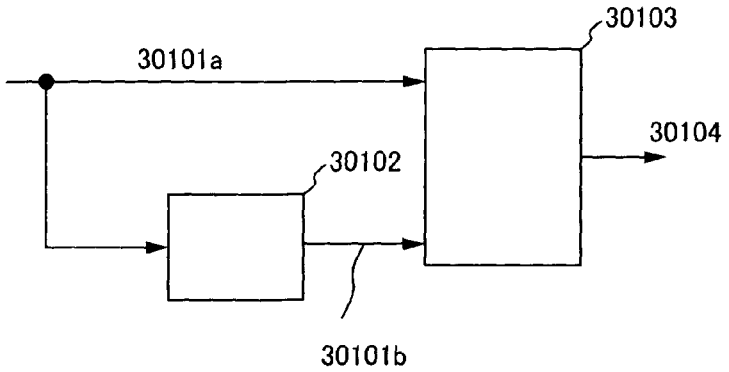
FIGS. 44A to 44E are diagrams for describing specific examples of the present invention.

First, a general structure of the overdriving circuit is described with reference to FIG. 44A. Here, input image signals 30101*a* and 30101*b* are used as signals for controlling the overdriving voltage. As a result of processing these signals, an output image signal 30104 is to be output as a signal which supplies the overdriving voltage.

Here, since the voltage $|V_1|$ and the voltage $|V_2|$ which supply intended transmittance $TR_1$ and $TR_2$ are image signals in adjacent frames, it is preferable that the input image signals 30101*a* and 30101*b* be similarly image signals in adjacent frames. In order to obtain such signals, the input image signal 30101*a* is input to a delay circuit 30102 in FIG. 44A and a signal which is consequently output can be used as the input image signal 30101*b*. For example, a memory can be given as the delay circuit 30102. That is, the input image signal 30101*a* is stored in the memory in order to delay the input image signal 30101*a* by one frame; a signal stored in the previous frame is taken out from the memory as the input image signal 30101*b* at the same time; and the input image signal 30101*a* and the input image signal 30101*b* are simultaneously input to a correction circuit 30103. Therefore, the image signals in adjacent frames can be processed. By inputting the image signals in adjacent frames to the correction circuit 30103, the output image signal 30104 can be obtained. Note that when a memory is used as the delay circuit 30102, a memory having capacity for storing an image signal for one frame in order to delay the input image signal 30101*a* by one frame (i.e., a frame memory) can be obtained. Thus, the memory can have a function as a delay circuit without causing excess and deficiency of memory capacity.

Next, the delay circuit 30102 formed mainly for reducing memory capacity is described. Since memory capacity can be reduced by using such a circuit as the delay circuit 30102, manufacturing cost can be reduced.

Figure 44B:
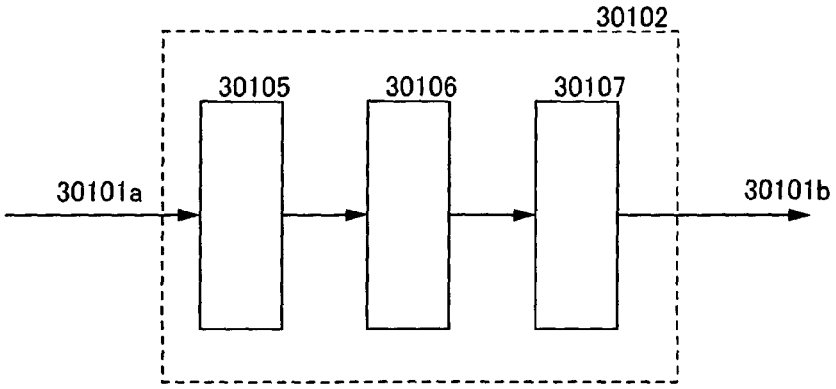

Specifically, a delay circuit as shown in FIG. 44B can be used as the delay circuit 30102 having such characteristics. The delay circuit shown in FIG. 44B includes an encoder 30105, a memory 30106, and a decoder 30107.

Operations of the delay circuit 30102 shown in FIG. 44B are as follows. First, compression treatment is performed by the encoder 30105 before the input image signal 30101*a* is stored in the memory 30106. Thus, size of data to be stored in the memory 30106 can be reduced. Accordingly, since the memory capacity can be reduced, manufacturing cost can also be reduced. Then, a compressed image signal is transferred to the decoder 30107 and extension treatment is performed here. Thus, the previous signal which is compressed by the encoder 30105 can be restored. Here, compression and extension treatment which is performed by the encoder 30105 and the decoder 30107 may be reversible treatment. Thus, since the image signal does not deteriorate even after compression and extension treatment is performed, memory capacity can be reduced without causing deterioration of quality of an image, which is finally displayed on a device. Further, compression and extension treatment which is performed by the encoder 30105 and the decoder 30107 may be non-reversible treatment. Thus, since size of data of the compressed image signal can be extremely made small, memory capacity can be significantly reduced.

Note that as a method for reducing memory capacity, various methods can be used as well as the above-described method. A method in which color information included in an image signal is reduced (e.g., tone reduction from 2.6 hundred thousand colors to 65 thousand colors is performed) or the number of data is reduced (e.g., resolution is made small) without performing image compression by an encoder, or the like can be used.

Figure 44C:
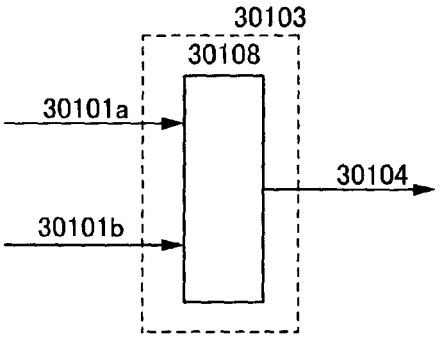

Next, specific examples of the correction circuit 30103 are described with reference to FIGS. 44C to 44E. The correction circuit 30103 corresponds to a circuit for outputting an output image signal having a certain value from two input image signals. Here, when relation between the two input image signals and the output image signal is non-linear and it is difficult to calculate the relation by simple operation, a look up table (an LUT) may be used as the correction circuit 30103. Since the relation between the two input image signals and the output image signal is calculated in advance by measurement in an LUT, the output image signal corresponding to the two input image signals can be calculated only by referring to the LUT (see FIG. 44C). By using a LUT 30108 as the correction circuit 30103, the correction circuit 30103 can be realized without performing complicated circuit design or the like.

Here, since the LUT 30108 is one of memories, it is preferable to reduce memory capacity as much as possible in order to reduce manufacturing cost. As an example of the correction circuit 30103 for realizing reduction in memory capacity, a circuit shown in FIG. 44D can be given. The correction circuit 30103 shown in FIG. 44D includes an LUT 30109 and an adder 30110. Data of difference between the input image signal 30101*a* and the output image signal 30104 to be output is stored in the LUT 30109. That is, corresponding difference data from the input image signal 30101*a* and the input image signal 30101*b* is taken out from the LUT 30109 and the taken out difference data and the input image signal 30101*a* are added by the adder 30110, so that the output image signal 30104 can be obtained. Note that when data stored in the LUT 30109 is difference data, memory capacity of the LUT 30109 can be reduced. This is because data size of difference data is smaller than data size of the output image signal 30104 itself, so that memory capacity necessary for the LUT 30109 can be made small.

In addition, when the output image signal can be calculated by simple operation such as four arithmetic operations of the two input image signals, the correction circuit 30103 can be realized by combination of simple circuits such as an adder, a subtracter, and a multiplier. Accordingly, it is not necessary to use a LUT, so that manufacturing cost can be significantly reduced. As such a circuit, a circuit shown in FIG. 44E can be given. The correction circuit 30103 shown in FIG. 44E includes a subtracter 30111, a multiplier 30112, and an adder 30113. First, difference between the input image signal 30101*a* and the input image signal 30101*b* is calculated by the subtracter 30111. After that, a differential value is multiplied by an appropriate coefficient by using the multiplier 30112. Then, by adding the differential value multiplied by appropriate coefficient to the input image signal 30101*a* by the adder 30113, the output image signal 30104 can be obtained. By using such a circuit, it is not necessary to use the LUT. Therefore, manufacturing cost can be significantly reduced.

Figure 44E:
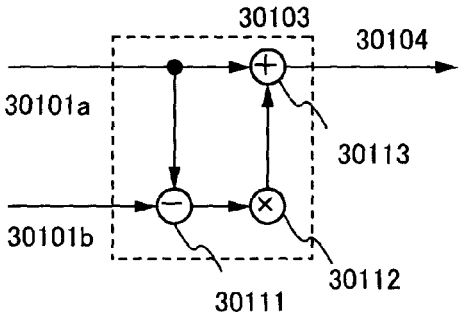
Figure 44D:
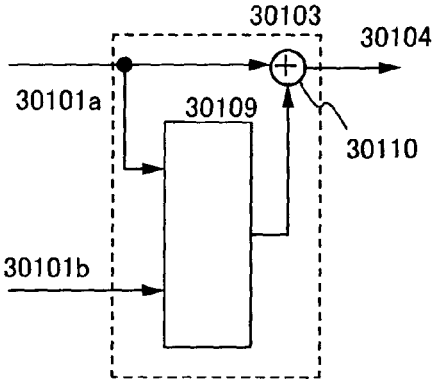

Note that by using the correction circuit 30103 shown in FIG. 44E under a certain condition, output of the inappropriate output image signal 30104 can be prevented. The condition is as follows. A value of difference between the output image signal 30104 which supplies the overdriving voltage and the input image signals 30101*a* and 30101*b* has linearity. In addition, the differential value corresponds to a coefficient multiplied by inclination of this linearity by using the adder 30112. That is, it is preferable that the correction circuit 30103 shown in FIG. 44E be used for a liquid crystal element having such properties. As a liquid crystal element having such properties, an IPS-mode liquid crystal element in which response speed has low dependency on a gray scale can be given. For example, by using the correction circuit 30103 shown in FIG. 44E for an IPS-mode liquid crystal element in this manner, manufacturing cost can be significantly reduced and an overdriving circuit which can prevent output of an inappropriate output image signal 30104 can be obtained.

Operations which are similar to those of the circuit shown in FIGS. 44A to 44E may be realized by software processing. As for the memory used for the delay circuit, another memory included in the liquid crystal display device, a memory included in a device which transfers an image displayed on the liquid crystal display device (e.g., a video card or the like included in a personal computer or a device similar to the personal computer), or the like can be used. Thus, intensity of overdriving, availability, or the like can be selected in accordance with user's preference, in addition to reduction in manufacturing cost.

Figure 45A:
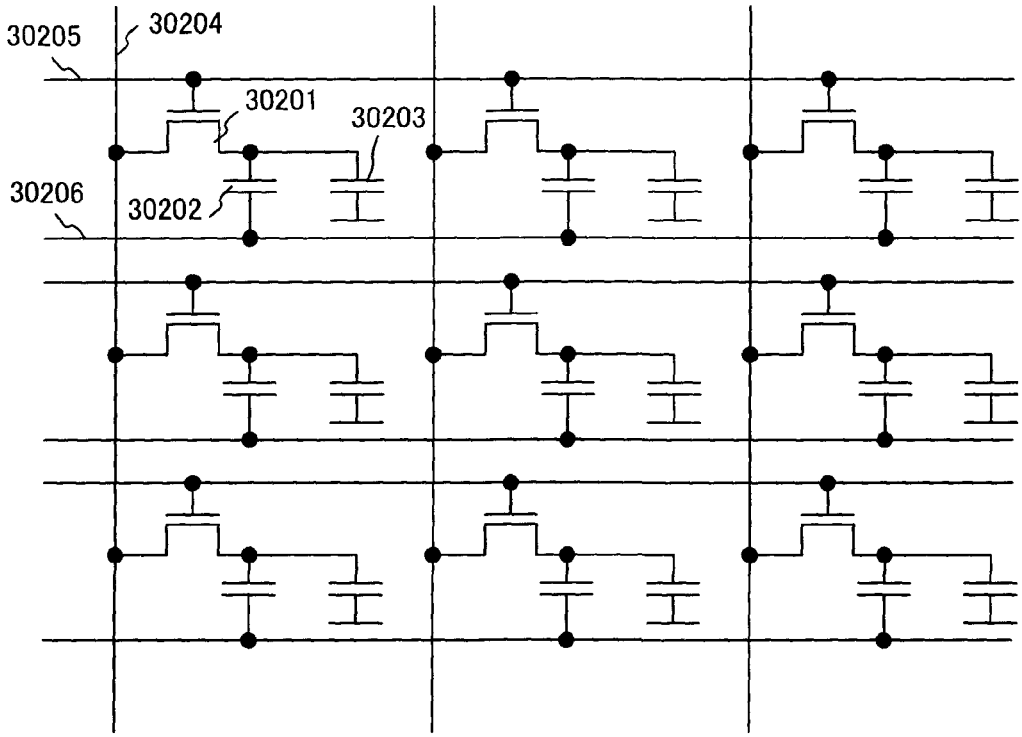
FIGS. 45A and 45B are diagrams for describing specific examples of the present invention.

Driving which controls a potential of a common line is described with reference to FIGS. 45A and 45B. FIG. 45A is a diagram showing a plurality of pixel circuits in which one common line is provided with respect to one scanning line in a display device using a display element which has capacitive properties like a liquid crystal element. Each of the pixel circuits shown in FIG. 45A includes a transistor 30201, an auxiliary capacitor 30202, a display element 30203, a video signal line 30204, a scanning line 30205, and a common line 30206.

A gate electrode of the transistor 30201 is electrically connected to the scanning line 30205; one of a source electrode and a drain electrode of the transistor 30201 is electrically connected to the video signal line 30204; and the other of the source electrode and the drain electrode of the transistor 30201 is electrically connected to one of electrodes of the auxiliary capacitor 30202 and one of electrodes of the display element 30203. In addition, the other of the electrodes of the auxiliary capacitor 30202 is electrically connected to the common line 30206.

First, in each of pixels selected by the scanning line 30205, voltage corresponding to an image signal is applied to the display element 30203 and the auxiliary capacitor 30202 through the video signal line 30204 because the transistor 30201 is turned on. At this time, when the image signal is a signal which makes all of pixels connected to the common line 30206 display a minimum gray scale or when the image signal is a signal which makes all of the pixels connected to the common line 30206 display a maximum gray scale, it is not necessary that the image signal be written in each of the pixels through the video signal line 30204. Voltage applied to the display element 30203 can be changed by changing a potential of the common line 30206 instead of writing the image signal through the video signal line 30204.

Figure 45B:
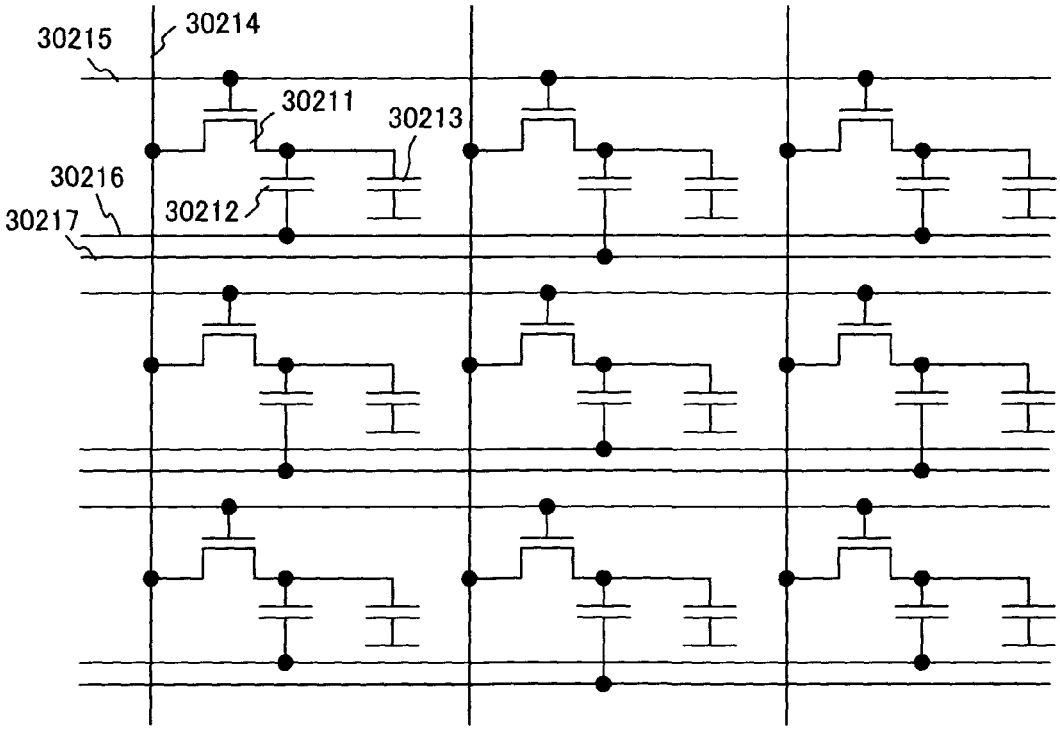

Next, FIG. 45B is a diagram showing a plurality of pixel circuits in which two common lines are provided with respect to one scanning line in a display device using a display element which has capacitive properties like a liquid crystal element. Each of the pixel circuits shown in FIG. 45B includes a transistor 30211, an auxiliary capacitor 30212, a display element 30213, a video signal line 30214, a scanning line 30215, a first common line 30216, and a second common line 30217.

A gate electrode of the transistor 30211 is electrically connected to the scanning line 30215; one of a source electrode and a drain electrode of the transistor 30211 is electrically connected to the video signal line 30214; and the other of the source electrode and the drain electrode of the transistor 30211 is electrically connected to one of electrodes of the auxiliary capacitor 30212 and one of electrodes of the display element 30213. In addition, the other of the electrodes of the auxiliary capacitor 30212 is electrically connected to the first common line 30216. Further, in a pixel which is adjacent to the pixel, the other of the electrodes of the auxiliary capacitor 30212 is electrically connected to the second common line 30217.

In the pixel circuits shown in FIG. 45B, the number of pixels which are electrically connected to one common line is small. Therefore, by changing a potential of the first common line 30216 or the second common line 30217 instead of writing an image signal through the video signal line 30214, frequency of changing voltage applied to the display element 30213 is significantly increased. In addition, source inversion driving or dot inversion driving can be performed. By performing source inversion driving or dot inversion driving, reliability of the element can be improved and a flicker can be suppressed.

Figure 46A:
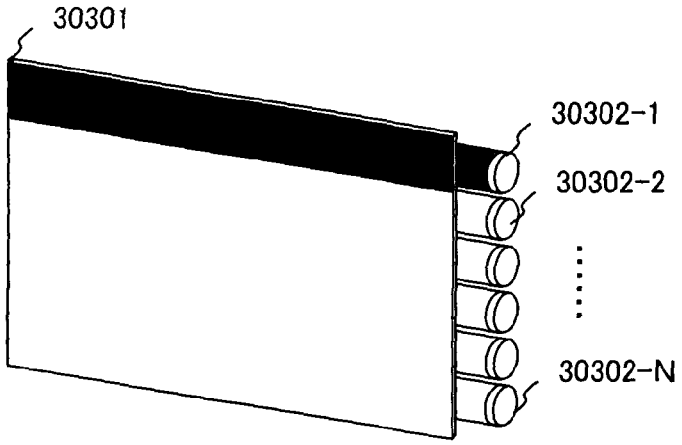
FIGS. 46A to 46C are diagrams for describing specific examples of the present invention.

A scanning backlight is described with reference to FIGS. 46A to 46C. FIG. 46A is a view showing a scanning backlight in which cold cathode fluorescent lamps are arranged. The scanning backlight shown in FIG. 46A includes a diffusion plate 30301 and N pieces of cold cathode fluorescent lamps 30302-1 to 30302-N. The N pieces of the cold cathode fluorescent lamps 30302-1 to 30302-N are arranged on the back side of the diffusion plate 30301, so that the N pieces of the cold cathode fluorescent lamps 30302-1 to 30302-N can be scanned while luminance thereof is changed.

Change in luminance of each of the cold cathode fluorescent lamps in scanning is described with reference to FIG. 46C. First, luminance of the cold cathode fluorescent lamp 30302-1 is changed for a certain period. After that, luminance of the cold cathode fluorescent lamp 30302-2 which is provided adjacent to the cold cathode fluorescent lamp 30302-1 is changed for the same period. In this manner, luminance of from the cold cathode fluorescent lamp 30302-1 to the cold cathode fluorescent lamp 30302-N is changed sequentially. Although luminance which is changed for a certain period is set to be lower than original luminance in FIG. 46C, it may also be higher than original luminance. In addition, although scanning is performed from the cold cathode fluorescent lamps 30302-1 to 30302-N, scanning may also be performed from the cold cathode fluorescent lamps 30302-N to 30302-1, which is in a reversed order.

Figure 46B:
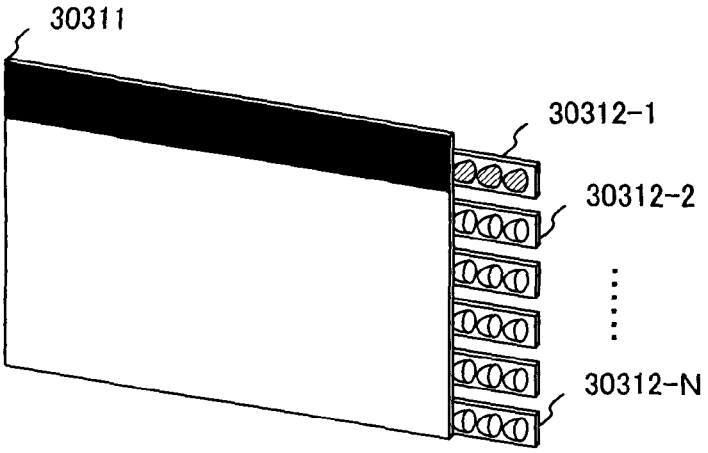
Figure 46C:
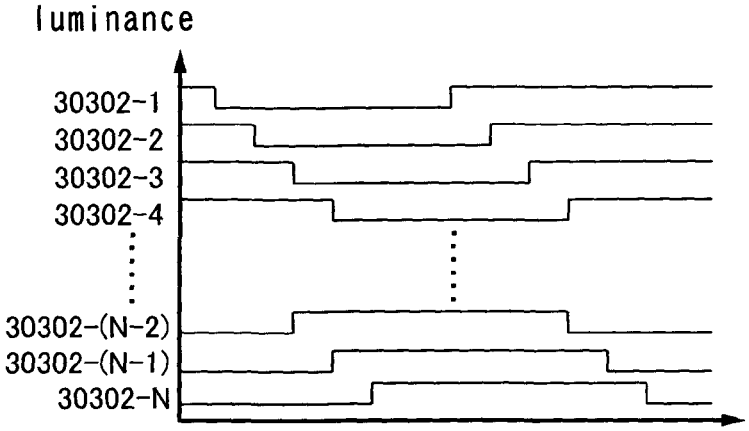

By performing driving as in FIGS. 46A to 46C, average luminance of the backlight can be decreased. Therefore, power consumption of the backlight, which mainly takes up power consumption of the liquid crystal display device, can be reduced.

Note that an LED may be used as a light source of the scanning backlight. The scanning backlight in that case is as shown in FIG. 46B. The scanning backlight shown in FIG. 46B includes a diffusion plate 30311 and light sources 30312-1 to 30312-N, in each of which LEDs are arranged. When the LED is used as the light source of the scanning backlight, there is an advantage in that the backlight can be thin and lightweight. In addition, there is also an advantage that a color reproduction area can be widened. Further, since the LEDs which are arranged in each of the light sources 30312-1 to 30312-N can be similarly scanned, a dot scanning backlight can also be obtained. By using the dot scanning backlight, image quality of a moving image can be further improved.

Note that when the LED is used as the light source of the backlight, driving can be performed by changing luminance as shown in FIG. 46C.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with another content (can be part of the content) described in a diagram of the other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

Embodiment Mode 10

In this embodiment mode, an operation of a display device is described.

Figure 81:
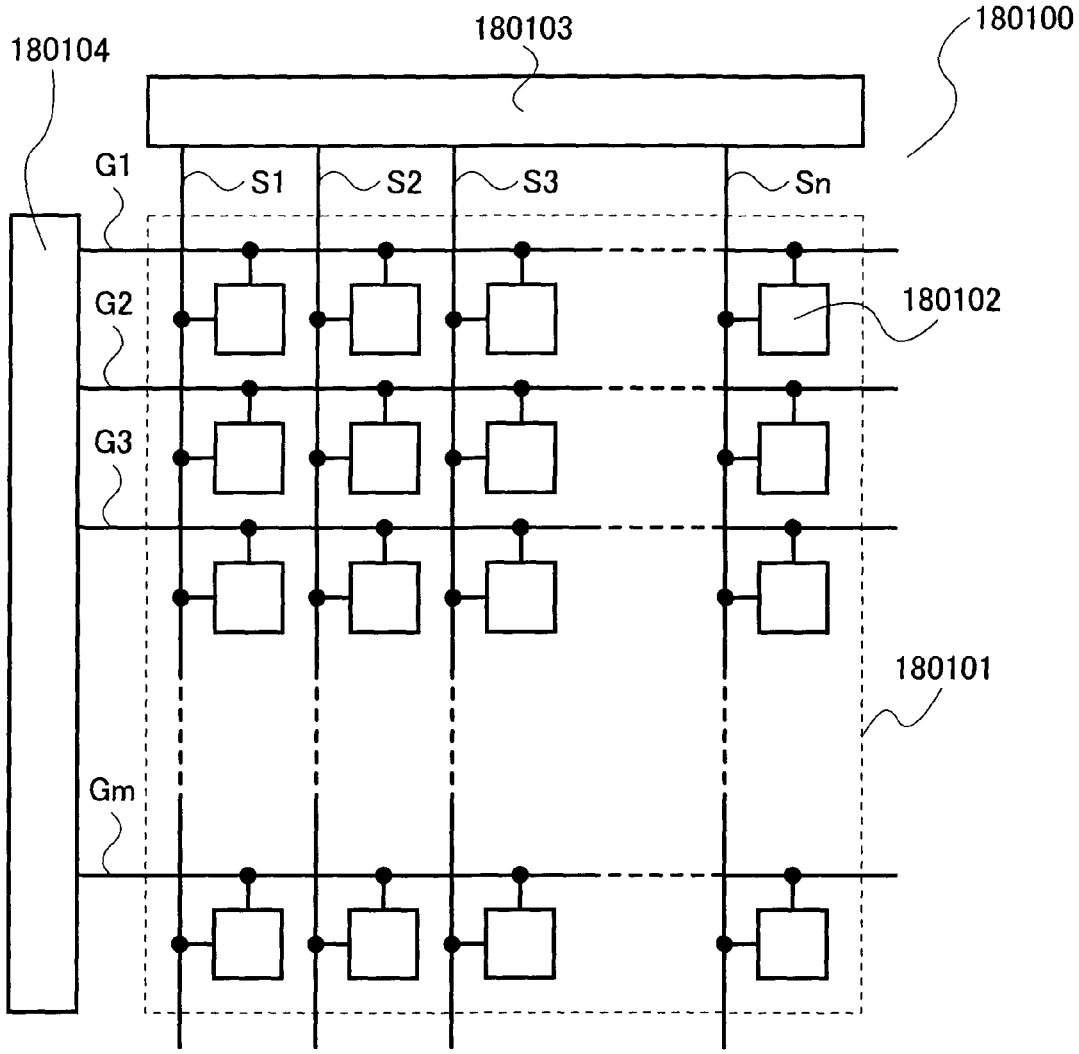
FIG. 81 is a diagram for describing a specific example of the present invention.

FIG. 81 shows a structure example of a display device.

A display device 180100 includes a pixel portion 180101, a signal line driver circuit 180103, and a scanning line driver circuit 180104. In the pixel portion 180101, a plurality of signal lines S1 to Sn extend from the signal line driver circuit 180103 in a column direction. In the pixel portion 180101, a plurality of scanning lines G1 to Gm extend from the scanning line driver circuit 180104 in a row direction. Pixels 180102 are arranged in matrix at each intersection of the plurality of signal lines S1 to Sn and the plurality of scanning lines G1 to Gm.

The signal line driver circuit 180103 has a function of outputting a signal to each of the signal lines S1 to Sn. This signal may be referred to as a video signal. The scanning line driver circuit 180104 has a function of outputting a signal to each of the scanning lines G1 to Gm. This signal may be referred to as a scan signal.

The pixel 180102 includes at least a switching element connected to the signal line. On/off of the switching element is controlled by a potential of the scanning line (a scan signal). When the switching element is turned on, the pixel 180102 is selected. On the other hand, when the switching element is turned off, the pixel 180102 is not selected.

When the pixel 180102 is selected (a selection state), a video signal is input to the pixel 180102 from the signal line. A state (e.g., luminance, transmittance, or voltage of a storage capacitor) of the pixel 180102 is changed in accordance with the video signal input thereto.

When the pixel 180102 is not selected (a non-selection state), the video signal is not input to the pixel 180102. Note that the pixel 180102 holds a potential corresponding to the video signal which is input when selected; thus, the pixel 180102 maintains the state (e.g., luminance, transmittance, or voltage of a storage capacitor) in accordance with the video signal.

Note that a structure of the display device is not limited to that shown in FIG. 81. For example, an additional wiring (such as a scanning line, a signal line, a power supply line, a capacitor line, or a common line) may be added in accordance with the structure of the pixel 180102. As another example, a circuit having various functions may be added.

Figure 82:
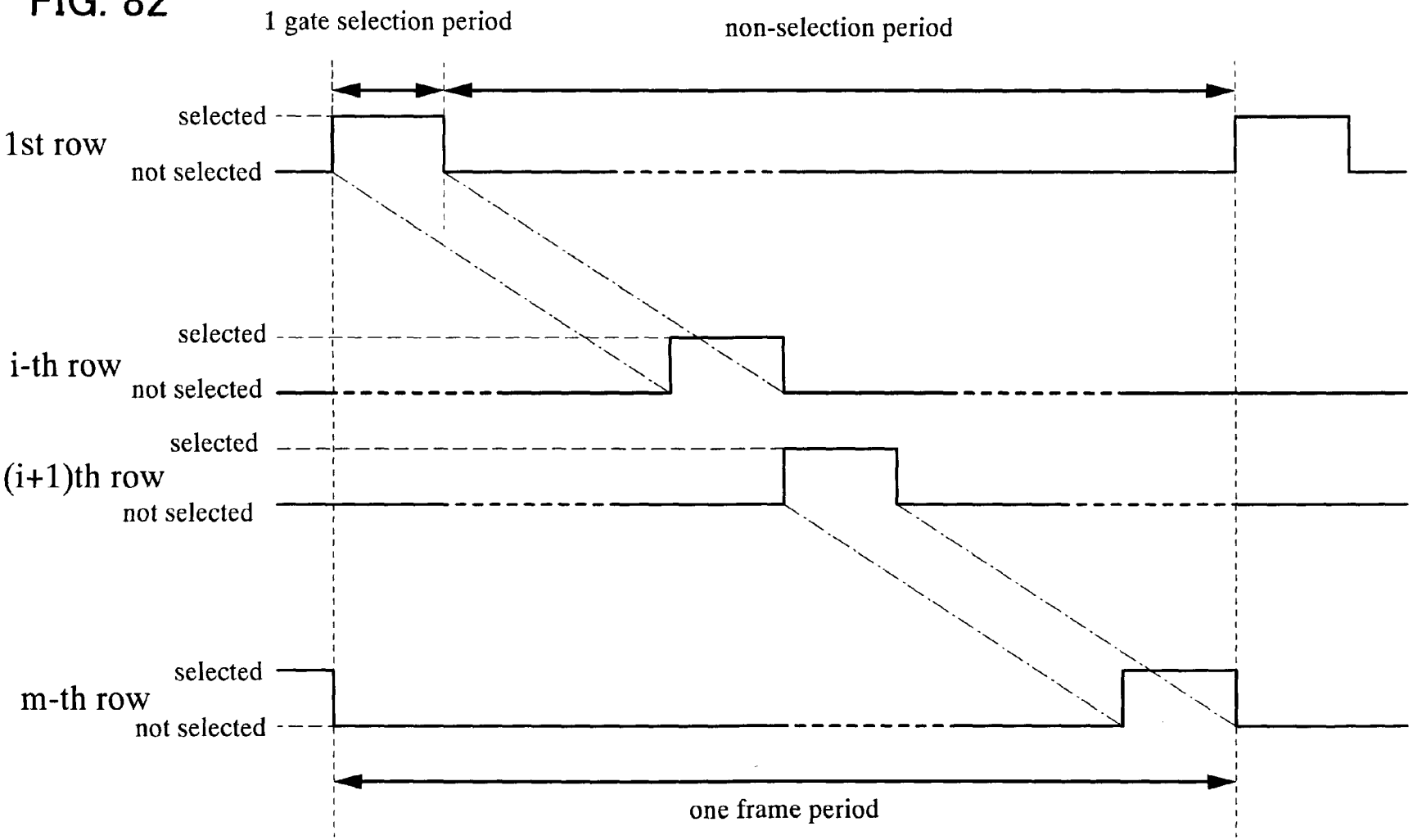
FIG. 82 is a diagram for describing a specific example of the present invention.

FIG. 82 shows an example of a timing chart for describing an operation of a display device.

The timing chart of FIG. 82 shows one frame period corresponding to a period when an image of one screen is displayed. One frame period is not particularly limited, but is preferably 1/60 second or less so that a viewer does not perceive a flicker.

The timing chart of FIG. 82 shows timing of selecting the scanning line G1 in the first row, the scanning line Gi (one of the scanning lines G1 to Gm) in the i-th row, the scanning line Gi+1 in the (i+1)th row, and the scanning line Gm in the m-th row.

At the same time as the scanning line is selected, the pixel 180102 connected to the scanning line is also selected. For example, when the scanning line Gi in the i-th row is selected, the pixel 180102 connected to the scanning line Gi in the i-th row is also selected.

The scanning lines G1 to Gm are sequentially selected (hereinafter also referred to as scanned) from the scanning line G1 in the first row to the scanning line Gm in the m-th row. For example, while the scanning line Gi in the i-th row is selected, the scanning lines (G1 to Gi−1 and Gi+1 to Gm) other than the scanning line Gi in the i-th row are not selected. Then, during the next period, the scanning line Gi+1 in the (i+1)th row is selected. Note that a period during which one scanning line is selected is referred to as one gate selection period.

Accordingly, when a scanning line in a certain row is selected, video signals from the signal lines S1 to Sn are input to a plurality of pixels 180102 connected to the scanning line, respectively. For example, while the scanning line Gi in the i-th row is selected, given video signals are input from the signal lines S1 to Sn to the plurality of pixels 180102 connected to the scanning line Gi in the i-th row, respectively. Thus, each of the plurality of pixels 180102 can be controlled individually by the scan signal and the video signal.

Next, the case where one gate selection period is divided into a plurality of subgate selection periods is described.

Figure 83:
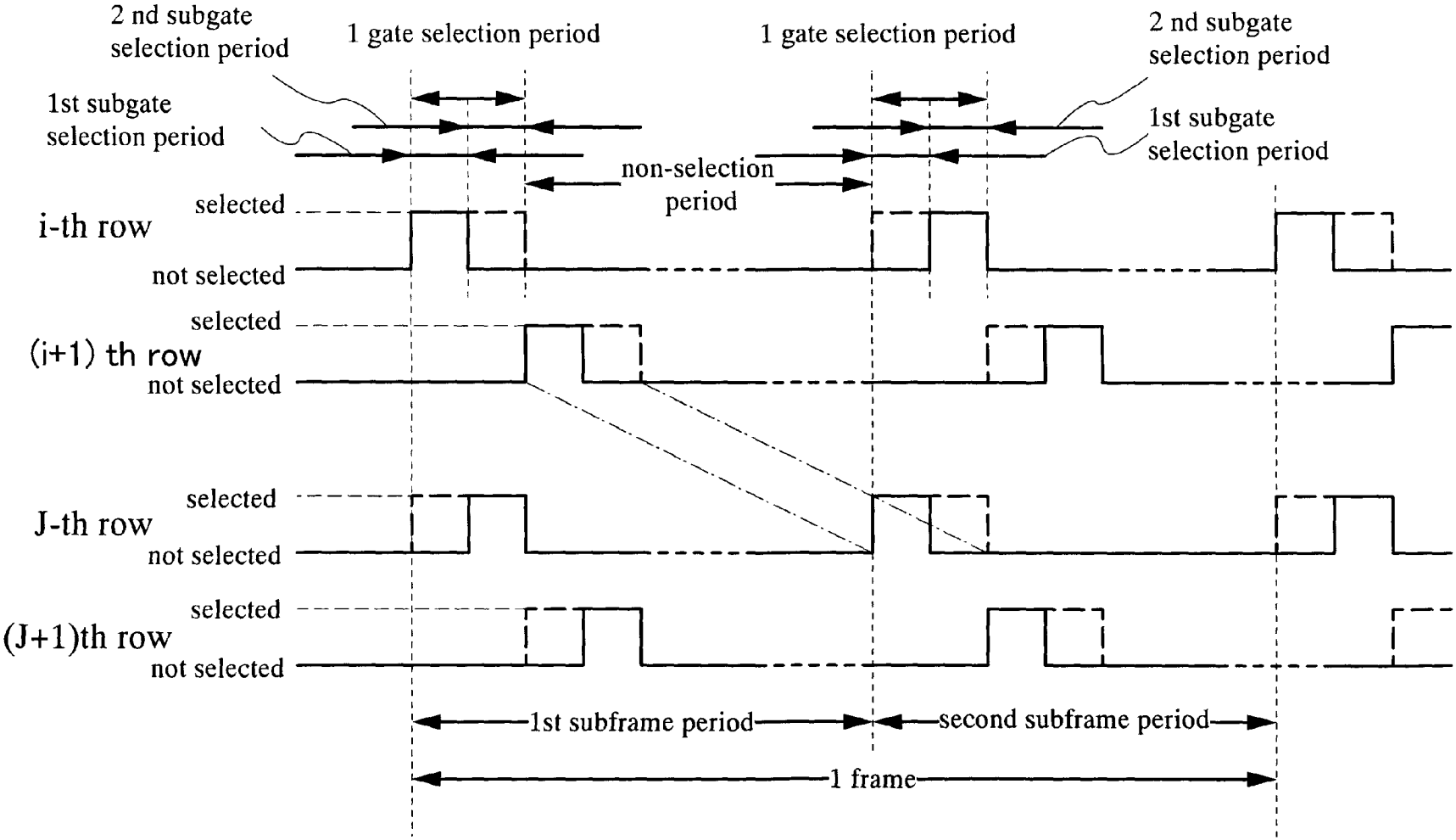
FIG. 83 is a diagram for describing a specific example of the present invention.

FIG. 83 is a timing chart in the case where one gate selection period is divided into two subgate selection periods (a first subgate selection period and a second subgate selection period).

Note that one gate selection period may be divided into three or more subgate selection periods.

The timing chart of FIG. 83 shows one frame period corresponding to a period when an image of one screen is displayed. One frame period is not particularly limited, but is preferably 1/60 second or less so that a viewer does not perceive a flicker.

Note that one frame is divided into two subframes (a first subframe and a second subframe).

The timing chart of FIG. 83 shows timing of selecting the scanning line Gi in the i-th row, the scanning line Gi+1 in the (i+1)th row, the scanning line Gj (one of the scanning lines Gi+1 to Gm) in the j-th row, and the scanning line Gj+1 in the (j+1)th row.

At the same time as the scanning line is selected, the pixel 180102 connected to the scanning line is also selected. For example, when the scanning line Gi in the i-th row is selected, the pixel 180102 connected to the scanning line Gi in the i-th row is also selected.

The scanning lines G1 to Gm are sequentially scanned in each subgate selection period. For example, in one gate selection period, the scanning line Gi in the i-th row is selected in the first subgate selection period, and the scanning line Gj in the j-th row is selected in the second subgate selection period. Thus, in one gate selection period, an operation can be performed as if the scan signals of two rows are selected. At this time, different video signals are input to the signal lines S1 to Sn in the first subgate selection period and the second subgate selection period. Accordingly, different video signals can be input to a plurality of pixels 180102 connected to the i-th row and a plurality of pixels 180102 connected to the j-th row.

Next, a driving method will be described in which a frame rate (also denoted as an input frame rate) of image data to be input, and a frame rate of display (also denoted as a display frame rate) are converted. Note that a frame rate is the number of frames per one second, and measured by Hz.

In this embodiment mode, the input frame rate is not necessarily same as the display frame rate. When the input frame rate and the display frame rate are different from each other, a frame rate can be converted by a circuit (a frame rate conversion circuit) which converts a frame rate of image data. In this manner, even when the input frame rate and the display frame rate are different from each other, display can be performed at various display frame rates.

When the input frame rate is higher than the display frame rate, part of the image data to be input is discarded and the input frame rate is converted so that display is performed at a variety of display frame rates. In this case, the display frame rate can be reduced; thus, operating frequency of a driver circuit used for display can be reduced, and power consumption can be reduced. On the other hand, when the input frame rate is lower than the display frame rate, display can be performed at a variety of converted display frame rates by a method such as a method in which all or part of the image data to be input is displayed more than once, a method in which another image is generated from the image data to be input, or a method in which an image having no relation to the image data to be input is generated. In this case, quality of moving images can be improved by the display frame rate being increased.

In this embodiment mode, a frame rate conversion method in the case where the input frame rate is lower than the display frame rate is described in detail. Note that a frame rate conversion method in the case where the input frame rate is higher than the display frame rate can be realized by performance of the frame rate conversion method in the case where the input frame rate is lower than the display frame rate in reverse order.

In this embodiment mode, an image displayed at the same frame rate as the input frame rate is referred to as a basic image. An image which is displayed at a frame rate different from that of the basic image and displayed to ensure that the input frame rate and the display frame rate are consistent to each other is referred to as an interpolation image. As the basic image, the same image as that of the image data to be input can be used. As the interpolation image, the same image as the basic image can be used. Further, an image different from the basic image can be generated, and the generated image can be used as the interpolation image.

In order to generate the interpolation image, the following methods can be used, for example: a method in which temporal change (movement of images) of the image data to be input is detected and an image in an intermediate state between the images is employed as the interpolation image, a method in which an image obtained by multiplication of luminance of the basic image by a coefficient is employed as the interpolation image, and a method in which a plurality of different images are generated from the image data to be input and the plurality of images are continuously displayed (one of the plurality of images is employed as the basic image and the other images are employed as interpolation images) so as to allow a viewer to perceive an image corresponding to the image data to be input. Examples of the method in which a plurality of different images are generated from the image data to be input include a method in which a gamma value of the image data to be input is converted and a method in which a gray scale value included in the image data to be input is divided up.

Note that an image in an intermediate state (an intermediate image) refers to an image obtained by detection of temporal change (movement of images) of the image data to be input and interpolation of the detected movement. Obtaining an intermediate image by such a method is referred to as motion compensation.

Next, a specific example of a frame rate conversion method is described. With this method, frame rate conversion multiplied by a given rational number (n/m) can be realized. Here, each of n and m is an integer equal to or more than 1. A frame rate conversion method in this embodiment mode can be treated as being divided into a first step and a second step. The first step is a step in which a frame rate is converted by being multiplied by the given rational number (n/m). As the interpolation image, the basic image or the intermediate image obtained by motion compensation may be used. The second step is a step in which a plurality of different images (sub-images) are generated from the image data to be input or from images each of which frame rate is converted in the first step and the plurality of sub-images are continuously displayed. By use of a method of the second step, human eyes can be made to perceive display such that the display appears to be an original image, despite the fact that a plurality of different images are displayed.

Note that in the frame rate conversion method in this embodiment mode, both the first and second steps can be used, the second step only can be used with the first step omitted, or the first step only can be used with the second step omitted.

Figure 84:
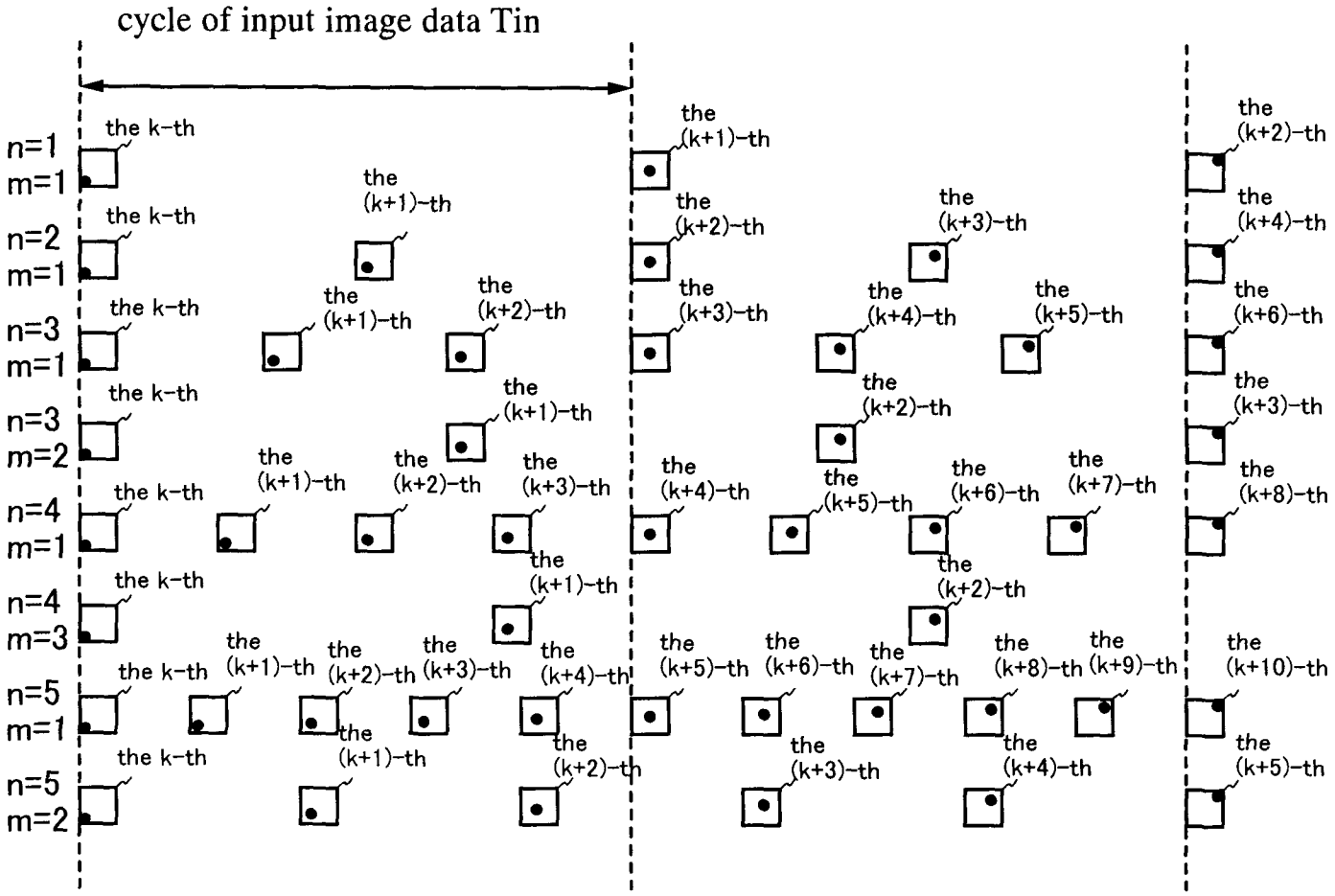
FIG. 84 is a diagram for describing a specific example of the present invention.

First, as the first step, frame rate conversion multiplied by the given rational number (n/m) is described with reference to FIG. 84. In FIG. 84, the horizontal axis represents time, and the vertical axis represents cases for various combinations of n and m. Each pattern in FIG. 84 is a schematic diagram of an image to be displayed, and a horizontal position of the pattern represents timing of display. A dot in the pattern schematically represents movement of an image. Note that each of these images is an example for explanation, and an image to be displayed is not limited to one of these images. This method can be applied to a variety of images.

The period $T_{in}$ represents a cycle of input image data. The cycle of input image data corresponds to an input frame rate. For example, when the input frame rate is 60 Hz, the cycle of input image data is 1/60 seconds. Similarly, when the input frame rate is 50 Hz, the cycle of input image data is 1/50 seconds. Accordingly, the cycle (unit:second) of input image data is an inverse number of the input frame rate (unit:Hz). Note that a variety of input frame rates such as 24 Hz, 50 Hz, 60 Hz, 70 Hz, 48 Hz, 100 Hz, 120 Hz, and 140 Hz can be used. 24 Hz is a frame rate for movies on film, for example. 50 Hz is a frame rate for a video signal of the PAL standard, for example. 60 Hz is a frame rate for a video signal of the NTSC standard, for example. 70 Hz is a frame rate of a display input signal of a personal computer, for example. 48 Hz, 100 Hz, 120 Hz, and 140 Hz are twice as high as 24 Hz, 50 Hz, 60 Hz, and 70 Hz, respectively. Note that the frame rate can not only be doubled but also multiplied by a variety of numbers. As described above, with the method shown in this embodiment mode, a frame rate can be converted with respect to an input signal of various standards.

Procedures of frame rate conversion multiplied by the given rational number (n/m) times in the first step are as follows. As a procedure 1, display timing of a k-th interpolation image (k is an integer equal to or more than 1, where the initial value is 1) with respect to a first basic image is decided. The display timing of the k-th interpolation image is at the timing of passage of a period obtained by multiplication of the cycle of input image data by k(m/n) after the first basic image is displayed. As a procedure 2, whether the coefficient k(m/n) used for deciding the display timing of the k-th interpolation image is an integer or not is determined. When the coefficient k is an integer, a (k(m/n)+1)th basic image is displayed at the display timing of the k-th interpolation image, and the first step is finished. When the coefficient k is not an integer, the operation proceeds to a procedure 3. As the procedure 3, an image used as the k-th interpolation image is decided. Specifically, the coefficient k(m/n) used for deciding the display timing of the k-th interpolation image is converted into the form (x+(y/n)). Each of x and y is an integer, and y is smaller than n. When an intermediate image obtained by motion compensation is employed as the k-th interpolation image, an intermediate image which is an image corresponding to movement obtained by multiplication of the amount of movement from an (x+1)th basic image to an (x+2)th basic image by (y/n) is employed as the k-th interpolation image. When the k-th interpolation image is the same image as the basic image, the (x+1)th basic image can be used. Note that a method for obtaining an intermediate image as an image corresponding to movement obtained by multiplication of the amount of movement of the image by y/n) will be described in detail later. As a procedure 4, a next interpolation image is set to be the objective interpolation image. Specifically, the value of k is increased by one, and the operation returns to the procedure 1.

Next, the procedures in the first step are described in detail using specific values of n and m.

Note that a mechanism for performing the procedures in the first step may be mounted on a device or decided in the design phase of the device in advance. When the mechanism for performing the procedures in the first step is mounted on the device, a driving method can be switched so that optimal operations depending on circumstances can be performed. Note that the circumstances here include contents of image data, environment inside and outside the device (e.g., temperature, humidity, barometric pressure, light, sound, electric field, the amount of radiation, altitude, acceleration, or movement speed), user settings, software version, and the like. On the other hand, when the mechanism for performing the procedures in the first step is decided in the design phase of the device in advance, driver circuits optimal for respective driving methods can be used. Moreover, since the mechanism is decided, manufacturing cost can be reduced due to efficiency of mass production.

When n=1 and m=1, that is, when a conversion ratio (n/m) is 1 (where n=1 and m=1 in FIG. 84), an operation in the first step is as follows. When k=1, in the procedure 1, display timing of a first interpolation image with respect to the first basic image is decided. The display timing of the first interpolation image is at the timing of passage of a period obtained by multiplication of the length of the cycle of input image data by k(m/n), that is, 1 after the first basic image is displayed.

Next, in the procedure 2, whether the coefficient k(m/n) used for deciding the display timing of the first interpolation image is an integer or not is determined. Here, the coefficient k(m/n) is 1, which is an integer. Consequently, the (k(m/n)+1)th basic image, that is, a second basic image is displayed at the display timing of the first interpolation image, and the first step is finished.

In other words, when the conversion ratio is 1, the k-th image is a basic image, the (k+1)th image is a basic image, and an image display cycle is equal to the cycle of input image data.

Specifically, in a driving method of a display device in which, when the conversion ratio is 1 (n/m=1), i-th image data (i is a positive integer) and (i+1)th image data are sequentially input as input image data in a certain cycle and the k-th image (k is a positive integer) and the (k+1)th image are sequentially displayed at an interval equal to the cycle of the input image data, the k-th image is displayed in accordance with the i-th image data, and the (k+1)th image is displayed in accordance with the (i+1)th image data.

Since the frame rate conversion circuit can be omitted when the conversion ratio is 1, manufacturing cost can be reduced. Further, when the conversion ratio is 1, quality of moving images can be improved compared with the case where the conversion ratio is less than 1. Moreover, when the conversion ratio is 1, power consumption and manufacturing cost can be reduced compared with the case where the conversion ratio is more than 1.

When n=2 and m=1, that is, when the conversion ratio (n/m) is 2 (where n=2 and m=1 in FIG. 84), an operation in the first step is as follows. When k=1, in the procedure 1, display timing of the first interpolation image with respect to the first basic image is decided. The display timing of the first interpolation image is at the timing of passage of a period obtained by multiplication of the length of the cycle of input image data by k(m/n), that is, 1/2 after the first basic image is displayed.

Next, in the procedure 2, whether the coefficient k(m/n) used for deciding the display timing of the first interpolation image is an integer or not is determined. Here, the coefficient k(m/n) is 1/2, which is not an integer. Consequently, the operation proceeds to the procedure 3.

In the procedure 3, an image used as the first interpolation image is decided. In order to decide the image, the coefficient 1/2 is converted into the form (x+(y/n)). In the case of the coefficient 1/2, x=0 and y=1. When an intermediate image obtained by motion compensation is employed as the first interpolation image, an intermediate image corresponding to movement obtained by multiplication of the amount of movement from the (x+1)th basic image, that is, the first basic image to the (x+2)th basic image, that is, the second basic image by (y/n), that is, 1/2 is employed as the first interpolation image. When the first interpolation image is the same image as the basic image, the (x+1)th basic image, that is, the first basic image can be used.

According to the procedures performed up to this point, the display timing of the first interpolation image and the image displayed as the first interpolation image can be decided. Next, in the procedure 4, the objective interpolation image is shifted from the first interpolation image to a second interpolation image. That is, k is changed from 1 to 2, and the operation returns to the procedure 1.

When k=2, in the procedure 1, display timing of the second interpolation image with respect to the first basic image is decided. The display timing of the second interpolation image is at the timing of passage of a period obtained by multiplication of the length of the cycle of input image data by k(m/n), that is, 1 after the first basic image is displayed.

Next, in the procedure 2, whether the coefficient k(m/n) used for deciding the display timing of the second interpolation image is an integer or not is determined. Here, the coefficient k(m/n) is 1, which is an integer. Consequently, the (k(m/n)+1)th basic image, that is, the second basic image is displayed at the display timing of the second interpolation image, and the first step is finished.

In other words, when the conversion ratio is 2 (n/m=2), the k-th image is a basic image, the (k+1)th image is an interpolation image, a (k+2)th image is a basic image, and an image display cycle is half the cycle of input image data.

Specifically, in a driving method of a display device in which, when the conversion ratio is 2 (n/m=2), the i-th image data (i is a positive integer) and the (i+1)th image data are sequentially input as input image data in a certain cycle and the k-th image (k is a positive integer), the (k+1)th image, and the (k+2)th image are sequentially displayed at an interval which is half the cycle of the input image data, the k-th image is displayed in accordance with the i-th image data, the (k+1)th image is displayed in accordance with image data corresponding to movement obtained by multiplication of the amount of movement from the i-th image data to the (i+1)th image data by 1/2, and the (k+2)th image is displayed in accordance with the (i+1)th image data.

Even specifically, in a driving method of a display device in which, when the conversion ratio is 2 (n/m=2), the i-th image data (i is a positive integer) and the (i+1)th image data are sequentially input as input image data in a certain cycle and the k-th image (k is a positive integer), the (k+1)th image, and the (k+2)th image are sequentially displayed at an interval which is half the cycle of the input image data, the k-th image is displayed in accordance with the i-th image data, the (k+1)th image is displayed in accordance with the i-th image data, and the (k+2)th image is displayed in accordance with the (i+1)th image data.

Specifically, when the conversion ratio is 2, driving is also referred to as double-frame rate driving. For example, when the input frame rate is 60 Hz, the display frame rate is 120 Hz (120 Hz driving). Accordingly, two images are continuously displayed with respect to one input image. At this time, when an interpolation image is an intermediate image obtained by motion compensation, the movement of moving images can be made to be smooth; thus, quality of the moving image can be significantly improved. Further, quality of moving images can be significantly improved particularly when the display device is an active matrix liquid crystal display device. This is related to a problem of lack of writing voltage due to change in the electrostatic capacity of a liquid crystal element by applied voltage, so-called dynamic capacitance. That is, when the display frame rate is made higher than the input frame rate, the frequency of a writing operation of image data can be increased; thus, defects such as an afterimage and a phenomenon of a moving image in which traces are seen due to lack of writing voltage because of dynamic capacitance can be reduced. Moreover, a combination of 120 Hz driving and alternating-current driving of a liquid crystal display device is effective. That is, when driving frequency of the liquid crystal display device is 120 Hz and frequency of alternating-current driving is an integer multiple of 120 Hz or a unit fraction of 120 Hz (e.g., 30 Hz, 60 Hz, 120 Hz, or 240 Hz), flickers which appear in alternating-current driving can be reduced to a level that cannot be perceived by human eyes.

When n=3 and m=1, that is, when the conversion ratio (n/m) is 3 (where n=3 and m=1 in FIG. 84), an operation in the first step is as follows. First, when k=1, in the procedure 1, display timing of the first interpolation image with respect to the first basic image is decided. The display timing of the first interpolation image is at the timing of passage of a period obtained by multiplication of the length of the cycle of input image data by k(m/n), that is, 1/3 after the first basic image is displayed.

Next, in the procedure 2, whether the coefficient k(m/n) used for deciding the display timing of the first interpolation image is an integer or not is determined. Here, the coefficient k(m/n) is 1/3, which is not an integer. Consequently, the operation proceeds to the procedure 3.

In the procedure 3, an image used as the first interpolation image is decided. In order to decide the image, the coefficient 1/3 is converted into the form (x+(y/n)). In the case of the coefficient 1/3, x=0 and y=1. When an intermediate image obtained by motion compensation is employed as the first interpolation image, an intermediate image corresponding to movement obtained by multiplication of the amount of movement from the (x+1)th basic image, that is, the first basic image to the (x+2)th basic image, that is, the second basic image by (y/n), that is, 1/3 is employed as the first interpolation image. When the first interpolation image is the same image as the basic image, the (x+1)th basic image, that is, the first basic image can be used.

According to the procedures performed up to this point, the display timing of the first interpolation image and the image displayed as the first interpolation image can be decided. Next, in the procedure 4, the objective interpolation image is shifted from the first interpolation image to the second interpolation image. That is, k is changed from 1 to 2, and the operation returns to the procedure 1.

When k=2, in the procedure 1, display timing of the second interpolation image with respect to the first basic image is decided. The display timing of the second interpolation image is at the timing of passage of a period obtained by multiplication of the length of the cycle of input image data by k(m/n), that is, 2/3 after the first basic image is displayed.

Next, in the procedure 2, whether the coefficient k(m/n) used for deciding the display timing of the second interpolation image is an integer or not is determined. Here, the coefficient k(m/n) is 2/3, which is not an integer. Consequently, the operation proceeds to the procedure 3.

In the procedure 3, an image used as the second interpolation image is decided. In order to decide the image, the coefficient 2/3 is converted into the form (x+(y/n)). In the case of the coefficient 2/3, x=0 and y=2. When an intermediate image obtained by motion compensation is employed as the second interpolation image, an intermediate image corresponding to movement obtained by multiplication of the amount of movement from the (x+1)th basic image, that is, the first basic image to the (x+2)th basic image, that is, the second basic image by (y/n), that is, 2/3 is employed as the second interpolation image. When the second interpolation image is the same image as the basic image, the (x+1)th basic image, that is, the first basic image can be used.

According to the procedures performed up to this point, the display timing of the second interpolation image and the image displayed as the second interpolation image can be decided. Next, in the procedure 4, the objective interpolation image is shifted from the second interpolation image to a third interpolation image. That is, k is changed from 2 to 3, and the operation returns to the procedure 1.

When k=3, in the procedure 1, display timing of the third interpolation image with respect to the first basic image is decided. The display timing of the third interpolation image is at the timing of passage of a period obtained by multiplication of the length of the cycle of input image data by k(m/n), that is, 1 after the first basic image is displayed.

Next, in the procedure 2, whether the coefficient k(m/n) used for deciding the display timing of the third interpolation image is an integer or not is determined. Here, the coefficient k(m/n) is 1, which is an integel Consequently, the (k(m/n)+1)th basic image, that is, the second basic image is displayed at the display timing of the third interpolation image, and the first step is finished.

In other words, when the conversion ratio is 3 (n/m=3), the k-th image is a basic image, the (k+1)th image is an interpolation image, the (k+2)th image is an interpolation image, a (k+3)th image is a basic image, and an image display cycle is 1/3 times the cycle of input image data.

Specifically, in a driving method of a display device in which, when the conversion ratio is 3 (n/m=3), the i-th image data (i is a positive integer) and the (i+1)th image data are sequentially input as input image data in a certain cycle and the k-th image (k is a positive integer), the (k+1)th image, the (k+2)th image, and the (k+3)th image are sequentially displayed at an interval which is 1/3 times the cycle of the input image data, the k-th image is displayed in accordance with the i-th image data, the (k+1)th image is displayed in accordance with image data corresponding to movement obtained by multiplication of the amount of movement from the i-th image data to the (i+1)th image data by 1/3, the (k+2)th image is displayed in accordance with image data corresponding to movement obtained by multiplication of the amount of movement from the i-th image data to the (i+1)th image data by 2/3, and the (k+3)th image is displayed in accordance with the (i+1)th image data.

Even specifically, in a driving method of a display device in which, when the conversion ratio is 3 (n/m=3), the i-th image data (i is a positive integer) and the (i+1)th image data are sequentially input as input image data in a certain cycle and the k-th image (k is a positive integer), the (k+1)th image, the (k+2)th image, and the (k+3)th image are sequentially displayed at an interval which is 1/3 times the cycle of the input image data, the k-th image is displayed in accordance with the i-th image data, the (k+1)th image is displayed in accordance with the i-th image data, the (k+2)th image is displayed in accordance with the i-th image data, and the (k+3)th image is displayed in accordance with the (i+1)th image data.

When the conversion ratio is 3, quality of moving images can be improved compared with the case where the conversion ratio is less than 3. Moreover, when the conversion ratio is 3, power consumption and manufacturing cost can be reduced compared with the case where the conversion ratio is more than 3.

Specifically, when the conversion ratio is 3, driving is also referred to as triple-frame rate driving. For example, when the input frame rate is 60 Hz, the display frame rate is 180 Hz (180 Hz driving). Accordingly, three images are continuously displayed with respect to one input image. At this time, when an interpolation image is an intermediate image obtained by motion compensation, the movement of moving images can be made to be smooth; thus, quality of the moving image can be significantly improved. Further, when the display device is an active matrix liquid crystal display device, a problem of lack of writing voltage due to dynamic capacitance can be avoided; thus, quality of moving images can be significantly improved, in particular with respect to defects such as an afterimage and a phenomenon of a moving image in which traces are seen. Moreover, a combination of 180 Hz driving and alternating-current driving of a liquid crystal display device is effective. That is, when driving frequency of the liquid crystal display device is 180 Hz and frequency of alternating-current driving is an integer multiple of 180 Hz or a unit fraction of 180 Hz (e.g., 45 Hz, 90 Hz, 180 Hz, or 360 Hz), flickers which appear in alternating-current driving can be reduced to a level that cannot be perceived by human eyes.

When n=3 and m=2, that is, when the conversion ratio (n/m) is 3/2 (where n=3 and m=2 in FIG. 84), an operation in the first step is as follows. When k=1, in the procedure 1, the display timing of the first interpolation image with respect to the first basic image is decided. The display timing of the first interpolation image is at the timing of passage of a period obtained by multiplication of the length of the cycle of input image data by k(m/n), that is, 2/3 after the first basic image is displayed.

Next, in the procedure 2, whether the coefficient k(m/n) used for deciding the display timing of the first interpolation image is an integer or not is determined. Here, the coefficient k(m/n) is 2/3, which is not an integer. Consequently, the operation proceeds to the procedure 3.

In the procedure 3, an image used as the first interpolation image is decided. In order to decide the image, the coefficient 2/3 is converted into the form (x+(y/n)). In the case of the coefficient 2/3, x=0 and y=2. When an intermediate image obtained by motion compensation is employed as the first interpolation image, an intermediate image corresponding to movement obtained by multiplication of the amount of movement from the (x+1)th basic image, that is, the first basic image to the (x+2)th basic image, that is, the second basic image by (y/n), that is, 2/3 is employed as the first interpolation image. When the first interpolation image is the same image as the basic image, the (x+1)th basic image, that is, the first basic image can be used.

According to the procedures performed up to this point, the display timing of the first interpolation image and the image displayed as the first interpolation image can be decided. Next, in the procedure 4, the objective interpolation image is shifted from the first interpolation image to the second interpolation image. That is, k is changed from 1 to 2, and the operation returns to the procedure 1.

When k=2, in the procedure 1, the display timing of the second interpolation image with respect to the first basic image is decided. The display timing of the second interpolation image is at the timing of passage of a period obtained by multiplication of the length of the cycle of input image data by k(m/n), that is, 4/3 after the first basic image is displayed.

Next, in the procedure 2, whether the coefficient k(m/n) used for deciding the display timing of the second interpolation image is an integer or not is determined. Here, the coefficient k(m/n) is 4/3, which is not an integer. Consequently, the operation proceeds to the procedure 3.

In the procedure 3, an image used as the second interpolation image is decided. In order to decide the image, the coefficient 4/3 is converted into the form (x+(y/n)). In the case of the coefficient 4/3, x=1 and y=1. When an intermediate image obtained by motion compensation is employed as the second interpolation image, an intermediate image corresponding to movement obtained by multiplication of the amount of movement from the (x+1)th basic image, that is, the second basic image to the (x+2)th basic image, that is, a third basic image by (y/n), that is, 1/3 is employed as the second interpolation image. When the second interpolation image is the same image as the basic image, the (x+1)th basic image, that is, the second basic image can be used.

According to the procedures performed up to this point, the display timing of the second interpolation image and the image displayed as the second interpolation image can be decided. Next, in the procedure 4, the objective interpolation image is shifted from the second interpolation image to the third interpolation image. That is, k is changed from 2 to 3, and the operation returns to the procedure 1.

When k=3, in the procedure 1, the display timing of the third interpolation image with respect to the first basic image is decided. The display timing of the third interpolation image is at the timing of passage of a period obtained by multiplication of the length of the cycle of input image data by k(m/n), that is, 2 after the first basic image is displayed.

Next, in the procedure 2, whether the coefficient k(m/n) used for deciding the display timing of the third interpolation image is an integer or not is determined. Here, the coefficient k(m/n) is 2, which is an integer. Consequently, the (k(m/n)+1)th basic image, that is, the third basic image is displayed at the display timing of the third interpolation image, and the first step is finished.

In other words, when the conversion ratio is 3/2 (n/m=3/2), the k-th image is a basic image, the (k+1)th image is an interpolation image, the (k+2)th image is an interpolation image, the (k+3)th image is a basic image, and an image display cycle is 2/3 times the cycle of input image data.

Specifically, in a driving method of a display device in which, when the conversion ratio is 3/2 (n/m=3/2), the i-th image data (i is a positive integer), the (i+1)th image data, and (i+2)th image data are sequentially input as input image data in a certain cycle and the k-th image (k is a positive integer), the (k+1)th image, the (k+2)th image, and the (k+3)th image are sequentially displayed at an interval which is 2/3 times the cycle of the input image data, the k-th image is displayed in accordance with the i-th image data, the (k+1)th image is displayed in accordance with image data corresponding to movement obtained by multiplication of the amount of movement from the i-th image data to the (i+1)th image data by 2/3, the (k+2)th image is displayed in accordance with image data corresponding to movement obtained by multiplication of the amount of movement from the (i+1)th image data to the (i+2)th image data by 1/3, and the (k+3)th image is displayed in accordance with the (i+2)th image data.

Even specifically, in a driving method of a display device in which, when the conversion ratio is 3/2 (n/m=3/2), the i-th image data (i is a positive integer), the (i+1)th image data, and the (i+2)th image data are sequentially input as input image data in a certain cycle and the k-th image (k is a positive integer), the (k+1)th image, the (k+2)th image, and the (k+3)th image are sequentially displayed at an interval which is 2/3 times the cycle of the input image data, the k-th image is displayed in accordance with the i-th image data, the (k+1)th image is displayed in accordance with the i-th image data, the (k+2)th image is displayed in accordance with the (i+1)th image data, and the (k+3)th image is displayed in accordance with the (i+2)th image data.

When the conversion ratio is 3/2, quality of moving images can be improved compared with the case where the conversion ratio is less than 3/2. Moreover, when the conversion ratio is 3/2, power consumption and manufacturing cost can be reduced compared with the case where the conversion ratio is more than 3/2.

Specifically, when the conversion ratio is 3/2, driving is also referred to as 3/2-fold frame rate driving or 1.5-fold frame rate driving. For example, when the input frame rate is 60 Hz, the display frame rate is 90 Hz (90 Hz driving). Accordingly, three images are continuously displayed with respect to two input images. At this time, when an interpolation image is an intermediate image obtained by motion compensation, the movement of moving images can be made to be smooth; thus, quality of the moving image can be significantly improved. Moreover, operating frequency of a circuit used for obtaining an intermediate image by motion compensation can be reduced, in particular, compared with a driving method with high driving frequency, such as 120 Hz driving (double-frame rate driving) or 180 Hz driving (triple-frame rate driving); thus, an inexpensive circuit can be used, and manufacturing cost and power consumption can be reduced. Further, when the display device is an active matrix liquid crystal display device, a problem of lack of writing voltage due to dynamic capacitance can be avoided; thus, quality of moving images can be significantly improved, in particular with respect to defects such as an afterimage and a phenomenon of a moving image in which traces are seen. Moreover, a combination of 90 Hz driving and alternating-current driving of a liquid crystal display device is effective. That is, when driving frequency of the liquid crystal display device is 90 Hz and frequency of alternating-current driving is an integer multiple of 90 Hz or a unit fraction of 90 Hz (e.g., 30 Hz, 45 Hz, 90 Hz, or 180 Hz), flickers which appear in alternating-current driving can be reduced to a level that cannot be perceived by human eyes.

Detailed description of procedures for positive integers n and m other than those described above is omitted. A conversion ratio can be set as a given rational number (n/m) in accordance with the procedures of frame rate conversion in the first step. Note that among combinations of the positive integers n and m, a combination in which a conversion ratio (n/m) can be reduced to its lowest term can be treated the same as a conversion ratio that is already reduced to its lowest term.

For example, when n=4 and m=1, that is, when the conversion ratio (n/m) is 4 (where n=4 and m=1 in FIG. 84), the k-th image is a basic image, the (k+1)th image is an interpolation image, the (k+2)th image is an interpolation image, the (k+3)th image is an interpolation image, a (k+4)th image is a basic image, and an image display cycle is 1/4 times the cycle of input image data.

Specifically, in a driving method of a display device in which, when the conversion ratio is 4 (n/m=4), the i-th image data (i is a positive integer) and the (i+1)th image data are sequentially input as input image data in a certain cycle and the k-th image (k is a positive integer), the (k+1)th image, the (k+2)th image, the (k+3)th image, and the (k+4)th image are sequentially displayed at an interval which is 1/4 times the cycle of the input image data, the k-th image is displayed in accordance with the i-th image data, the (k+1)th image is displayed in accordance with image data corresponding to movement obtained by multiplication of the amount of movement from the i-th image data to the (i+1)th image data by 1/4, the (k+2)th image is displayed in accordance with image data corresponding to movement obtained by multiplication of the amount of movement from the i-th image data to the (i+1)th image data by 1/2, the (k+3)th image is displayed in accordance with image data corresponding to movement obtained by multiplication of the amount of movement from the i-th image data to the (i+1)th image data by 3/4, and the (k+4)th image is displayed in accordance with the (i+1)th image data.

Even specifically, in a driving method of a display device in which, when the conversion ratio is 4 (n/m=4), the i-th image data (i is a positive integer) and the (i+1)th image data are sequentially input as input image data in a certain cycle and the k-th image (k is a positive integer), the (k+1)th image, the (k+2)th image, the (k+3)th image, and the (k+4)th image are sequentially displayed at an interval which is 1/4 times the cycle of the input image data, the k-th image is displayed in accordance with the i-th image data, the (k+1)th image is displayed in accordance with the i-th image data, the (k+2)th image is displayed in accordance with the i-th image data, the (k+3)th image is displayed in accordance with the i-th image data, and the (k+4)th image is displayed in accordance with the (i+1)th image data.

When the conversion ratio is 4, quality of moving images can be improved compared with the case where the conversion ratio is less than 4. Moreover, when the conversion ratio is 4, power consumption and manufacturing cost can be reduced compared with the case where the conversion ratio is more than 4.

Specifically, when the conversion ratio is 4, driving is also referred to as quadruple-frame rate driving. For example, when the input frame rate is 60 Hz, the display frame rate is 240 Hz (240 Hz driving). Accordingly, four images are continuously displayed with respect to one input image. At this time, when an interpolation image is an intermediate image obtained by motion compensation, the movement of moving images can be made to be smooth; thus, quality of the moving image can be significantly improved. Moreover, an interpolation image obtained by more accurate motion compensation can be used, in particular, compared with a driving method with low driving frequency, such as 120 Hz driving (double-frame rate driving) or 180 Hz driving (triple-frame rate driving); thus, the movement of moving images can be made smoother, and quality of the moving image can be significantly improved. Further, when the display device is an active matrix liquid crystal display device, a problem of lack of writing voltage due to dynamic capacitance can be avoided; thus, quality of moving images can be significantly improved, in particular with respect to defects such as an afterimage and a phenomenon of a moving image in which traces are seen. Moreover, a combination of 240 Hz driving and alternating-current driving of a liquid crystal display device is effective. That is, when driving frequency of the liquid crystal display device is 240 Hz and frequency of alternating-current driving is an integer multiple of 240 Hz or a unit fraction of 240 Hz (e.g., 30 Hz, 40 Hz, 60 Hz, or 120 Hz), flickers which appear in alternating-current driving can be reduced to a level that cannot be perceived by human eyes.

Moreover, when n=4 and m=3, that is, when the conversion ratio (n/m) is 4/3 (where n=4 and m=3 in FIG. 84), the k-th image is a basic image, the (k+1)th image is an interpolation image, the (k+2)th image is an interpolation image, the (k+3)th image is an interpolation image, the (k+4)th image is a basic image, and the length of an image display cycle is 3/4 times the cycle of input image data.

As a further specific description, in a driving method of a display device in which when the conversion ratio is 4/3 (n/m=4/3), the i-th image data (i is a positive integer), the (i+1)th image data, the (i+2)th image data, and the (i+3)th image data are sequentially input as input image data in a certain cycle and the k-th image (k is a positive integer), the (k+1)th image, the (k+2)th image, the (k+3)th image, and the (k+4)th image are sequentially displayed at an interval which is 3/4 times the cycle of the input image data, the k-th image is displayed in accordance with the i-th image data, the (k+1)th image is displayed in accordance with image data corresponding to movement obtained by multiplying the amount of movement from the i-th image data to the (i+1)th image data by 3/4, the (k+2)th image is displayed in accordance with image data corresponding to movement obtained by multiplying the amount of movement from the (i+1)th image data to the (i+2)th image data by 1/2, the (k+3)th image is displayed in accordance with image data corresponding to movement obtained by multiplying the amount of movement from the (i+2)th image data to the (i+3)th image data by 1/4, and the (k+4)th image is displayed in accordance with the (i+3)th image data.

As a further specific description, in a driving method of a display device in which when the conversion ratio is 4/3 (n/m=4/3), the i-th image data (i is a positive integer), the (i+1)th image data, the (i+2)th image data, and the (i+3)th image data are sequentially input as input image data in a certain cycle and the k-th image (k is a positive integer), the (k+1)th image, the (k+2)th image, the (k+3)th image, and the (k+4)th image are sequentially displayed at an interval which is 3/4 times the cycle of the input image data, the k-th image is displayed in accordance with the i-th image data, the (k+1)th image is displayed in accordance with the i-th image data, the (k+2)th image is displayed in accordance with the (i+1)th image data, the (k+3)th image is displayed in accordance with the (i+2)th image data, and the (k+4)th image is displayed in accordance with the (i+3)th image data.

When the conversion ratio is 4/3, quality of moving images can be improved compared with the case where the conversion ratio is less than 4/3. Moreover, when the conversion ratio is 4/3, power consumption and manufacturing cost can be reduced compared with the case where the conversion ratio is more than 4/3.

Specifically, when the conversion ratio is 4/3, driving is also referred to as 4/3-fold frame rate driving or 1.25-fold frame rate driving. For example, when the input frame rate is 60 Hz, the display frame rate is 80 Hz (80 Hz driving). Four images are successively displayed with respect to three input images. At this time, when an interpolation image is an intermediate image obtained by motion compensation, motion of moving images can be made smooth; thus, quality of the moving image can be significantly improved. Moreover, operating frequency of a circuit for obtaining an intermediate image by motion compensation can be reduced particularly as compared with a driving method with high driving frequency, such as 120 Hz driving (double-frame rate driving) or 180 Hz driving (triple-frame rate driving); thus, an inexpensive circuit can be used, and manufacturing cost and power consumption can be reduced. Further, when a display device is an active matrix liquid crystal display device, a problem of shortage of writing voltage due to dynamic capacitance can be avoided; thus, quality of moving images can be significantly improved particularly with respect to defects such as traces and afterimages of a moving image. Moreover, a combination of 80 Hz driving and alternating-current driving of a liquid crystal display device is effective. That is, when driving frequency of the liquid crystal display device is 80 Hz and frequency of alternating-current driving is an integer multiple of 80 Hz or a unit fraction of 80 Hz (e.g., 40 Hz, 80 Hz, 160 Hz, or 240 Hz), a flicker which appears by alternating-current driving can be reduced to the extent that the flicker is not perceived by human eyes.

Moreover, when n=5 and m=1, that is, when the conversion ratio (n/m) is 5 (where n=5 and m=1 in FIG. 84), the k-th image is a basic image, the (k+1)th image is an interpolation image, the (k+2)th image is an interpolation image, the (k+3)th image is an interpolation image, a (k+4)th image is an interpolation image, a (k+5)th image is a basic image, and the length of an image display cycle is 1/5 times the cycle of input image data.

As a further specific description, in a driving method of a display device in which when the conversion ratio is 5 (n/m=5), the i-th image data (i is a positive integer) and the (i+1)th image data are sequentially input as input image data in a certain cycle and the k-th image (k is a positive integer), the (k+1)th image, the (k+2)th image, the (k+3)th image, the (k+4)th image, and the (k+5)th image are sequentially displayed at an interval whose length is 1/5 times the cycle of the input image data, the k-th image is displayed in accordance with the i-th image data, the (k+1)th image is displayed in accordance with image data corresponding to movement obtained by multiplying the amount of movement from the i-th image data to the (i+1)th image data by 1/5, the (k+2)th image is displayed in accordance with image data corresponding to movement obtained by multiplying the amount of movement from the i-th image data to the (i+1)th image data by 2/5, the (k+3)th image is displayed in accordance with image data corresponding to movement obtained by multiplying the amount of movement from the i-th image data to the (i+1)th image data by 3/5, the (k+4)th image is displayed in accordance with image data corresponding to movement obtained by multiplying the amount of movement from the i-th image data to the (i+1)th image data by 4/5, and the (k+5)th image is displayed in accordance with the (i+1)th image data.

As a further specific description, in a driving method of a display device in which when the conversion ratio is 5 (n/m=5), the i-th image data (i is a positive integer) and the (i+1)th image data are sequentially input as input image data in a certain cycle and the k-th image (k is a positive integer), the (k+1)th image, the (k+2)th image, the (k+3)th image, the (k+4)th image, and the (k+5)th image are sequentially displayed at an interval whose length is 1/5 times the cycle of the input image data, the k-th image is displayed in accordance with the i-th image data, the (k+1)th image is displayed in accordance with the i-th image data, the (k+2)th image is displayed in accordance with the i-th image data, the (k+3)th image is displayed in accordance with the i-th image data, the (k+4)th image is displayed in accordance with the i-th image data, and the (k+5)th image is displayed in accordance with the (i+1)th image data.

When the conversion ratio is 5, quality of moving images can be improved compared with the case where the conversion ratio is less than 5. Moreover, when the conversion ratio is 5, power consumption and manufacturing cost can be reduced compared with the case where the conversion ratio is more than 5.

Specifically, when the conversion ratio is 5, driving is also referred to as 5-fold frame rate driving. For example, when the input frame rate is 60 Hz, the display frame rate is 300 Hz (300 Hz driving). Five images are successively displayed with respect to one input image. At this time, when an interpolation image is an intermediate image obtained by motion compensation, motion of moving images can be made smooth; thus, quality of the moving image can be significantly improved. Moreover, an intermediate image obtained by more accurate motion compensation can be used as the interpolation image particularly as compared with a driving method with low driving frequency, such as 120 Hz driving (double-frame rate driving) or 180 Hz driving (triple-frame rate driving); thus, motion of moving images can be made smoother, and quality of the moving image can be significantly improved. Further, when a display device is an active matrix liquid crystal display device, a problem of shortage of writing voltage due to dynamic capacitance can be avoided; thus, quality of moving images can be significantly improved particularly with respect to defects such as traces and afterimages of a moving image. Moreover, a combination of 300 Hz driving and alternating-current driving of a liquid crystal display device is effective. That is, when driving frequency of the liquid crystal display device is 300 Hz and frequency of alternating-current driving is an integer multiple of 300 Hz or a unit fraction of 300 Hz (e.g., 30 Hz, 50 Hz, 60 Hz, or 100 Hz), a flicker which appears by alternating-current driving can be reduced to the extent that the flicker is not perceived by human eyes.

Moreover, when n=5 and m=2, that is, when the conversion ratio (n/m) is 5/2 (where n=5 and m=2 in FIG. 84), the k-th image is a basic image, the (k+1)th image is an interpolation image, the (k+2)th image is an interpolation image, the (k+3)th image is an interpolation image, a (k+4)th image is an interpolation image, the (k+5)th image is a basic image, and the length of an image display cycle is 2/5 times the cycle of input image data.

As a further specific description, in a driving method of a display device in which when the conversion ratio is 5/2 (n/m=5/2), the i-th image data (i is a positive integer), the (i+1)th image data, and the (i+2)th image data are sequentially input as input image data in a certain cycle and the k-th image (k is a positive integer), the (k+1)th image, the (k+2)th image, the (k+3)th image, the (k+4)th image, and the (k+5)th image are sequentially displayed at an interval whose length is 2/5 times the cycle of the input image data, the k-th image is displayed in accordance with the i-th image data, the (k+1)th image is displayed in accordance with image data corresponding to movement obtained by multiplying the amount of movement from the i-th image data to the (i+1)th image data by 2/5, the (k+2)th image is displayed in accordance with image data corresponding to movement obtained by multiplying the amount of movement from the i-th image data to the (i+1)th image data by 4/5, the (k+3)th image is displayed in accordance with image data corresponding to movement obtained by multiplying the amount of movement from the (i+1)th image data to the (i+2)th image data by 1/5, the (k+4)th image is displayed in accordance with image data corresponding to movement obtained by multiplying the amount of movement from the (i+1)th image data to the (i+2)th image data by 3/5, and the (k+5)th image is displayed in accordance with the (i+2)th image data.

As a further specific description, in a driving method of a display device in which when the conversion ratio is 5/2 (n/m=5/2), the i-th image data (i is a positive integer), the (i+1)th image data, the (i+2)th image data, and the (i+3)th image data are sequentially input as input image data in a certain cycle and the k-th image (k is a positive integer), the (k+1)th image, the (k+2)th image, the (k+3)th image, the (k+4)th image, and the (k+5)th image are sequentially displayed at an interval whose length is 2/5 times the cycle of the input image data, the k-th image is displayed in accordance with the i-th image data, the (k+1)th image is displayed in accordance with the i-th image data, the (k+2)th image is displayed in accordance with the i-th image data, the (k+3)th image is displayed in accordance with the (i+1)th image data, the (k+4)th image is displayed in accordance with the (i+1)th image data, and the (k+5)th image is displayed in accordance with the (i+2)th image data.

When the conversion ratio is 5/2, quality of moving images can be improved compared with the case where the conversion ratio is less than 5/2. Moreover, when the conversion ratio is 5/2, power consumption and manufacturing cost can be reduced compared with the case where the conversion ratio is more than 5/2.

Specifically, when the conversion ratio is 5/2, driving is also referred to as 5/2-fold frame rate driving or 2.5-fold frame rate driving. For example, when the input frame rate is 60 Hz, the display frame rate is 150 Hz (150 Hz driving). Five images are successively displayed with respect to two input images. At this time, when an interpolation image is an intermediate image obtained by motion compensation, motion of moving images can be made smooth; thus, quality of the moving image can be significantly improved. Moreover, an intermediate image obtained by more accurate motion compensation can be used as the interpolation image particularly as compared with a driving method with low driving frequency, such as 120 Hz driving (double-frame rate driving); thus, motion of moving images can be made smoother, and quality of the moving image can be significantly improved. Further, operating frequency of a circuit for obtaining an intermediate image by motion compensation can be reduced particularly as compared with a driving method with high driving frequency, such as 180 Hz driving (triple-frame rate driving); thus, an inexpensive circuit can be used, and manufacturing cost and power consumption can be reduced. Furthermore, when a display device is an active matrix liquid crystal display device, a problem of shortage of writing voltage due to dynamic capacitance can be avoided; thus, quality of moving images can be significantly improved particularly with respect to defects such as traces and afterimages of a moving image. Moreover, a combination of 150 Hz driving and alternating-current driving of a liquid crystal display device is effective. That is, when driving frequency of the liquid crystal display device is 150 Hz and frequency of alternating-current driving is an integer multiple of 150 Hz or a unit fraction of 150 Hz (e.g., 30 Hz, 50 Hz, 75 Hz, or 150 Hz), a flicker which appears by alternating-current driving can be reduced to the extent that the flicker is not perceived by human eyes.

In this manner, by setting positive integers n and m to be various numbers, the conversion ratio can be set to be a given rational number (n/m). Although detailed description is omitted, when n is 10 or less, combinations listed below can be possible: n=1, m=1, that is, the conversion ratio is (n/m)=1 (1-fold frame rate driving, 60 Hz), n=2, m=1, that is, the conversion ratio is (n/m)=2 (double-frame rate driving, 120 Hz), n=3, m=1, that is, the conversion ratio is (n/m)=3 (triple-frame rate driving, 180 Hz), n=3, m=2, that is, the conversion ratio is (n/m)=3/2 (3/2-fold frame rate driving, 90 Hz), n=4, m=1, that is, the conversion ratio is (n/m)=4 (quadruple-frame rate driving, 240 Hz), n=4, m=3, that is, the conversion ratio is (n/m)=4/3 (4/3-fold frame rate driving, 80 Hz), n=5, m=1, that is, the conversion ratio is (n/m)=5/1 (5-fold frame rate driving, 300 Hz), n=5, m=2, that is, the conversion ratio is (n/m)=5/2 (5/2-fold frame rate driving, 150 Hz), n=5, m=3, that is, the conversion ratio is (n/m)=5/3 (5/3-fold frame rate driving, 100 Hz), n=5, m=4, that is, the conversion ratio is (n/m)=5/4 (5/4-fold frame rate driving, 75 Hz), n=6, m=1, that is, the conversion ratio is (n/m)=6 (6-fold frame rate driving, 360 Hz), n=6, m=5, that is, the conversion ratio is (n/m)=6/5 (6/5-fold frame rate driving, 72 Hz), n=7, m=1, that is, the conversion ratio is (n/m)=7 (7-fold frame rate driving, 420 Hz), n=7, m=2, that is, the conversion ratio is (n/m)=7/2 (7/2-fold frame rate driving, 210 Hz), n=7, m=3, that is, the conversion ratio is (n/m)=7/3 (7/3-fold frame rate driving, 140 Hz), n=7, m=4, that is, the conversion ratio is (n/m)=7/4 (7/4-fold frame rate driving, 105 Hz), n=7, m=5, that is, the conversion ratio is (n/m)=7/5 (7/5-fold frame rate driving, 84 Hz), n=7, m=6, that is, the conversion ratio is (n/m)=7/6 (7/6-fold frame rate driving, 70 Hz), n=8, m=1, that is, the conversion ratio is (n/m)=8 (8-fold frame rate driving, 480 Hz), n=8, m=3, that is, the conversion ratio is (n/m)=8/3 (8/3-fold frame rate driving, 160 Hz), n=8, m=5, that is, the conversion ratio is (n/m)=8/5 (8/5-fold frame rate driving, 96 Hz), n=8, m=7, that is, the conversion ratio is (n/m)=8/7 (8/7-fold frame rate driving, 68.6 Hz), n=9, m=1, that is, the conversion ratio is (n/m)=9 (9-fold frame rate driving, 540 Hz), n=9, m=2, that is, the conversion ratio is (n/m)=9/2 (9/2-fold frame rate driving, 270 Hz), n=9, m=4, that is, the conversion ratio is (n/m)=9/4 (9/4-fold frame rate driving, 135 Hz), n=9, m=5, that is, the conversion ratio is (n/m)=9/5 (9/5-fold frame rate driving, 108 Hz), n=9, m=7, that is, the conversion ratio is (n/m)=9/7 (9/7-fold frame rate driving, 77.1 Hz), n=9, m=8, that is, the conversion ratio is (n/m)=9/8 (9/8-fold frame rate driving, 67.5 Hz), n=10, m=1, that is, the conversion ratio is (n/m)=10 (10-fold frame rate driving, 600 Hz), n=10, m=3, that is, the conversion ratio is (n/m)=10/3 (10/3-fold frame rate driving, 200 Hz), n=10, m=7, that is, the conversion ratio is (n/m)=10/7 (10/7-fold frame rate driving, 85.7 Hz), and n=10, m=9, that is, the conversion ratio is (n/m)=10/9 (10/9-fold frame rate driving, 66.7 Hz). Note that these frequencies are examples in the case where the input frame rate is 60 Hz. With regard to other frame rates, a product obtained by multiplication of each conversion ratio and an input frame rate can be a driving frequency.

In the case where n is an integer more than 10, although specific numbers for n and m are not stated here, the procedure of frame rate conversion in the first step can be obviously applied to various n and m.

Depending on how many images which can be displayed without motion compensation to the input image data are included in the displayed images, the conversion ratio can be determined. Specifically, the smaller m becomes, the higher the proportion of images which can be displayed without motion compensation to the input image data becomes. When motion compensation is performed less frequently, power consumption can be reduced because a circuit which performs motion compensation operates less frequently. In addition, the likelihood of generation of an image (an intermediate image which does not correctly reflect motion of an image) including an error by motion compensation can be decreased, so that image quality can be improved. For example, as such a conversion ratio, in the case where n is 10 or less, 1, 2, 3, 3/2, 4, 5, 5/2, 6, 7, 7/2, 8, 9, 9/2, or 10 is possible. By employing such a conversion ratio, especially when an intermediate image obtained by motion compensation is used as an interpolation image, the image quality can be improved and power consumption can be reduced because the number (half the total number of images input) of images, which can be displayed without motion compensation to the input image data, is comparatively large and motion compensation is performed less frequently in the case where m is 2; and because the number (equal to the total number of images input) of images which can be displayed without motion compensation to the input image data is large and motion compensation cannot be performed in the case where m is 1. On the other hand, the larger m becomes, the smoother motion of images can be made because an intermediate image which is generated by motion compensation with high accuracy is used.

Note that, in the case where a display device is a liquid crystal display device, the conversion ratio can be determined in accordance with a response time of a liquid crystal element. Here, the response time of the liquid crystal element is the time from when a voltage applied to the liquid crystal element is changed until when the liquid crystal element responds. When the response time of the liquid crystal element differs depending on the amount of change of the voltage applied to the liquid crystal element, an average of the response times of plural typical voltage changes can be used. Alternatively, the response time of the liquid crystal element can be defined as MRPT (moving picture response time). Then, by frame rate conversion, the conversion ratio which enables the length of the image display cycle to be near the response time of the liquid crystal element can be determined. Specifically, the response time of the liquid crystal element is preferably the time from the value obtained by multiplication of the cycle of input image data and the inverse number of the conversion ratio, to approximately half that value. In this manner, the image display cycle can be made to correspond to the response time of the liquid crystal element, so that the image quality is improved. For example, when the response time of the liquid crystal element is more than or equal to 4 milliseconds and less than or equal to 8 milliseconds, double-frame rate driving (120 Hz driving) can be employed. This is because the image display cycle of 120 Hz driving is approximately 8 milliseconds and the half of the image display cycle of 120 Hz driving is approximately 4 milliseconds. Similarly, for example, when the response time of the liquid crystal element is more than or equal to 3 milliseconds and less than or equal to 6 milliseconds, triple-frame rate driving (180 Hz driving) can be employed; when the response time of the liquid crystal element is more than or equal to 5 milliseconds and less than or equal to 11 milliseconds, 1.5-fold frame rate driving (90 Hz driving) can be employed; when the response time of the liquid crystal element is more than or equal to 2 milliseconds and less than or equal to 4 milliseconds, quadruple-frame rate driving (240 Hz driving) can be employed; and when the response time of the liquid crystal element is more than or equal to 6 milliseconds and less than or equal to 12 milliseconds, 1.25-fold frame rate driving (80 Hz driving) can be employed. Note that this is similar to the case of other driving frequencies.

Note that the conversion ratio can also be determined by a tradeoff between the quality of the moving image, and power consumption and manufacturing cost. That is, the quality of the moving image can be improved by increasing the conversion ratio while power consumption and manufacturing cost can be reduced by decreasing the conversion ratio. Therefore, when n is 10 or less, each conversion ratio has an advantage described below.

When the conversion ratio is 1, the quality of the moving image can be improved compared to the case where the conversion ratio is less than 1, and power consumption and manufacturing cost can be more reduced compared to the case where the conversion ratio is more than 1. Moreover, since m is small, power consumption can be reduced while high image quality is obtained. Further, by applying the conversion ratio of 1 to a liquid crystal display device in which the response time of the liquid crystal elements is approximately 1 times the cycle of input image data, the image quality can be improved.

When the conversion ratio is 2, the quality of the moving image can be more improved compared to the case where the conversion ratio is less than 2, and power consumption and manufacturing cost can be more reduced compared to the case where the conversion ratio is more than 2. Moreover, since m is small, power consumption can be reduced while high image quality is obtained. Further, by applying the conversion ratio of 2 to a liquid crystal display device in which the response time of the liquid crystal elements is approximately 1/2 times the cycle of input image data, the image quality can be improved.

When the conversion ratio is 3, the quality of the moving image can be more improved compared to the case where the conversion ratio is less than 3, and power consumption and manufacturing cost can be more reduced compared to the case where the conversion ratio is more than 3. Moreover, since m is small, power consumption can be reduced while high image quality is obtained. Further, by applying the conversion ratio of 3 to a liquid crystal display device in which the response time of the liquid crystal elements is approximately 1/3 times the cycle of input image data, the image quality can be improved.

When the conversion ratio is 3/2, the quality of the moving image can be more improved compared to the case where the conversion ratio is less than 3/2, and power consumption and manufacturing cost can be more reduced compared to the case where the conversion ratio is more than 3/2. Moreover, since m is small, power consumption can be reduced while high image quality is obtained. Further, by applying the conversion ratio of 3/2 to a liquid crystal display device in which the response time of the liquid crystal elements is approximately 2/3 times the cycle of input image data, the image quality can be improved.

When the conversion ratio is 4, the quality of the moving image can be more improved compared to the case where the conversion ratio is less than 4, and power consumption and manufacturing cost can be more reduced compared to the case where the conversion ratio is more than 4. Moreover, since m is small, power consumption can be reduced while high image quality is obtained. Further, by applying the conversion ratio of 4 to a liquid crystal display device in which the response time of the liquid crystal elements is approximately 1/4 times the cycle of input image data, the image quality can be improved.

When the conversion ratio is 4/3, the quality of the moving image can be more improved compared to the case where the conversion ratio is less than 4/3, and power consumption and manufacturing cost can be more reduced compared to the case where the conversion ratio is more than 4/3. Moreover, since m is large, motion of the image can be made smoother. Further, by applying the conversion ratio of 4/3 to a liquid crystal display device in which the response time of the liquid crystal elements is approximately 3/4 times the cycle of input image data, the image quality can be improved.

When the conversion ratio is 5, the quality of the moving image can be more improved compared to the case where the conversion ratio is less than 5, and power consumption and manufacturing cost can be more reduced compared to the case where the conversion ratio is more than 5. Moreover, since m is small, power consumption can be reduced while high image quality is obtained. Further, by applying the conversion ratio of 5 to a liquid crystal display device in which the response time of the liquid crystal elements is approximately 1/5 times the cycle of input image data, the image quality can be improved.

When the conversion ratio is 5/2, the quality of the moving image can be more improved compared to the case where the conversion ratio is less than 5/2, and power consumption and manufacturing cost can be more reduced compared to the case where the conversion ratio is more than 5/2. Moreover, since m is small, power consumption can be reduced while high image quality is obtained. Further, by applying the conversion ratio of 5/2 to a liquid crystal display device in which the response time of the liquid crystal elements is approximately 2/5 times the cycle of input image data, the image quality can be improved.

When the conversion ratio is 5/3, the quality of the moving image can be more improved compared to the case where the conversion ratio is less than 5/3, and power consumption and manufacturing cost can be more reduced compared to the case where the conversion ratio is more than 5/3. Moreover, since m is large, motion of the image can be made smoother. Further, by applying the conversion ratio of 5/3 to a liquid crystal display device in which the response time of the liquid crystal elements is approximately 3/5 times the cycle of input image data, the image quality can be improved.

When the conversion ratio is 5/4, the quality of the moving image can be more improved compared to the case where the conversion ratio is less than 5/4, and power consumption and manufacturing cost can be more reduced compared to the case where the conversion ratio is more than 5/4. Moreover, since m is large, motion of the image can be made smoother. Further, by applying the conversion ratio of 5/4 to a liquid crystal display device in which the response time of the liquid crystal elements is approximately 4/5 times the cycle of input image data, the image quality can be improved.

When the conversion ratio is 6, the quality of the moving image can be more improved compared to the case where the conversion ratio is less than 6, and power consumption and manufacturing cost can be more reduced compared to the case where the conversion ratio is more than 6. Moreover, since m is small, power consumption can be reduced while high image quality is obtained. Further, by applying the conversion ratio of 6 to a liquid crystal display device in which the response time of the liquid crystal elements is approximately 1/6 times the cycle of input image data, the image quality can be improved.

When the conversion ratio is 6/5, the quality of the moving image can be more improved compared to the case where the conversion ratio is less than 6/5, and power consumption and manufacturing cost can be more reduced compared to the case where the conversion ratio is more than 6/5. Moreover, since m is large, motion of the image can be made smoother. Further, by applying the conversion ratio of 6/5 to a liquid crystal display device in which the response time of the liquid crystal elements is approximately 5/6 times the cycle of input image data, the image quality can be improved.

When the conversion ratio is 7, the quality of the moving image can be more improved compared to the case where the conversion ratio is less than 7, and power consumption and manufacturing cost can be more reduced compared to the case where the conversion ratio is more than 7. Moreover, since m is small, power consumption can be reduced while high image quality is obtained. Further, by applying the conversion ratio of 7 to a liquid crystal display device in which the response time of the liquid crystal elements is approximately 11 times the cycle of input image data, the image quality can be improved.

When the conversion ratio is 7/2, the quality of the moving image can be more improved compared to the case where the conversion ratio is less than 7/2, and power consumption and manufacturing cost can be more reduced compared to the case where the conversion ratio is more than 7/2. Moreover, since m is small, power consumption can be reduced while high image quality is obtained. Further, by applying the conversion ratio of 7/2 to a liquid crystal display device in which the response time of the liquid crystal elements is approximately 2/7 times the cycle of input image data, the image quality can be improved.

When the conversion ratio is 7/3, the quality of the moving image can be more improved compared to the case where the conversion ratio is less than 7/3, and power consumption and manufacturing cost can be more reduced compared to the case where the conversion ratio is more than 7/3. Moreover, since m is large, motion of the image can be made smoother. Further, by applying the conversion ratio of 7/3 to a liquid crystal display device in which the response time of the liquid crystal elements is approximately 3/7 times the cycle of input image data, the image quality can be improved.

When the conversion ratio is 7/4, the quality of the moving image can be more improved compared to the case where the conversion ratio is less than 7/4, and power consumption and manufacturing cost can be more reduced compared to the case where the conversion ratio is more than 7/4. Moreover, since m is large, motion of the image can be made smoother. Further, by applying the conversion ratio of 7/4 to a liquid crystal display device in which the response time of the liquid crystal elements is approximately 4/7 times the cycle of input image data, the image quality can be improved.

When the conversion ratio is 7/5, the quality of the moving image can be more improved compared to the case where the conversion ratio is less than 7/5, and power consumption and manufacturing cost can be more reduced compared to the case where the conversion ratio is more than 7/5. Moreover, since m is large, motion of the image can be made smoother. Further, by applying the conversion ratio of 7/5 to a liquid crystal display device in which the response time of the liquid crystal elements is approximately 5/7 times the cycle of input image data, the image quality can be improved.

When the conversion ratio is 7/6, the quality of the moving image can be more improved compared to the case where the conversion ratio is less than 7/6, and power consumption and manufacturing cost can be more reduced compared to the case where the conversion ratio is more than 7/6. Moreover, since m is large, motion of the image can be made smoother. Further, by applying the conversion ratio of 7/6 to a liquid crystal display device in which the response time of the liquid crystal elements is approximately 6/7 times the cycle of input image data, the image quality can be improved.

When the conversion ratio is 8, the quality of the moving image can be more improved compared to the case where the conversion ratio is less than 8, and power consumption and manufacturing cost can be more reduced compared to the case where the conversion ratio is more than 8. Moreover, since m is small, power consumption can be reduced while high image quality is obtained. Further, by applying the conversion ratio of 8 to a liquid crystal display device in which the response time of the liquid crystal elements is approximately 1/8 times the cycle of input image data, the image quality can be improved.

When the conversion ratio is 8/3, the quality of the moving image can be more improved compared to the case where the conversion ratio is less than 8/3, and power consumption and manufacturing cost can be more reduced compared to the case where the conversion ratio is more than 8/3. Moreover, since m is large, motion of the image can be made smoother. Further, by applying the conversion ratio of 8/3 to a liquid crystal display device in which the response time of the liquid crystal elements is approximately 3/8 times the cycle of input image data, the image quality can be improved.

When the conversion ratio is 8/5, the quality of the moving image can be more improved compared to the case where the conversion ratio is less than 8/5, and power consumption and manufacturing cost can be more reduced compared to the case where the conversion ratio is more than 8/5. Moreover, since m is large, motion of the image can be made smoother. Further, by applying the conversion ratio of 8/5 to a liquid crystal display device in which the response time of the liquid crystal elements is approximately 5/8 times the cycle of input image data, the image quality can be improved.

When the conversion ratio is 8/7, the quality of the moving image can be more improved compared to the case where the conversion ratio is less than 8/7, and power consumption and manufacturing cost can be more reduced compared to the case where the conversion ratio is more than 8/7. Moreover, since m is large, motion of the image can be made smoother. Further, by applying the conversion ratio of 8/7 to a liquid crystal display device in which the response time of the liquid crystal elements is approximately 7/8 times the cycle of input image data, the image quality can be improved.

When the conversion ratio is 9, the quality of the moving image can be more improved compared to the case where the conversion ratio is less than 9, and power consumption and manufacturing cost can be more reduced compared to the case where the conversion ratio is more than 9. Moreover, since m is small, power consumption can be reduced while high image quality is obtained. Further, by applying the conversion ratio of 9 to a liquid crystal display device in which the response time of the liquid crystal elements is approximately 1/9 times the cycle of input image data, the image quality can be improved.

When the conversion ratio is 9/2, the quality of the moving image can be more improved compared to the case where the conversion ratio is less than 9/2, and power consumption and manufacturing cost can be more reduced compared to the case where the conversion ratio is more than 9/2. Moreover, since m is small, power consumption can be reduced while high image quality is obtained. Further, by applying the conversion ratio of 9/2 to a liquid crystal display device in which the response time of the liquid crystal elements is approximately 2/9 times the cycle of input image data, the image quality can be improved.

When the conversion ratio is 9/4, the quality of the moving image can be more improved compared to the case where the conversion ratio is less than 9/4, and power consumption and manufacturing cost can be more reduced compared to the case where the conversion ratio is more than 9/4. Moreover, since m is large, motion of the image can be made smoother. Further, by applying the conversion ratio of 9/4 to a liquid crystal display device in which the response time of the liquid crystal elements is approximately 4/9 times the cycle of input image data, the image quality can be improved.

When the conversion ratio is 9/5, the quality of the moving image can be more improved compared to the case where the conversion ratio is less than 9/5, and power consumption and manufacturing cost can be more reduced compared to the case where the conversion ratio is more than 9/5. Moreover, since m is large, motion of the image can be made smoother. Further, by applying the conversion ratio of 9/5 to a liquid crystal display device in which the response time of the liquid crystal elements is approximately 5/9 times the cycle of input image data, the image quality can be improved.

When the conversion ratio is 9/7, the quality of the moving image can be more improved compared to the case where the conversion ratio is less than 9/7, and power consumption and manufacturing cost can be more reduced compared to the case where the conversion ratio is more than 9/7. Moreover, since m is large, motion of the image can be made smoother. Further, by applying the conversion ratio of 9/7 to a liquid crystal display device in which the response time of the liquid crystal elements is approximately 7/9 times the cycle of input image data, the image quality can be improved.

When the conversion ratio is 9/8, the quality of the moving image can be more improved compared to the case where the conversion ratio is less than 9/8, and power consumption and manufacturing cost can be more reduced compared to the case where the conversion ratio is more than 9/8. Moreover, since m is large, motion of the image can be made smoother. Further, by applying the conversion ratio of 9/8 to a liquid crystal display device in which the response time of the liquid crystal elements is approximately 8/9 times the cycle of input image data, the image quality can be improved.

When the conversion ratio is 10, the quality of the moving image can be more improved compared to the case where the conversion ratio is less than 10, and power consumption and manufacturing cost can be more reduced compared to the case where the conversion ratio is more than 10. Moreover, since m is small, power consumption can be reduced while high image quality is obtained. Further, by applying the conversion ratio of 10 to a liquid crystal display device in which the response time of the liquid crystal elements is approximately 1/10 times the cycle of input image data, the image quality can be improved.

When the conversion ratio is 10/3, the quality of the moving image can be more improved compared to the case where the conversion ratio is less than 10/3, and power consumption and manufacturing cost can be more reduced compared to the case where the conversion ratio is more than 10/3. Moreover, since m is large, motion of the image can be made smoother. Further, by applying the conversion ratio of 10/3 to a liquid crystal display device in which the response time of the liquid crystal elements is approximately 3/10 times the cycle of input image data, the image quality can be improved.

When the conversion ratio is 10/7, the quality of the moving image can be more improved compared to the case where the conversion ratio is less than 10/7, and power consumption and manufacturing cost can be more reduced compared to the case where the conversion ratio is more than 10/7. Moreover, since m is large, motion of the image can be made smoother. Further, by applying the conversion ratio of 10/7 to a liquid crystal display device in which the response time of the liquid crystal elements is approximately 7/10 times the cycle of input image data, the image quality can be improved.

When the conversion ratio is 10/9, the quality of the moving image can be more improved compared to the case where the conversion ratio is less than 10/9, and power consumption and manufacturing cost can be more reduced compared to the case where the conversion ratio is more than 10/9. Moreover, since m is large, motion of the image can be made smoother. Further, by applying the conversion ratio of 10/9 to a liquid crystal display device in which the response time of the liquid crystal elements is approximately 9/10 times the cycle of input image data, the image quality can be improved.

Note that it is obvious that each conversion ratio where n is more than 10 also has a similar advantage.

Next, as the second step, a method will be described in which a plurality of different images (sub-images) are generated from an image based on input image data or each image (hereinafter referred to as an original image) whose frame rate is converted by a given rational number (n/n) times in the first step, and the plurality of sub-images are displayed in temporal succession. In this manner, a method of the second step can make human eyes perceive as if one original image were displayed in appearance, despite the fact that a plurality of different images are displayed.

Here, among the sub-images generated from one original image, a sub-image which is displayed first is referred to as a first sub-image. The timing when the first sub-image is displayed is the same as the timing when the original image determined in the first step is displayed. On the other hand, a sub-image which is displayed after that is referred to as a second sub-image. The timing when the second sub-image is displayed can be determined at will regardless of the timing when the original image determined in the first step is displayed. Note that an image which is actually displayed is an image generated from the original image by a method in the second step. Various images can be used for the original image for generating sub-images. The number of sub-images is not limited to two and more than two sub-images are also possible. In the second step, the number of sub-images is represented as J (J is an integer of 2 or more). At that time, a sub-image which is displayed at the same timing as the timing when the original image determined in the first step is displayed is referred to as a first sub-image. Sub-images which are sequentially displayed are referred to as a second sub-image, a third sub image . . . and J-th sub-image in order from a sub-image which is displayed.

There are many methods for generating a plurality of sub-images from one original image. As main ones, the following methods can be given. The first one is a method in which the original image is used as it is as the sub-image. The second one is a method in which brightness of the original image is distributed to the plurality of sub-images. The third one is a method in which an intermediate image obtained by motion compensation is used as the sub-image.

Here, a method for distributing brightness of the original image to the plurality of sub-images can be further divided into some methods. As main ones, the following methods can be given. The first one is a method in which at least one sub-image is a black image (hereinafter referred to as black data insertion). The second one is a method in which the brightness of the original image is distributed to a plurality of ranges and just one sub-image among all the sub-images is used to control the brightness in the ranges (hereinafter referred to as time-division gray scale control). The third one is a method in which one sub-image is a bright image which is made by changing a gamma value of the original image, and the other sub-image is a dark image which is made by changing the gamma value of the original image (hereinafter referred to as gamma complement).

Some of the methods described above will be briefly described. In the method in which the original image is used as it is as the sub-image, the original image is used as it is as the first sub-image. Further, the original image is used as it is as the second sub-image. By using this method, a circuit which newly generates a sub-image does not need to operate, or the circuit itself is not necessary, so that power consumption and manufacturing cost can be reduced. Particularly in a liquid crystal display device, this method is preferably used after frame rate conversion using an intermediate image obtained by motion compensation in the first step as an interpolation image. This is because defects such as traces and afterimages of a moving image attributed to shortage of writing voltage due to dynamic capacitance of the liquid crystal elements can be reduced by using the intermediate image obtained by motion compensation as the interpolation image to make motion of the moving image smooth and displaying the same image repeatedly.

Next, in the method in which the brightness of the original image is distributed to the plurality of sub-images, a method for setting the brightness of the image and the length of a period when the sub-images are displayed will be specifically described. Note that J is the number of sub-images, and an integer of 2 or more. The lower case j and capital J are distinguished. The lower case j is an integer of more than or equal to 1 and less than or equal to J. The brightness of a pixel in normal hold driving is L, the cycle of original image data is T, the brightness of a pixel in a j-th sub-image is $L_j$, and the length of a period when the j-th sub-image is displayed is $T_j$. The total sum of products of $L_j$ and $T_j$ where j=1 to where j=J ($L_1T_1+L_2T_2+\ldots+L_JT_J$) is preferably equal to a product of L and T (LT) (brightness is unchangeable). Further, the total sum of $T_j$ where j=1 to where j=J is preferably equal to T (a display cycle of the original image is maintained). Here, unchangeableness of brightness and maintenance of the display cycle of the original image is referred to as sub-image distribution condition.

In the methods for distributing brightness of the original image to a plurality of sub-images, black data insertion is a method in which at least one sub-image is made a black image. In this manner, a display method can be made close to pseudo impulse type display so that deterioration of quality of moving image due to hold-type display method can be prevented. In order to prevent a decrease in brightness due to black data insertion, sub-image distribution condition is preferably satisfied. However, in the situation that a decrease in brightness of the displayed image is acceptable (dark surrounding or the like) or in the case where a decrease in brightness of the displayed image is set to be acceptable by the user, sub-image distribution condition is not necessarily satisfied. For example, one sub-image may be the same as the original image and the other sub-image can be a black image. In this case, power consumption can be reduced compared to the case where sub-image distribution condition is satisfied. Further, in a liquid crystal display device, when one sub-image is made by increasing the whole brightness of the original image without limitation of the maximum brightness, sub-image distribution condition can be satisfied by increasing brightness of a backlight. In this case, since sub-image distribution condition can be satisfied without controlling the voltage value which is applied to a pixel, operation of an image processing circuit can be omitted, so that power consumption can be reduced.

Note that a feature of black data insertion is to make $L_j$ of all pixels 0 in any one of sub-images. In this manner, a display method can be made close to pseudo-impulse type display, so that deterioration of quality of a moving image due to a hold-type display method can be prevented.

In the methods for distributing the brightness of the original image to a plurality of sub-images, time-division gray scale control is a method in which brightness of the original image is divided into a plurality of ranges and brightness in that range is controlled by just one sub-image among all sub-images. In this manner, a display method can be made close to pseudo impulse type display without a decrease in brightness. Therefore, deterioration of quality of moving image due to a hold-type display method can be prevented.

As a method for dividing the brightness of the original image into a plurality of ranges, a method in which the maximum brightness ($L_{max}$) is divided into the number of sub-images can be given. This method will be described with a display device which can adjust brightness of 0 to $L_{max}$ by 256 grades (from the grade 0 to 255) in the case where two sub-images are provided. When the grade 0 to 127 is displayed, brightness of one sub-image is adjusted in a range of the grade 0 to 255 while brightness of the other sub-image is set to be the grade 0. When the grade 128 to 255 is displayed, the brightness of on sub-image is set to be 255 while brightness of the other sub-image is adjusted in a range of the grade 0 to 255. In this manner, this method can make human eyes perceive as if an original image is displayed and make a display method close to pseudo-impulse type display, so that deterioration of quality of an moving image due to a hold-type display method can be prevented. Note that more than two sub-images can be provided. For example, if three sub-images are provided, the grade (grade 0 to 255) of brightness of an original image is divided into three. In some cases, the number of grades of brightness is not divisible by the number of sub-images, depending on the number of grades of brightness of the original image and the number of sub-images; however, the number of grades of brightness which is included in a range of each divided brightness can be distributed as appropriate even if the number of grades of brightness is not just the same as the number of sub-images.

In the case of time-division gray scale control, by satisfying sub-image distribution condition, the same image as the original image can be displayed without a decrease in brightness or the like, which is preferable.

In the methods for distributing brightness of the original image to a plurality of sub-images, gamma complement is a method in which one sub-image is made a bright image by changing the gamma characteristic of the original image while the other sub-image is made a dark image by changing the gamma characteristic of the original image. In this manner, a display method can be made close to pseudo impulse type display without a decrease in brightness. Therefore, deterioration of quality of moving image due to a hold-type display method can be prevented. Here, a gamma characteristic is a degree of brightness with respect to a grade (gray scale) of brightness. In general, a line of the gamma characteristic is adjusted so as to be close to a linear shape. This is because a smooth gray scale can be obtained if change in brightness is proportion to one gray scale in the grade of brightness. In gamma complement, the curve of the gamma characteristic of one sub-image is deviated from the linear shape so that the one sub-image is brighter than a sub-image in the linear shape in a region of intermediate brightness (halftone) (the image in halftone is brighter than as it usually is). Further, a line of the gamma characteristic of the other sub-image is also deviated from the linear shape so that the other sub-image is darker than the sub-image in the linear shape in a region of intermediate brightness (the image in halftone is darker than as it usually is). Here, the amount of change for brightening the one sub-image than that in the linear shape, and the amount of change for darkening the other sub-image than the sub-image in the linear shape, are preferably almost the same. This method can make human eyes perceive as if an original image is displayed and a decrease in quality of a moving image due to a hold-type display method can be prevented. Note that more than two sub-images can be provided. For example, if three sub-images are provided, each gamma characteristic of three sub-images are adjusted and the sum of the amounts of change for brightening sub-images, and the sum of the amounts of change for darkening sub-images are almost the same.

Note that also in the case of gamma complement, by satisfying sub-image distribution condition, the same image as the original image can be displayed without a decrease in brightness or the like, which is preferable. Further, in gamma complement, since change in brightness $L_j$ of each sub-image with respect to gray scale follows a gamma curve, the gray scale of each sub-image can be displayed smoothly by itself. Therefore, there is an advantage that image quality to be perceived by human eyes is improved.

A method in which an intermediate image obtained by motion compensation is used as a sub-image is a method in which one sub-image is an intermediate image obtained by motion compensation using previous and next images. In this manner, motion of images can be smooth and quality of a moving image can be improved.

The relation between the timing when a sub-image is displayed and a method of making a sub-image will be described. Although the timing when the first sub-image is displayed is the same as that when the original image determined in the first step is displayed, and the timing when the second sub-image is displayed can be decided at will regardless of the timing when the original image determined in the first step is displayed, the sub-image itself may be changed in accordance with the timing when the second sub-image is displayed. In this manner, even if the timing when the second sub-image is displayed is changed variously, human eyes can be made to perceive as if the original image is displayed. Specifically, if the timing when the second sub-image is displayed is earlier, the first sub-image can be brighter and the second sub-image can be darker. Further, if the timing when the second sub-image is displayed is later, the first sub-image may be darker and the second sub-image may be brighter. This is because brightness perceived by human eyes changes in accordance with the length of a period when an image is displayed. More specifically, the longer the length of the period when an image is displayed becomes, the higher brightness perceived by human eyes becomes while the shorter the length of the period when an image is displayed becomes, the lower brightness perceived by human eyes becomes. That is, by making the timing when the second sub-image is displayed earlier, the length of the period when the first sub-image is displayed becomes shorter and the length of period when the second sub-image is displayed becomes longer. This means human eyes perceive as if the first sub-image is dark and the second sub-image is bright. As a result, a different image from the original image is perceived by human eyes. In order to prevent this, the first sub-image can be made much brighter and the second sub-image can be made much darker. Similarly, by making the timing when the second sub-image is displayed later, the length of the period when the first sub-image is displayed becomes longer, and the length of the period when the second sub-image is displayed becomes shorter; in such a case, the first sub-image can be made much darker and the second sub-image can be made much brighter.

In accordance with the above description, procedures in the second step is shown below. As a procedure 1, a method for making a plurality of sub-images from one original image is decided. More specifically, a method for making a plurality of sub-images can be selected from a method in which an original image is used as it is as a sub-image, a method in which brightness of an original image is distributed to a plurality of sub-images, and a method in which an intermediate image obtained by motion compensation is used as a sub-image. As a procedure 2, the number J of sub-images is decided. Note that J is an integer of 2 or more. As a procedure 3, the brightness $L_j$ of a pixel in j-th sub-image and the length of the period $T_j$ when the j-th sub-image is displayed are decided in accordance with the method shown in the procedure 1. Through the procedure 3, the length of a period when each sub-image is displayed and the brightness of each pixel included in each sub-image are specifically decided. As a procedure 4, the original image is processed in accordance with what decided in respective procedures 1 to 3 to actually perform display. As a procedure 5, the objective original image is shifted to the next original image and the operation returns to the procedure 1.

Note that a mechanism for performing the procedures in the second step may be mounted on a device or decided in the design phase of the device in advance. When the mechanism for performing the procedures in the second step is mounted on the device, a driving method can be switched so that an optimal operation depending on circumstances can be performed. Note that the circumstances here include contents of image data, environment inside and outside the device (e.g., temperature, humidity, barometric pressure, light, sound, an electromagnetic field, an electric field, radiation quantity, an altitude, acceleration, or movement speed), user setting, a software version, and the like. On the other hand, when the mechanism for performing the procedures in the second step is decided in the design phase of the device in advance, driver circuits optimal for respective driving methods can be used. Further, since the mechanism is decided, manufacturing cost can be reduced due to efficiency of mass production.

Next, various driving methods are employed depending on the procedures in the second step and are described in detail, specifically showing values of n and m in the first step.

In the procedure 1 in the second step, in the case where a method using an original image as it is as a sub-image is selected, the driving method is as follows.

One feature of a driving method of the display device is that i-th (i is a positive integer) image data and (i+1)th image data are sequentially prepared in a constant cycle T. The cycle T is divided into J (J is an integer equal to or more than 2) sub-image display periods. The i-th image data is data which can make each of a plurality of pixels have unique brightness L. The j-th (j is an integer equal to or more than 1, and equal to or less than J) sub-image is formed by arranging the plurality of pixels each having unique brightness $L_j$, and is an image displayed only during the j-th sub-image display period $T_j$. The L, the T, the $L_j$, and the $T_j$ satisfy the sub-image distribution condition. In all values of j, the brightness $L_j$ of each pixel which is included in the j-th sub-image is equal to L. Here, as image data which are prepared sequentially in a constant cycle T, the original image data which is formed in the first step can be used. That is, all display patterns given in the description of the first step can be combined with the above mentioned driving method.

Then, J, which is the number of sub-images, is determined to be 2 in the procedure 2 in the second step, and in the case where it is determined that $T_1=T_2=T/2$ in the procedure 3, the above-mentioned driving method is as shown in FIG. 75. In FIG. 75, the horizontal axis indicates time, and the vertical axis indicates cases which are classified with respect to various values of n and m used in the first step.

Figure 85:
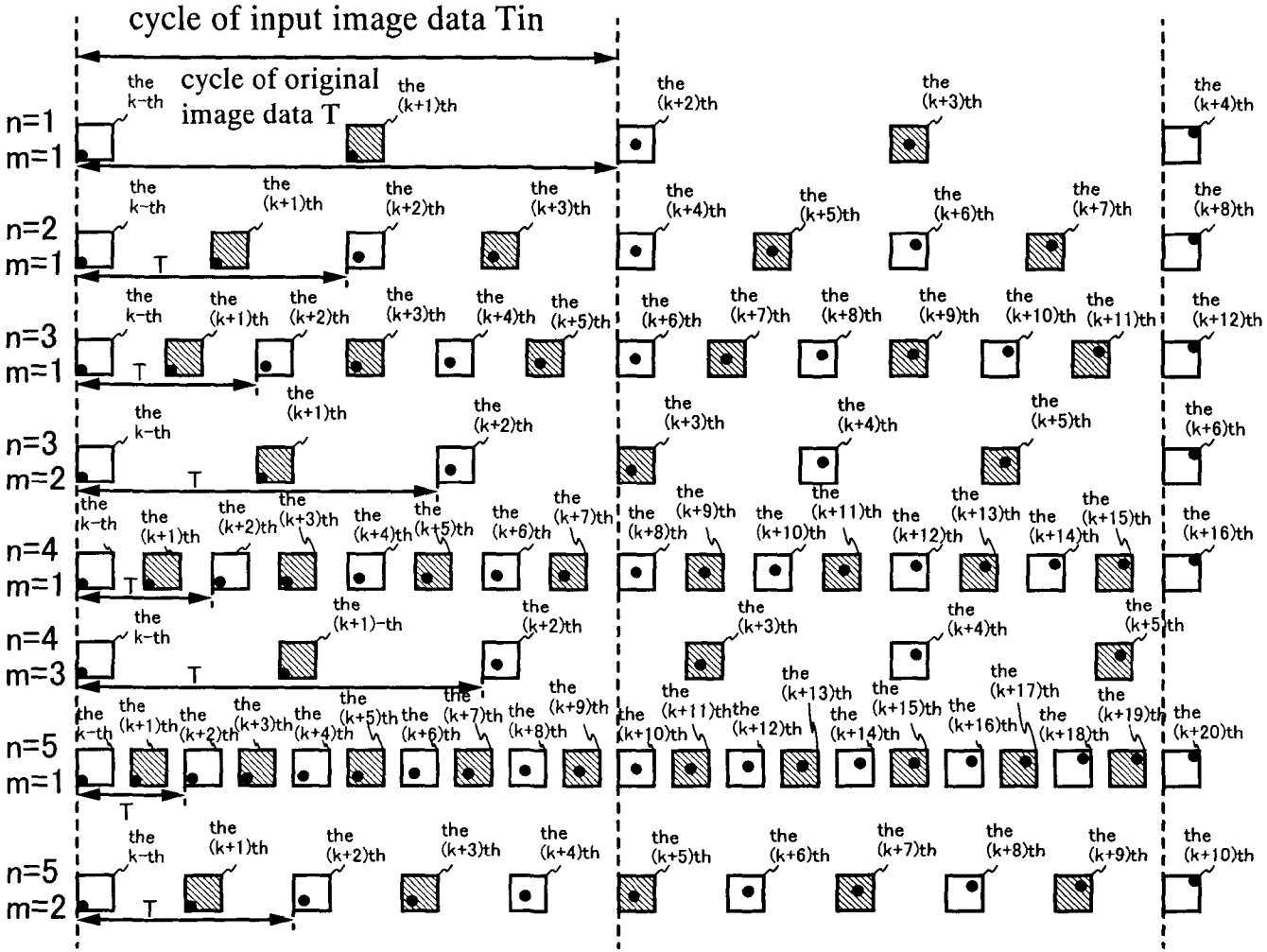
FIG. 85 is a diagram for describing a specific example of the present invention.

For example, in the first step, in the case of n=1 and m=1, in other words, when the conversion ratio (n/m) is 1, a driving method as shown in the case of n=1 and m=1 in FIG. 85 is employed. At this time, the display frame rate is twice (double-frame rate driving) as high as the frame rate of input image data. Specifically, for example, when the input frame rate is 60 Hz, the display frame rate is 120 Hz (120 Hz driving). Then, two images are continuously displayed with respect to a piece of input image data. Here, in the case of double-frame rate driving, quality of moving images can be improved than the case where the frame rate is lower than that of the double-frame rate driving, and power consumption and a production cost can be reduced than the case where the frame rate is higher than that of the double-frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 120 Hz driving and alternating-current driving of a liquid crystal display device is effective. That is, when the driving frequency of the liquid crystal display device is 120 Hz and the frequency of alternating-current driving is an integer multiple of 120 Hz or a unit fraction of 120 Hz (e.g., 30 Hz, 60 Hz, 120 Hz, or 240 Hz), flickers which appear by alternating-current driving can be reduced so as not to be perceived by human eyes. Moreover, image quality can be improved by applying the driving method to the liquid crystal display device in which the response time of the liquid crystal element is approximately half a cycle of input image data.

Further, for example, in the first step, in the case of n=2 and m=1, in other words, when the conversion ratio (n/n) is 2, a driving method as shown in the case of n=2 and m=1 in FIG. 85 is employed. At this time, the display frame rate is 4-fold (quadruple-frame rate driving) as high as the frame rate of input image data. Specifically, for example, when the input frame rate is 60 Hz, the display frame rate is 240 Hz (240 Hz driving). Then, four images are continuously displayed with respect to one input image data. At this time, when an interpolated image in the first step is an intermediate image obtained by motion compensation, motion of moving images can be smooth; thus, quality of moving images can be significantly improved. In the case of quadruple-frame rate driving, quality of moving images can be improved than the case where the frame rate is lower than that of the quadruple-frame rate driving, and power consumption and a production cost can be reduced than the case where the frame rate is higher than that of the quadruple-frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particularly, such as a phenomenon of a moving image in which traces are seen and an afterimage are reduced. Moreover, a combination of 240 Hz driving and alternating-current driving of a liquid crystal display device is effective. That is, when the driving frequency of the liquid crystal display device is 240 Hz and the frequency of alternating-current driving is an integer multiple of 240 Hz or a unit fraction of 240 Hz (e.g., 30 Hz, 60 Hz, 120 Hz, or 240 Hz), flickers which appear by alternating-current driving can be reduced so as not to be perceived by human eyes. Moreover, image quality can be improved by applying the driving method to the liquid crystal display device in which the response time of the liquid crystal element is approximately quarter of a cycle of input image data.

Further, for example, in the first step, in the case of n=3 and m=1, in other words, when the conversion ratio (n/m) is 3, a driving method as shown in the case of n=3 and m=1 in FIG. 85 is employed. At this time, the display frame rate is 6-fold (6-fold frame rate driving) as high as the frame rate of input image data. Specifically, for example, when the input frame rate is 60 Hz, the display frame rate is 360 Hz (360 Hz driving). Then, six images are continuously displayed with respect to one input image data. At this time, when an interpolated image in the first step is an intermediate image obtained by motion compensation, motion of moving images can be smooth; thus, quality of moving images can be significantly improved. In the case of 6-fold frame rate driving, quality of moving images can be improved than the case where the frame rate is lower than that of the 6-fold frame rate driving, and power consumption and a production cost can be reduced than the case where the frame rate is higher than that of the 6-fold frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 360 Hz driving and alternating-current driving of a liquid crystal display device is effective. That is, when the driving frequency of the liquid crystal display device is 360 Hz and the frequency of alternating-current driving is an integer multiple of 360 Hz or a unit fraction of 360 Hz (e.g., 30 Hz, 60 Hz, 120 Hz, or 180 Hz), flickers which appear by alternating-current driving can be reduced so as not to be perceived by human eyes. Moreover, image quality can be improved by applying the driving method to the liquid crystal display device in which the response time of the liquid crystal element is approximately 1/6 of a cycle of input image data.

Further, for example, in the first step, in the case of n=3 and m=2, in other words, when the conversion ratio (n/m) is 3/2, a driving method as shown in the case of n=3 and m=2 in FIG. 85 is employed. At this time, the display frame rate is 3 times (triple-frame rate driving) as high as the frame rate of input image data. Specifically, for example, when the input frame rate is 60 Hz, the display frame rate is 180 Hz (180 Hz driving). Then, three images are continuously displayed with respect to one input image data. At this time, when an interpolated image in the first step is an intermediate image obtained by motion compensation, motion of moving images can be smooth; thus, quality of moving images can be significantly improved. In the case of triple-frame rate driving, quality of moving images can be improved than the case where the frame rate is lower than that of the triple-frame rate driving, and power consumption and a production cost can be reduced than the case where the frame rate is higher than that of the triple-frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 180 Hz driving and alternating-current driving of a liquid crystal display device is effective. That is, when the driving frequency of the liquid crystal display device is 180 Hz and the frequency of alternating-current driving is an integer multiple of 180 Hz or a unit fraction of 180 Hz (e.g., 30 Hz, 60 Hz, 120 Hz, or 180 Hz), flickers which appear by alternating-current driving can be reduced so as not to be perceived by human eyes. Moreover, image quality can be improved by applying the driving method to the liquid crystal display device in which the response time of the liquid crystal element is approximately 1/3 of a cycle of input image data.

Further, for example, in the first step, in the case of n=4 and m=1, in other words, when the conversion ratio (n/m) is 4, a driving method as shown in the case of n=4 and m=1 in FIG. 85 is employed. At this time, the display frame rate is 8-fold (8-fold frame rate driving) as high as the frame rate of input image data. Specifically, for example, when the input frame rate is 60 Hz, the display frame rate is 480 Hz (480 Hz driving). Then, eight images are continuously displayed with respect to one input image data. At this time, when an interpolated image in the first step is an intermediate image obtained by motion compensation, motion of moving images can be smooth; thus, quality of moving images can be significantly improved. In the case of 8-fold frame rate driving, quality of moving images can be improved than the case where the frame rate is lower than that of the 8-fold frame rate driving, and power consumption and a production cost can be reduced than the case where the frame rate is higher than that of the 8-fold frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 480 Hz driving and alternating-current driving of a liquid crystal display device is effective. That is, when the driving frequency of the liquid crystal display device is 480 Hz and the frequency of alternating-current driving is an integer multiple of 480 Hz or a unit fraction of 480 Hz (e.g., 30 Hz, 60 Hz, 120 Hz, or 240 Hz), flickers which appear by alternating-current driving can be reduced so as not to be perceived by human eyes. Moreover, image quality can be improved by applying the driving method to the liquid crystal display device in which the response time of the liquid crystal element is approximately 1/8 of a cycle of input image data.

Further, for example, in the first step, in the case of n=4 and m=3, in other words, when the conversion ratio (n/m) is 4/3, a driving method as shown in the case of n=4 and m=3 in FIG. 85 is employed. At this time, the display frame rate is 8/3 times (8/3-fold frame rate driving) as high as the frame rate of input image data. Specifically, for example, when the input frame rate is 60 Hz, the display frame rate is 160 Hz (160 Hz driving). Then, eight images are continuously displayed with respect to three pieces of input image data. At this time, when an interpolated image in the first step is an intermediate image obtained by motion compensation, motion of moving images can be smooth; thus, quality of moving images can be significantly improved. In the case of 8/3-fold frame rate driving, quality of moving images can be improved than the case where the frame rate is lower than that of the 8/3-fold frame rate driving, and power consumption and a production cost can be reduced than the case where the frame rate is higher than that of the 8/3-fold frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 160 Hz driving and alternating-current driving of a liquid crystal display device is effective. That is, when the driving frequency of the liquid crystal display device is 160 Hz and the frequency of alternating-current driving is an integer multiple of 160 Hz or a unit fraction of 160 Hz (e.g., 40 Hz, 80 Hz, 160 Hz, or 320 Hz), flickers which appear by alternating-current driving can be reduced so as not to be perceived by human eyes. Moreover, image quality can be improved by applying the driving method to the liquid crystal display device in which the response time of the liquid crystal element is approximately 3/8 of a cycle of input image data.

Further, for example, in the first step, in the case of n=5 and m=1, in other words, when the conversion ratio (n/m) is 5, a driving method as shown in the case of n=5 and m=1 in FIG. 85 is employed. At this time, the display frame rate is 10-fold (10-fold frame rate driving) as high as the frame rate of input image data. Specifically, for example, when the input frame rate is 60 Hz, the display frame rate is 600 Hz (600 Hz driving). Then, ten images are continuously displayed with respect to one input image data. At this time, when an interpolated image in the first step is an intermediate image obtained by motion compensation, motion of moving images can be smooth; thus, quality of moving images can be significantly improved. In the case of 10-fold frame rate driving, quality of moving images can be improved than the case where the frame rate is lower than that of the 10-fold frame rate driving, and power consumption and a production cost can be reduced than the case where the frame rate is higher than that of the 10-fold frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 600 Hz driving and alternating-current driving of a liquid crystal display device is effective. That is, when the driving frequency of the liquid crystal display device is 600 Hz and the frequency of alternating-current driving is an integer multiple of 600 Hz or a unit fraction of 600 Hz (e.g., 30 Hz, 60 Hz, 100 Hz, or 120 Hz), flickers which appear by alternating-current driving can be reduced so as not to be perceived by human eyes. Moreover, image quality can be improved by applying the driving method to the liquid crystal display device in which the response time of the liquid crystal element is approximately 1/10 of a cycle of input image data.

Further, for example, in the first step, in the case of n=5 and m=2, in other words, when the conversion ratio (n/m) is 5/2, a driving method as shown in the case of n=5 and m=2 in FIG. 85 is employed. At this time, the display frame rate is 5 times (5-fold frame rate driving) as high as the frame rate of input image data. Specifically, for example, when the input frame rate is 60 Hz, the display frame rate is 300 Hz (300 Hz driving). Then, five images are continuously displayed with respect to one input image data. At this time, when an interpolated image in the first step is an intermediate image obtained by motion compensation, motion of moving images can be smooth; thus, quality of moving images can be significantly improved. In the case of 5-fold frame rate driving, quality of moving images can be improved than the case where the frame rate is lower than that of the 5-fold-frame rate driving, and power consumption and a production cost can be reduced than the case where the frame rate is higher than that of the 5-fold frame rate driving. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Moreover, a combination of 300 Hz driving and alternating-current driving of a liquid crystal display device is effective. That is, when the driving frequency of the liquid crystal display device is 300 Hz and the frequency of alternating-current driving is an integer multiple of 300 Hz or a unit fraction of 300 Hz (e.g., 30 Hz, 50 Hz, 60 Hz, or 100 Hz), flickers which appear by alternating-current driving can be reduced so as not to be perceived by human eyes. Moreover, image quality can be improved by applying the driving method to the liquid crystal display device in which the response time of the liquid crystal element is approximately 1/5 of a cycle of input image data.

As described above, when a method in which an original image is used as it is as a sub-image is selected the procedure 1 in the second step; the number of sub-images is determined to be 2 in the procedure 2 in the second step; when it is determined that $T_1=T_2=T/2$ in the procedure 3 in the second step, the display frame rate can be double of the display frame rate obtained by the frame rate conversion using a conversion ratio determined by the values of n and m in the first step; thus, quality of moving images can be further improved. Further, the quality of moving images can be improved than the case where a display frame rate is lower than the display frame rate, and power consumption and a production cost can be reduced than the case where a display frame rate is higher than the display frame rate. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Furthermore, when the driving frequency of the liquid crystal display device is made high and the frequency of alternating-current driving is an integer multiple or a unit fraction, flickers which appear by alternating-current driving can be reduced so as not to be perceived by human eyes. Moreover, image quality can be improved by applying the driving method to the liquid crystal display device in which the response time of the liquid crystal element is approximately (1/(double the conversion ratio)) of a cycle of input image data.

Note that it is obvious that there are similar advantages in the case of using a conversion ratio than those described above, though detailed description is omitted. For example when n is 10 or less, the following combinations are possible in addition to the above mentioned cases:

n=5, m=3, that is, the conversion ratio (n/m)=5/3 (10/3-fold frame rate driving, 200 Hz), n=5, m=4, that is, the conversion ratio (n/m)=5/4 (5/2-fold frame rate driving, 150 Hz), n=6, m=1, that is, the conversion ratio (n/m)=6 (12-fold frame rate driving, 720 Hz), n=6, m=5, that is, the conversion ratio (n/m)=6/5 (12/5-fold frame rate driving, 144 Hz), n=7, m=1, that is, the conversion ratio (n/m)=7 (14-fold frame rate driving, 840 Hz), n=7, m=2, that is, the conversion ratio (n/m)=7/2 (7-fold frame rate driving, 420 Hz), n=7, m=3, that is, the conversion ratio (n/m)=7/3 (14/3-fold frame rate driving, 280 Hz), n=7, m=4, that is, the conversion ratio (n/m)=7/4 (7/2-fold frame rate driving, 210 Hz), n=7, m=5, that is, the conversion ratio (n/m)=7/5 (14/5-fold frame rate driving, 168 Hz), n=7, m=6, that is, the conversion ratio (n/m)=7/6 (7/3-fold frame rate driving, 140 Hz), n=8, m=1, that is, the conversion ratio (n/m)=8 (16-fold frame rate driving, 960 Hz), n=8, m=3, that is, the conversion ratio (n/m)=8/3 (16/3-fold frame rate driving, 320 Hz), n=8, m=5, that is, the conversion ratio (n/m)=8/5 (16/5-fold frame rate driving, 192 Hz), n=8, m=7, that is, the conversion ratio (n/m)=8/7 (16/7-fold frame rate driving, 137 Hz), n=9, m=1, that is, the conversion ratio (n/m)=9 (18-fold frame rate driving, 1080 Hz), n=9, m=2, that is, the conversion ratio (n/m)=9/2 (9-fold frame rate driving, 540 Hz), n=9, m=4, that is, the conversion ratio (n/m)=9/4 (9/2-fold frame rate driving, 270 Hz), n=9, m=5, that is, the conversion ratio (n/m)=9/5 (18/5-fold frame rate driving, 216 Hz), n=9, m=7, that is, the conversion ratio (n/m)=9/7 (18/7-fold frame rate driving, 154 Hz), n=9, m=8, that is, the conversion ratio (n/m)=9/8 (9/4-fold frame rate driving, 135 Hz), n=10, m=1, that is, the conversion ratio (n/m)=10 (20-fold frame rate driving, 1200 Hz), n=10, m=3, that is, the conversion ratio (n/m)=10/3 (20/3-fold frame rate driving, 400 Hz), n=10, m=7, that is, the conversion ratio (n/m)=10/7 (20/7-fold frame rate driving, 171 Hz), and n=10, m=9, that is, the conversion ratio (n/m)=10/9 (20/9-fold frame rate driving, 133 Hz). Note that these frequencies are examples in the case where the input frame rate is 60 Hz. As for other frame rates, the product of an input frame rate multiplied by double of conversion ratio in each case is a driving frequency.

Although specific numbers for n and m in the case where n is an integer more than 10 are not stated here, the procedure in the second step can be obviously applied to various values of n and m.

Note that in the case of J=2, it is particularly effective that the conversion ratio in the first step is larger than 2. This is because when the number of sub-images is comparatively smaller like J=2 in the second step, the conversion ratio in the first step can be higher. Such a conversion ratio includes 3, 4, 5, 5/2, 6, 7, 7/2, 7/3, 8, 8/3, 9, 9/2, 9/4, 10, and 10/3, when n is equal to or less than 10. When the display frame rate after the first step is such a value, by setting the value of J at 3 or more balance between an advantage (e.g., reduction of power consumption and a production cost) by the number of sub-images in the second step being small and an advantage (e.g., increase of moving image quality and reduction of flickers) by the final display frame rate being high can be achieved.

Note that although the case where the number of sub-images J is determined to be 2 in the procedure 2 and it is determined that $T_1=T_2=T/2$ in the procedure 3 has been described here, the present invention is not limited to this obviously.

For example, in the case where it is determined that $T_1<T_2$ in the procedure 3 in the second step, the first sub-image can be brightened and the second sub-image can be darkened. Further, in the case where it is determined that $T_1>T_2$ in the procedure 3 in the second step, the first sub-image can be darkened and the second sub-image can be brightened. Thus, a display method can be pseudo impulse driving, while the original image can be perceived by human eyes; therefore, quality of moving images can be improved. Note that when a method in which an original image is used as it is as a sub-image is selected in the procedure 1 as the case of the above-mentioned driving method, the sub-image can be displayed as it is without changing the brightness of the sub-image. This is because an image which is used as a sub-image is the same in this case, and the original image can be displayed properly regardless of display timing of the sub-image.

Further, it is obvious that the number of sub-images J may be another value instead of 2 in the procedure 2. In this case, the display frame rate can be J times as high as the display frame rate obtained by the frame rate conversion using a conversion ratio determined by the values of n and m in the first step; thus, quality of moving images can be further improved. Further, the quality of moving images can be improved than the case where a display frame rate is lower than the display frame rate, and power consumption and a production cost can be reduced than the case where a display frame rate is higher than the display frame rate. Further, in the procedure 1 in the second step, when a method in which an original image is used as it is as a sub-image is selected, a circuit operation which produces an intermediate image by motion compensation can be stopped, or the circuit itself can be omitted from the device, whereby power consumption and a production cost of the device can be reduced. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Furthermore, when the driving frequency of the liquid crystal display device is made high and the frequency of alternating-current driving is an integer multiple or a unit fraction, flickers which appear by alternating-current driving can be reduced so as not to be perceived by human eyes. Moreover, image quality can be improved by applying the driving method to the liquid crystal display device in which the response time of the liquid crystal element is approximately (1/(J times the conversion ratio)) of a cycle of input image data.

For example, in the case of J=3, particularly there is advantages that the quality of moving images can be improved compared to the case where the number of sub-images is smaller than 3, and that power consumption and a production cost can be reduced compared to the case where the number of sub-images is larger than 3. Moreover, image quality can be improved by applying the driving method to the liquid crystal display device in which the response time of the liquid crystal element is approximately (1/(three times the conversion ratio)) of a cycle of input image data.

For example, in the case of J=4, particularly there is advantages that the quality of moving images can be improved compared to the case where the number of sub-images is smaller than 4, and that power consumption and a production cost can be reduced compared to the case where the number of sub-images is larger than 4. Moreover, image quality can be improved by applying the driving method to the liquid crystal display device in which the response time of the liquid crystal element is approximately (1/(four times the conversion ratio)) of a cycle of input image data.

For example, in the case of J=5, particularly there is advantages that the quality of moving images can be improved compared to the case where the number of sub-images is smaller than 5, and that power consumption and a production cost can be reduced compared to the case where the number of sub-images is larger than 5. Moreover, image quality can be improved by applying the driving method to the liquid crystal display device in which the response time of the liquid crystal element is approximately (1/(five times the conversion ratio)) of a cycle of input image data.

Furthermore, there are similar advantages even in the case where the number of J is anything other than the above mentioned numbers.

Figure 86:
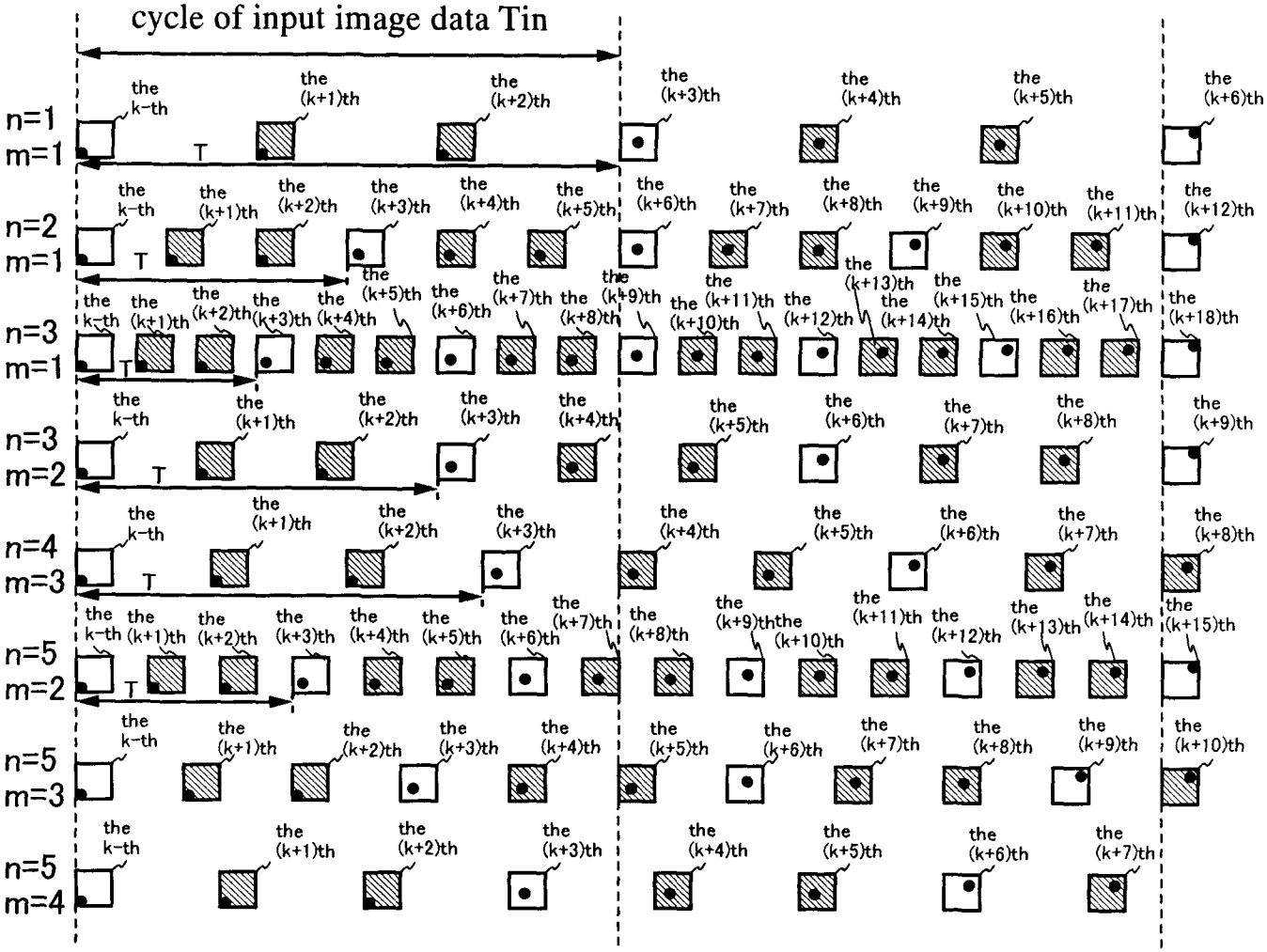
FIG. 86 is a diagram for describing a specific example of the present invention.

Note that in the case of J=3 or more, the conversion ratio in the first step can be various values. J=3 or more is effective particularly when the conversion ratio in the first step is relatively small (equal to or less than 2). This is because when the display frame rate after the first step is relatively lower, J can be larger in the second step. Such a conversion ratio includes 1, 2, 3/2, 4/3, 5/3, 5/4, 6/5, 7/4, 7/5, 7/6, 8/7, 9/5, 9/7, 9/8, 10/7, and 10/9 when n is equal to or less than 10. FIG. 86 shows the case where the conversion ratio is 1, 2, 3/2, 4/3, 5/3, and 5/4 among the above-described conversion ratios. As described above, when the display frame rate after the first step is a relatively small value, by setting the value of J at 3 or more balance between an advantage (e.g., reduction of power consumption and a production cost) by the number of sub-images in the first step being small and an advantage (e.g., increase of moving image quality and reduction of flickers) by the final display frame rate being high can be achieved.

Next, another example of the driving method determined by the procedure in the second step will be described.

In the procedure 1 in the second step, when black data insertion is selected among methods in which brightness of the original image is distributed to a plurality of sub-images, the driving method is as follows.

One feature of a driving method of the display device is that i-th (i is a positive integer) image data and (i+1)th image data are sequentially prepared in a constant cycle T. The cycle T is divided into J (J is an integer equal to or more than 2) sub-image display periods. The i-th image data is data which can make each of a plurality of pixels have unique brightness L. The j-th (j is an integer equal to or more than 1, and equal to or less than J) sub-image is formed by arranging a plurality of pixels each having unique brightness $L_j$, and is an image which is displayed only during the j-th sub-image display period $T_j$. The L, the T, the $L_j$, and the $T_j$ satisfy the sub-image distribution condition. In at least one value of j, the brightness $L_j$ of all pixels which are included in the j-th sub-image is equal to 0. Here, as image data which are prepared sequentially in a constant cycle T, the original image data which is formed in the first step can be used. That is, all display patterns given in the description of the first step can be combined with the above mentioned driving method.

It is obvious that the driving method can be implemented by combining various values of n and m which are used in the first step.

Then, when the number of sub-images J is determined to be 2 in the procedure 2 in the second step, and it is determined that $T_1=T_2=T/2$ in the procedure 3, the driving method can be as shown in FIG. 85. Since features and advantages of the driving method (display timing using various values of n and m) shown in FIG. 85 have already been described, detailed description is omitted here. In the procedure 1 in the second step, even when black data insertion is selected among methods in which brightness of the original image is distributed to a plurality of sub-images, it is obvious that similar advantages can be gained. For example, when an interpolated image in the first step is an intermediate image obtained by motion compensation, motion of a moving image can be smooth; thus, quality of moving images can be significantly improved. The quality of moving images can be improved when the display frame rate is high, and power consumption and a production cost can be reduced when the display frame rate is low. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Flickers which appear by alternating-current driving can be reduced so as not to be perceived by human eyes.

In the procedure 1 in the second step, as a typical advantage of selecting black data insertion among methods in which brightness of the original image is distributed to a plurality of sub-images, a circuit operation which produces an intermediate image by motion compensation can be stopped, or the circuit itself can be omitted from the device, whereby power consumption and a production cost of the device can be reduced. Further, display method can be pseudo impulse driving regardless of the gray scale value included in the image data; therefore, quality of a moving image can be improved.

Note that the case where the number of sub-images J is determined to be 2 in the procedure 2 and it is determined that $T_1=T_2=T/2$ in the procedure 3 has been described here, the present invention is not limited to this obviously.

For example, in the case where it is determined that $T_1<T_2$ in the procedure 3 in the second step, the first sub-image can be brightened and the second sub-image can be darkened. Further, in the case where it is determined that $T_1>T_2$ in the procedure 3 in the second step, the first sub-image can be darkened and the second sub-image can be brightened. Thus, a display method can be pseudo impulse driving, while the original image can be perceived by human eyes; therefore, quality of moving images can be improved. Note that as in the case of the above-mentioned driving method, when black data insertion is selected among methods in which brightness of the original image is distributed to a plurality of sub-images in the procedure 1, the sub-image may be displayed as it is without changing the brightness of the sub-image. This is because when the brightness of the sub-image is not changed, the original image is merely displayed only in such a manner that entire brightness of the original image is low. In other words, when this method is positively used for controlling the brightness of the display device, brightness can be controlled and the quality of moving images increases at the same time.

Further, it is obvious that the number of sub-images J may be another value instead of 2 in the procedure 2. Since advantages in that case have been already described, detailed description is omitted here. In the procedure 1 in the second step, even when black data insertion is selected among methods in which brightness of the original image is distributed to a plurality of sub-images, it is obvious that similar advantages can be gained. For example, image quality can be improved by applying the driving method to the liquid crystal display device in which the response time of the liquid crystal element is approximately (1/(J times the conversion ratio)) of a cycle of input image data.

Next, another example of the driving method determined by the procedure in the second step will be described.

In the procedure 1 in the second step, when time ratio gray scale controlling method is selected among methods in which brightness of the original image is distributed to a plurality of sub-images, the driving method is as follows.

One feature of a driving method of the display device is that i-th (i is a positive integer) image data and (i+1)th image data are sequentially prepared in a constant cycle T. The cycle T is divided into J (J is an integer equal to or more than 2) sub-image display periods. The i-th image data is data which can make each of a plurality of pixels have unique brightness L. The maximum value of the unique brightness L is $L_{max}$. The j-th (j is an integer equal to or more than 1, and equal to or less than J) sub-image is formed by arranging a plurality of pixels each having unique brightness $L_j$ and is an image which is displayed only during the j-th sub-image display period $T_j$. The L, the T, the $L_j$, and the $T_j$ satisfy the sub-image distribution condition. When the unique brightness L is displayed, the brightness is adjusted in the range of from $(-1)\times L_{max}/J$ to $J\times L_{max}/J$ by adjusting brightness in only one sub-image display period among the J sub-image display periods. Here, as image data which are prepared sequentially in a constant cycle T, the original image data which is formed in the first step can be used. That is, all display patterns given in the description of the first step can be combined with the above mentioned driving method.

It is obvious that the driving method can be implemented by combining various values of n and m which are used in the first step.

Then, when the number of sub-images J is determined to be 2 in the procedure 2 in the second step, and it is determined that $T_1=T_2=T/2$ in the procedure 3, the driving method can be as shown in FIG. 85. Since features and advantages of the driving method (display timing using various values of n and m) shown in FIG. 85 have already been described, detailed description is omitted here. In the procedure 1 in the second step, even when time ratio gray scale controlling method is selected among methods in which brightness of the original image is distributed to a plurality of sub-images, it is obvious similar advantages can be gained. For example, when an interpolated image in the first step is an intermediate image obtained by motion compensation, motion of a moving image can be smooth; thus, quality of moving images can be significantly improved. The quality of moving images can be improved when the display frame rate is high, and power consumption and a production cost can be reduced when the display frame rate is low. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an after-image are reduced. Flickers which appear by alternating-current driving can be reduced so as not to be perceived by human eyes.

In the procedure 1 in the second step, as a typical advantage of selecting a time ratio gray scale controlling method among methods in which brightness of the original image is distributed to a plurality of sub-images, a circuit operation which produces an intermediate image by motion compensation can be stopped, or the circuit itself can be omitted from the device, whereby power consumption and a production cost of the device can be reduced. Further, since display method can be pseudo impulse driving, quality of a moving image can be improved, and since brightness of the display device does not become lower, power consumption can be further reduced.

Note that although the case where the number of sub-images J is determined to be 2 in the procedure 2 and it is determined that $T_1=T_2=T/2$ in the procedure 3 has been described here, the present invention is not limited to this obviously.

For example, in the case where it is determined that $T_1<T_2$ in the procedure 3 in the second step, the first sub-image can be brightened and the second sub-image can be darkened. Further, in the case where it is determined that $T_1>T_2$ in the procedure 3 in the second step, the first sub-image can be darkened and the second sub-image can be brightened. Thus, display method can be pseudo impulse driving, while the original image can be perceived by human eyes; therefore, quality of moving image can be improved.

Further, it is obvious that the number of sub-images J may be another value instead of 2 in the procedure 2. Since advantages in that case have been already described, detailed description is omitted here. In the procedure 1 in the second step, even when time ratio gray scale controlling method is selected among methods in which brightness of the original image is distributed to a plurality of sub-images, it is obvious similar advantages can be gained. For example, image quality can be improved by applying the driving method to the liquid crystal display device in which the response time of the liquid crystal element is approximately (1/(J times the conversion ratio)) of a cycle of input image data.

Next, another example of the driving method determined by the procedure in the second step will be described.

In the procedure 1 in the second step, when gamma complement is selected among methods in which brightness of the original image is distributed to a plurality of sub-images, the driving method is as follows.

One feature of a driving method of the display device is that i-th (i is a positive integer) image data and (i+1)th image data are sequentially prepared in a constant cycle T. The cycle T is divided into J (J is an integer equal to or more than 2) sub-image display periods. The i-th image data is data which can make each of a plurality of pixels have unique brightness L. The j-th (j is an integer equal to or more than 1, and equal to or less than J) sub-image is formed by arranging a plurality of pixels each having unique brightness $L_j$, and is an image which is displayed only during the j-th sub-image display period $T_j$. The L, the T, the $L_j$, and the $T_j$ satisfy the sub-image distribution condition. In each sub-image, characteristics of a change of brightness with respect to the gray scale is changed from the linear shape, and total amount of brightness which is changed to a lighter area from the linear shape and the total amount of brightness which is changed to a darker area from the linear shape are almost the same in all gray scale. Here, as image data which are prepared sequentially in a constant cycle T, the original image data which is formed in the first step can be used. That is, all display patterns given in the description of the first step can be combined with the above-mentioned driving method.

It is obvious that the driving method can be implemented by combining various values of n and m which are used in the first step.

Then, when the number of sub-images J is determined to be 2 in the procedure 2 in the second step, and it is determined that $T_1=T_2=T/2$ in the procedure 3, the driving method can be as shown in FIG. 85. Since features and advantages of the driving method (display timing using various values of n and m) shown in FIG. 85 have already been described, detailed description is omitted here. In the procedure 1 in the second step, even when gamma complement is selected among methods in which brightness of the original image is distributed to a plurality of sub-images, it is obvious similar advantages can be gained. For example, when an interpolated image in the first step is an intermediate image obtained by motion compensation, motion of moving images can be smooth; thus, quality of moving images can be significantly improved. The quality of moving images can be improved when the display frame rate is high, and power consumption and a production cost can be reduced when the display frame rate is low. Further, when a display device is an active matrix liquid crystal display device, a problem of shortage of writing voltage due to dynamic capacitance can be avoided; thus, quality of moving images can be significantly improved while defects, in particular, such as a phenomenon of a moving image in which traces are seen and an afterimage are reduced. Flickers which appear by alternating-current driving can be reduced so as not to be perceived by human eyes.

In the procedure 1 in the second step, as a typical advantage of selecting gamma complement among methods in which brightness of the original image is distributed to a plurality of sub-images, a circuit operation which produces an intermediate image by motion compensation can be stopped, or the circuit itself can be omitted from the device, whereby power consumption and a production cost of the device can be reduced. Further, since display method can be pseudo impulse driving regardless of the gray scale value included in the image data, quality of a moving image can be improved. Moreover, image data may be directly subjected to gamma conversion to obtain a sub-image. In this case, there is an advantage in that the gamma value can be controlled variously by the amount of movement of a moving image. Further, without the image data being directly subjected to gamma conversion, a sub-image whose gamma value is changed may be obtained by change of the reference voltage of a digital-to-analog converter circuit (DAC). In this case, since the image data is not directly subjected to gamma conversion, a circuit operation for gamma conversion can be stopped, or the circuit itself can be omitted from the device, whereby power consumption and a production cost of the device can be reduced. Further, in gamma complement, since the change of the brightness $L_j$ of each sub-image with respect to gray scale follows a gamma curve, the gray scale of each sub-image can be displayed smoothly by itself; therefore, there is an advantage in that image quality to be perceived in the end by human eyes is improved.

Note that although the case where the number of sub-images J is determined to be 2 in the procedure 2 and it is determined that $T_1=T_2=T/2$ in the procedure 3 has been described here, the present invention is not limited to this obviously.

For example, in the case where it is determined that $T_1<T_2$ in the procedure 3 in the second step, the first sub-image can be brightened and the second sub-image can be darkened. Further, in the case where it is determined that $T_1>T_2$ in the procedure 3 in the second step, the first sub-image can be darkened and the second sub-image can be brightened. Thus, a display method can be pseudo impulse driving, while the original image can be perceived by human eyes; therefore, quality of moving images can be improved. In the procedure 1, when gamma complement is selected among methods in which brightness of the original image is distributed to a plurality of sub-images as in the case of the above-mentioned driving method, the gamma value may be changed in the case where brightness of the sub-image is changed. That is, the gamma value may be determined in accordance with display timing of the second sub-image. Accordingly, the operation of a circuit for changing brightness of the entire image can be stopped, or the circuit itself can be omitted from the device, whereby power consumption and a production cost of the device can be reduced.

Further, it is obvious that the number of sub-images J may be another value instead of 2 in the procedure 2. Since advantages in that case have been already described, detailed description is omitted here. In the procedure 1 in the second step, even when gamma complement is selected among methods in which brightness of the original image is distributed to a plurality of sub-images, it is obvious similar advantages can be gained. For example, image quality can be improved by applying the driving method to the liquid crystal display device in which the response time of the liquid crystal element is approximately (1/(J times the conversion ratio)) of a cycle of input image data.

Next, another example of the driving method determined by the procedure in the second step will be described in detail.

When a method in which an intermediate image obtained by motion compensation is used as a sub-image is selected in the procedure 1 in the second step; when the number of sub-images is determined to be 2 in the procedure 2 in the second step; and when it is determined that $T_1=T_2=T/2$ in the procedure 3 in the second step, the driving method determined by the procedures in the second step can be as follows.

One feature of a driving method of the display device is that i-th (i is a positive integer) image data and (i+1)th image data are sequentially prepared in a constant cycle T. A driving method of the display device is in such a manner that a k-th (k is a positive integer) image, a (k+1)th image, and a (k+2)th image are sequentially displayed at half interval of the period of the original image data. The k-th image is displayed in accordance with the i-th image data. The (k+1)th image is displayed in accordance with the image data which corresponds to half amount of the movement of from the i-th image data to the (i+1)th image data. The (k+2)th image is displayed in accordance with the (i+1)th image data. Here, as the image data which are prepared sequentially in a constant cycle T, the original image data which is formed in the first step can be used. That is, all display patterns given in the description of the first step can be combined with the above-mentioned driving method.

It is obvious that the driving method can be implemented by combining various values of n and m which are used in the first step.

In the procedure 1 in the second step, a typical advantage of selecting a method in which an intermediate image obtained by motion compensation is used as a sub-image is that a method for obtaining an intermediate image employed in the first step can be similarly used in the second step when an intermediate image obtained by motion compensation is an interpolated image. In other words, a circuit for obtaining an intermediate image by motion compensation can be used not only in the first step, but also in the second step, whereby the circuit can be used efficiently and treatment efficiency can be increased. In addition, motion of moving images can be further smooth; thus, quality of moving images can be further improved.

Note that although the case where the number of sub-images J is determined to be 2 in the procedure 2 and it is determined that $T_1=T_2=T/2$ in the procedure 3 has been described here, the present invention is not limited to this obviously.

For example, in the case where it is determined that $T_1<T_2$ in the procedure 3 in the second step, the first sub-image can be brightened and the second sub-image can be darkened. Further, in the case where it is determined that $T_1>T_2$ in the procedure 3 in the second step, the first sub-image can be darkened and the second sub-image can be brightened. Thus, display method can be pseudo impulse driving, while the original image can be perceived by human eyes; therefore, quality of moving images can be improved. Note that as in the case of the above-mentioned driving method, when a method in which an intermediate image obtained by motion compensation is used as a sub-image is selected in the procedure 2, it is not necessary that brightness of the sub-image is changed. This is because the image in an intermediate state is completed as an image in itself, and even when display timing of the second sub-image is changed, the image which is perceived by human eyes is not changed. In this case, the operation of a circuit for changing brightness of the entire image can be stopped, or the circuit itself can be omitted from the device, whereby power consumption and a production cost of the device can be reduced.

Further, it is obvious that the number of sub-images J may be another value instead of 2 in the procedure 2. Since advantages in that case have been already described, detailed description is omitted here. In the procedure 1 in the second step, even when a method in which an intermediate image obtained by motion compensation is used as a sub-image is selected, it is obvious similar advantages can be gained. For example, image quality can be improved by applying the driving method to the liquid crystal display device in which the response time of the liquid crystal element is approximately (1/(J times the conversion ratio)) of a cycle of input image data.

Next, specific examples of a method for converting the frame rate when the input frame rate and the display frame rate are different are described with reference to FIGS. 87A to 87C. In methods shown in FIGS. 87A to 87C, circular regions in images are changed from frame to frame, and triangle regions in the images are hardly changed from frame to frame. Note that the images are just examples for explanation, and the images to be displayed are not limited to these examples. The methods shown in FIGS. 87A to 87C can be applied to various images.

Figure 87A:
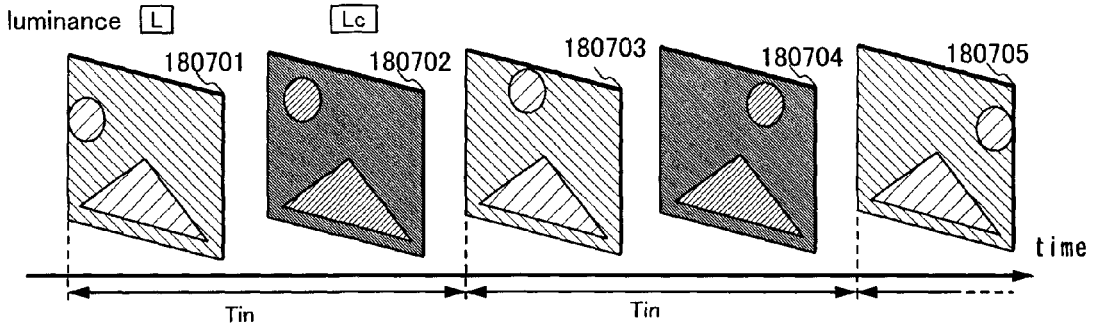
FIGS. 87A to 87C are diagrams for describing specific examples of the present invention.

FIG. 87A shows the case where the display frame rate is twice as high as the input frame rate (the conversion ratio is 2). When the conversion ratio is 2, there is an advantage in that quality of moving images can be improved compared to the case where the conversion ratio is less than 2. Further, when the conversion ratio is 2, there is an advantage in that power consumption and manufacturing cost can be reduced compared to the case where the conversion ratio is more than 2. FIG. 87A schematically shows time change in images to be displayed with time represented by the horizontal axis. Here, a focused image is referred to as a p-th image (p is a positive integer). An image displayed after the focused image is referred to as a (p+1)th image, and an image displayed before the focused image is referred to as a (p−1)th image, for example. Thus, how far an image to be displayed is apart from the focused image is described for convenience. An image 180701 is the p-th image; an image 180702 is the (p+1)th image; an image 180703 is a (p+2)th image; an image 180704 is a (p+3)th image; and an image 180705 is a (p+4)th image. The period $T_{in}$ shows a cycle of input image data. Note that since FIG. 87A shows the case where the conversion ratio is 2, the period $T_{in}$ is twice as long as a period after the p-th image is displayed until the (p+1)th image is displayed.

Here, the (p+1)th image 180702 may be an image which is made to be in an intermediate state between the p-th image 180701 and the (p+2)th image 180703 by detecting the amount of change in the images from the p-th image 180701 to the (p+2)th image 180703. FIG. 87A shows an image in an intermediate state by a region whose position is changed from frame to frame (the circular region) and a region whose position is hardly changed from frame to frame (the triangle region). In other words, the position of the circular region in the (p+1)th image 180702 is an intermediate position between the positions of the circular regions in the p-th image 180701 and the (p+2)th image 180703. That is, as for the (p+1)th image 180702, image data is interpolated by motion compensation. When motion compensation is performed on a moving object on the image in this manner to interpolate the image data, smooth display can be performed.

Further, the (p+1)th image 180702 may be an image which is made to be in an intermediate state between the p-th image 180701 and the (p+2)th image 180703 and may be an image, luminance of which is controlled by a certain rule. As the certain rule, for example, $L>L_c$ may be satisfied when typical luminance of the p-th image 180701 is denoted by L and typical luminance of the (p+1)th image 180702 is denoted by $L_c$, as shown in FIG. 87A. Preferably, $0.1L<L_{c<0.8}L$ is satisfied, and more preferably $0.2L<L_c<0.5L$ is satisfied. Alternatively, $L<L_c$ may be satisfied, preferably $0.1L_c<L<0.8L_c$ is satisfied, and more preferably $0.2L_c<L<0.5L_c$ is satisfied. In this manner, display can be made pseudo impulse display, so that an afterimage perceived by human eyes can be suppressed.

Note that typical luminance of the images is described later in detail with reference to FIGS. 88A to 88E.

When two different causes of motion blur (non-smoothness in movement of images and an afterimage perceived by human eyes) are removed at the same time in this manner, motion blur can be considerably reduced.

Moreover, the (p+3)th image 180704 may also be formed from the (p+2)th image 180703 and the (p+4)th image 180705 by using a similar method. That is, the p+3)th image 180704 may be an image which is made to be in an intermediate state between the (p+2)th image 180703 and the (p+4)th image 180705 by detecting the amount of change in the images from the (p+2)th image 180703 to the (p+4)th image 180705 and may be an image, luminance of which is controlled by a certain rule.

Figure 87B:
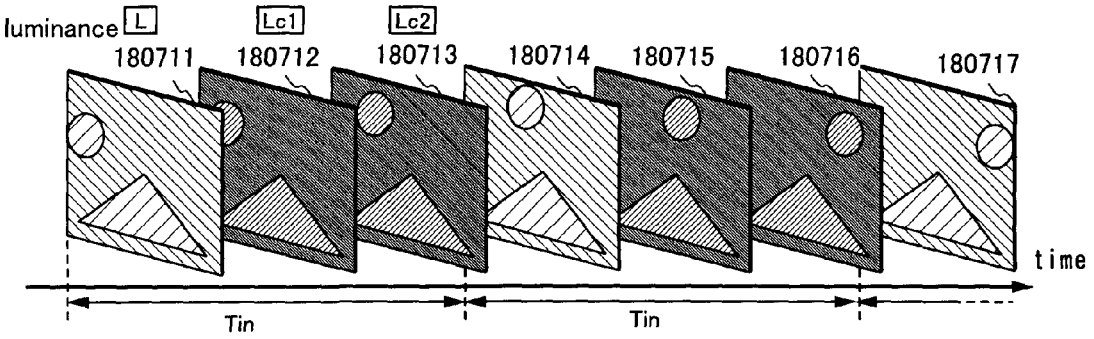

FIG. 87B shows the case where the display frame rate is three times as high as the input frame rate (the conversion ratio is 3). FIG. 87B schematically shows time change in images to be displayed with time represented by the horizontal axis. An image 180711 is the p-th image; an image 180712 is the (p+1)th image; an image 180713 is a (p+2)th image; an image 180714 is a (p+3)th image; an image 180715 is a (p+4)th image; an image 180716 is a (p+5)th image; and an image 180717 is a (p+6)th image. The period $T_{in}$ shows a cycle of input image data. Note that since FIG. 87B shows the case where the conversion ratio is 3, the period $T_{in}$ is three times as long as a period after the p-th image is displayed until the (p+1)th image is displayed.

Here, each of the (p+1)th image 180712 and the (p+2)th image 180713 may be an image which is made to be in an intermediate state between the p-th image 180711 and the (p+3)th image 180714 by detecting the amount of change in the images from the p-th image 180711 to the (p+3)th image 180714. FIG. 87B shows an image in an intermediate state by a region whose position is changed from frame to frame (the circular region) and a region whose position is hardly changed from frame to frame (the triangle region). That is, the position of the circular region in each of the (p+1)th image 180712 and the (p+2)th image 180713 is an intermediate position between the positions of the circular regions in the p-th image 180711 and the (p+3)th image 180714. Specifically, when the amount of movement of the circular regions detected from the p-th image 180711 and the (p+3)th image 180714 is denoted by X, the position of the circular region in the (p+1)th image 180712 may be displaced by approximately (1/3)X from the position of the circular region in the p-th image 180711. Further, the position of the circular region in the (p+2)th image 180713 may be displaced by approximately (2/3)X from the position of the circular region in the p-th image 180711. That is, as for each of the (p+1)th image 180712 and the (p+2)th image 180713, image data is interpolated by motion compensation. When motion compensation is performed on a moving object on the image in this manner to interpolate the image data, smooth display can be performed.

Further, each of the (p+1)th image 180712 and the (p+2)th image 180713 may be an image which is made to be in an intermediate state between the p-th image 180711 and the (p+3)th image 180714 and may be an image, luminance of which is controlled by a certain rule. As the certain rule, for example, $L>L_c1$, $L>L_c2$, or $Lc1=L_c2$ may be satisfied when typical luminance of the p-th image 180711 is denoted by L, typical luminance of the (p+1)th image 180712 is denoted by $L_c1$, and typical luminance of the (p+2)th image 180713 is denoted by $L_c2$, as shown in FIG. 87B. Preferably, $0.1L<L_c1=L_c2<0.8L$ is satisfied, and more preferably $0.2L<L_c1=L_c2<0.5L$ is satisfied. Alternatively, $L<L_c1$, $L<L_c2$, or $L_c1=L_c2$ may be satisfied, preferably $0.1L_c1=0.1L_c2<L<0.8L_c1=0.8L_c2$ is satisfied, and more preferably $0.2L_c1=0.2L_c2<L<0.5L_c1=0.5L_c2$ is satisfied. In this manner, display can be made pseudo impulse display, so that an afterimage perceived by human eyes can be suppressed. Alternatively, images, luminance of which is changed, may be made to appear alternately. In this manner, a cycle of luminance change can be shortened, so that flickers can be reduced.

When two different causes of motion blur (non-smoothness in movement of images and an afterimage perceived by human eyes) are removed at the same time in this manner, motion blur can be considerably reduced.

Moreover, each of the (p+4)th image 180715 and the (p+5)th image 180716 may also be formed from the (p+3)th image 180714 and the (p+6)th image 180717 by using a similar method. That is, each of the (p+4)th image 180715 and the (p+5)th image 180716 may be an image which is made to be in an intermediate state between the (p+3)th image 180714 and the (p+6)th image 180717 by detecting the amount of change in the images from the (p+3)th image 180714 to the (p+6)th image 180717 and may be an image, luminance of which is controlled by a certain rule.

Note that when the method shown in FIG. 87B is used, the display frame rate is so high that movement of the image can follow movement of human eyes, so that movement of the image can be displayed smoothly. Therefore, motion blur can be considerably reduced.

Figure 87C:
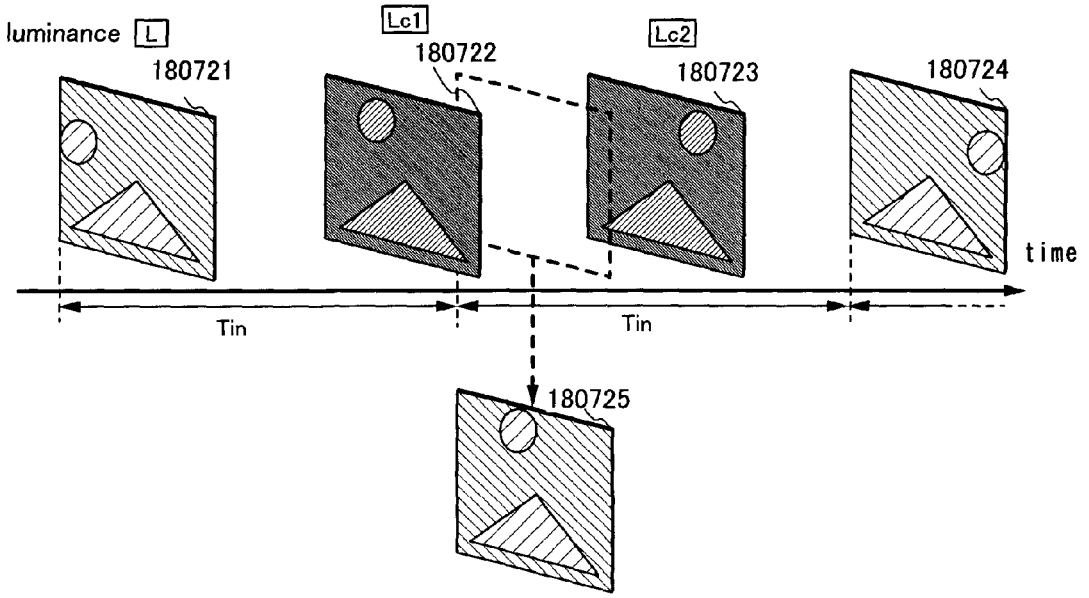

FIG. 87C shows the case where the display frame rate is 1.5 times as high as the input frame rate (the conversion ratio is 1.5). FIG. 87C schematically shows time change in images to be displayed with time represented by the horizontal axis. An image 180721 is the p-th image; an image 180722 is the (p+1)th image; an image 180723 is the (p+2)th image; and an image 180724 is the (p+3)th image. Note that although not necessarily displayed actually, an image 180725, which is input image data, may be used to form the (p+1)th image 180722 and the (p+2)th image 180723. The period $T_{in}$ shows a cycle of input image data. Note that since FIG. 87C shows the case where the conversion ratio is 1.5, the period $T_{in}$ is 1.5 times as long as a period after the p-th image is displayed until the (p+1)th image is displayed.

Here, each of the (p+1)th image 180722 and the (p+2)th image 180723 may be an image which is made to be in an intermediate state between the p-th image 180721 and the (p+3)th image 180724 by detecting the amount of change in the images from the p-th image 180721 to the (p+3)th image 180724 via the image 180725. FIG. 87C shows an image in an intermediate state by a region whose position is changed from frame to frame (the circular region) and a region whose position is hardly changed from frame to frame (the triangle region). That is, the position of the circular region in each of the (p+1)th image 180722 and the (p+2)th image 180723 is an intermediate position between the positions of the circular regions in the p-th image 180721 and the (p+3)th image 180724. That is, as for each of the (p+1)th image 180722 and the (p+2)th image 180723, image data is interpolated by motion compensation. When motion compensation is performed on a moving object on the image in this manner to interpolate the image data, smooth display can be performed.

Further, each of the (p+1)th image 180722 and the (p+2)th image 180723 may be an image which is made to be in an intermediate state between the p-th image 180721 and the (p+3)th image 180724 and may be an image, luminance of which is controlled by a certain rule. As the certain rule, for example, $L>L_c1$, $L>L_c2$, or $L_c1=L_c2$ is satisfied when typical luminance of the p-th image 180721 is denoted by L, typical luminance of the (p+1)th image 180722 is denoted by $L_c1$, and typical luminance of the (p+2)th image 180723 is denoted by $L_c2$, as shown in FIG. 87C. Preferably, $0.1L<L_c1=L_c2<0.8L$ is satisfied, and more preferably $0.2L<L_c1=L_c2<0.5L$ is satisfied. Alternatively, $L<L_c1$, $L<L_c2$, or $L_c1=L_c2$ may be satisfied, preferably $0.1L_c1-0.1L_c2<L<0.8L_c1=0.8L_c2$ is satisfied, and more preferably $0.2L_c1=0.2L_c2<L<0.5L_c1=0.5L_c2$ is satisfied. In this manner, display can be made pseudo impulse display, so that an afterimage perceived by human eyes can be suppressed. Alternatively, images, luminance of which is changed, may be made to appear alternately. In this manner, a cycle of luminance change can be shortened, so that flickers can be reduced.

When two different causes of motion blur (non-smoothness in movement of images and an afterimage perceived by human eyes) are removed at the same time in this manner, motion blur can be considerably reduced.

Note that when the method shown in FIG. 87C is used, the display frame rate is so low that time for writing a signal to a display device can be increased. Therefore, clock frequency of the display device can be made lower, so that power consumption can be reduced. Further, processing speed of motion compensation can be decreased, so that power consumption can be reduced.

Next, typical luminance of images is described with reference to FIGS. 88A to 88E. FIGS. 88A to 88D each schematically show time change in images to be displayed with time represented by the horizontal axis. FIG. 88E shows an example of a method for measuring luminance of an image in a certain region.

An example of a method for measuring luminance of an image is a method for individually measuring luminance of each pixel which forms the image. With this method, luminance in every detail of the image can be strictly measured.

Note that since a method for individually measuring luminance of each pixel which forms the image needs much energy, another method may be used. An example of another method for measuring luminance of an image is a method for measuring average luminance of a region in an image, which is focused. With this method, luminance of an image can be easily measured. In this embodiment mode, luminance measured by a method for measuring average luminance of a region in an image is referred to as typical luminance of an image for convenience.

Then, which region in an image is focused in order to measure typical luminance of the image is described below.

Figure 88A:
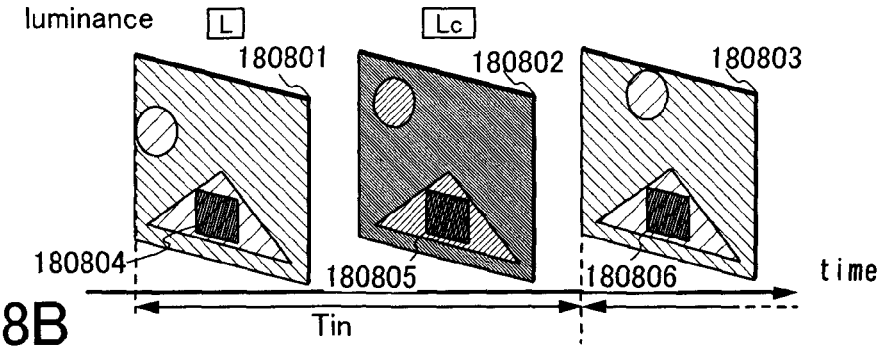
FIGS. 88A to 88E are diagrams for describing specific examples of the present invention.

FIG. 88A shows an example of a measuring method in which luminance of a region whose position is hardly changed with respect to change in an image (the triangle region) is typical luminance of the image. The period $T_{in}$ shows a cycle of input image data; an image 180801 is the p-th image; an image 180802 is the (p+1)th image; an image 180803 is the (p+2)th image; a first region 180804 is a luminance measurement region in the p-th image 180801; a second region 180805 is a luminance measurement region in the (p+1)th image 180802; and a third region 180806 is a luminance measurement region in the (p+2)th image 180803. Here, the first to third regions may be provided in almost the same spatial positions in a device. That is, when typical luminance of the images is measured in the first to third regions, time change in typical luminance of the images can be calculated.

When the typical luminance of the images is measured, whether display is made pseudo impulse display or not can be judged. For example, if $L_c<L$ is satisfied when luminance measured in the first region 180804 is denoted by L and luminance measured in the second region 180805 is denoted by $L_c$, it can be said that display is made pseudo impulse display. At that time, it can be said that quality of a moving image is improved.

Note that when the amount of change in typical luminance of the images with respect to time change (relative luminance) in the luminance measurement regions is in the following range, image quality can be improved. As for relative luminance, for example, relative luminance between the first region 180804 and the second region 180805 can be the ratio of lower luminance to higher luminance; relative luminance between the second region 180805 and the third region 180806 can be the ratio of lower luminance to higher luminance; and relative luminance between the first region 180804 and the third region 180806 can be the ratio of lower luminance to higher luminance. That is, when the amount of change in typical luminance of the images with respect to time change (relative luminance) is 0, relative luminance is 100%. When the relative luminance is less than or equal to 80%, quality of a moving image can be improved. In particular, when the relative luminance is less than or equal to 50%, quality of a moving image can be significantly improved. Further, when the relative luminance is more than or equal to 10%, power consumption and flickers can be reduced. In particular, when the relative luminance is more than or equal to 20%, power consumption and flickers can be significantly reduced. That is, when the relative luminance is more than or equal to 10% and less than or equal to 80%, quality of a moving image can be improved and power consumption and flickers can be reduced. Further, when the relative luminance is more than or equal to 20% and less than or equal to 50%, quality of a moving image can be significantly improved and power consumption and flickers can be significantly reduced.

Figure 88B:
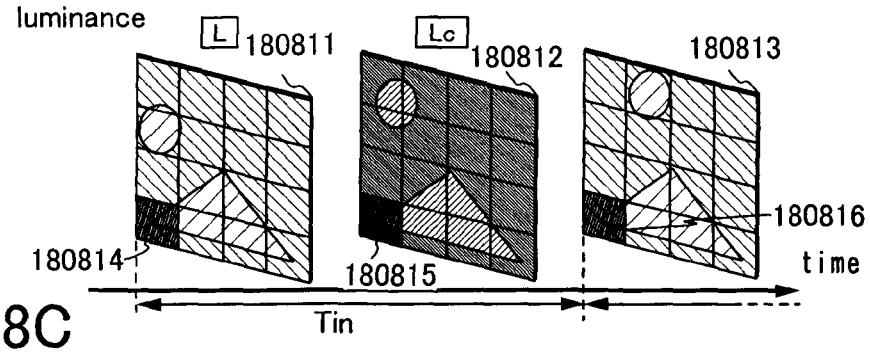

FIG. 88B shows an example of a method in which luminance of regions which are divided into tiled shapes is measured and an average value thereof is typical luminance of an image. The period $T_{in}$ shows a cycle of input image data; an image 180811 is the p-th image; an image 180812 is the (p+1)th image; an image 180813 is the (p+2)th image; a first region 180814 is a luminance measurement region in the p-th image 180811; a second region 180815 is a luminance measurement region in the (p+1)th image 180812; and a third region 180816 is a luminance measurement region in the (p+2)th image 180813. Here, the first to third regions may be provided in almost the same spatial positions in a device. That is, when typical luminance of the images is measured in the first to third regions, time change in typical luminance of the images can be measured.

When the typical luminance of the images is measured, whether display is made pseudo impulse display or not can be judged. For example, if $L_c<L$ is satisfied when luminance measured in the first region 180814 is denoted by L and luminance measured in the second region 180815 is denoted by $L_c$, it can be said that display is made pseudo impulse display. At that time, it can be said that quality of a moving image is improved.

Note that when the amount of change in typical luminance of the images with respect to time change (relative luminance) in the luminance measurement regions is in the following range, image quality can be improved. As for relative luminance, for example, relative luminance between the first region 180814 and the second region 180815 can be the ratio of lower luminance to higher luminance; relative luminance between the second region 180815 and the third region 180816 can be the ratio of lower luminance to higher luminance; and relative luminance between the first region 180814 and the third region 180816 can be the ratio of lower luminance to higher luminance. That is, when the amount of change in typical luminance of the images with respect to time change (relative luminance) is 0, relative luminance is 100%. When the relative luminance is less than or equal to 80%, quality of a moving image can be improved. In particular, when the relative luminance is less than or equal to 50%, quality of a moving image can be significantly improved. Further, when the relative luminance is more than or equal to 10%, power consumption and flickers can be reduced. In particular, when the relative luminance is more than or equal to 20%, power consumption and flickers can be significantly reduced. That is, when the relative luminance is more than or equal to 10% and less than or equal to 80%, quality of a moving image can be improved and power consumption and flickers can be reduced. Further, when the relative luminance is more than or equal to 20% and less than or equal to 50%, quality of a moving image can be significantly improved and power consumption and flickers can be significantly reduced.

Figure 88C:
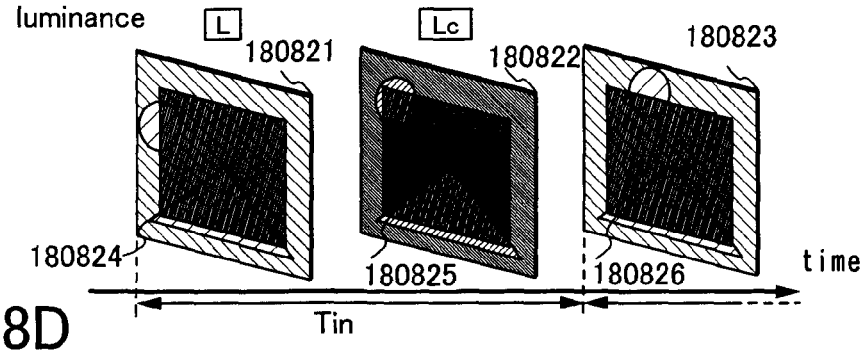

FIG. 88C shows an example of a method in which luminance of a center region in an image is measured and an average value thereof is typical luminance of the image. The period $T_{in}$ shows a cycle of input image data; an image 180821 is the p-th image; an image 180822 is the (p+1)th image; an image 180823 is the (p+2)th image; a first region 180824 is a luminance measurement region in the p-th image 180821; a second region 180825 is a luminance measurement region in the (p+1)th image 180822; and a third region 180826 is a luminance measurement region in the (p+2)th image 180823.

When the typical luminance of the images is measured, whether display is made pseudo impulse display or not can be judged. For example, if $L_c<L$ is satisfied when luminance measured in the first region 180824 is denoted by L and luminance measured in the second region 180825 is denoted by $L_c$, it can be said that display is made pseudo impulse display. At that time, it can be said that quality of a moving image is improved.

Note that when the amount of change in typical luminance of the images with respect to time change (relative luminance) in the luminance measurement regions is in the following range, image quality can be improved. As for relative luminance, for example, relative luminance between the first region 180824 and the second region 180825 can be the ratio of lower luminance to higher luminance; relative luminance between the second region 180825 and the third region 180826 can be the ratio of lower luminance to higher luminance; and relative luminance between the first region 180824 and the third region 180826 can be the ratio of lower luminance to higher luminance. That is, when the amount of change in typical luminance of the images with respect to time change (relative luminance) is 0, relative luminance is 100%. When the relative luminance is less than or equal to 80%, quality of a moving image can be improved. In particular, when the relative luminance is less than or equal to 50%, quality of a moving image can be significantly improved. Further, when the relative luminance is more than or equal to 10%, power consumption and flickers can be reduced. In particular, when the relative luminance is more than or equal to 20%, power consumption and flickers can be significantly reduced. That is, when the relative luminance is more than or equal to 10% and less than or equal to 80%, quality of a moving image can be improved and power consumption and flickers can be reduced. Further, when the relative luminance is more than or equal to 20% and less than or equal to 50%, quality of a moving image can be significantly improved and power consumption and flickers can be significantly reduced.

Figure 88D:
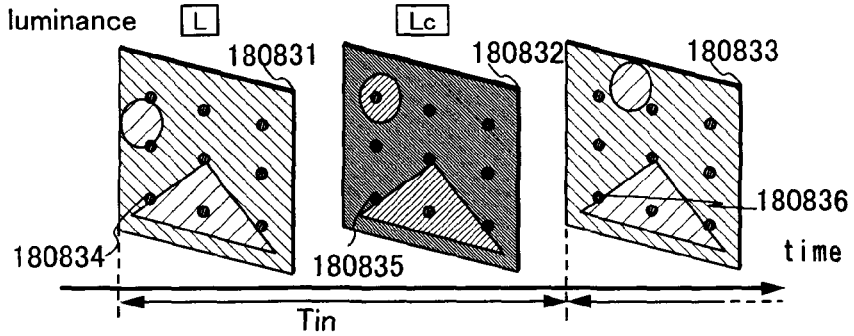
Figure 88E:
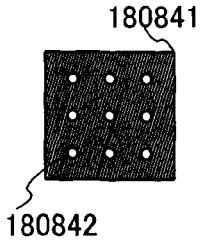

FIG. 88D shows an example of a method in which luminance of a plurality of points sampled from the entire image is measured and an average value thereof is typical luminance of the image. The period $T_{in}$ shows a cycle of input image data; an image 180831 is the p-th image; an image 180832 is the (p+1)th image; an image 180833 is the (p+2)th image; a first region 180834 is a luminance measurement region in the p-th image 180831; a second region 180835 is a luminance measurement region in the (p+1)th image 180832; and a third region 180836 is a luminance measurement region in the (p+2)th image 180833.

When the typical luminance of the images is measured, whether display is made pseudo impulse display or not can be judged. For example, if $L_c<L$ is satisfied when luminance measured in the first region 180834 is denoted by L and luminance measured in the second region 180835 is denoted by $L_c$, it can be said that display is made pseudo impulse display. At that time, it can be said that quality of a moving image is improved.

Note that when the amount of change in typical luminance of the images with respect to time change (relative luminance) in the luminance measurement regions is in the following range, image quality can be improved. As for relative luminance, for example, relative luminance between the first region 180834 and the second region 180835 can be the ratio of lower luminance to higher luminance; relative luminance between the second region 180835 and the third region 180836 can be the ratio of lower luminance to higher luminance; and relative luminance between the first region 180834 and the third region 180836 can be the ratio of lower luminance to higher luminance. That is, when the amount of change in typical luminance of the images with respect to time change (relative luminance) is 0, relative luminance is 100%. When the relative luminance is less than or equal to 80%, quality of a moving image can be improved. In particular, when the relative luminance is less than or equal to 50%, quality of a moving image can be significantly improved. Further, when the relative luminance is more than or equal to 10%, power consumption and flickers can be reduced. In particular, when the relative luminance is more than or equal to 20%, power consumption and flickers can be significantly reduced. That is, when the relative luminance is more than or equal to 10% and less than or equal to 80%, quality of a moving image can be improved and power consumption and flickers can be reduced. Further, when the relative luminance is more than or equal to 20% and less than or equal to 50%, quality of a moving image can be significantly improved and power consumption and flickers can be significantly reduced.

FIG. 88E shows a measurement method in the luminance measurement regions shown in FIGS. 88A to 88D. A region 180841 is a focused luminance measurement region, and a point 180842 is a luminance measurement point in the region 180841. In a luminance measurement apparatus having high time resolution, a measurement range thereof is small in some cases. Therefore, in the case where the region 180841 is large, unlike the case of measuring the whole region, a plurality of points in the region 180841 may be measured uniformly by dots and an average value thereof may be the luminance of the region 18084, as shown in FIG. 88E.

Note that in the case where the image is formed using combination of three primary colors of R, G and B, luminance to be measured may be luminance of R, G, and B, luminance of R and G, luminance of G and B, luminance of B and R, or each luminance of R, G, and B.

Next, a method for producing an image in an intermediate state by detecting movement of an image, which is included in input image data, and a method for controlling a driving method in accordance with movement of an image, which is included in input image data, or the like are described.

Figure 89A:
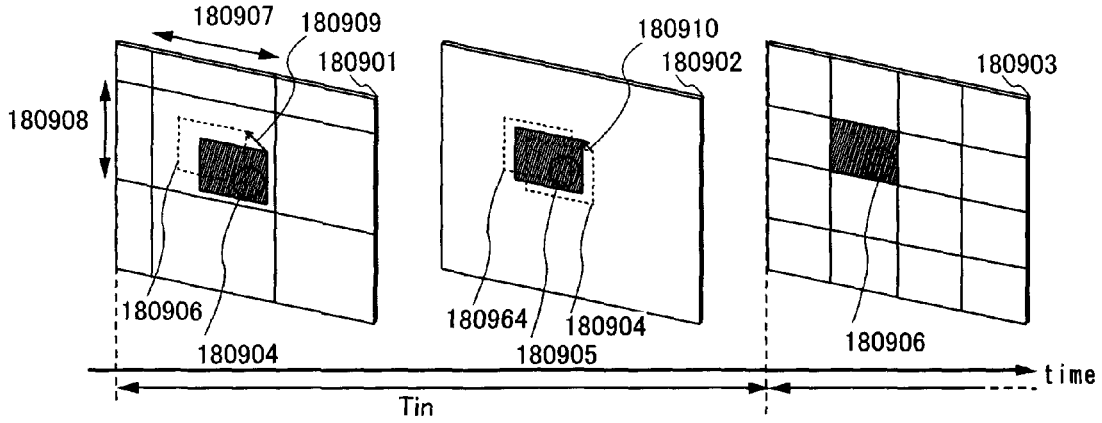
FIGS. 89A and 89B are diagrams for describing specific examples of the present invention.

A method for producing an image in an intermediate state by detecting movement of an image, which is included in input image data, is described with reference to FIGS. 89A and 89B. FIG. 89A shows the case where the display frame rate is twice as high as the input frame rate (the conversion ratio is 2). FIG. 89A schematically shows a method for detecting movement of an image with time represented by the horizontal axis. The period $T_{in}$ shows a cycle of input image data; an image 180901 is the p-th image; an image 180902 is the (p+1)th image; and an image 180903 is the (p+2)th image. Further, as regions which are independent of time, a first region 180904, a second region 180905, and a third region 180906 are provided in images.

First, in the (p+2)th image 180903, the image is divided into a plurality of tiled regions, and image data in the third region 180906 which is one of the regions is focused.

Next, in the p-th image 180901, a region which uses the third region 180906 as the center and is larger than the third region 180906 is focused. Here, the region which uses the third region 180906 as the center and is larger than the third region 180906 corresponds to a data retrieval region. In the data retrieval region, a range in a horizontal direction (an X direction) is denoted by 180907 and a range in a perpendicular direction (a Y direction) is denoted by 180908. Note that the range in the horizontal direction 180907 and the range in the perpendicular direction 180908 may be ranges in which each of a range in a horizontal direction and a range in a perpendicular direction of the third region 180906 is enlarged by approximately 15 pixels.

Then, in the data retrieval region, a region having image data which is most similar to the image data in the third region 180906 is retrieved. As a retrieval method, a least-squares method or the like can be used. As a result of retrieval, it is assumed that the first region 180904 be derived as the region having the most similar image data.

Next, as an amount which shows positional difference between the derived first region 180904 and the third region 180906, a vector 180909 is derived. Note that the vector 180909 is referred to as a motion vector.

Then, in the (p+1)th image 180902, the second region 180905 is formed by a vector calculated from the motion vector 180909, the image data in the third region 180906 in the (p+2)th image 180903, and image data in the first region 180904 in the p-th image 180901.

Here, the vector calculated from the motion vector 180909 is referred to as a displacement vector 180910. The displacement vector 180910 has a function of determining a position in which the second region 180905 is formed. The second region 180905 is formed in a position which is apart from the third region 180906 by the displacement vector 180910. Note that the amount of the displacement vector 180910 may be an amount which is obtained by multiplying the motion vector 180909 by a coefficient (1/2).

Image data in the second region 180905 in the (p+1)th image 180902 may be determined by the image data in the third region 180906 in the (p+2)th image 180903 and the image data in the first region 180904 in the p-th image 180901. For example, the image data in the second region 180905 in the (p+1)th image 180902 may be an average value between the image data in the third region 180906 in the (p+2)th image 180903 and the image data in the first region 180904 in the p-th image 180901.

In this manner, the second region 180905 in the (p+1)th image 180902, which corresponds to the third region 180906 in the (p+2)th image 180903, can be formed. Note that when the above-described treatment is also performed on other regions in the (p+2)th image 180903, the (p+1)th image 180902 which is made to be in an intermediate state between the (p+2)th image 180903 and the p-th image 180901 can be formed.

Figure 89B:
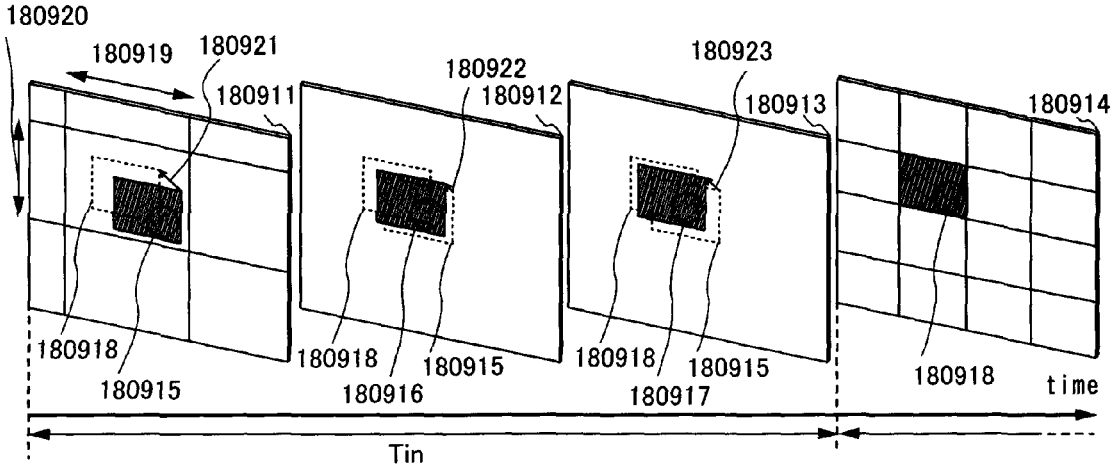

FIG. 89B shows the case where the display frame rate is three times as high as the input frame rate (the conversion ratio is 3). FIG. 89B schematically shows a method for detecting movement of an image with time represented by the horizontal axis. The period $T_{in}$ shows a cycle of input image data; an image 180911 is the p-th image; an image 180912 is the (p+1)th image; an image 180913 is the (p+2)th image; and an image 180914 is the (p+3)th image. Further, as regions which are independent of time, a first region 180915, a second region 180916, a third region 180917, and a fourth region 180918 are provided in images.

First, in the (p+3)th image 180914, the image is divided into a plurality of tiled regions, and image data in the fourth region 180918 which is one of the regions is focused.

Next, in the p-th image 180911, a region which uses the fourth region 180918 as the center and is larger than the fourth region 180918 is focused. Here, the region which uses the fourth region 180918 as the center and is larger than the fourth region 180918 corresponds to a data retrieval region. In the data retrieval region, a range in a horizontal direction (an X direction) is denoted by 180919 and a range in a perpendicular direction (a Y direction) is denoted by 180920. Note that the region in the horizontal direction 180919 and the range in the perpendicular direction 180920 may be ranges in which each of a range in a horizontal direction and a range in a perpendicular direction of the fourth region 180918 is enlarged by approximately 15 pixels.

Then, in the data retrieval region, a region having image data which is most similar to the image data in the fourth region 180918 is retrieved. As a retrieval method, a least-squares method or the like can be used. As a result of retrieval, it is assumed that the first region 180915 be derived as the region having the most similar image data.

Next, as an amount which shows positional difference between the derived first region 180915 and the fourth region 180918, a vector is derived. Note that the vector is referred to as the motion vector 180921.

Then, in each of the (p+1)th image 180912 and the (p+2)th image 180913, the second region 1809016 and the third region 180917 are formed by a first vector and a second vector calculated from the motion vector 180921, the image data in the fourth region 180918 in the (p+3)th image 180914, and image data in the first region 180915 in the p-th image 180911.

Here, the first vector calculated from the motion vector 180921 is referred to as the first displacement vector 180922. In addition, the second vector is referred to as the second displacement vector 180923. The first displacement vector 180922 has a function of determining a position in which the second region 180916 is formed. The second region 180916 is formed in a position which is apart from the fourth region 180918 by the first displacement vector 180922. Note that the first displacement vector 180922 may be an amount which is obtained by multiplying the motion vector 180921 by a coefficient (1/3). Further, the second displacement vector 180923 has a function of determining a position in which the third region 180917 is formed. The third region 180917 is formed in a position which is apart from the fourth region 180918 by the second displacement vector 180923. Note that the second displacement vector 180923 may be an amount which is obtained by multiplying the motion vector 180921 by a coefficient (2/3).

Image data in the second region 180916 in the (p+1)th image 180912 may be determined by the image data in the fourth region 180918 in the (p+3)th image 180914 and the image data in the first region 180915 in the p-th image 180911. For example, the image data in the second region 180916 in the (p+1)th image 180912 may be an average value between the image data in the fourth region 180918 in the (p+3)th image 180914 and the image data in the first region 180915 in the p-th image 180911.

Image data in the third region 180917 in the (p+2)th image 180913 may be determined by the image data in the fourth region 180918 in the (p+3)th image 180914 and the image data in the first region 180915 in the p-th image 180911. For example, the image data in the third region 180917 in the (p+2)th image 180913 may be an average value between the image data in the fourth region 180918 in the (p+3)th image 180914 and the image data in the first region 180915 in the p-th image 180911.

In this manner, the second region 180916 in the (p+1)th image 180912 and the third region 180917 in the (p+2)th image 180913 which correspond to the fourth region 180918 in the (p+3)th image 180914 can be formed. Note that when the above-described treatment is also performed on other regions in the (p+3)th image 180914, the (p+1)th image 180912 and the (p+2)th image 180913 which are made to be in an intermediate state between the (p+3)th image 180914 and the p-th image 180911 can be formed.

Figure 90A:
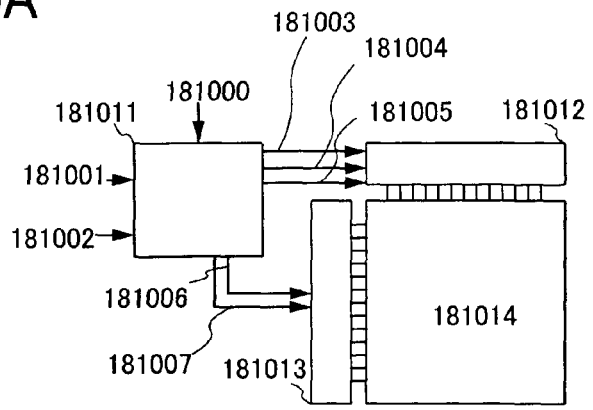
FIGS. 90A to 90D are diagrams for describing specific examples of the present invention.
Figure 90B:
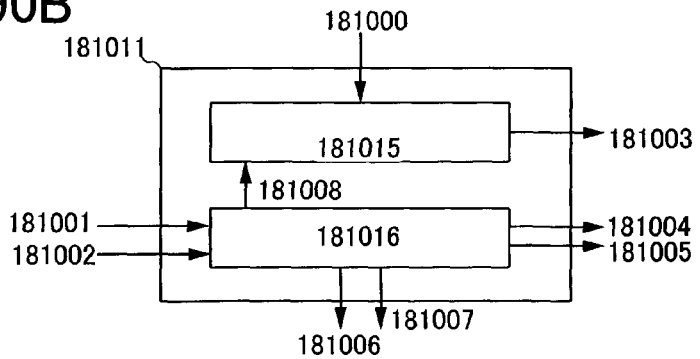
Figure 90C:
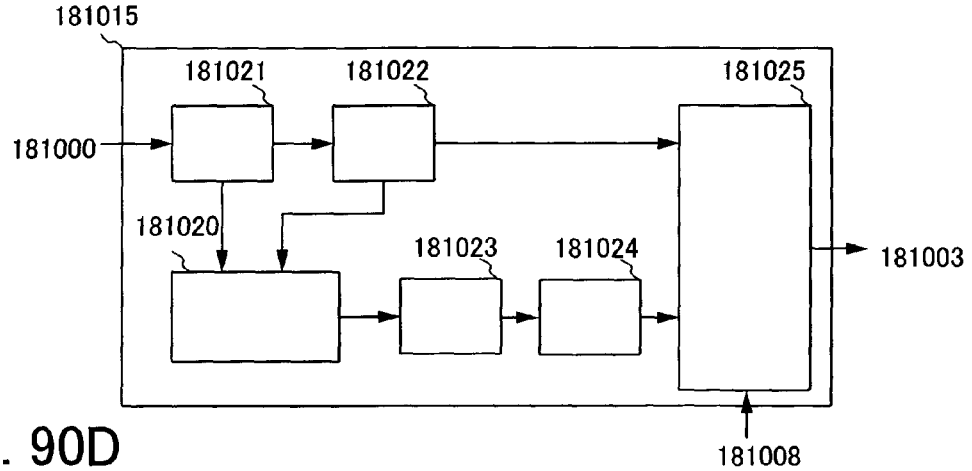
Figure 90D:
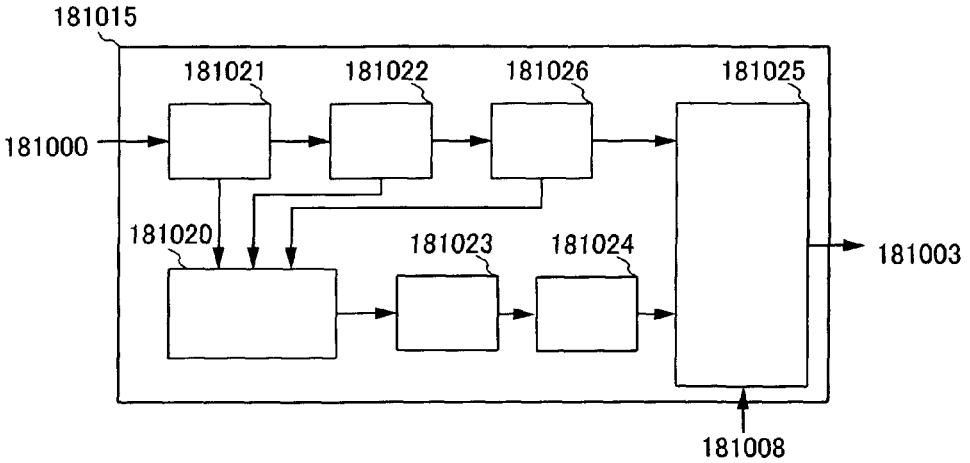

Next, an example of a circuit which produces an image in an intermediate state by detecting movement of an image, which is included in input image data, is described with reference to FIGS. 90A to 90D. FIG. 90A shows a connection relation between a peripheral driver circuit including a source driver and a gate driver for displaying an image on a display region, and a control circuit for controlling the peripheral driver circuit. FIG. 90B shows an example of a specific circuit structure of the control circuit. FIG. 90C shows an example of a specific circuit structure of an image processing circuit included in the control circuit. FIG. 90D shows another example of the specific circuit structure of the image processing circuit included in the control circuit.

As shown in FIG. 90A, a device in this embodiment mode may include a control circuit 181011, a source driver 181012, a gate driver 181013, and a display region 181014.

Note that the control circuit 181011, the source driver 181012, and the gate driver 181013 may be formed over the same substrate as the display region 181014.

Note that part of the control circuit 181011, the source driver 181012, and the gate driver 181013 may be formed over the same substrate as the display region 181014, and other circuits may be formed over a different substrate from that of the display region 181014. For example, the source driver 181012 and the gate driver 181013 may be formed over the same substrate as the display region 181014, and the control circuit 181011 may be formed over a different substrate as an external IC. Similarly, the gate driver 181013 may be formed over the same substrate as the display region 181014, and other circuits may be formed over a different substrate as an external IC. Similarly, part of the source driver 181012, the gate driver 181013, and the control circuit 181011 may be formed over the same substrate as the display region 181014, and other circuits may be formed over a different substrate as an external IC.

The control circuit 181011 may have a structure to which an external image signal 181000, a horizontal synchronization signal 181001, and a vertical synchronization signal 181002 are input and an image signal 181003, a source start pulse 181004, a source clock 181005, a gate start pulse 181006, and a gate clock 181007 are output.

The source driver 181012 may have a structure in which the image signal 181003, the source start pulse 181004, and the source clock 181005 are input and voltage or current in accordance with the image signal 181003 is output to the display region 181014.

The gate driver 181013 may have a structure to which the gate start pulse 181006 and the gate clock 181007 are input and a signal which specifies timing for writing a signal output from the source driver 181012 to the display region 181014 is output.

In the case where frequency of the external image signal 181000 is different from frequency of the image signal 181003, a signal for controlling timing for driving the source driver 181012 and the gate driver 181013 is also different from frequency of the horizontal synchronization signal 181001 and the vertical synchronization signal 181002 which are input. Therefore, in addition to processing of the image signal 181003, it is necessary to process the signal for controlling timing for driving the source driver 181012 and the gate driver 181013. The control circuit 181011 may have a function of processing the signal for controlling timing for driving the source driver 181012 and the gate driver 181013. For example, in the case where the frequency of the image signal 181003 is twice as high as the frequency of the external image signal 181000, the control circuit 181011 generates the image signal 181003 having twice frequency by interpolating an image signal included in the external image signal 181000 and controls the signal for controlling timing so that the signal also has twice frequency.

Further, as shown in FIG. 90B, the control circuit 181011 may include an image processing circuit 181015 and a timing generation circuit 181016.

The image processing circuit 181015 may have a structure to which the external image signal 181000 and a frequency control signal 181008 are input and the image signal 181003 is output.

The timing generation circuit 181016 may have a structure to which the horizontal synchronization signal 181001 and the vertical synchronization signal 181002 are input, and the source start pulse 181004, the source clock 181005, the gate start pulse 181006, the gate clock 181007, and the frequency control signal 181008 are output. Note that the timing generation circuit 181016 may have a memory, a register, or the like for holding data for specifying the state of the frequency control signal 181008. Alternatively, the timing generation circuit 181016 may have a structure to which a signal for specifying the state of the frequency control signal 181008 is input from outside.

As shown in FIG. 90C, the image processing circuit 181015 may include a motion detection circuit 181020, a first memory 181021, a second memory 181022, a third memory 181023, a luminance control circuit 181024, and a high-speed processing circuit 181025.

The motion detection circuit 181020 may have a structure in which a plurality of pieces of image data are input, movement of an image is detected, and image data which is in an intermediate state of the plurality of pieces of image data is output.

The first memory 181021 may have a structure in which the external image signal 181000 is input, the external image signal 181000 is held for a certain period, and the external image signal 181000 is output to the motion detection circuit 181020 and the second memory 181022.

The second memory 181022 may have a structure in which image data output from the first memory 181021 is input, the image data is held for a certain period, and the image data is output to the motion detection circuit 181020 and the high-speed processing circuit 181025.

The third memory 181023 may have a structure in which image data output from the motion detection circuit 181020 is input, the image data is held for a certain period, and the image data is output to the luminance control circuit 181024.

The high-speed processing circuit 181025 may have a structure in which image data output from the second memory 181022, image data output from the luminance control circuit 181024, and a frequency control signal 181008 are input and the image data is output as the image signal 181003.

In the case where the frequency of the external image signal 181000 is different from the frequency of the image signal 181003, the image signal 181003 may be generated by interpolating the image signal included in the external image signal 181000 by the image processing circuit 181015. The input external image signal 181000 is once held in the first memory 181021. At that time, image data which is input in the previous frame is held in the second memory 181022. The motion detection circuit 181020 may read the image data held in the first memory 181021 and the second memory 181022 as appropriate to detect a motion vector by difference between the both pieces of image data and to generate image data in an intermediate state. The generated image data in an intermediate state is held in the third memory 181023.

When the motion detection circuit 181020 generates the image data in an intermediate state, the high-speed processing circuit 181025 outputs the image data held in the second memory 181022 as the image signal 181003. After that, the image data held in the third memory 181023 is output through the luminance control circuit 181024 as the image signal 181003. At this time, frequency which is updated by the second memory 181022 and the third memory 181023 is the same as the external image signal 181000; however, the frequency of the image signal 181003 which is output through the high-speed processing circuit 181025 may be different from the frequency of the external image signal 181000. Specifically, for example, the frequency of the image signal 181003 is 1.5 times, twice, or three times as high as the frequency of the external image signal 181000. However, the present invention is not limited to this, and a variety of frequency can be used. Note that the frequency of the image signal 181003 may be specified by the frequency control signal 181008.

The structure of the image processing circuit 181015 shown in FIG. 90D is obtained by adding a fourth memory 181026 to the structure of the image processing circuit 181015 shown in FIG. 90C. When image data output from the fourth memory 181026 is also output to the motion detection circuit 181020 in addition to the image data output from the first memory 181021 and the image data output from the second memory 181022 in this manner, movement of an image can be detected adequately.

Note that in the case where image data to be input has already included a motion vector for data compression or the like, for example, the image data to be input is image data which is based on an MPEG (moving picture expert group) standard, an image in an intermediate state may be generated as an interpolated image by using this image data. At this time, a portion which generates a motion vector included in the motion detection circuit 181020 is not necessary. Further, since encoding and decoding processing of the image signal 181003 is simplified, power consumption can be reduced.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the contents (or part of the contents) described in each drawing in this embodiment mode can be freely applied to, combined with, or replaced with the contents (or part of the contents) described in a drawing in another embodiment mode. Further, much more drawings can be formed by combining each part in each drawing in this embodiment mode with part of another embodiment mode.

Note that this embodiment mode shows examples of embodying, slightly transforming, partially modifying, improving, describing in detail, or applying the contents (or part of the contents) described in other embodiment modes, an example of related part thereof, or the like. Therefore, the contents described in other embodiment modes can be freely applied to, combined with, or replaced with this embodiment mode.

Embodiment Mode 11

In this embodiment mode, examples of electronic devices according to the present invention are described.

Figure 47:
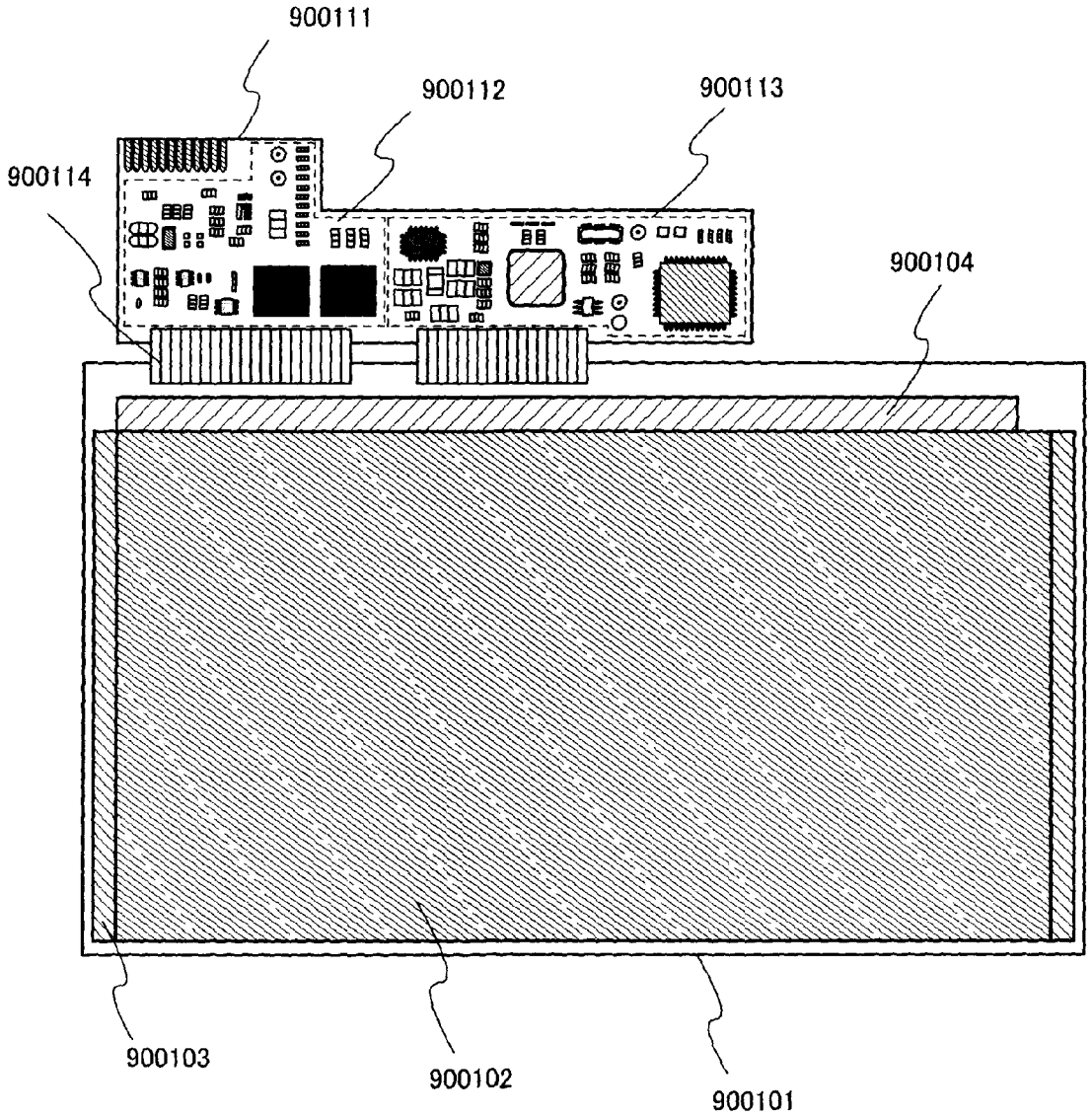
FIG. 47 is a diagram for describing a specific example of the present invention.

FIG. 47 shows a display panel module combining a display panel 900101 and a circuit board 900111. The display panel 900101 includes a pixel portion 900102, a scan line driver circuit 900103, and a signal line driver circuit 900104. The circuit board 900111 is provided with a control circuit 900112, a signal dividing circuit 900113, and the like, for example. The display panel 900101 and the circuit board 900111 are connected by a connection wiring 900114. An FPC or the like can be used for the connection wiring.

In the display panel 900101, the pixel portion 900102 and part of peripheral driver circuits (a driver circuit having a low operation frequency among a plurality of driver circuits) may be formed over the same substrate by using transistors, and another part of the peripheral driver circuits (a driver circuit having a high operation frequency among the plurality of driver circuits) may be formed over an IC chip. Then, the IC chip may be mounted on the display panel 900101 by COG (chip on glass) or the like. Thus, the area of the circuit board 900111 can be reduced, and a small display device can be obtained. Alternatively, the IC chip may be mounted on the display panel 900101 by using TAB (tape automated bonding) or a printed wiring board. Thus, the area of the display panel 900101 can be reduced, and a display device with a narrower frame can be obtained.

For example, in order to reduce power consumption, a pixel portion may be formed over a glass substrate by using transistors, and all peripheral circuits may be formed over an IC chip. Then, the IC chip may be mounted on a display panel by COG or TAB.

Figure 48:
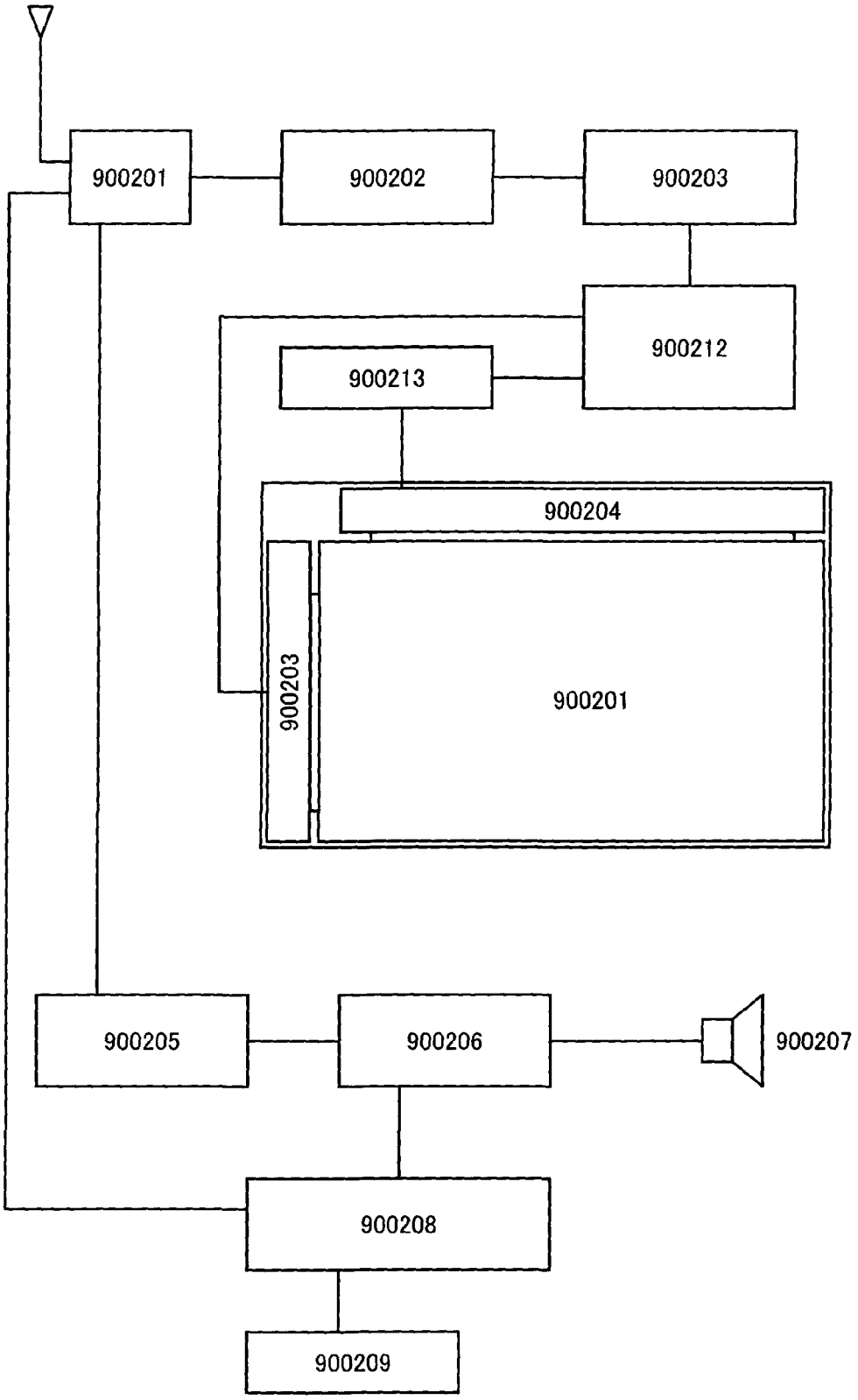
FIG. 48 is a diagram for describing a specific example of the present invention.

A television receiver can be completed with the display panel module shown in FIG. 47. FIG. 48 is a block diagram showing a main structure of a television receiver. A tuner 900201 receives a video signal and an audio signal. The video signals are processed by an video signal amplifier circuit 900202; a video signal processing circuit 900203 which converts a signal output from the video signal amplifier circuit 900202 into a color signal corresponding to each color of red, green, and blue; and a control circuit 900212 which converts the video signal into an input specification of a driver circuit. The control circuit 900212 outputs signals to each of the scan line side and the signal line side. When digital driving is performed, a structure may be employed in which a signal dividing circuit 900213 is provided on the signal line side and an input digital signal is divided into m signals (m is a positive integer) to be supplied.

Among the signals received by the tuner 900201, an audio signal is transmitted to an audio signal amplifier circuit 900205, and an output thereof is supplied to a speaker 900207 through an audio signal processing circuit 900206. A control circuit 900208 receives control information on receiving station (receiving frequency) and volume from an input portion 900209 and transmits a signal to the tuner 900201 or the audio signal processing circuit 900206.

Figure 49A:
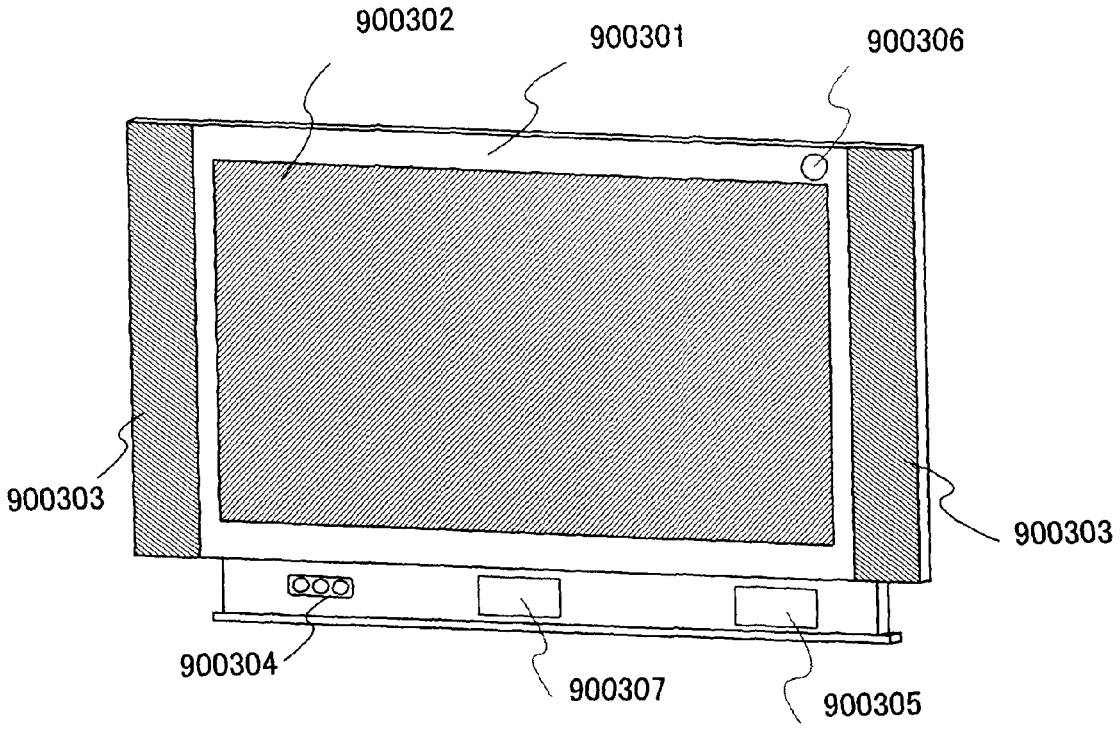
FIGS. 49A and 49B are diagrams for describing specific examples of the present invention.

FIG. 49A shows a television receiver incorporated with a display panel module which is different from FIG. 48. In FIG. 49A, a display screen 900302 stored in a housing 900301 is formed using the display panel module. Note that speakers 900303, an operation switch 900304, an input means 900305, a sensor 900306 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 900307, and the like may be provided as appropriate.

Figure 49B:
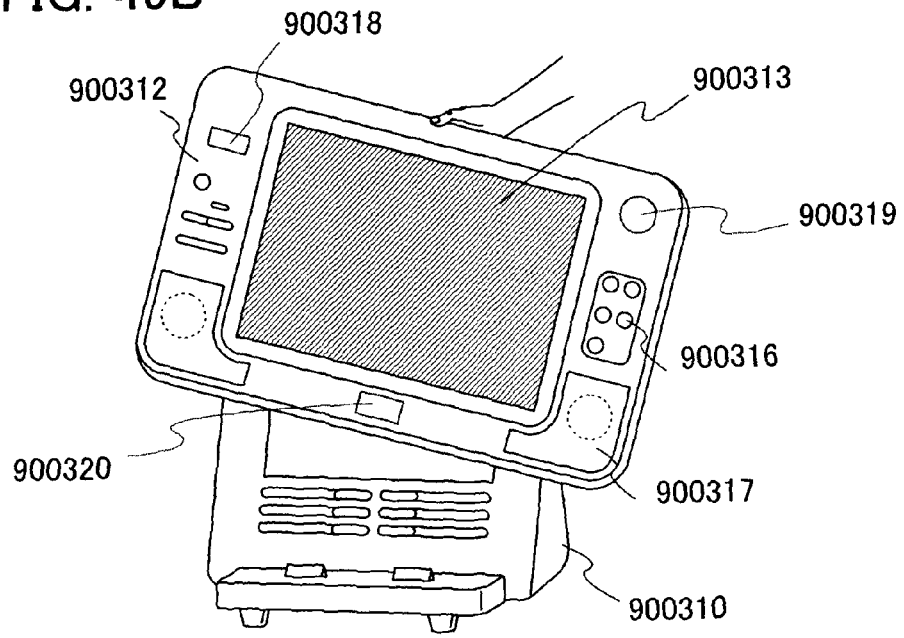

FIG. 49B shows a television receiver in which only a display can be carried wirelessly. A battery and a signal receiver are incorporated in a housing 900312. By the battery, a display portion 900313, a speaker portion 900317, a sensor 900319 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), and a microphone 900320 are driven. The battery can be repeatedly charged by a charger 900310. The charger 900310 which is capable of transmitting and receiving a video signal can transmit the video signal to the signal receiver of the display. The device shown in FIG. 49B is controlled by an operation key 900316. Alternatively, the device shown in FIG. 49B can transmit a signal to the charger 900310 by operating the operation key 900316. That is, the device may be an image and audio interactive communication device. Further alternatively, by operating the operation key 900316, a signal is transmitted to the charger 900310 from the housing 900312, and another electronic device is made to receive a signal which can be transmitted from the charger 900310; thus, the device shown in FIG. 49B can control communication of another electronic device. That is, the device may be a general-purpose remote control device. Note that an input means 900318 or the like may be provided as appropriate. Note that the contents (or part of the contents) described in each drawing of this embodiment mode can be applied to the display portion 900313.

Figure 50A:
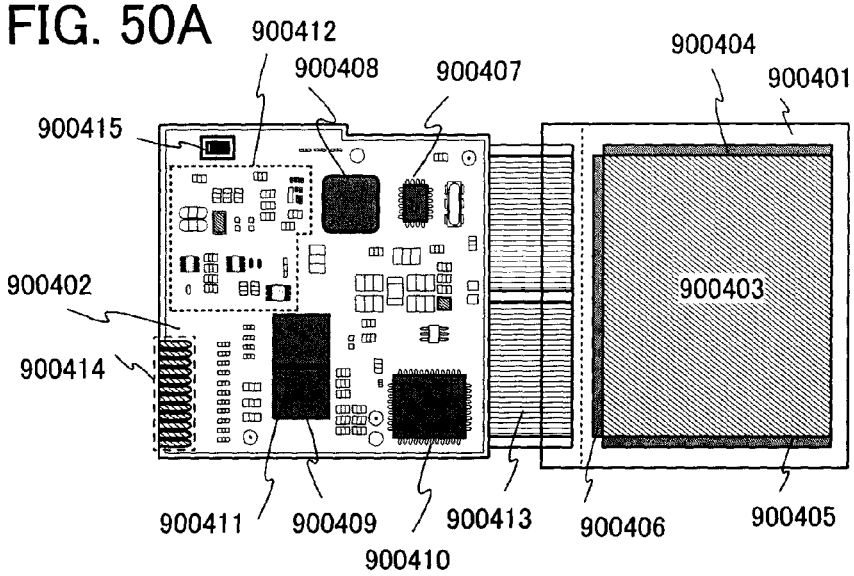
FIGS. 50A and 50B are diagrams for describing specific examples of the present invention.

FIG. 50A shows a module combining a display panel 900401 and a printed wiring board 900402. The display panel 900401 may be provided with a pixel portion 900403 including a plurality of pixels, a first scan line driver circuit 900404, a second scan line driver circuit 900405, and a signal line driver circuit 900406 which supplies a video signal to a selected pixel.

The printed wiring board 900402 is provided with a controller 900407, a central processing unit (CPU) 900408, a memory 900409, a power supply circuit 900410, an audio processing circuit 900411, a transmitting/receiving circuit 900412, and the like. The printed wiring board 900402 and the display panel 900401 are connected by a flexible printed circuit (FPC) 900413. The flexible printed circuit (FPC) 900413 may be provided with a capacitor, a buffer circuit, or the like so as to prevent noise on power supply voltage or a signal, and increase in rise time of a signal. Note that the controller 900407, the audio processing circuit 900411, the memory 900409, the central processing unit (CPU) 900408, the power supply circuit 900410, or the like can be mounted to the display panel 900401 by using a COG (chip on glass) method. By using a COG method, the size of the printed wiring board 900402 can be reduced.

Various control signals are input and output through an interface (I/F) portion 900414 provided for the printed wiring board 900402. An antenna port 900415 for transmitting a signal to and receiving a signal from an antenna is provided for the printed wiring board 900402.

Figure 50B:
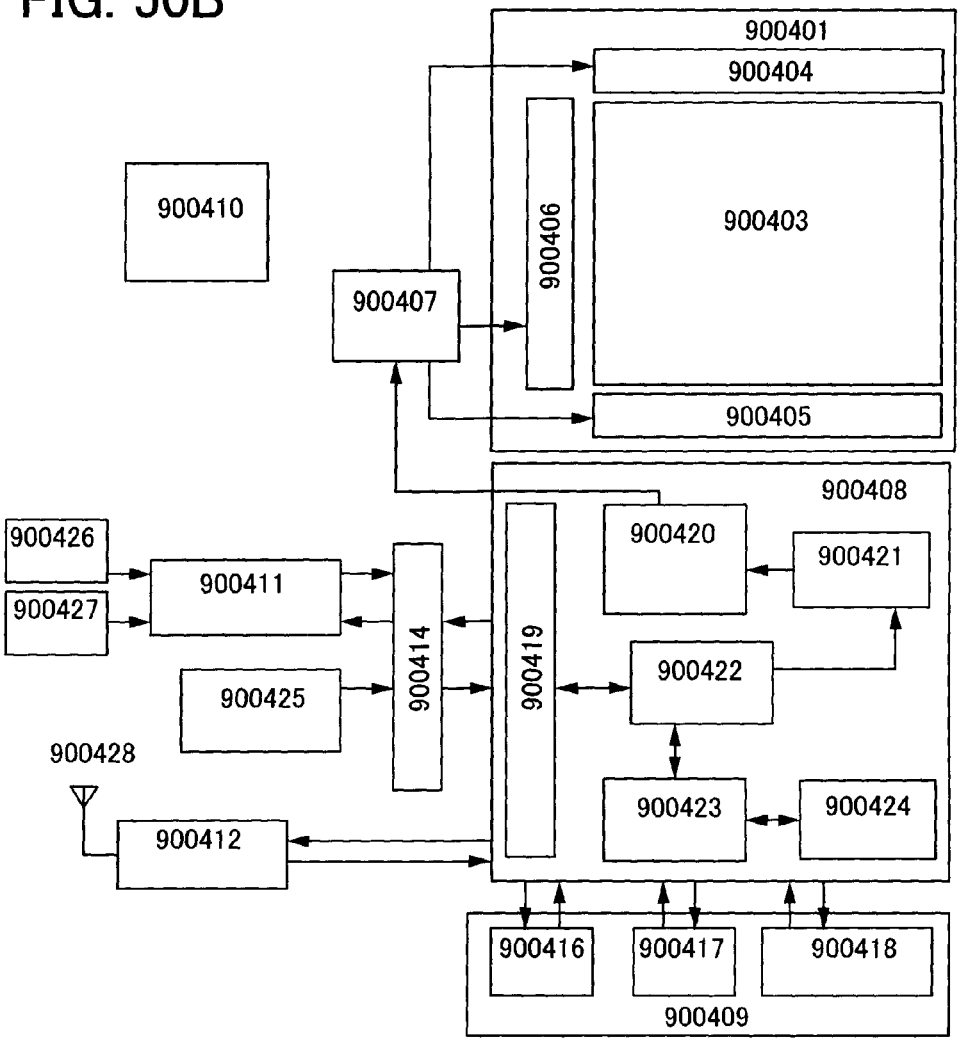

FIG. 50B is a block diagram of the module shown in FIG. 50A. The module includes a VRAM 900416, a DRAM 900417, a flash memory 900418, and the like as the memory 900409. The VRAM 900416 stores data on an image displayed on a panel, the DRAM 900417 stores video data or audio data, and the flash memory 900418 stores various programs.

The power supply circuit 900410 supplies electric power for operating the display panel 900401, the controller 900407, the central processing unit (CPU) 900408, the audio processing circuit 900411, the memory 900409, and the transmitting/receiving circuit 900412. Note that the power supply circuit 900410 may be provided with a current source depending on a panel specification.

The central processing unit (CPU) 900408 includes a control signal generation circuit 900420, a decoder 900421, a register 900422, an arithmetic circuit 900423, a RAM 900424, an interface (I/F) portion 900419 for the central processing unit (CPU) 900408, and the like. Various signals input to the central processing unit (CPU) 900408 via the interface (I/F) portion 900414 are once stored in the register 900422, and subsequently input to the arithmetic circuit 900423, the decoder 900421, and the like. The arithmetic circuit 900423 performs operation based on the signal input thereto so as to designate a location to which various instructions are sent. On the other hand, the signal input to the decoder 900421 is decoded and input to the control signal generation circuit 900420. The control signal generation circuit 900420 generates a signal including various instructions based on the signal input thereto, and transmits the signal to the location designated by the arithmetic circuit 900423, specifically the memory 900409, the transmitting/receiving circuit 900412, the audio processing circuit 900411, and the controller 900407, for example.

The memory 900409, the transmitting/receiving circuit 900412, the audio processing circuit 900411, and the controller 900407 operate in accordance with instructions which they receive. Hereinafter, the operation is briefly described.

A signal input from an input means 900425 is transmitted via the interface (I/F) portion 900414 to the central processing unit (CPU) 900408 mounted to the printed wiring board 900402. The control signal generation circuit 900420 converts image data stored in the VRAM 900416 into a predetermined format depending on the signal transmitted from the input means 900425 such as a pointing device or a keyboard, and transmits the converted data to the controller 900407.

The controller 900407 performs data processing of the signal including the image data transmitted from the central processing unit (CPU) 900408 in accordance with the panel specification, and supplies the signal to the display panel 900401. The controller 900407 generates an Hsync signal, a Vsync signal, a clock signal CLK, alternating voltage (AC Cont), and a switching signal L/R based on power supply voltage input from the power supply circuit 900410 or various signals input from the central processing unit (CPU) 900408, and supplies the signals to the display panel 900401.

The transmitting/receiving circuit 900412 processes a signal which is to be transmitted and received as an electric wave by an antenna 900428. Specifically, the transmitting/receiving circuit 900412 may include a high-frequency circuit such as an isolator, a band pass filter, a VCO (voltage controlled oscillator), an LPF (low pass filter), a coupler, or a balun. A signal including audio information among signals transmitted and received by the transmitting/receiving circuit 900412 is transmitted to the audio processing circuit 900411 in accordance with an instruction from the central processing unit (CPU) 900408.

The signal including the audio information which is transmitted in accordance with the instruction from the central processing unit (CPU) 900408 is demodulated into an audio signal by the audio processing circuit 900411 and transmitted to a speaker 900427. An audio signal transmitted from a microphone 900426 is modulated by the audio processing circuit 900411 and transmitted to the transmitting/receiving circuit 900412 in accordance with an instruction from the central processing unit (CPU) 900408.

The controller 900407, the central processing unit (CPU) 900408, the power supply circuit 900410, the audio processing circuit 900411, and the memory 900409 can be mounted as a package of this embodiment mode.

It is needless to say that this embodiment mode is not limited to a television receiver and can be applied to various uses, such as a monitor of a personal computer, and especially as a large display medium such as an information display board at the train station, the airport, or the like, or an advertisement display board on the street.

Next, a structure example of a mobile phone according to the present invention is described with reference to FIG. 51.

A display panel 900501 is detachably incorporated in a housing 900530. The shape or the size of the housing 900530 can be changed as appropriate in accordance with the size of the display panel 900501. The housing 900530 to which the display panel 900501 is fixed is fitted in a printed wiring board 900531 to be assembled as a module.

The display panel 900501 is connected to the printed wiring board 900531 through an FPC 900513. The printed wiring board 900531 is provided with a speaker 900532, a microphone 900533, a transmitting/receiving circuit 900534, a signal processing circuit 900535 including a CPU, a controller, and the like, and a sensor 900541 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray). Such a module, an input means 900536, and a battery 900537 are combined and stored in a housing 900539. A pixel portion of the display panel 900501 is provided so as to be seen from an opening window formed in the housing 900539.

In the display panel 900501, the pixel portion and part of peripheral driver circuits (a driver circuit having a low operation frequency among a plurality of driver circuits) may be formed over the same substrate by using transistors, and another part of the peripheral driver circuits (a driver circuit having a high operation frequency among the plurality of driver circuits) may be formed over an IC chip. Then, the IC chip may be mounted on the display panel 900501 by COG (chip on glass). Alternatively, the IC chip may be connected to a glass substrate by using TAB (tape automated bonding) or a printed wiring board. With such a structure, power consumption of the mobile phone (also a display panel is also possible) can be reduced, and operation time of the mobile phone per charge can be extended. Further, reduction in cost of the mobile phone can be realized.

Figure 51:
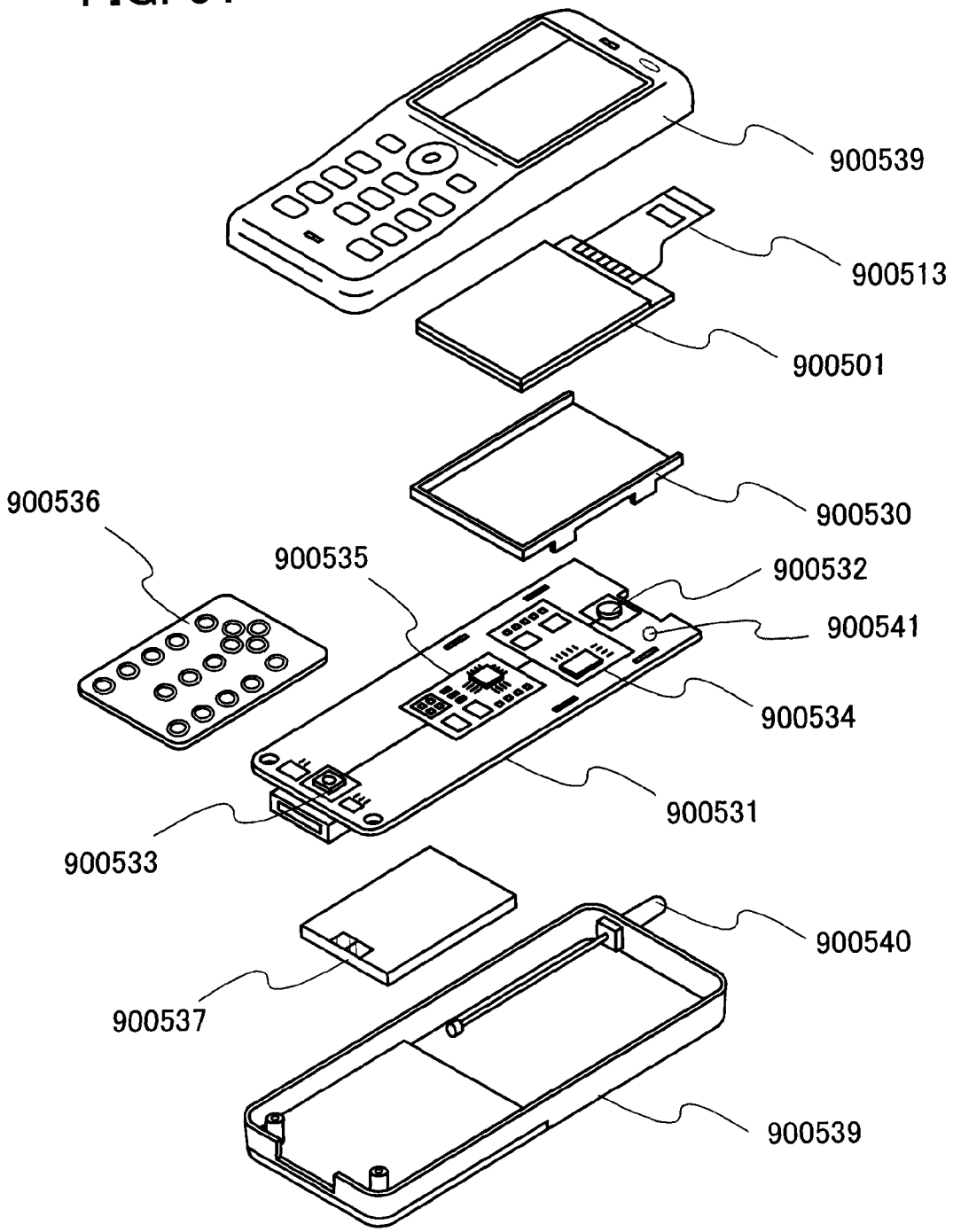
FIG. 51 is a diagram for describing a specific example of the present invention.

The mobile phone shown in FIG. 51 has various functions such as, but not limited to, a function of displaying various kinds of information (e.g., a still image, a moving image, and a text image); a function of displaying a calendar, a date, the time, and the like on a display portion; a function of operating or editing the information displayed on the display portion; a function of controlling processing by various kinds of software (programs); a function of wireless communication; a function of communicating with another mobile phone, a fixed phone, or an audio communication device by using the wireless communication function; a function of connecting with various computer networks by using the wireless communication function; a function of transmitting or receiving various kinds of data by using the wireless communication function; a function of operating a vibrator in accordance with incoming call, reception of data, or an alarm; and a function of generating a sound in accordance with incoming call, reception of data, or an alarm.

Figure 52:
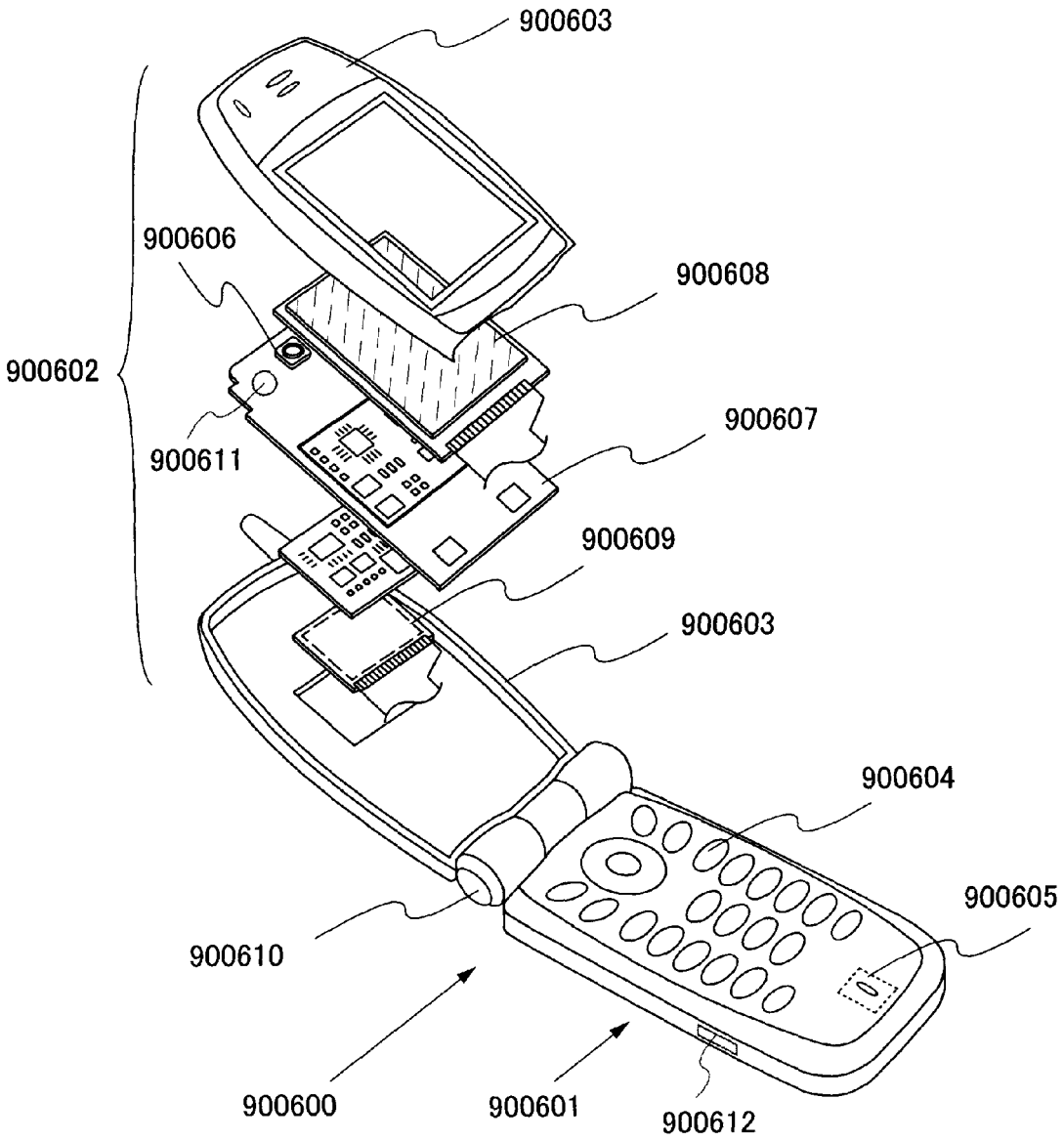
FIG. 52 is a diagram for describing a specific example of the present invention.

In a mobile phone shown in FIG. 52, a main body (A) 900601 provided with operation switches 900604, a microphone 900605, and the like is connected to a main body (B) 900602 provided with a display panel (A) 900608, a display panel (B) 900609, a speaker 900606, a sensor 900611 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), an input means 900612, and the like by using a hinge 900610 so that the mobile phone can be opened and closed. The display panel (A) 900608 and the display panel (B) 900609 are placed in a housing 900603 of the main body (B) 900602 together with a circuit board 900607. Each of pixel portions of the display panel (A) 900608 and the display panel (B) 900609 is arranged so as to be seen from an opening window formed in the housing 900603.

Specifications of the display panel (A) 900608 and the display panel (B) 900609, such as the number of pixels, can be set as appropriate in accordance with functions of a mobile phone 900600. For example, the display panel (A) 900608 can be used as a main screen and the display panel (B) 900609 can be used as a sub-screen.

A mobile phone according to this embodiment mode can be changed in various modes depending on functions or applications thereof. For example, it may be a camera-equipped mobile phone by incorporating an imaging element in a portion of the hinge 900610. When the operation switches 900604, the display panel (A) 900608, and the display panel (B) 900609 are placed in one housing, the aforementioned effects can be obtained. Further, the similar effects can be obtained when the structure of this embodiment mode is applied to an information display terminal equipped with a plurality of display portions.

The mobile phone in FIG. 52 has various functions such as, but not limited to, a function of displaying various kinds of information (e.g., a still image, a moving image, and a text image); a function of displaying a calendar, a date, the time, and the like on a display portion; a function of operating or editing the information displaying on the display portion; a function of controlling processing by various kinds of software (programs); a function of wireless communication; a function of communicating with another mobile phone, a fixed phone, or an audio communication device by using the wireless communication function; a function of connecting with various computer networks by using the wireless communication function; a function of transmitting or receiving various kinds of data by using the wireless communication function; a function of operating a vibrator in accordance with incoming call, reception of data, or an alarm; and a function of generating a sound in accordance with incoming call, reception of data, or an alarm.

The contents (or part of the contents) described in each drawing in this embodiment mode can be applied to various electronic devices. Specifically, the present invention can be applied to a display portion of an electronic device. Examples of such electronic devices include cameras such as a video camera and a digital camera, a goggle-type display, a navigation system, an audio reproducing device (such as car audio components and audio components), a computer, a game machine, a portable information terminal (such as a mobile computer, a mobile phone, a mobile game machine, and an e-book reader), and an image reproducing device provided with a recording medium (specifically, a device which reproduces content of a recording medium such as a digital versatile disc (DVD) and has a display for displaying the reproduced image).

Figure 53A:
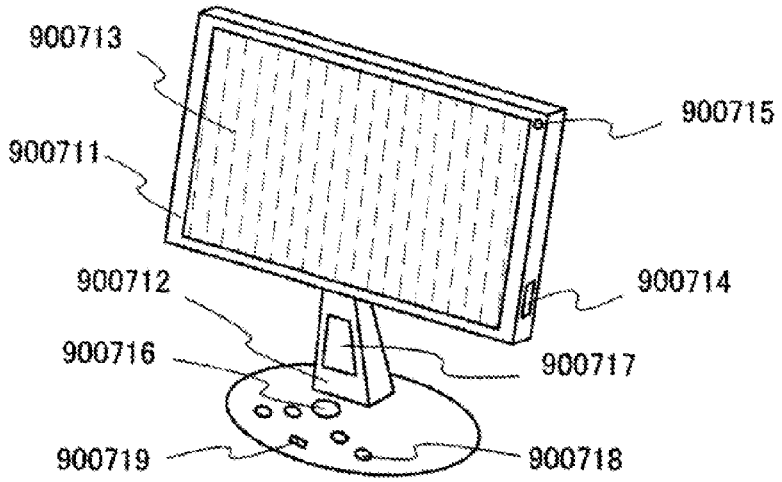
FIGS. 53A to 53C are diagrams for describing specific examples of the present invention.

FIG. 53A shows a display, which includes a housing 900711, a support base 900712, a display portion 900713, an input means 900714, a sensor 900715 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 900716, a speaker 900717, operation keys 900718, an LED lamp 900719, and the like. The display shown in FIG. 53A can have various functions such as, but not limited to, a function of displaying various kinds of information (e.g., a still image, a moving image, and a text image) on the display portion.

Figure 53B:
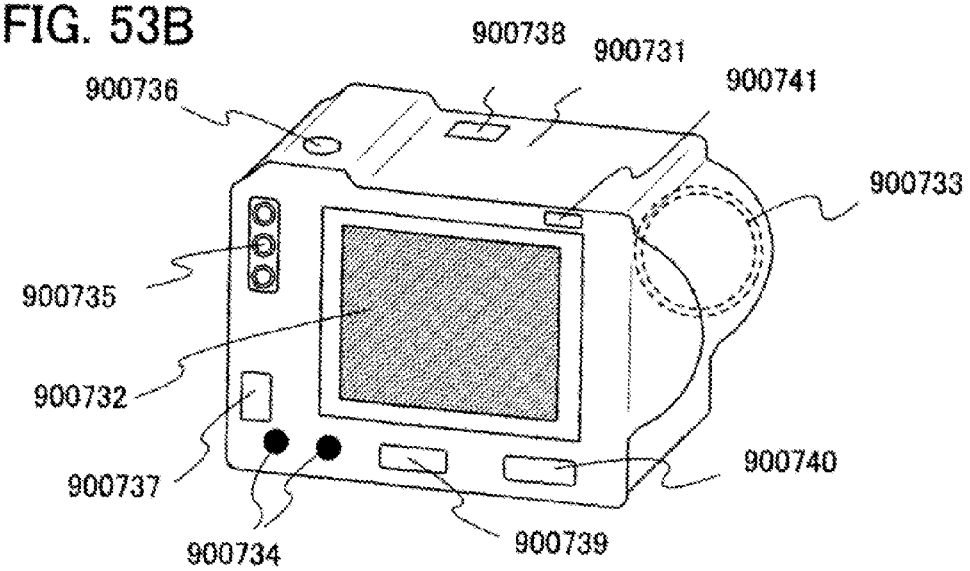

FIG. 53B shows a camera, which includes a main body 900731, a display portion 900732, an image receiving portion 900733, operation keys 900734, an external connection port 900735, a shutter button 900736, an input means 900737, a sensor 900738 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 900739, a speaker 900740, an LED lamp 900741, and the like. The camera shown in FIG. 53B can have various functions such as, but not limited to, a function of photographing a still image and a moving image; a function of automatically adjusting the photographed image (the still image or the moving image); a function of storing the photographed image in a recording medium (provided externally or incorporated in the camera); and a function of displaying the photographed image on the display portion.

Figure 53C:
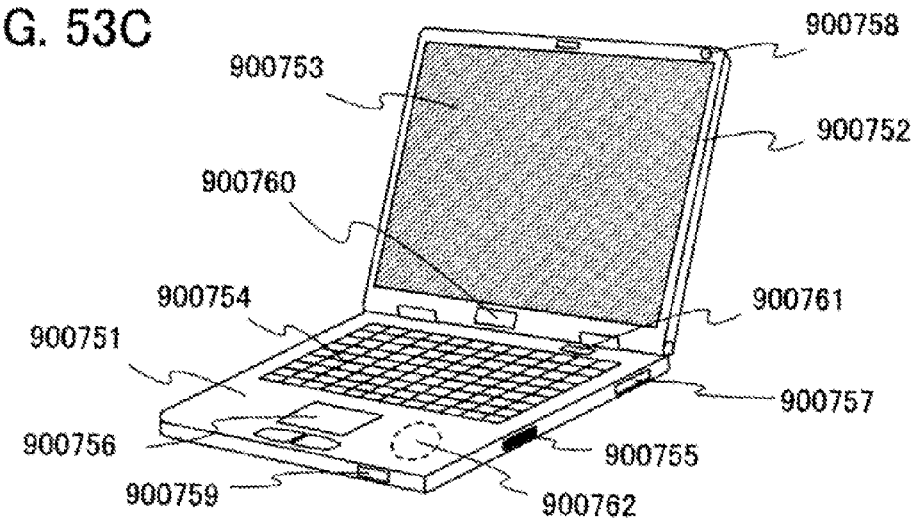

FIG. 53C shows a computer, which includes a main body 900751, a housing 900752, a display portion 900753, a keyboard 900754, an external connection port 900755, a pointing device 900756, an input means 900757, a sensor 900758 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 900759, a speaker 900760, an LED lamp 900761, a reader/writer 900762, and the like. The computer shown in FIG. 53C can have various functions such as, but not limited to, a function of displaying various kinds of information (e.g., a still image, a moving image, and a text image) on the display portion; a function of controlling processing by various kinds of software (programs); a communication function such as wireless communication or wire communication; a function of connecting with various computer networks by using the communication function; and a function of transmitting or receiving various kinds of data by using the communication function.

Figure 54A:
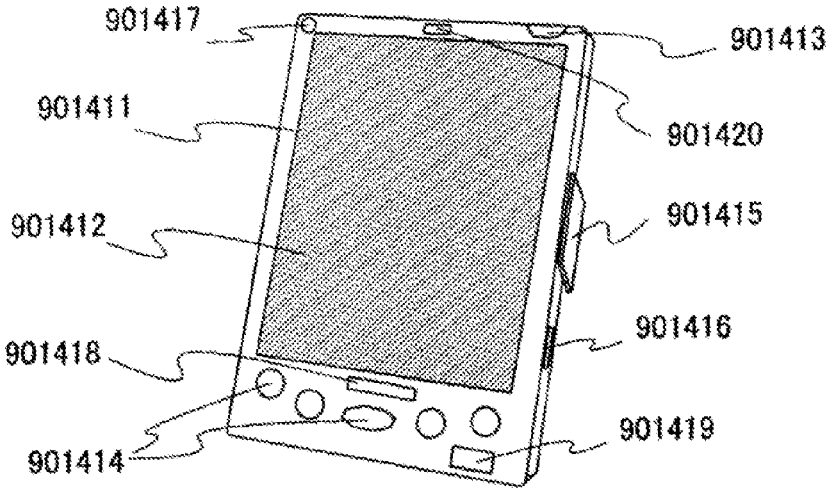
FIGS. 54A to 54C are diagrams for describing specific examples of the present invention.

FIG. 54A shows a mobile computer, which includes a main body 901411, a display portion 901412, a switch 901413, operation keys 901414, an infrared port 901415, an input means 901416, a sensor 901417 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901418, a speaker 901419, an LED lamp 901420, and the like. The mobile computer shown in FIG. 54A can have various functions such as, but not limited to, a function of displaying various kinds of information (e.g., a still image, a moving image, and a text image) on the display portion; a touch panel function provided on the display portion; a function of displaying a calendar, a date, the time, and the like on the display portion; a function of controlling processing by various kinds of software (programs); a function of wireless communication; a function of connecting with various computer networks by using the wireless communication function; and a function of transmitting or receiving various kinds of data by using the wireless communication function.

Figure 54B:
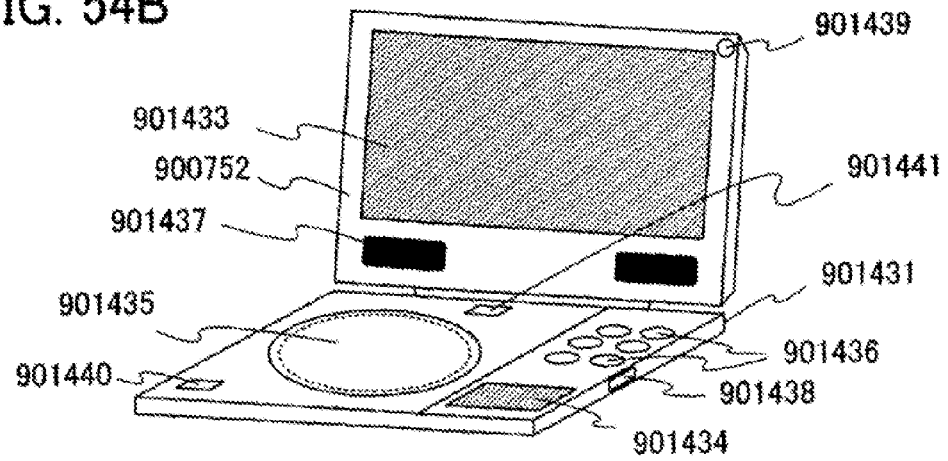

FIG. 54B shows a portable image reproducing device provided with a recording medium (e.g., a DVD player), which includes a main body 901431, a housing 901432, a display portion A 901433, a display portion B 901434, a recording medium (e.g., DVD) reading portion 901435, operation keys 901436, a speaker portion 901437, an input means 901438, a sensor 901439 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901440, an LED lamp 901441, and the like. The display portion A 901433 can mainly display image information, and the display portion B 901434 can mainly display text information.

Figure 54C:
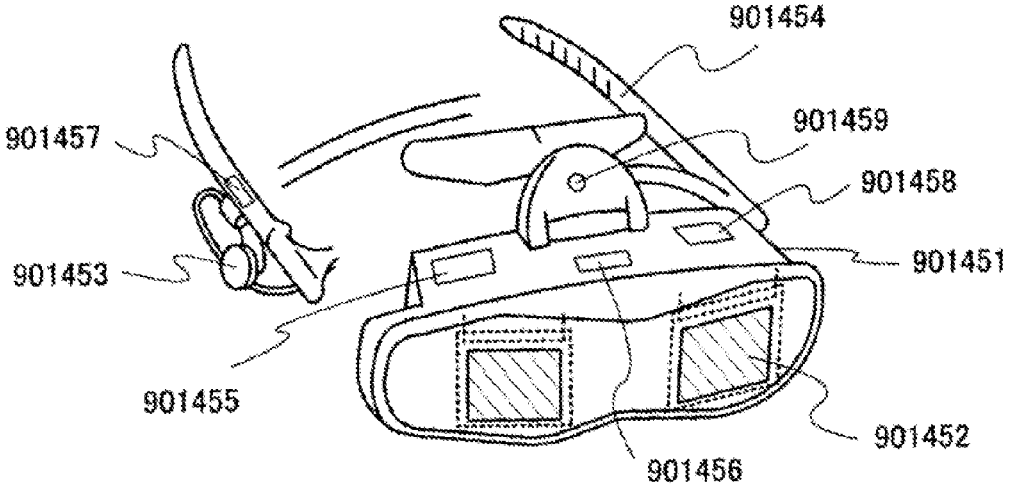

FIG. 54C shows a goggle-type display, which includes a main body 901451, a display portion 901452, an earphone 901453, a support portion 901454, an input means 901455, a sensor 901456 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901457, a speaker 901458, an LED lamp 901459, and the like. The goggle-type display shown in FIG. 54C can have various functions such as, but not limited to, a function of displaying an image (e.g., a still image, a moving image, and a text image) which is obtained from outside, on the display portion.

Figure 55A:
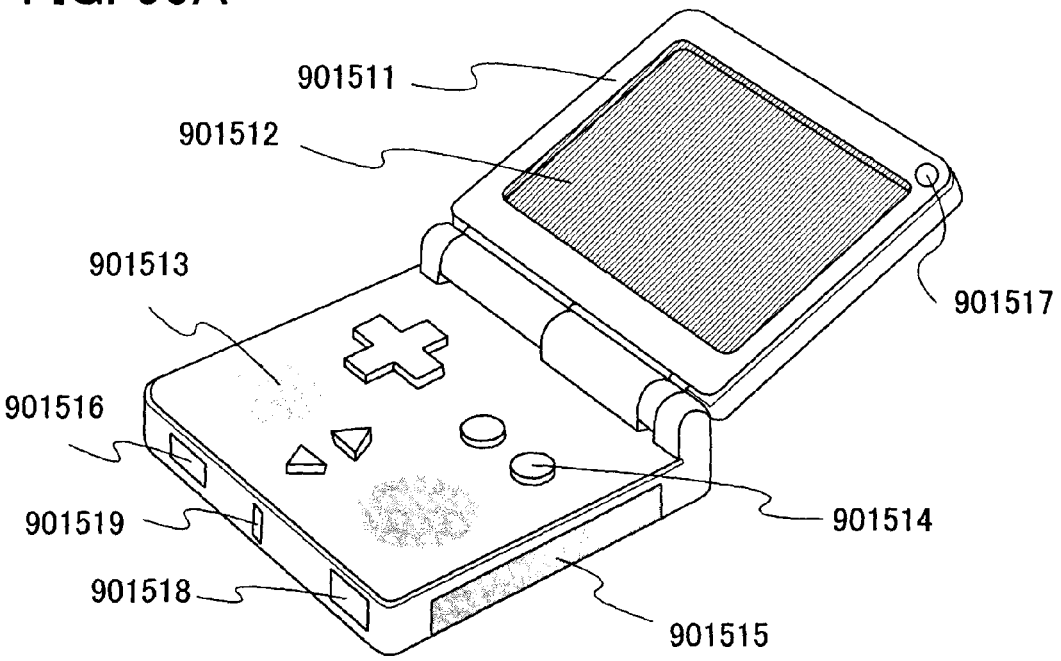
FIGS. 55A and 55B are diagrams for describing specific examples of the present invention.

FIG. 55A shows a portable game machine, which includes a housing 901511, a display portion 901512, speaker portions 901513, operation keys 901514, a recording medium insert portion 901515, an input means 901516, a sensor 901517 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901518, an LED lamp 901519, and the like. The portable game machine shown in FIG. 55A can have various functions such as, but not limited to, a function of reading a program or data stored in the recording medium to display it on the display portion; and a function of sharing information by wireless communication with another portable game machine.

Figure 55B:
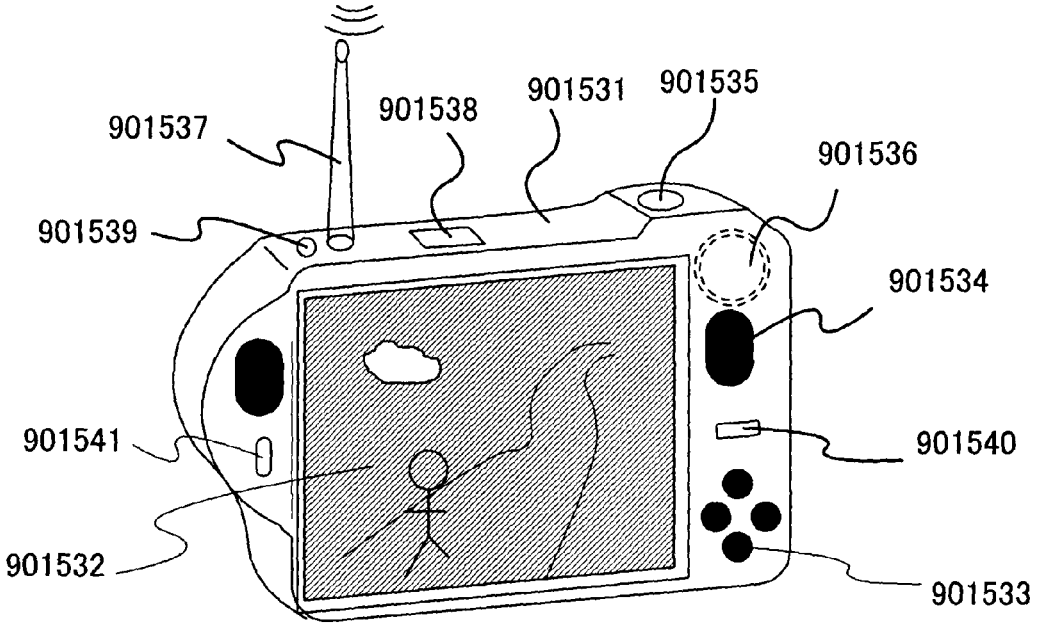

FIG. 55B shows a digital camera having a television reception function, which includes a housing 901531, a display portion 901532, operation keys 901533, a speaker 901534, a shutter button 901535, an image receiving portion 901536, an antenna 901537, an input means 901538, a sensor 901539 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901540, an LED lamp 901541, and the like. The digital camera having the television reception function shown in FIG. 55B can have various functions such as, but not limited to, a function of photographing a still image and a moving image; a function of automatically adjusting the photographed image; a function of obtaining various kinds of information from the antenna; a function of storing the photographed image or the information obtained from the antenna; and a function of displaying the photographed image or the information obtained from the antenna on the display portion.

Figure 56:
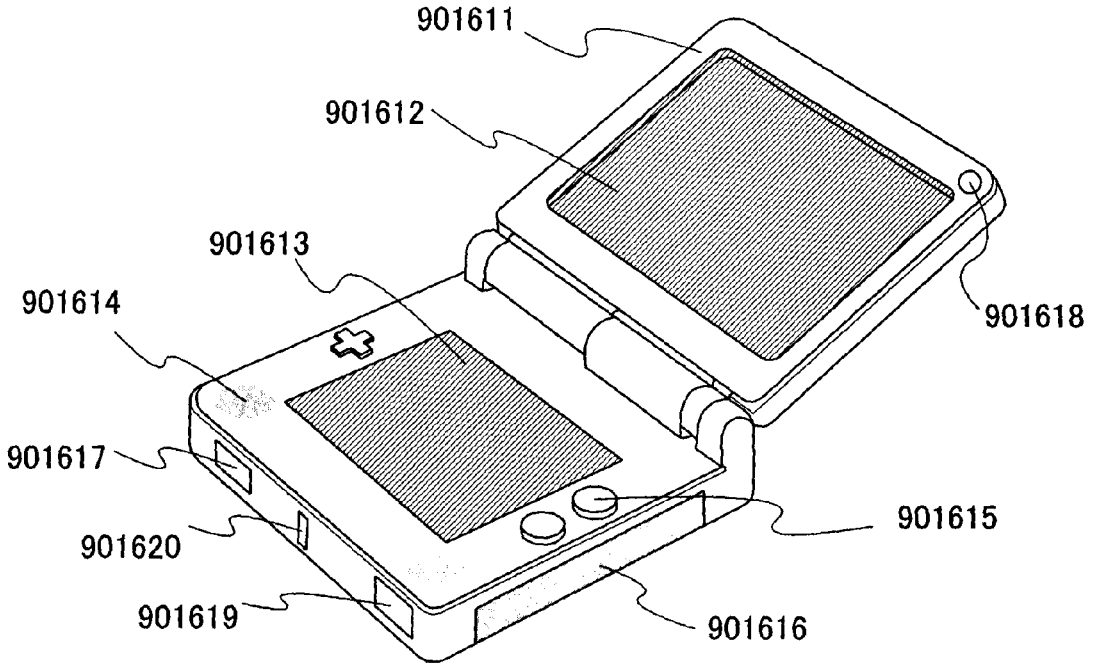
FIG. 56 is a diagram for describing a specific example of the present invention.

FIG. 56 shows a portable game machine, which includes a housing 901611, a first display portion 901612, a second display portion 901613, speaker portions 901614, operation keys 901615, a recording medium insert portion 901616, an input means 901617, a sensor 901618 (having a function of measuring force, displacement, position, speed, acceleration, angular velocity, rotation number, distance, light, liquid, magnetism, temperature, chemical reaction, sound, time, hardness, electric field, current, voltage, electric power, radial ray, flow rate, humidity, gradient, vibration, smell, or infrared ray), a microphone 901619, an LED lamp 901620, and the like. The portable game machine shown in FIG. 56 can have various functions such as, but not limited to, a function of reading a program or data stored in the recording medium to display it on the display portion, and a function of sharing information with another portable game machine by wireless communication.

As shown in FIGS. 53A to 53C, 54A to 54C, 55A and 55B, and 56, the electronic device includes a display portion for displaying some kind of information. Such electronic devices can provide display with improved viewing angle characteristics.

Next, application examples of a semiconductor device are described.

Figure 73:
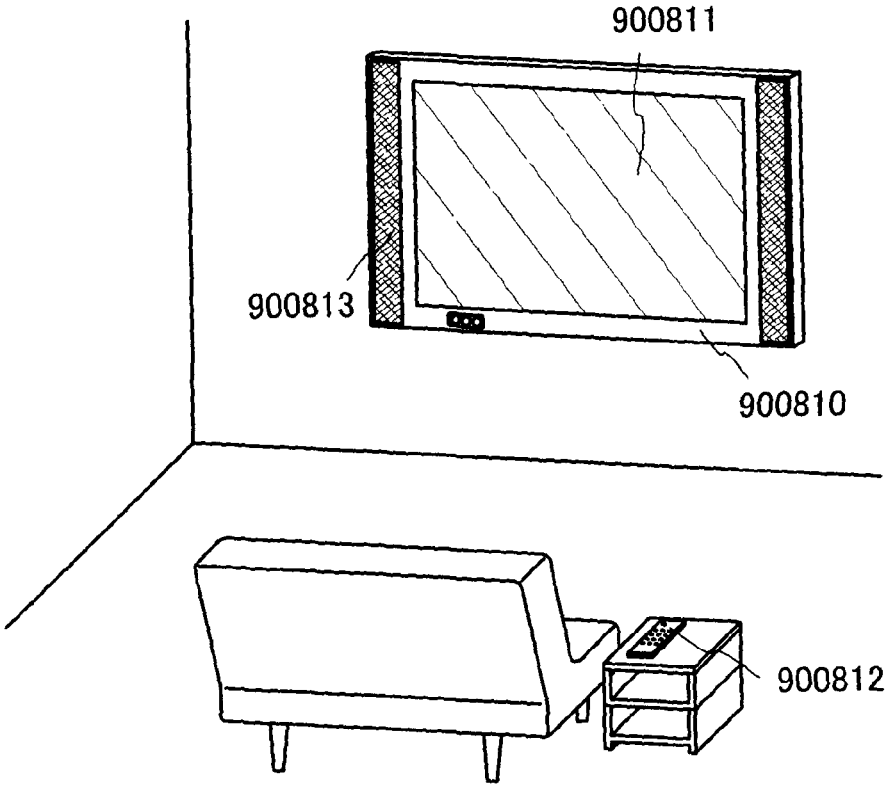
FIG. 73 is a diagram for describing a specific example of the present invention.

FIG. 73 shows an example in which the semiconductor device is incorporated in a constructed object. FIG. 73 shows a housing 900810, a display portion 900811, a remote control device 900812 which is an operation portion, a speaker portion 900813, and the like. The semiconductor device is incorporated in the constructed object as a wall-mounted semiconductor device, which can be provided without requiring a large space.

Figure 74:
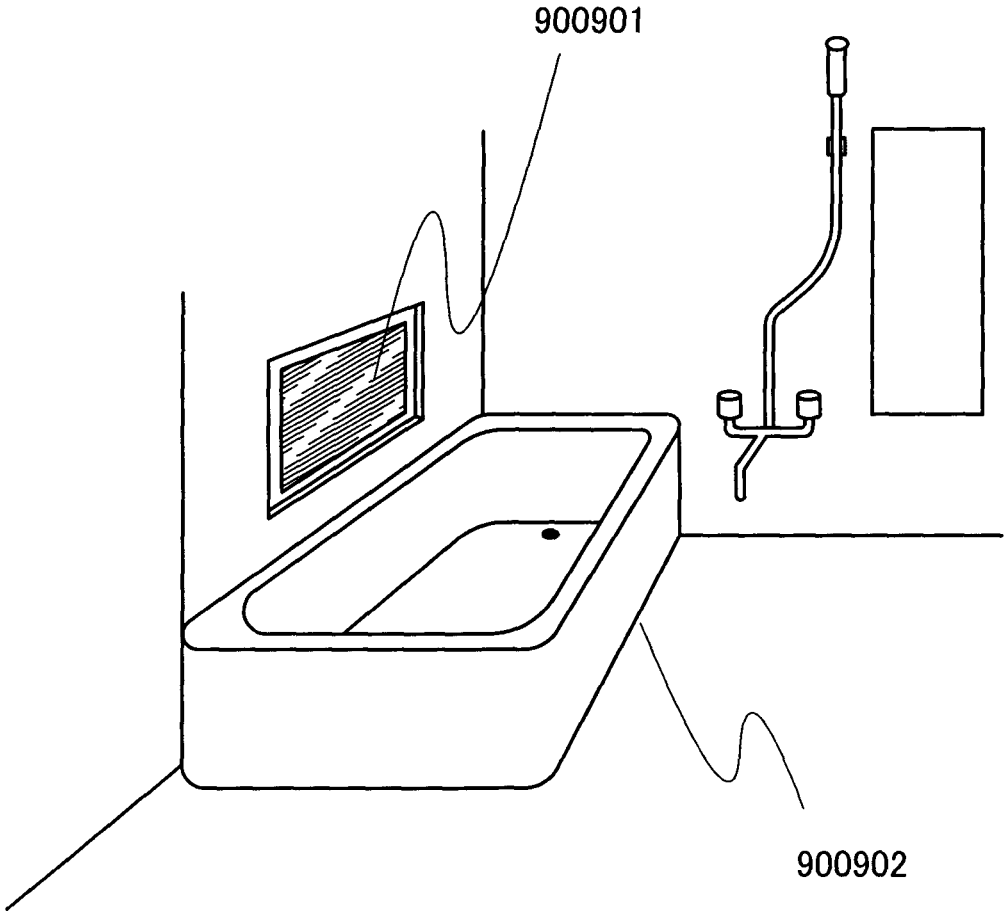
FIG. 74 is a diagram for describing a specific example of the present invention.

FIG. 74 shows another example in which the semiconductor device is incorporated in a constructed object. A display panel 900901 is incorporated with a prefabricated bath (or a bath module) 900902, and a person who takes a bath can view the display panel 900901. The display panel 900901 has a function of displaying information by an operation by the person who takes a bath; and a function of being used as an advertisement or an entertainment means.

Note that the semiconductor device can be provided not only for a side wall of the prefabricated bath 900902 as shown in FIG. 74, but also for various places. For example, the semiconductor device can be incorporated with part of a mirror, a bathtub itself, or the like. At this time, the shape of the display panel 900901 may be changed in accordance with the shape of the mirror or the bathtub.

Figure 77:
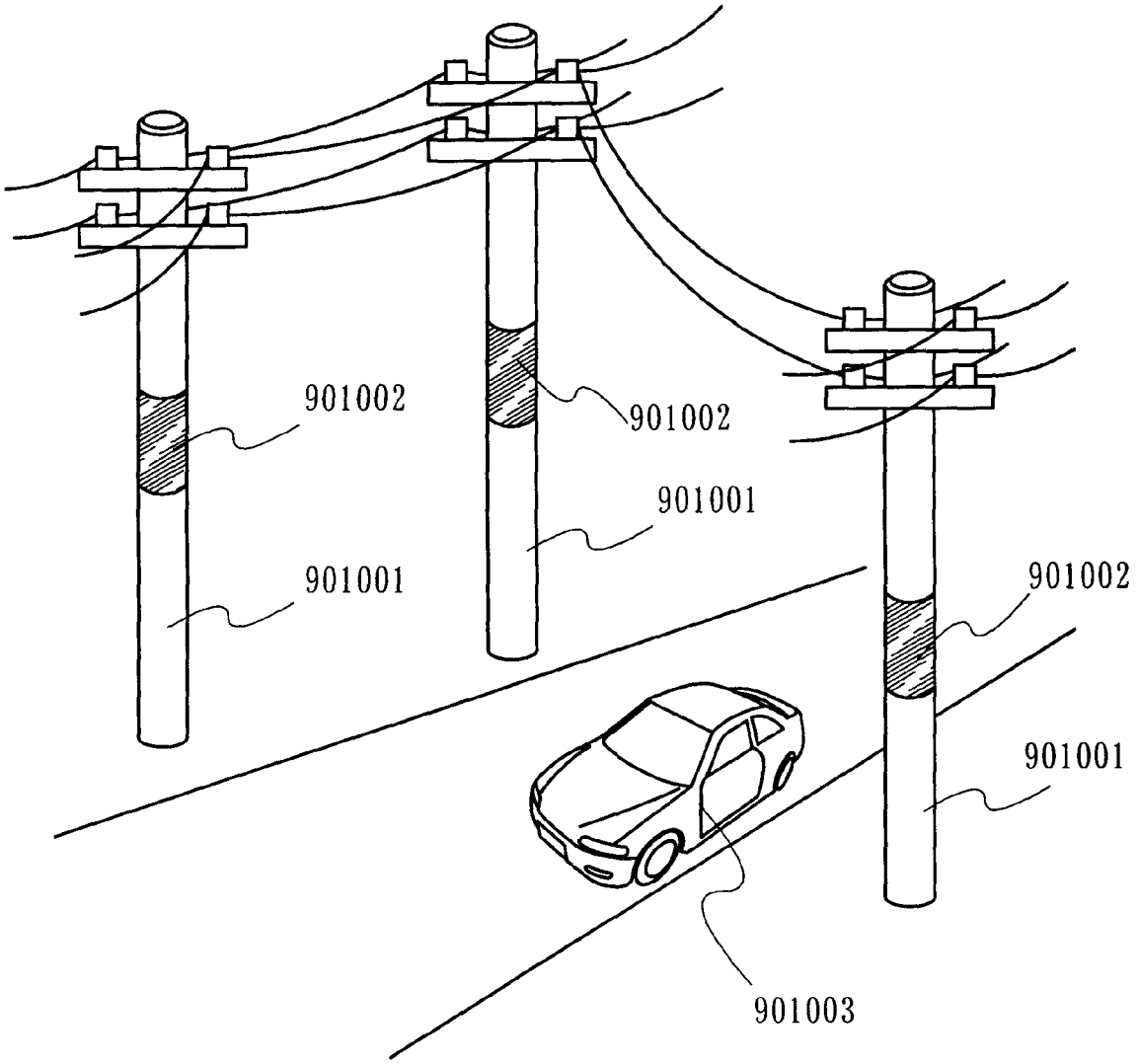
FIG. 77 is a diagram for describing a specific example of the present invention.

FIG. 77 shows another example in which the semiconductor device is incorporated in a constructed object. A display panel 901002 is bent and attached to a curved surface of a column-shaped object 901001. Note that here, a utility pole is described as the column-shaped object 901001.

The display panel 901002 shown in FIG. 77 is provided at a position higher than a human viewpoint. When the display panels 901002 are provided in constructed objects which stand together in large numbers outdoors, such as utility poles, advertisement can be performed to an unspecified number of viewers. Since it is easy for the display panels 901002 to display the same images and instantly switch images by external control, highly efficient information display and advertisement effect can be expected. By provision of self-luminous display elements, the display panel 901002 can be useful as a highly visible display medium even at night. When the display panel 901002 is provided in the utility pole, a power supply means for the display panel 901002 can be easily obtained. In an emergency such as disaster, the display panel 901002 can also be used as a means to transmit correct information to victims rapidly.

Note that an example of the display panel 901002 includes a display panel in which a switching element such as an organic transistor is provided over a film-shaped substrate and a display element is driven so that an image is displayed.

Note that in this embodiment mode, a wall, a column-shaped object, and a prefabricated bath are shown as examples of constructed objects; however, this embodiment mode is not limited thereto, and various constructed objects can be provided with the semiconductor device.

Next, examples where the semiconductor device is incorporated with a moving object are described.

Figure 78:
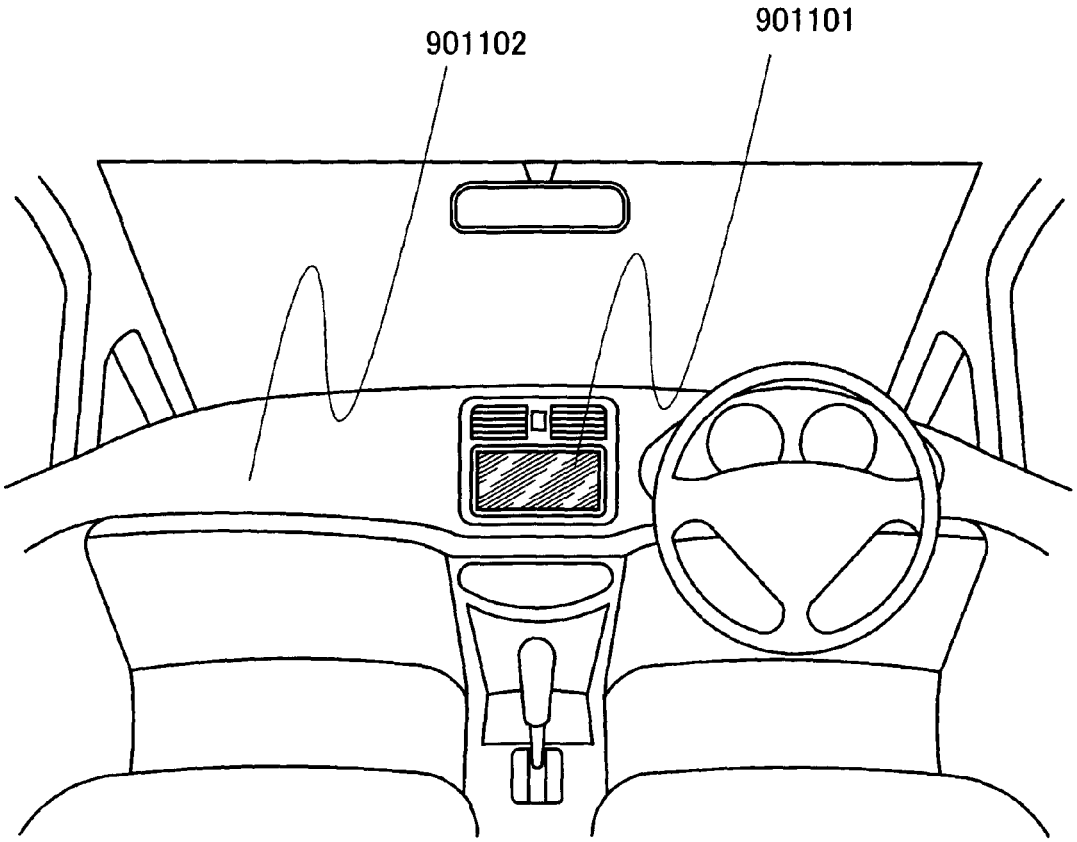
FIG. 78 is a diagram for describing a specific example of the present invention.

FIG. 78 shows an example in which the semiconductor device is incorporated with a car. A display panel 901101 is incorporated with a car body 901102 and can display an operation of the car body or information input from the inside or outside of the car body on demand. Note that a navigation function may be provided.

The semiconductor device can be provided not only for the car body 901102 as shown in FIG. 78, but also for various places. For example, the semiconductor device can be incorporated with a glass window, a door, a steering wheel, a gear shift, a seat, a rear-view mirror, and the like. At this time, the shape of the display panel 901101 may be changed in accordance with the shape of an object to be provided with the display panel 901101.

Figure 79A:
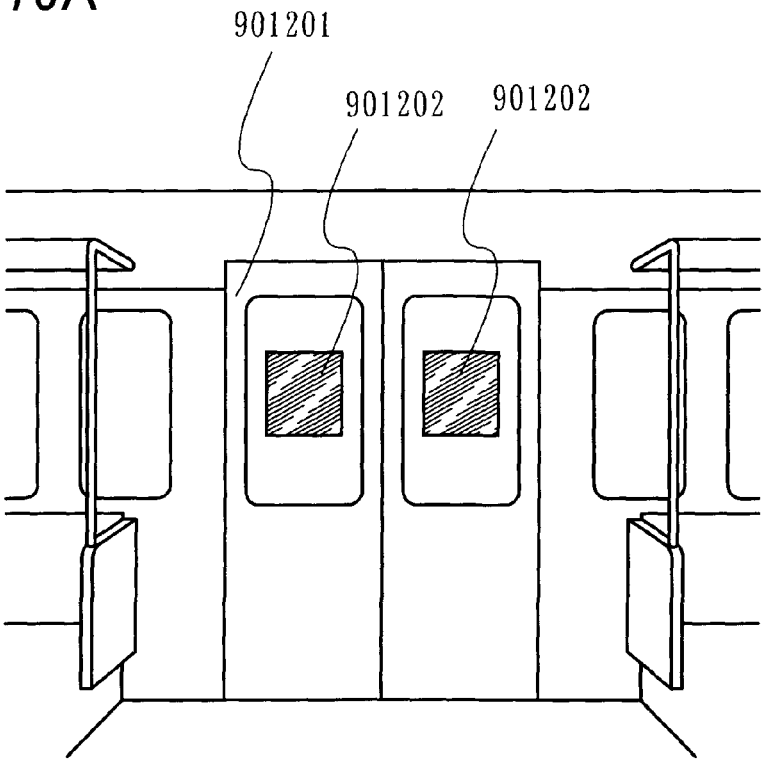
FIGS. 79A and 79B are diagrams for describing specific examples of the present invention.
Figure 79B:
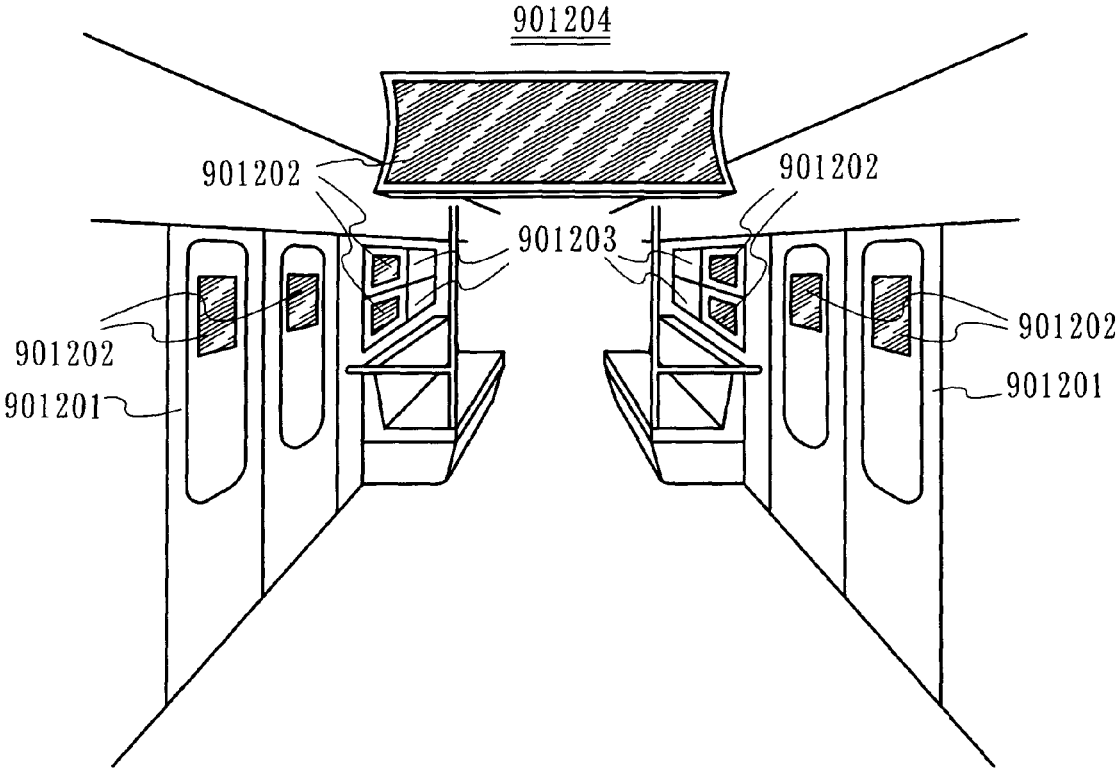

FIGS. 79A and 79B show examples where the semiconductor device is incorporated with a train car.

FIG. 79A shows an example in which a display panel 901202 is provided in glass of a door 901201 in a train car, which has an advantage, compared with a conventional advertisement using paper, in that labor cost for changing an advertisement is not necessary. Since the display panel 901202 can instantly switch images displaying on the display portion by an external signal, images on the display panel can be switched in every time period when types of passengers on the train are changed, for example. Thus, a more effective advertisement effect can be expected.

FIG. 79B shows an example in which the display panels 901202 are provided for a glass window 901203 and a ceiling 901204 as well as the glass of the door 901201 in the train car. In such a manner, the semiconductor device can be easily provided for a place where a semiconductor device has been difficult to be provided conventionally; thus, an effective advertisement effect can be obtained. Further, the semiconductor device can instantly switch images displayed on a display portion by an external signal; thus, cost and time for changing an advertisement can be reduced, and more flexible advertisement management and information transmission can be realized.

Note that the semiconductor device can be provided not only for the door 901201, the glass window 901203, and the ceiling 901204 as shown in FIGS. 79A and 79B, but also for various places. For example, the semiconductor device can be incorporated with a strap, a seat, a handrail, a floor, or the like. At this time, the shape of the display panel 901202 may be changed in accordance with the shape of an object to be provided with the display panel 901202.

Figure 80A:
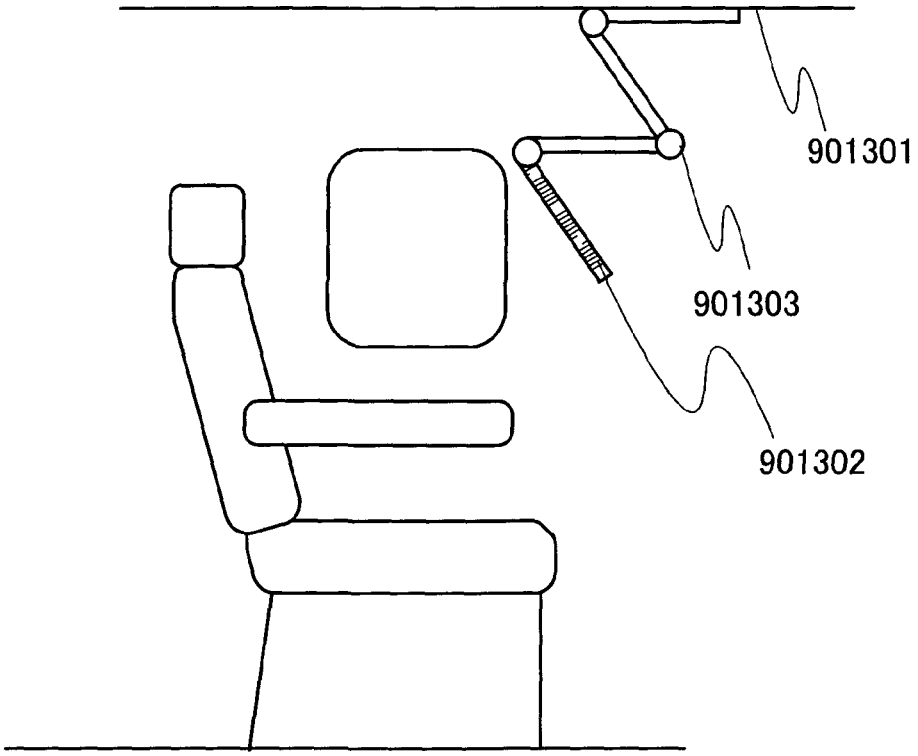
FIGS. 80A and 80B are diagrams for describing specific examples of the present invention.
Figure 80B:
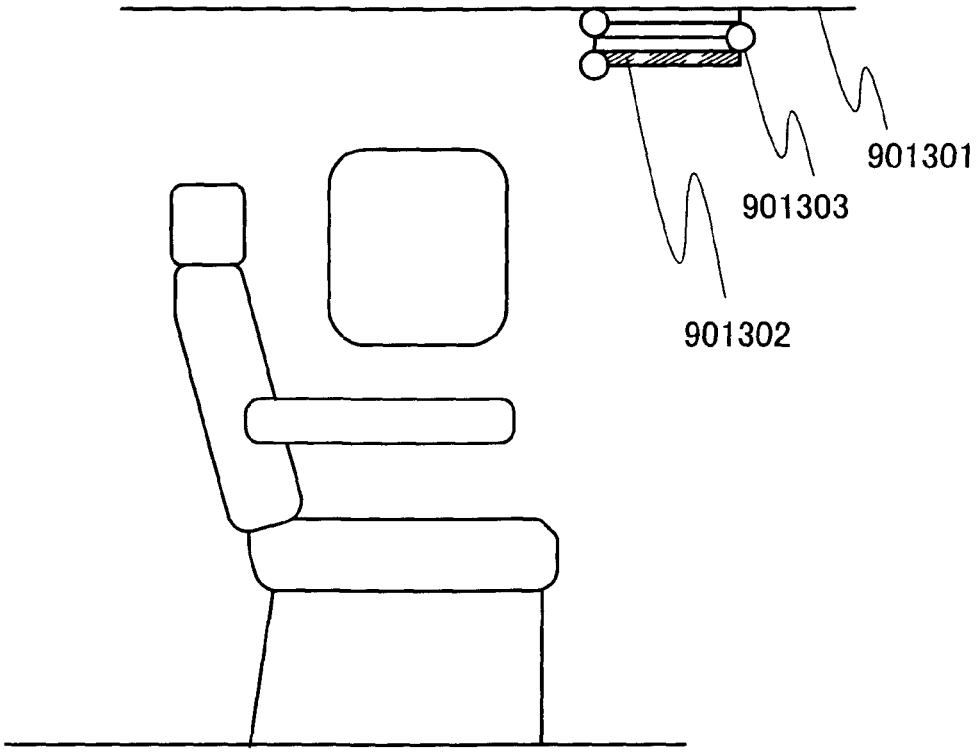

FIGS. 80A and 80B show an example in which the semiconductor device is incorporated with a passenger airplane.

FIG. 80A shows the shape of a display panel 901302 provided on a ceiling 901301 above a seat of the passenger airplane when the display panel 901302 is used. The display panel 901302 is incorporated with the ceiling 901301 with a hinge portion 901303, and a passenger can view the display panel 901302 by stretching of the hinge portion 901303. The display panel 901302 has a function of displaying information by an operation by the passenger and a function of being used for an advertisement or an entertainment means. As shown in FIG. 80B, when the hinge portion is bent so that the display panel is stored in the ceiling 901301, safety in taking-off and landing can be assured. Note that in an emergency, the display panel can also be used for an information transmission means and a guide light by lighting a display element in the display panel.

Note that the semiconductor device can be provided not only for the ceiling 901301 as shown in FIGS. 80A and 80B, but also for various places. For example, the semiconductor device can be incorporated with a seat, a table attached to a seat, an armrest, a window, or the like. A large display panel which a plurality of people can view at the same time may be provided on a wall of an airframe. At this time, the shape of the display panel 901302 may be changed in accordance with the shape of an object to be provided with the display panel 901302.

Note that in this embodiment mode, bodies of a train car, a car, and an airplane are shown as moving objects; however, the present invention is not limited thereto, and the semiconductor device can be provided for various objects such as a motorcycle, an four-wheel drive car (including a car, a bus, and the like), a train (including a monorail, a railroad car, and the like), and a vessel. Since the semiconductor device can instantly switch images displayed on a display panel in a moving object by an external signal, the moving object provided with the semiconductor device can be used as an advertisement display board for an unspecified number of customers, an information display board in disaster, and the like.

Note that although this embodiment mode are described with reference to various diagrams, the content described in each diagram can be freely applied to, combined or replaced with the content (can be part of the content) described in a different diagram. Further, as for the diagrams described so far, each portion therein can be combined with another portion, so that more diagrams can be provided.

Similarly, the content (can be part of the content) described with reference to each diagram in this embodiment mode can be freely applied to, combined or replaced with another content (can be part of the content) described in a diagram of the other embodiment modes. Further, as for the diagrams in this embodiment mode, each portion therein can be combined with other portions in the other embodiment modes, so that more and more diagrams can be provided.

Note that this embodiment mode shows an example of embodiment of a content (can be part of the content) described in other embodiment modes, an example of slight modification thereof; an example of partial modification thereof; an example of improvement thereof; an example of detailed description thereof; an example of application thereof; an example of related part thereof; and the like. Therefore, contents described in the other embodiment modes can be applied to, combined, or replaced with this embodiment mode at will.

The present application is based on Japanese Priority Patent Application No. 2007-132302 filed on May 18, 2007 with the Japan Patent Office, the entire contents of which are hereby incorporated by reference.

What is claimed is:

1. A liquid crystal display device comprising:

a pixel including a plurality of sub-pixels;

a driving portion electrically connected to the plurality of sub-pixels;

a grayscale data memory portion which stores a plurality of combination data corresponding to a level of a grayscale signal and which outputs a selected combination data; and a grayscale data conversion portion which receives the selected combination data from the grayscale data memory portion and which outputs sub-grayscale signals through the driving portion to each of the plurality of sub-pixels;

wherein the grayscale data memory portion selects and outputs any one of the plurality of combination data to the grayscale data conversion portion in a first period, wherein the grayscale data memory portion selects and outputs another one of the plurality of combination data in a second period which is after the first period, and wherein the level of the grayscale signal in the first period is equal to the level of the grayscale signal in the second period.

2. An electronic device comprising the liquid crystal display device in claim 1.

3. An electronic device comprising the liquid crystal display device in claim 1 and an operation switch.

4. A liquid crystal display device comprising:

a pixel including a first sub-pixel and a second sub-pixel;

a driving portion electrically connected to the first sub-pixel and the second sub-pixel;

a grayscale data memory portion which stores a first combination data and a second combination data corresponding to a level of a grayscale signal and which outputs the first combination data or the second combination data; and a grayscale data conversion portion which receives the first combination data or the second combination data from the grayscale data memory portion and which outputs sub-grayscale signals through the driving portion to the first sub-pixel and the second sub-pixel;

wherein the grayscale data memory portion selects and outputs the first combination data to the grayscale data conversion portion in a first one frame period, wherein the grayscale data memory portion selects and outputs the second combination data in a second one frame period which is after the first one frame period, and wherein the level of the grayscale signal in the first one frame period is equal to the level of the grayscale signal in the second one frame period.

5. An electronic device comprising the liquid crystal display device in claim 4.

6. An electronic device comprising the liquid crystal display device in claim 4 and an operation switch.

7. A liquid crystal display device comprising:

a pixel including a first sub-pixel and a second sub-pixel;

a driving portion electrically connected to the first sub-pixel and the second sub-pixel;

a grayscale data memory portion which stores a first combination data and a second combination data corresponding to a level of a grayscale signal and which outputs the first combination data or the second combination data; and a grayscale data conversion portion which receives the first combination data or the second combination data from the grayscale data memory portion and which outputs sub-grayscale signals through the driving portion to the first sub-pixel and the second sub-pixel;

wherein the grayscale data memory portion selects and outputs the first combination data to the grayscale data conversion portion in a first one sub-frame period, wherein the grayscale data memory portion selects and outputs the second combination data in a second one sub-frame period which is after the first one sub-frame period, and wherein the level of the grayscale signal in the first one sub-frame period is equal to the level of the grayscale signal in the second one sub-frame period.

8. An electronic device comprising the liquid crystal display device in claim 7.

9. An electronic device comprising the liquid crystal display device in claim 7 and an operation switch.

10. A driving method for a liquid crystal display device including a pixel having a plurality of sub-pixels comprising the steps of:

selecting any one of a plurality of combination data corresponding to a level of a grayscale signal in a first period, wherein the plurality of combination data is stored in a grayscale data memory portion;

inputting the selected combination data from the grayscale data memory portion to a grayscale data conversion portion;

generating first sub-grayscale signals corresponding to the plurality of sub-pixels;

outputting the first sub-grayscale signals through a driving portion to the plurality of sub-pixels;

selecting another one of the plurality of combination data corresponding to the level of the grayscale signal in a second period;

inputting the another combination data to the grayscale data conversion portion;

generating second sub-grayscale signals corresponding to the plurality of sub-pixels;

outputting the second sub-grayscale signals through the driving portion to the plurality of sub-pixels, and wherein the level of the grayscale signal in the first period is equal to the level of the grayscale signal in the second period.

11. The driving method for the liquid crystal display device according to claim 10, wherein the first period and the second period is one frame period.

12. The driving method for the liquid crystal display device according to claim 10, wherein the first period and the second period is one sub-frame period.

13. The driving method for the liquid crystal display device according to claim 10, wherein the second sub-grayscale signals generated though the grayscale data conversion portion from the another combination data, which is input to an adjacent pixels, is different from the first sub-grayscale signals input to the pixels.

14. The driving method for the liquid crystal display device according to claim 11, wherein the second sub-grayscale signals generated though the grayscale data conversion portion from the another combination data, which is input to adjacent pixels, is different from the first sub-grayscale signals input to the pixels.

15. The driving method for the liquid crystal display device according to claim 12, wherein the second sub-grayscale signals generated though the grayscale data conversion portion from the another combination data, which is input to adjacent pixels, is different from the first sub-grayscale signals input to the pixels.

16. A liquid crystal display device according to claim 4, wherein an area of the first sub-pixel is different from an area of the second sub-pixel.

17. A liquid crystal display device according to claim 7, wherein an area of the first sub-pixel is different from an area of the second sub-pixel.

* * * * *